US007503778B2

(12) United States Patent
Lehman et al.

(10) Patent No.: US 7,503,778 B2
(45) Date of Patent: Mar. 17, 2009

(54) LIGHTING SYSTEM AND METHOD

(75) Inventors: Gregg Arthur Lehman, Peachtree City, GA (US); Paul James Bartlett, Newnan, GA (US); Steen Vann, Morrow, GA (US); Steven Walter Pyshos, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 102 days.

(21) Appl. No.: 11/322,837

(22) Filed: Dec. 30, 2005

(65) Prior Publication Data

US 2007/0153516 A1 Jul. 5, 2007

(51) Int. Cl.
*H01R 25/00* (2006.01)

(52) U.S. Cl. ..... 439/110; 362/147; 362/391

(58) Field of Classification Search ..... 439/110, 439/115, 119, 120, 121; 362/147, 148, 150, 362/153, 391
See application file for complete search history.

(56) References Cited

U.S. PATENT DOCUMENTS

| | | | | |
|---|---|---|---|---|
| 4,688,154 | A * | 8/1987 | Nilssen | 362/147 |
| 4,861,273 | A | 8/1989 | Wenman et al. | |
| 5,017,838 | A * | 5/1991 | Nilssen | 315/200 R |
| 5,154,509 | A | 10/1992 | Wulfman et al. | |
| 5,833,358 | A | 11/1998 | Patik | |
| 5,855,485 | A | 1/1999 | Patti | |
| 6,004,005 | A | 12/1999 | Demshki, Jr. | |
| D442,309 | S | 5/2001 | Miller et al. | |
| 6,227,884 | B1 * | 5/2001 | Hierzer | 439/110 |
| D444,252 | S | 6/2001 | Miller et al. | |
| 6,244,733 | B1 | 6/2001 | Fong et al. | |
| D448,506 | S | 9/2001 | Miller et al. | |
| 6,383,013 | B1 | 5/2002 | Ghesla et al. | |
| 6,676,281 | B2 | 1/2004 | Bray et al. | |
| 6,716,042 | B2 * | 4/2004 | Lin | 439/110 |
| 7,038,380 | B2 * | 5/2006 | Hsu | 313/578 |
| D546,497 | S | 7/2007 | Lehman et al. | |
| D549,388 | S | 8/2007 | Lehman et al. | |
| 2003/0003785 | A1 | 1/2003 | Ross | |
| 2004/0160767 | A1 | 8/2004 | Mobarak et al. | |
| 2007/0015388 | A1 | 1/2007 | Boike | |
| 2007/0153309 | A1 * | 7/2007 | Sasanuma et al. | 358/1.9 |
| 2007/0153509 | A1 | 7/2007 | Lehman et al. | |
| 2007/0153516 | A1 * | 7/2007 | Lehman et al. | 362/238 |
| 2007/0153550 | A1 * | 7/2007 | Lehman et al. | 362/648 |
| 2007/0167043 | A1 * | 7/2007 | Lehman et al. | 439/115 |

OTHER PUBLICATIONS

NRS90 Rail Series Rail Systems and Accessories ("NQRA"), Nora Lighting, 2001, pp. NRS.01.01 through NRS.01.02 (2 pages).
LIR *Odyssey* Line Voltage Rail System Rail System Parts and Accessories, Con-Tech Lighting, AD040RSS04, 2 pages.
LIR *Odyssey* Line Voltage Rail System 120V Fixtures, Con-Tech Lighting, AD040RSS02, (1 page).
Catalog, p. 50 (1 page).

(Continued)

*Primary Examiner*—James Harvey
(74) *Attorney, Agent, or Firm*—King & Spalding LLP

(57) ABSTRACT

Lighting systems and methods are described, including track lighting systems and methods.

18 Claims, 63 Drawing Sheets

OTHER PUBLICATIONS

Symphony MiniTrack Low Voltage Lighting System, Con-Tech Lighting (16 pages).

Buckingham, http://www.buckingham.com.tw/main.html (1 page).

Capri Lighting, MR1-29 Specifications, http://www.caprilighting.com/pdfspecs/MR1-29.pdf, 2005 (2 pages).

Planlicht, Vision Catalog, No Limit and Take Five sections, http://www.planlicht.com/pdf/vision-54-91.pdf, pp. 54-91.

* cited by examiner

LIGHTING SYSTEM AND METHOD

CROSS-REFERENCE TO RELATED APPLICATIONS

The present application is related to the following co-pending applications: U.S. patent application Ser. No. 11/324,099, filed on Dec. 30, 2005; U.S. patent application Ser. No. 11/323,231, filed on Dec. 30, 2005; and U.S. patent application Ser. No. 11/323,755, filed on Dec. 30, 2005, the disclosures of which are incorporated herein by reference.

BACKGROUND

The present disclosure relates in general to lighting systems and methods and in particular to track lighting systems and methods.

DETAILED DESCRIPTION OF THE ILLUSTRATIVE EMBODIMENTS

Figure 1:
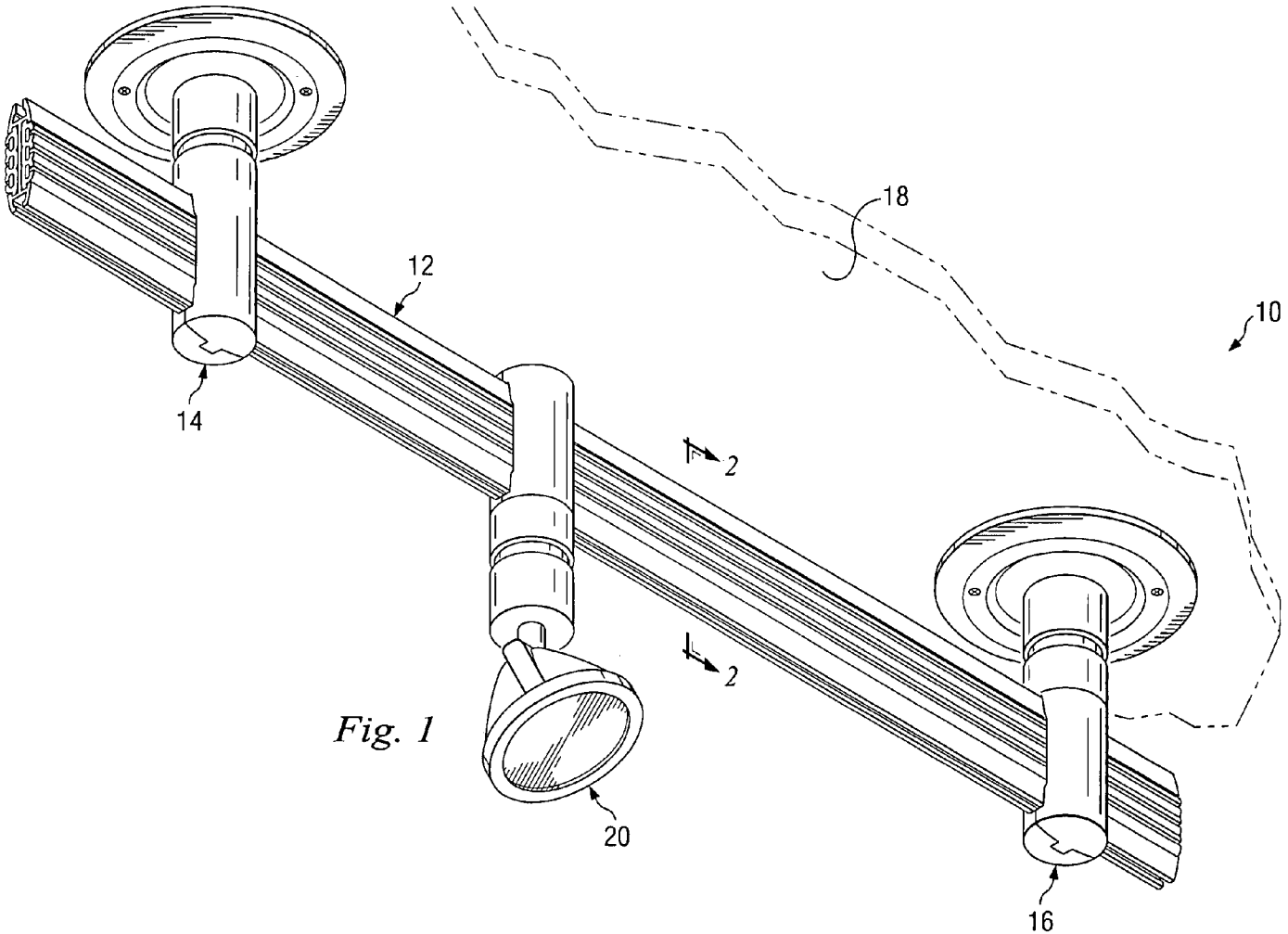
FIG. 1 is a perspective view of a lighting system according to an embodiment, which includes a track according to an embodiment, a power feed assembly according to an embodiment, a support assembly according to an embodiment, and a lamp assembly according to an embodiment.

In an exemplary embodiment, as illustrated in FIG. 1, a lighting system is generally referred to by the reference numeral 10 and includes a lighting track 12 that is supported by a power feed assembly 14 and a support assembly 16, which are each coupled to a ceiling 18. A lamp assembly 20 is coupled to the track 12.

Figure 2:
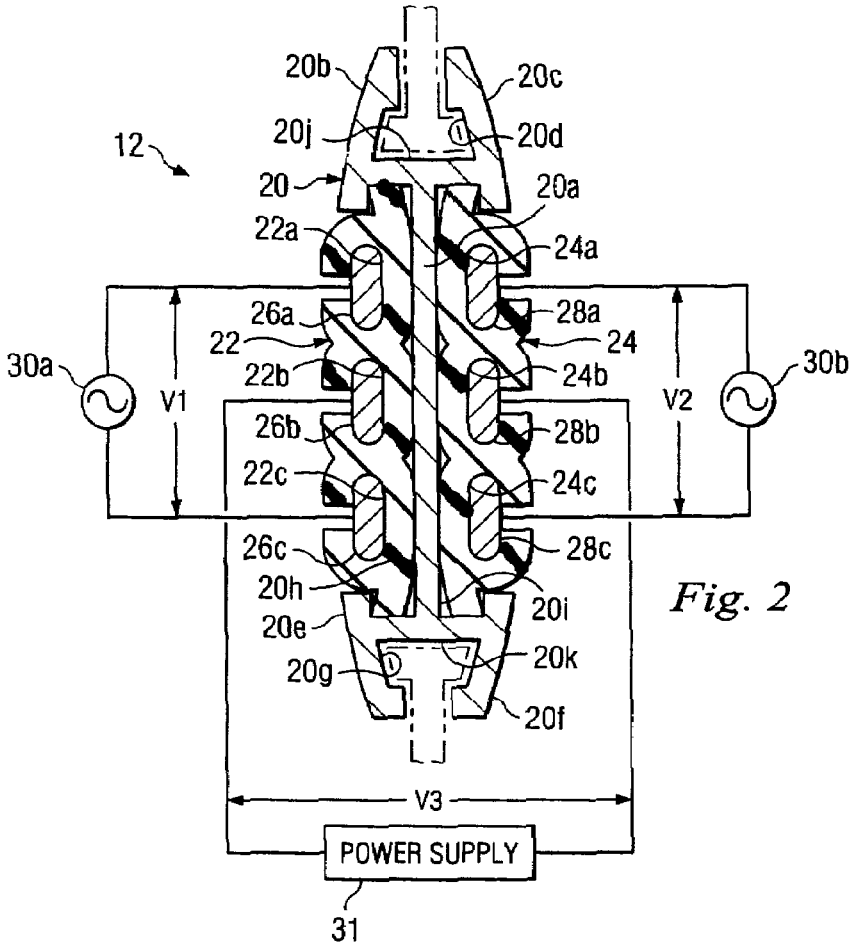
FIG. 2 is a sectional view of the track of FIG. 1 taken along line 2-2.
Figure 3:
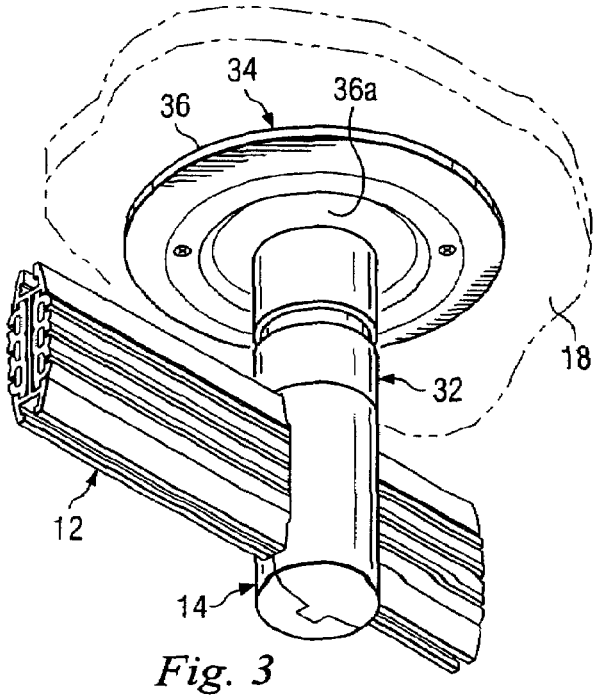
FIG. 3 is enlarged perspective view of the power feed assembly of FIG. 1.
Figure 4A:
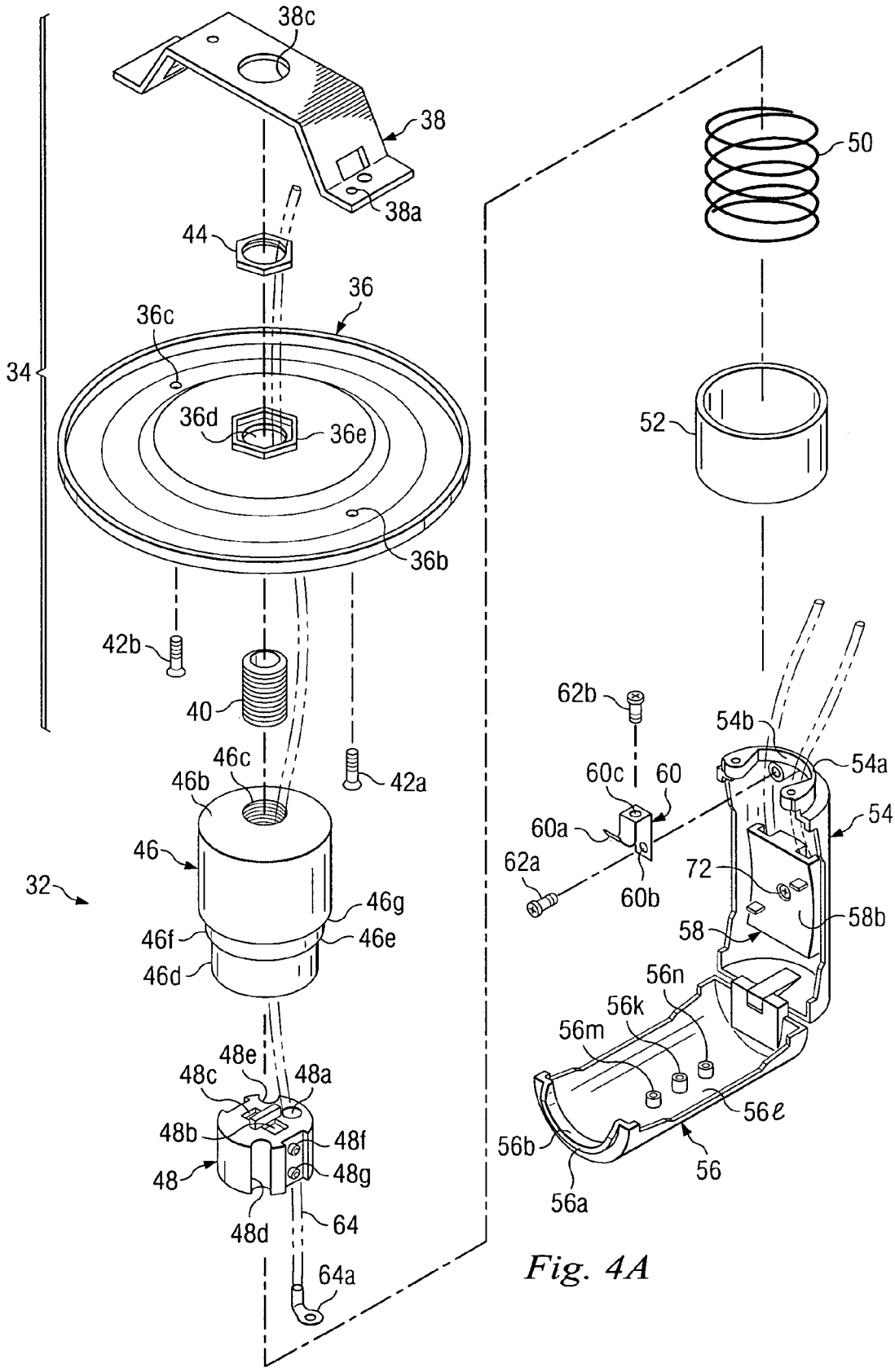
FIG. 4A is an exploded view of the power feed assembly of FIG. 1.
Figure 5:
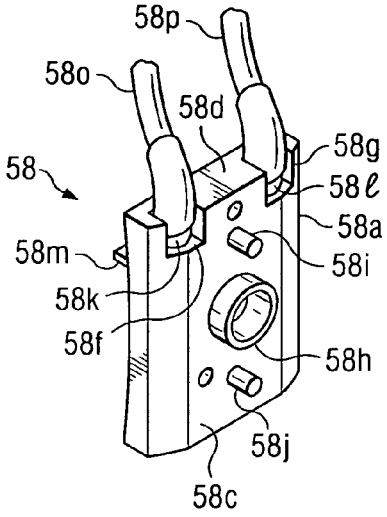
FIG. 5 is a perspective view of a contact pad assembly of the power feed assembly of FIG. 1.
Figure 4B:
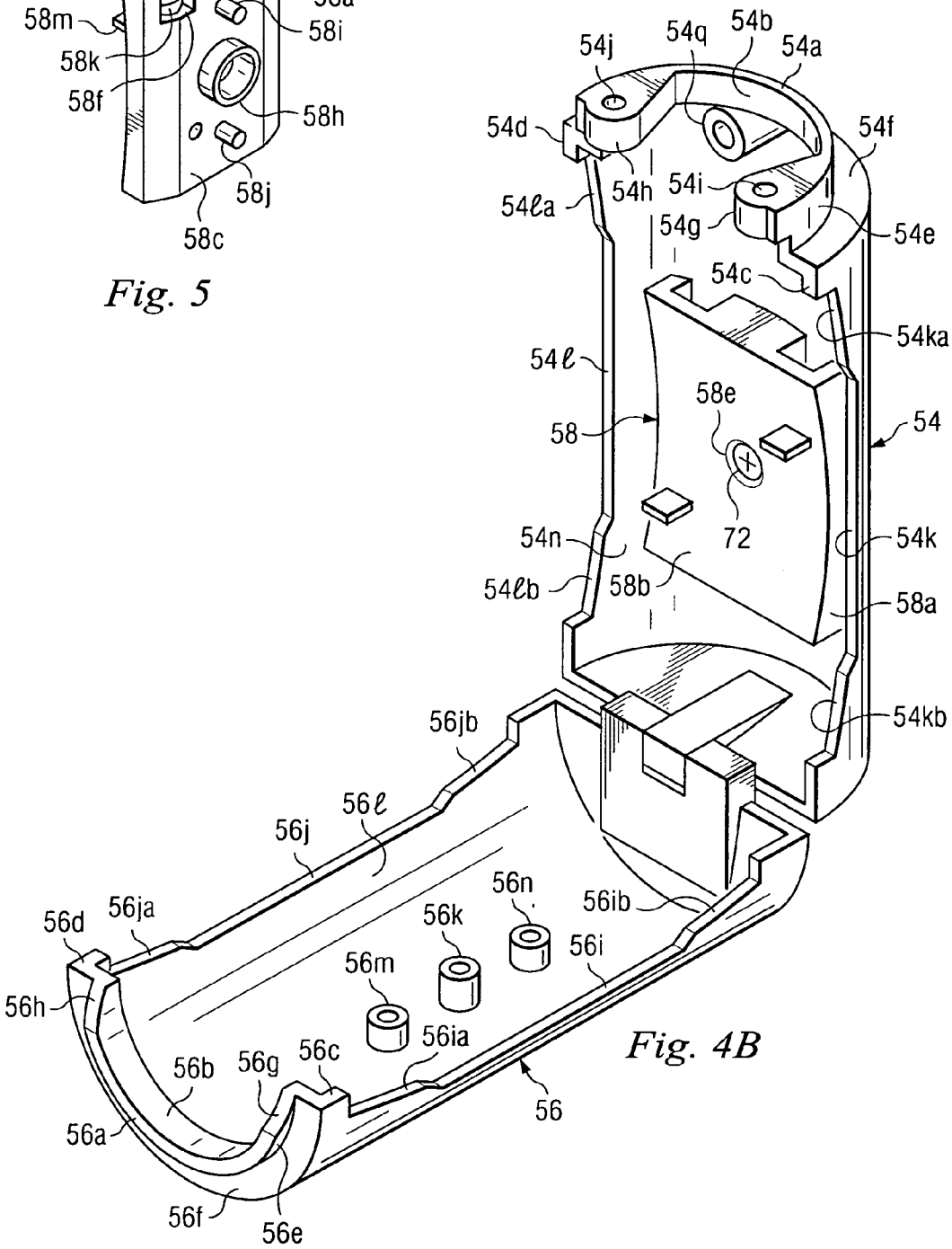
FIG. 4B is an enlarged view of a portion of the exploded view depicted in FIG. 4A.

In an exemplary embodiment, as illustrated in FIG. 2, the track 12 includes a longitudinally-extending protrusion 20 having an I-beam portion 20*a*. Protrusions 20*b* and 20*c* extend from the I-beam portion 20*a* to define a channel 20*d*, and protrusions 20*e* and 20*f* extend from the I-beam portion to define a channel 20*g*. Channels 20*h* and 20*i* are defined by the I-beam 20*a*, the protrusions 20*b* and 20*c*, and the protrusions 20*d* and 20*e*. Horizontally-extending surfaces 20*j* and 20*k* are defined by the I-beam portion 20*a*. In an exemplary embodiment, the protrusion 20 may be composed in whole or in part of aluminum and/or an aluminum alloy. In an exemplary embodiment, the I-beam portion 20*a* may have a nominal wall thickness of 0.060 inches.

An insulated liner 22 is disposed in the channel 20*h*, and defines longitudinally-extending channels 22*a*, 22*b* and 22*c*. An insulated liner 24 is disposed in the channel 20*i*, and defines longitudinally-extending channels 24*a*, 24*b* and 24*c*. In an exemplary embodiment, the liners 22 and 24 may be in the form of extruded polyvinyl insulators.

Longitudinally-extending buss bars 26*a*, 26*b* and 26*c* are disposed in the channels 22*a*, 22*b* and 22*c*, respectively, and longitudinally-extending buss bars 28*a*, 28*b* and 28*c* are disposed in the channels 24*a*, 24*b* and 24*c*, respectively. In an exemplary embodiment, the buss bars 26*a*, 26*b*, 26*c*, 28*a*, 28*b* and 28*c* may each be composed of nickel-plated solid copper, and may each have a cross section that is equivalent to #10AWG wire. As viewed in FIG. 2, the cross-section of the track 12 is symmetric across an imaginary vertical center axis, but is asymmetric across an imaginary horizontal center axis.

During installation, in an exemplary embodiment, the track 12 may be placed in a flexed or bent configuration by, for example, bending the track 12 and then coupling the track 12 to the power feed assembly 14 and the support assembly 16, or by adjusting the locations at which the power feed assembly 14 and/or the support assembly 16 are coupled to the ceiling 18, bending the track 12, and coupling the track 12 to the power feed assembly 14 and the support assembly 16 in one or more manners, including one or manners to be described in detail below. In an exemplary embodiment, the nominal wall thickness of the I-beam portion 20*a* of the protrusion 20 of the track 12 may facilitate the flexing or bending of the track 12, and the minimum bend radius of the track 12 may be 24 inches when the track 12 is placed in a flexed or bent configuration. In several exemplary embodiments, the track 12 may be supported by the power feed assembly 14, the support assembly 16, a device which extends into, is received by and/or is slidably engaged with the channel 20*d* of the track 12, as shown in FIG. 2, and/or any combination thereof. Moreover, one or more devices may hang from and/or may be supported by the track 12 by, for example, extending into, being received by and/or slidably engaging the channel 20*g* of the track 12, as shown in FIG. 2.

In an exemplary embodiment, the buss bars 26*a* and 26*c* are electrically isolated from the buss bars 28*a* and 28*c*, and the buss bars 26*b* and 28*b*; the buss bars 28*a* and 28*c* are electrically isolated from the buss bars 26*b* and 28*b*, and the buss bars 26*a* and 26*c*; and the buss bars 26*b* and 28*b* are electrically isolated from the buss bars 26*a* and 26*c*, and the buss bars 28*a* and 28*c*. During operation, in an exemplary embodiment, the track 12 is adapted to be supplied with electrical power so that a voltage V1 is generated across the buss bars 26*a* and 26*c*, and the buss bars 26*a* and 26*c* are permitted to form at least part of a single and independent electrical circuit, which may be independently switched. In an exemplary embodiment, the track 12 is supplied with AC electrical power by a 240V/120V 60-Hz single phase system 30*a* with grounded neutral so that the voltage V1 is generated across the buss bars 26*a* and 26*c* and is equal to a predetermined voltage level such as, for example, 120 volts. In an exemplary embodiment, the buss bar 26*a* serves as a hot conductor, the buss bar 26*c* serves as a neutral conductor, and the channel 20*d* serves as a grounding channel, that is, the protrusions 20*b* and/or 20*c* in part provide a ground path. In an exemplary embodiment, the maximum capacity of each of the buss bars 26*a* and 26*c* is 20 A.

In an exemplary embodiment, in addition to, or instead of supplying electrical power to the track 12 so that the buss bars 26*a* and 26*c* are permitted to form at least part of a single and independent electrical circuit, which may be independently switched, the track 12 is adapted to be supplied with electrical power so that a voltage V2 is generated across the buss bars 28*a* and 28*c*, and the buss bars 28*a* and 28*c* are permitted to form at least part of a single and independent electrical circuit, which may be independently switched. In an exemplary embodiment, the track 12 is supplied with AC electrical power by a 240V/120V 60-Hz single phase system 30*b* with grounded neutral so that the voltage V2 is generated across the buss bars 28*a* and 28*c* and is equal to a predetermined voltage level such as, for example, 120 volts. In an exemplary embodiment, the buss bar 28*a* serves as a hot conductor, the buss bar 28*c* serves as a neutral conductor, and the channel 20*d* serves as a grounding channel, that is, the protrusions 20*b* and/or 20*c* in part provide a ground path. In an exemplary embodiment, the maximum capacity of each of the buss bars 28*a* and 28*c* is 20 A. In several exemplary embodiments, the systems 30*a* and 30*b* may be combined and/or the number of 240V/120V 60-Hz single phase systems may be increased.

In an exemplary embodiment, in addition to, or instead of supplying electrical power to the track 12 so that the buss bars 26*a* and 26*c* are permitted to form at least part of a single and independent electrical circuit, which may be independently switched, and/or so that the buss bars 28*a* and 28*c* are permitted to form at least part of a single and independent electrical circuit, which may be independently switched, the track 12 is adapted to be supplied with electrical power so that a voltage V3 is generated across the buss bars 26*b* and 28*b*, and the buss bars 26*b* and 28*b* are permitted to form at least part of a single and independent electrical circuit, which may be independently switched. In an exemplary embodiment, the track 12 is supplied with DC electrical power by one or more devices such as, for example, a remote transformer and/or a DC power supply 31 so that the voltage V3 is generated and is equal to a predetermined voltage level such as, for example, 12 volts. In an exemplary embodiment, the maximum capacity of each of the buss bars 26*b* and 28*b* is 25 A.

In view of the foregoing, and in an exemplary embodiment, the voltages V1, V2 and V3 may all be simultaneously generated on the track 12, and thus the track 12 may support up to three independent electrical circuits.

In several exemplary embodiments, in addition to, or instead of the foregoing, electrical power may be supplied to the track 12 in a wide variety of configurations so that one or more pairs of the buss bars 26*a*, 26*b*, 26*c*, 28*a*, 28*b* and 28*c* are permitted to form at least part of a single electrical circuit and a voltage is generated across each of the one or more pairs. In several exemplary embodiments, the track 12 may be coupled to one or more other tracks to form one or more other lighting system configurations, as will be described in further detail below.

In several exemplary embodiments, a wide variety of devices may be coupled to the track 12 such as, for example, the power feed assembly 14, the support assembly 16 and/or the lamp assembly 20, and these examples and other examples of devices that are adapted to be coupled to the track 12 will be described in further detail below.

In an exemplary embodiment, as illustrated in FIGS. 3, 4A, 4B, 5, 6 and 7, the power feed assembly 14 includes an attachment 32 that is coupled to the track 12 and a mounting assembly 34, which, in turn, is coupled to the ceiling 18.

In an exemplary embodiment, the mounting assembly 34 includes a canopy plate 36 having an external recess 36*a* and openings 36*b* and 36*c*, and an opening 36*d*. A hexagonally-shaped protrusion 36*e* surrounds the opening 36*d*. A conventional mounting strap 38 includes openings 38*a* and 38*b* having internal threaded connections, and further includes an opening 38*c*. The mounting assembly 34 further includes an externally-threaded stem 40, fasteners 42*a* and 42*b* and a hexagonal nut 44.

In an exemplary embodiment, the attachment 32 includes a generally tubular housing 46 defining a longitudinal passage 46*a* and having a capped end portion 46*b* and an internal threaded connection 46*c* extending through the capped end portion 46*b* and into the passage. The housing 46 further includes an external annular recess 46*d* defining a shoulder 46*e*, and an external annular recess 46*f* defining a shoulder 46*g*. Generally cylindrical bosses 46*h* and 46*i* having respective internal threaded connections extend radially inwardly from the inside surface of the housing 46, and further extend axially along the longitudinal length of housing 46, from the end of the housing 46 adjacent the external annular recess 46*f* to the inside surface of the capped end portion 46*b*

A generally cylindrically-shaped terminal block 48 includes a bore 48*a*, through-openings 48*b* and 48*c*, arcuate channels 48*d* and 48*e*, and set screws 48*f* and 48*g* that are disposed in the terminal block and are adapted to extend into the through-opening 48*b*. Another pair of set screws, not shown but symmetric to the set screws 48*f* and 48*g* across an imaginary vertical center axis, are disposed in the terminal block 48 and are adapted to extend into the through-opening 48*c*.

The attachment 32 further includes a spring 50, a tubular sleeve 52 having an internal annular shoulder 52*a*, an arcuate shell housing 54 and an arcuate shell cover 56 hingedly connected to the housing 54 at one end of the housing 54 via a pin 55. The housing 54 includes an arcuate rib 54*a* at the other end that extends radially inward from the outside surface of the housing 54 and defines an arcuate surface 54*b* and coplanar surfaces 54*c* and 54*d* at the respective circumferentially-spaced ends of the rib 54*a*. An external arcuate recess 54*e* is formed in the rib 54*a* and defines a shoulder 54*f*. Circumferentially-spaced bosses 54*g* and 54*h* having respective through-openings 54*i* and 54*j* extend generally radially inward from the arcuate surface 54*b* so that the center axes of the through-openings 54*i* and 54*j*, and the surfaces 54*c* and 54*d*, all lie in the same imaginary plane.

A pair of aligned notches 54*k* and 54*l* are formed in the housing 54 at the respective axially-extending edges of the housing, and define profiles that substantially correspond to the profile of approximately one half of the perimeter outline of the cross-section of the track 12, which may be defined in part by either the outside surfaces of the protrusions 20*c* and 20*f*, or the outside surfaces of the protrusions 20*b* and 20*e*. Each of the profiles of portions 54*ka* and 54*la* of the notches 54*k* and 54*l*, respectively, substantially corresponds to the perimeter outline of the outside surface of the protrusion 20*c* or 20*b*, and each of the profiles of portions 54*kb* and 54*lb* of the notches 54*k* and 54*l*, respectively, substantially corresponds to the perimeter outline of the outside surface of the protrusion 20*f* or 20*e*.

A boss 54*m* having an internal threaded connection extends radially inward from an arcuate inside surface 54*n* of the housing 54, and bosses 54*o* and 54*p* having respective blind bores extend radially inward from the surface 54*n* and are positioned so that the boss 54*m* is between the bosses 54*o*and 54*p*. A boss 54*q* having an internal threaded connection extends radially inward from the surface 54*n* and is adjacent the rib 54*a*. The respective locations of the bosses 54*m*, 54*o*, 54*p* and 54*q* on the surface 54*n* are longitudinally aligned.

The cover 56 includes at its distal end an arcuate rib 56*a* that extends radially inward from the outside surface of the cover 56 and defines an arcuate surface 56*b* and coplanar surfaces 56*c* and 56*d* at the respective circumferentially-spaced ends of the rib 56*a*. An external arcuate recess 56*e* is formed in the rib 56*a* and defines a shoulder 56*f*. Curved ramp surfaces 56*g* and 56*h* extend from the coplanar surfaces 56*c* and 56*d*, respectively, to the distal end of the external arcuate recess 56*e*.

A pair of aligned notches 56*i* and 56*j* are formed in the cover 56 at the respective longitudinally-extending edges of the cover 56, and define profiles that substantially correspond to the profile of approximately the other half of the perimeter outline of the cross-section of the track 12, which may be defined in part by either the outside surfaces of the protrusions 20*c* and 20*f*, or the outside surfaces of the protrusions 20*b* and 20*e*. Each of the profiles of portions 56*ia* and 56*ja* of the notches 56*i* and 56*j*, respectively, substantially corresponds to the perimeter outline of the outside surface of the protrusion 20*c* or 20*b*, and each of the profiles of portions 56*ib* and 56*jb* of the notches 56*i* and 56*j*, respectively, substantially corresponds to the perimeter outline of the outside surface of the protrusion 20*f* or 20*e*.

A boss 56*k* having an internal threaded connection extends radially inward from an arcuate inside surface 56*l* of the cover 56, and bosses 56*m* and 56*n* having respective blind bores extend radially inward from the surface 56*l* and are positioned so that the boss 56*k* is between the bosses 56*m* and 56*n*. The respective locations of the bosses 56*k*, 56*m* and 56*n* on the surface 56*l* are longitudinally aligned.

A contact pad assembly 58 is disposed in the housing 54 and includes a contact pad 58*a* defining a curved surface 58*b*, a rear surface 58*c* and a top surface 58*d*. A counterbore 58*e* is formed in the curved surface 58*b*, and openings 58*f* and 58*g* are formed in the rear surface 58*c* and the top surface 58*d*. A tubular protrusion 58*h* extends from the rear surface 58*c* and is axially aligned with the counterbore 58*e*. Pins 58*i* and 58*j* extend from the rear surface 58*c* and are positioned so that the tubular protrusion 58*h* is between the pins 58*i* and 58*j*. The respective locations of extension from the rear surface 58*c* of the tubular protrusion 58*h* and the pins 58*i* and 58*j* are longitudinally aligned. Lugs 58*k* and 58*l* extend from the openings 58*f* and 58*g*, respectively, through the interior of the contact pad 58*a*, and outwards from the curved surface 58*b*, and have distal ends that define contacts 58*m* and 58*n*, respectively. A hot wire 58*o* extends upward from the lug 58*k*, and a neutral wire 58*p* extends upward from the lug 58*l*.

The attachment 32 further includes a ground clip 60 that is coupled to the housing 54 and includes a curved portion 60*a* and holes 60*b* and 60*c*, through which fasteners 62*a* and 62*b*, respectively, are adapted to extend. A ground wire 64 having a lug 64*a* extends through the bore 48*a* of the terminal block 48.

Figure 6:
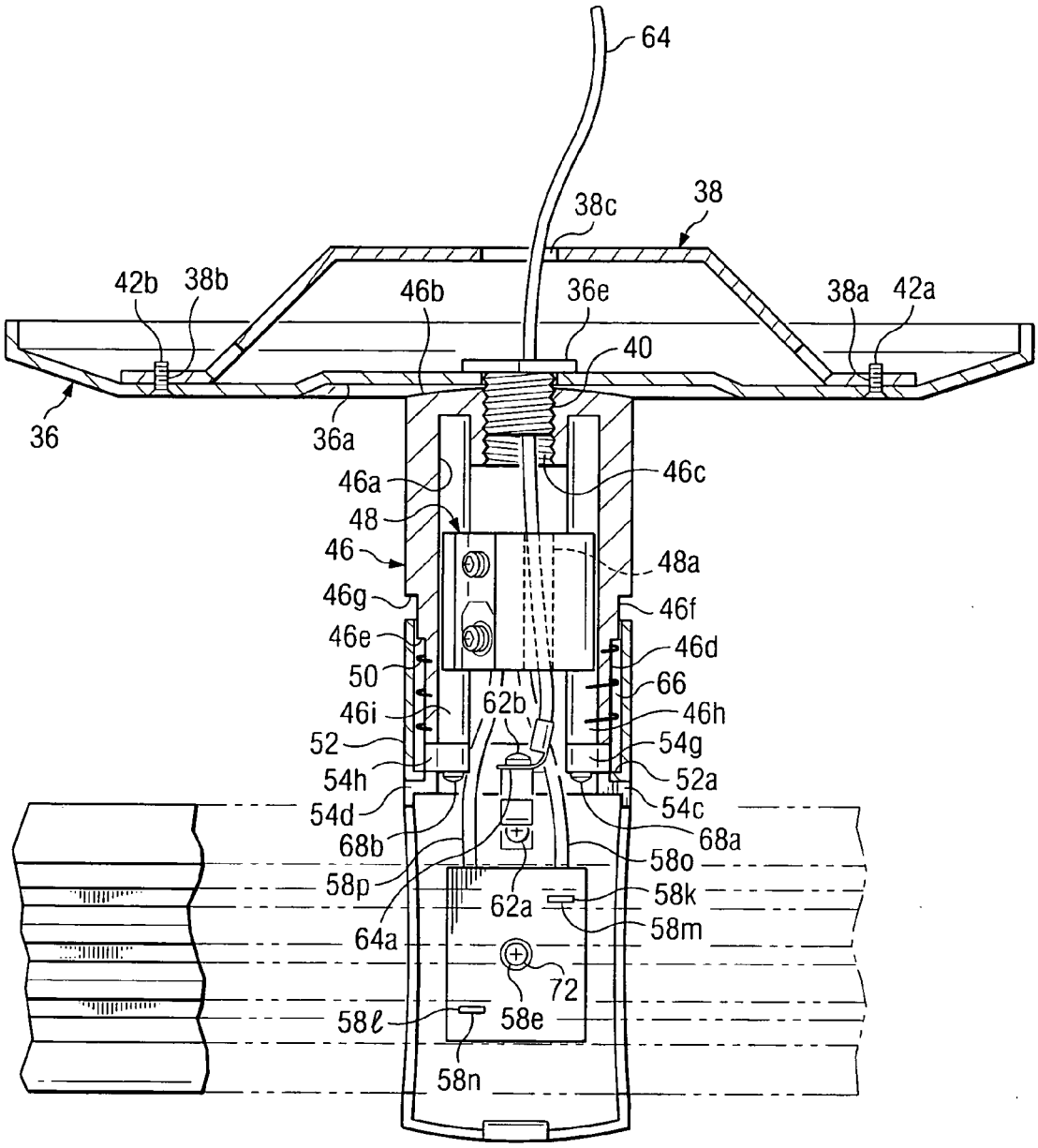
FIG. 6 is a sectional view of the power feed assembly of FIG. 1.
Figure 7:
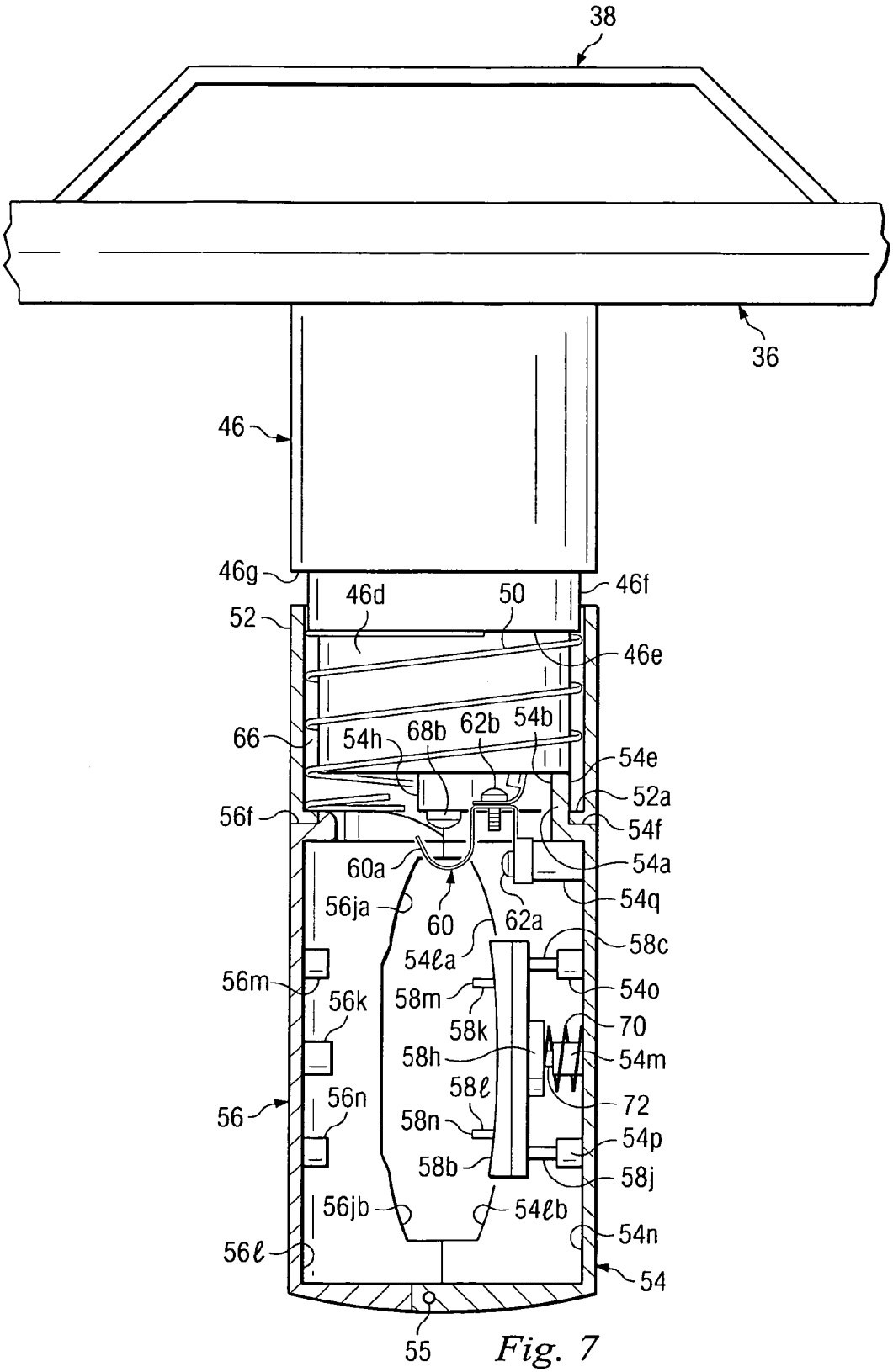
FIG. 7 is a partial sectional/partial elevational view of the power feed assembly of FIG. 1, except that wiring has been removed for clarity.

In an exemplary embodiment, when the mounting assembly 34 is in an assembled condition and coupled to the ceiling 18 as illustrated in FIGS. 6 and 7, the mounting strap 38 is connected in a conventional manner to a standard junction box, which is mounted in the ceiling 18 and not shown. The fasteners 42*a* and 42*b* extend through the openings 36*a* and 36*b*, respectively, of the canopy plate 36 and extend into and threadably engage the internal threaded connections of the openings 38*a* and 38*b*, respectively, of the mounting strap 38. As a result, the canopy plate 36 is coupled to the mounting strap 38 and the canopy plate 36 abuts the ceiling 18. The stem 40 is threadably engaged with the hex nut 44, which is supported by the canopy plate 36 and is surrounded by the protrusion 36*e*.

In an exemplary embodiment, when the attachment 32 is in an assembled condition and is coupled to the mounting assembly 34 as illustrated in FIGS. 6 and 7, the stem 40 is threadably engaged with the internal threaded connection 46*c* of the housing 46 so that the stem 40 couples the housing 46 to the canopy plate 36. In an exemplary embodiment, as a result of the coupling between the housing 46 and the canopy plate 36, the capped end portion 46*b* is adjacent the recess 36*a* of the canopy plate 36.

The terminal block 48 is received and at least partially extends within the passage 46*a* of the housing 46 so that the bosses 46*h* and 46*i* extend through the channels 48*e* and 48*d*, respectively, of the terminal block 48.

The external annular recesses 46*d* and 46*f* of the housing 46 are received and at least partially extend within the sleeve 52 to define an annular region 66 between the external annular recess 46*d* and the sleeve 52. The spring 50 extends within the annular region 66 and about the external annular recess 46*d*, abuts the shoulder 46*e* of the housing 46, and abuts the internal shoulder 52*a* of the sleeve 52. As a result, the spring 50 is compressed within the annular region 66.

Fasteners 68*a* and 68*b* extend through the through-openings 54*i* and 54*j*, respectively, of the bosses 54*g* and 54*h*, respectively, of the housing 54 and threadably engage the internal threaded connections of the bosses 46*h* and 46*i*, respectively, of the housing 46 until the end of the housing 54 adjacent the external annular recess 54*e* abuts the end of the housing 46 adjacent the external annular recess 46*d*. As a result, the housing 54 is coupled to the housing 46.

The fastener 62*a* extends through the hole 60*b* of the ground clip 60 and threadably engages the internal threaded connection of the boss 54*q* of the housing 54, thereby coupling the ground clip 60 to the housing 54.

A spring 70 extends about the boss 54*m* of the housing 54 and contacts the surface 54*n*, and further at least partially extends within the tubular protrusion 58*h*. The head of a fastener 72 is seated in the enlarged-diameter portion of the counterbore 58*e* of the contact pad assembly 58, and the fastener 72 extends through the counterbore 58*e* and threadably engages the internal threaded connection of the boss 54*m*, thereby coupling the contact pad assembly 58 to the housing 54 and causing the contact pad 58*a* to at least partially compress the spring 70 against the surface 54*n*. The pins 58*i* and 58*j* extend into the blind holes of the bosses 54*o* and 54*p*, respectively, of the housing 54.

The hot and neutral wires 58*o* and 58*p*, respectively, of the contact pad assembly 58 extend upward, through the passage 46*a* of the housing 46, and into the openings 48*c* and 48*b*, respectively, of the terminal block 48. The set screws 48*e* and 48*f* extend into the opening 48*b* to secure the neutral wire 58*p* against the inside wall of the opening 48*b*, thereby preventing relative movement between the neutral wire 58*p* and the terminal block 48 and providing strain relief. Similarly, the set screws that are symmetric to the set screws 48*e* and 48*f* and not shown extend into the opening 48*c* to secure the hot wire 58*o* against the inside wall of the opening 48*c*, thereby preventing relative movement between the hot wire 58*o* and the terminal block 48 and providing strain relief. In an exemplary embodiment, one or more clips may be coupled to each pair of set screws 48*e* and 48*f*, and the symmetric equivalents thereof, and at least partially disposed in the openings 48*b* and/or 48*c* to facilitate the securing of the wires 58*p* and 58*o* against the inside walls of the openings 48*b* and 48*c*, respectively.

The wires 58*o* and 58*p* terminate at the terminal block 48, and are electrically coupled in a conventional manner to a source of electrical power such as, for example, the system 30*b*.

The ground clip 60 is coupled to the housing 54, as noted above, and the ground wire 64 is coupled to the ground clip 60. More particularly, the fastener 62*b* extends through the lug 64*a* of the ground wire 64, and into the hole 60*c* of the ground clip 60, and threadably engages an internal threaded connection of the hole 60*c* to couple the ground wire 64 to the ground clip 60. The ground wire 64 extends upward through the bore 48*a* of the terminal block as noted above, through the passage 46*a* of the housing 46, and through the stem 40. The ground wire 64 may further extend through the opening 38*c* of the mounting strap 38, and/or may be coupled to a power ground source.

In an exemplary embodiment, as illustrated in FIGS. 6 and 7, the cover 56 is in a closed configuration in which the coplanar surfaces 56*c* and 56*d* of the cover 56 contact or nearly contact the coplanar surfaces 54*c* and 54*d*, respectively, of the housing 54, thereby enclosing the contact pad assembly 58. Moreover, due to the above-described compression of the spring 50 between the shoulder 46*e* of the housing and the internal shoulder 52*a* of the sleeve 52, the spring 50 urges the sleeve 52 against the shoulder 54*f* of the housing 54 and the shoulder 56*f* of the cover 56. As a result, the external annular recess 56*e* of the cover 56 contacts or nearly contacts the sleeve 52 and is thereby locked, that is, prevented from pivoting about the pin 55 and away from the coplanar surfaces 54*c* and 54*d* of the housing 54. In an exemplary embodiment, before, during or after the coupling of the attachment 32 to the mounting assembly 34 and/or the coupling of the mounting assembly 34 to the ceiling 18, the cover 56 may be placed in an open and/or a fully-open configuration in a manner, and under conditions, to be described in detail below.

Figure 8A:
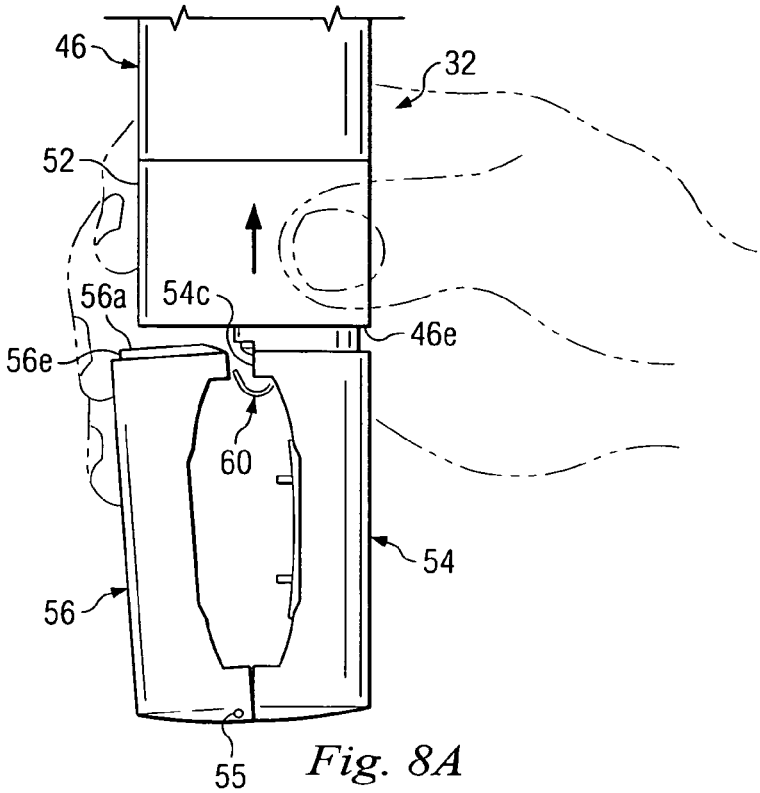
FIGS. 8A, 8B, 8C, 8D and 8E are elevational views depicting the coupling of the track of FIG. 1 to the power feed assembly of FIG. 1.

In an exemplary embodiment, the track 12 is coupled to the attachment 32 as illustrated in FIGS. 8A, 8B, 8C, 8D and 8E. As illustrated in FIG. 8A, the cover 56 is placed in an open configuration by an operator first moving the sleeve 52 in an upward direction, as indicated by the direction of the arrow in FIG. 8A. In an exemplary embodiment, the operator may move the sleeve 52 in the upward direction using only one hand. As a result of the movement of the sleeve 52 in the upward direction, the spring 50 is further compressed due to the axial movement of the internal shoulder 52*a* of the sleeve 52 towards the shoulder 46*e* of the housing 46, and the position of the internal shoulder 52*a* of the sleeve 52 is elevated above the cover 56, including the external annular recess 56*e*. As a result, the cover 56 is free to pivot about the pin 55 and away from the coplanar surfaces 54*c* and 54*d* of the housing 54. In an exemplary embodiment, the operator may rotate the cover 56 about the pin 55 so that the cover 56 pivots about the pin 55 and away from the coplanar surfaces 54*c* and 54*d* of the housing 54. In an exemplary embodiment, the operator may rotate the cover 56 about the pin 55 while maintaining the elevated position of the sleeve 52. In an exemplary embodiment, the operator may maintain the elevated position of the sleeve 52, thereby resisting the decompression of the spring 50, and rotate the cover 56 about the pin 55, using the same one hand. In an exemplary embodiment, gravity may cause or facilitate the pivoting of the cover 56 about the pin 55 and away from the coplanar surfaces 54*c* and 54*d* of the housing 54.

In an exemplary embodiment, the rotation of the cover 56 about the pin 55, so that the cover 56 pivots about the pin 55 and away from the housing 56, is continued until the position of at least a portion of the external annular recess 56*e* of the cover 56 is to the left of the sleeve 52, as viewed in FIG. 8A. At this point, the operator may release the sleeve 52, permitting the spring 50 to at least partially decompress and urge the sleeve 52 in a downward direction. In an exemplary embodiment, the sleeve 52 may contact the rib 56*a* of the cover 56 in response to the urging of the sleeve 52 downward by the spring 50. In response to any such contact, the rib 56*a* may ride against the sleeve 52 during the rotation of the cover 56 about the pin 55.

Figure 8B:
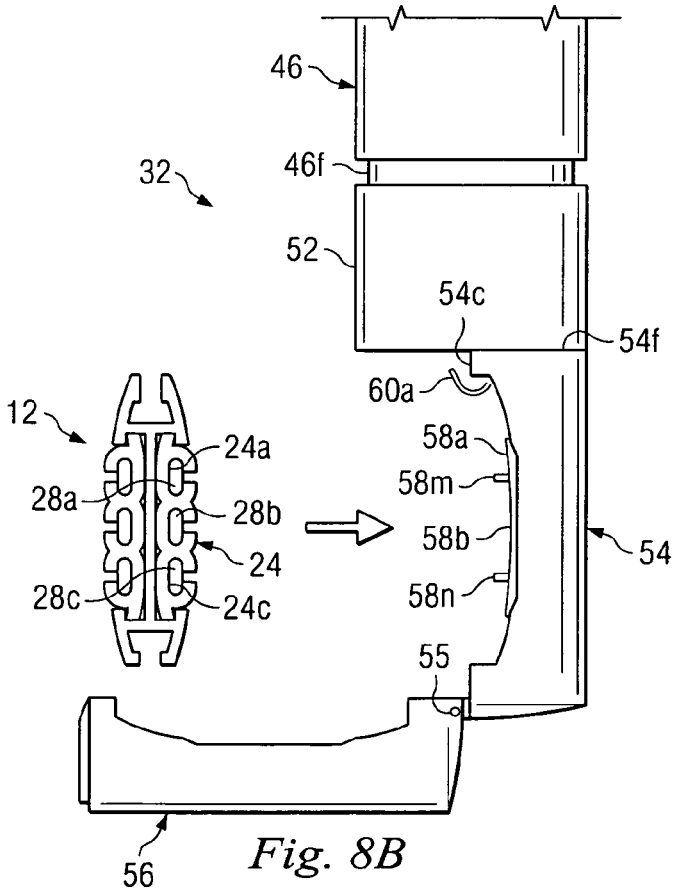

In an exemplary embodiment, as illustrated in FIG. 8B, the sleeve 52 abuts the shoulder 54*f* of the housing 54 in response to the operator's release of the sleeve 52 and the urging of the sleeve 52 downward by the spring 50, and the further rotation of the cover 56 about the pin 55 and away from the coplanar surfaces 54*c* and 54*d* of the housing 54. The cover 56 is further rotated about the pin 55, so that the cover 56 pivots about the pin 55 and away from the coplanar surfaces 54*c* and 54*d* of the housing 54, until the cover 56 is in a fully-open configuration. In an exemplary embodiment, once the cover 56 is a fully-open configuration, the cover 56 has rotated at least about 90 or more degrees in a circumferential direction away from the coplanar surfaces 54*c* and 54*d* of the housing 54.

Figure 8C:
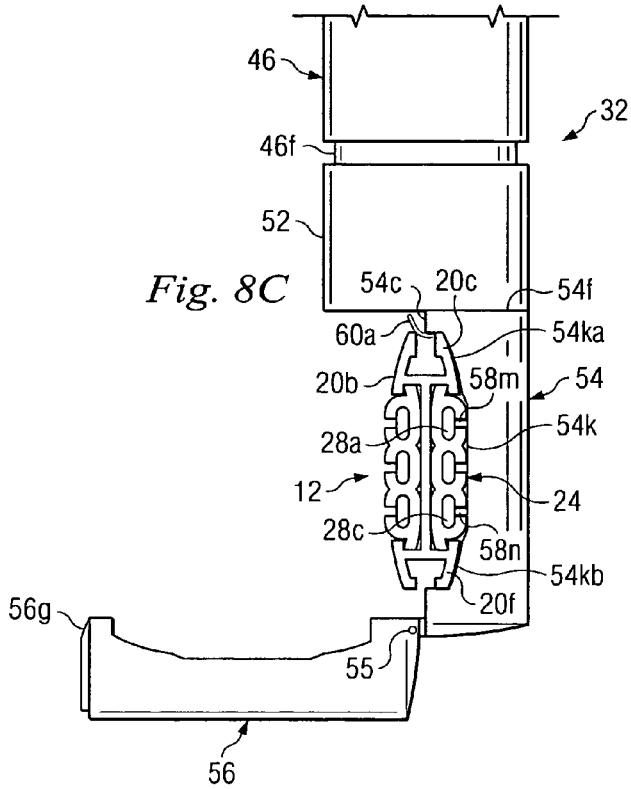
Figure 8D:
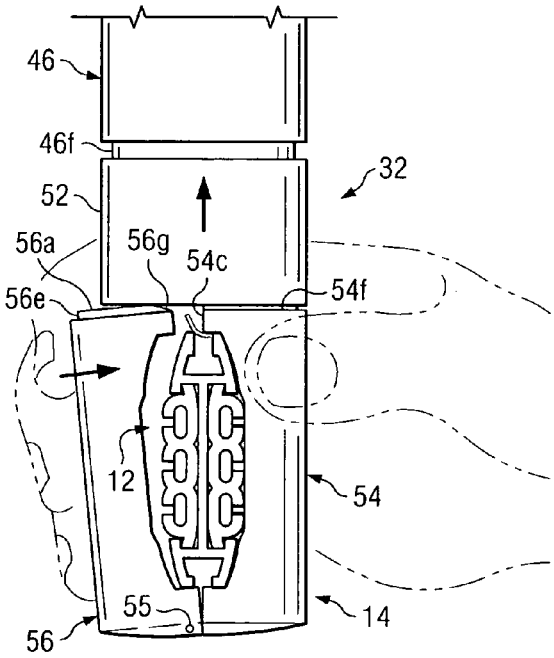

In an exemplary embodiment, as illustrated in FIGS. 8B and 8C, the track 12 is moved towards the attachment 32 so that at least aligned portions of the buss bars 28*a*, 28*b* and 28*c* travel in a direction that is perpendicular to the direction of the nominal longitudinal extension of the buss bars 28*a*, 28*b* and 28*c*, and is parallel to the direction of extension of the contacts 58*m* and 58*n* from the curved surface 58*b* of the contact pad 58*a* of the contact pad assembly 58, as indicated by the direction of the arrow in FIG. 8B. The position of the track 12 is adjusted until the buss bars 28*a* and 28*c* are vertically aligned with the contacts 58*m* and 58*n*, respectively, as viewed in FIG. 8B. This position of the track 12 is maintained and the track 12 is moved in the above-described direction until the contact 58*m* extends into the channel 24*a* and contacts or nearly contacts the buss bar 28*a*, and until the contact 58*n* extends into the channel 24*c* and contacts or nearly contacts the buss bar 28*c*, as viewed in FIG. 8C.

As a result of the contacts 58*m* and 58*n* contacting or nearly contacting the buss bars 28*a* and 28*c*, respectively, the curved portion 60*a* of the ground clip 60 contacts the protrusion 20*b* of the protrusion 20 of the track 12. In an exemplary embodiment, the curved portion 60*a* may contact the protrusion 20*c* of the protrusion 20 of the track 12. Due to the curved shape of the curved portion 60*a*, the curved portion 60*a* is compressed and applies a reaction or biasing force against the protrusion 20*b* and/or 20*c*.

As a further result of the contacts 58*m* and 58*n* contacting or nearly contacting the buss bars 28*a* and 28*c*, respectively, the protrusion 20*c* of the track 12 is positioned near or contacts the portions 54*ka* and 54*la* of the notches 54*k* and 54*l*, respectively, of the housing 54, the protrusion 20*f* of the track 12 is positioned near or contacts the portions 54*kb* and 54*lb* of the notches 54*k* and 54*l*, respectively, and the insulated liner 24 of the track 12 is positioned near or contacts the respective vertically-extending portions of the notches 54*k* and 54*l*.

After the above-described positioning of the track 12 relative to the housing 54, the cover 56 is rotated about the pin 55 so that the cover 56 pivots about the pin 55 and circumferentially towards the coplanar surfaces 54*c* and 54*d* of the housing 54. During this rotation, the curved ramp surfaces 56*g* and 56*h* contact the end of the sleeve 52 abutting the shoulder 54*e* of the housing 54. Continued rotation of the cover 56 after the contact between the sleeve 52 and the ramp surfaces 56*g* and 56*h* forces at least the portion of the sleeve 52 in contact with the ramp surfaces 56*g* and 56*h* upward, as indicated by the direction of the arrow in FIG. 8D, overcoming the local force exerted by the spring 50 on the sleeve 52 in the downward direction. The curved shape of the ramp surfaces 56*g* and 56*h* facilitate the forcing of the at least a portion of the sleeve 52 in the upward direction.

Continued rotation of the cover 56 continues to force the at least a portion of the sleeve 52 in contact with the ramp surfaces 56*g* and 56*h* upward, as the coplanar surfaces 56*c* and 56*d* of the cover 56 continue to approach the coplanar surfaces 54*c* and 54*d*, respectively, of the housing 54. As a result, the sleeve 52 slides along the ramp surfaces 56*g* and 56*h* and on top of the rib 56*a*, during the rotation of the cover 56, until the coplanar surfaces 56*c* and 56*d* contact or nearly contact the coplanar surfaces 54*c* and 54*d*, respectively, and the external annular recess 56*e* of the cover 56 is offset radially inwardly from the shoulder 52*a* of the sleeve 52.

Figure 8E:
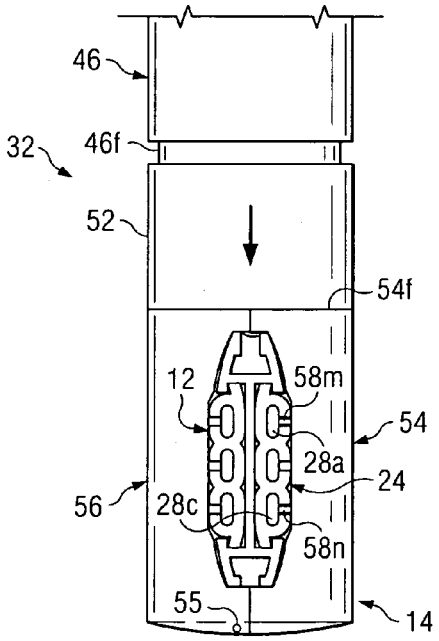

When the external annular recess 56*e* of the cover 56 is offset radially inwardly from the shoulder 52*a* of the sleeve 52, the spring 50 automatically at least partially decompresses, pushing the shoulder 52*a* of the sleeve 52, and therefore the sleeve 52, in a downward direction, as indicated by the direction of the arrow in FIG. 8E, until the sleeve 52 abuts substantially all of the shoulder 54*f* of the housing 54. As a result, the cover 56 is placed in its closed configuration and is thereby locked, that is, prevented from pivoting about the pin 55 and away from the coplanar surfaces 54*c* and 54*d* of the housing 54. In an exemplary embodiment, an operator may place the cover 56 in its closed configuration using only one hand by simply rotating the cover 56 in the above-described manner with only one hand. In an exemplary embodiment, an operator may place the cover 56 in its closed or locked configuration without the use of one or more tools, that is, without the use of, for example, a screwdriver, an allen wrench, another type of wrench, etc., thereby toollessly coupling the track 12 to the attachment 32.

In an exemplary embodiment, as a result of the above-described closing of the cover 56, the protrusion 20*b* of the track 12 contacts the portions 56*ia* and/or 56*ja* of the notches 56*i* and/or 56*j*, respectively, of the cover 56, the protrusion 20*e* of the track 12 contacts the portions 56*ib* and/or 56*jb* of the notches 56*i* and/or 56*j*, respectively, and/or the insulated liner 22 of the track 12 contacts one or both of the respective vertically-extending portions of the notches 56*i* and 56*j*. As a result, in an exemplary embodiment, the curved portion 60*a* of the ground clip 60 may be further compressed against the protrusion 20*b*. As another result, the buss bars 28*a* and 28*c* are urged further towards the contacts 58*m* and 58*n*, respectively, contacting and pushing against the contacts. As a result of the further urging of the buss bars 28*a* and 28*c* against the contacts 58*m* and 58*n*, respectively, the contact pad 58*a* is urged towards the surface 54*n* of the housing 54, relative to the fastener 72, thereby further compressing the spring 70 between the contact pad 58*a* and the surface 54*n*, and causing the boss 54*m* of the housing 54 to at least partially extend, or further at least partially extend, within the tubular protrusion 58*h*, and causing the pins 58*i* and 58*j* to further extend within the respective blind bores of the bosses 54*o* and 54*p*. The extension of the spring 70 about the boss 54*m* and at least partially within the tubular protrusion 58*h* facilitates the compression and/or decompression of the spring 70 in its axial direction, and limits unwanted positional adjustments of the spring 70. The extension of the pins 58*i* and 58*j* into the respective blind bores of the bosses 54*o* and 54 guide the contact pad 58*a* during its movement towards and/or away from the surface 54*n* of the housing 54, and facilitate in maintaining the rotational orientation and position of the contact pad 58*a*.

As a result of the further compression of the spring 70, the spring 70 applies a reaction or biasing force to the contact pad 58*a* which, in turn, causes the contacts 58*m* and 58*n* to more firmly contact the buss bars 28*a* and 28*c*, respectively. The curved shape of the curved surface 58*b* of the contact pad 58*a* facilitates this firm contact between the contacts 58*m* and 58*n* and the buss bars 28*a* and 28*c*, respectively, and the conformance of the contact pad 58*a* to the insulated liner 24.

In an exemplary embodiment, after the track 12 has been coupled to the power feed assembly 14 as illustrated in FIGS. 8A, 8B, 8C, 8D and 8E, the power feed assembly 14 operates to carry or transfer electrical power to the track 12 so that the voltage V2 is generated across the buss bars 28*a* and 28*c*. In an exemplary embodiment, the 240V/120V 60-Hz single phase system 30*b*may supply AC electrical power to the track 12, via the wires 58*o* and 58*p*, the lugs 58*k* and 58*l*, the contacts 58*m* and 58*n* and the buss bars 28*a* and 28*c* of the power feed assembly 14, so that the voltage V2 is generated across the buss bars 28*a* and 28*c*. A ground path is provided by the protrusion 20 of the track 12, the ground clip 60, the ground lug 64*a* and the ground wire 64 of the power feed assembly 14. In an exemplary embodiment, as a result of the electrical power carried by the power feed assembly 14 to the track 12, the voltage V2 is 120 volts.

In an exemplary embodiment, the power feed assembly 14 further operates to support, at least in part, the track 12, thereby permitting, at least in part, the track 12 to be suspended from the ceiling 18.

Figure 9A:
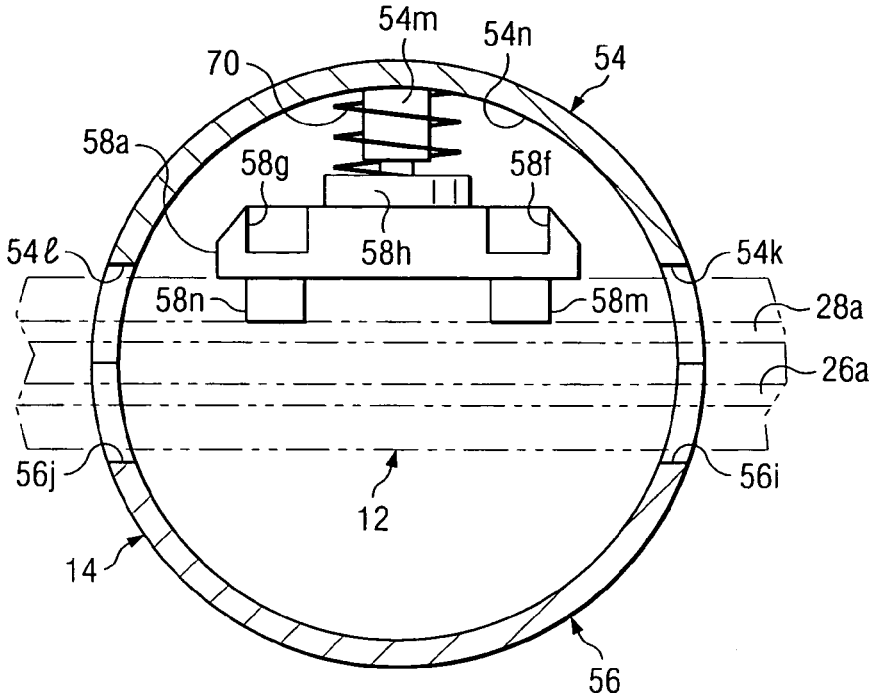
FIG. 9A is a partial sectional/partial top plan view of the track of FIG. 1 coupled to the power feed assembly of FIG. 1, but with selected components of the assemblies removed for clarity.

In an exemplary embodiment, as described above and illustrated in FIG. 9A, the at least partially compressed spring 70 provides a biasing force against the contact pad 58*a*, thereby forcing the contacts 58*m* and 58*n* against the buss bars 28*a* and 28*c*, respectively, to effect sufficient contact between the power feed assembly 14 and the track 12 (the buss bar 28*c* is hidden from view).

Figure 9B:
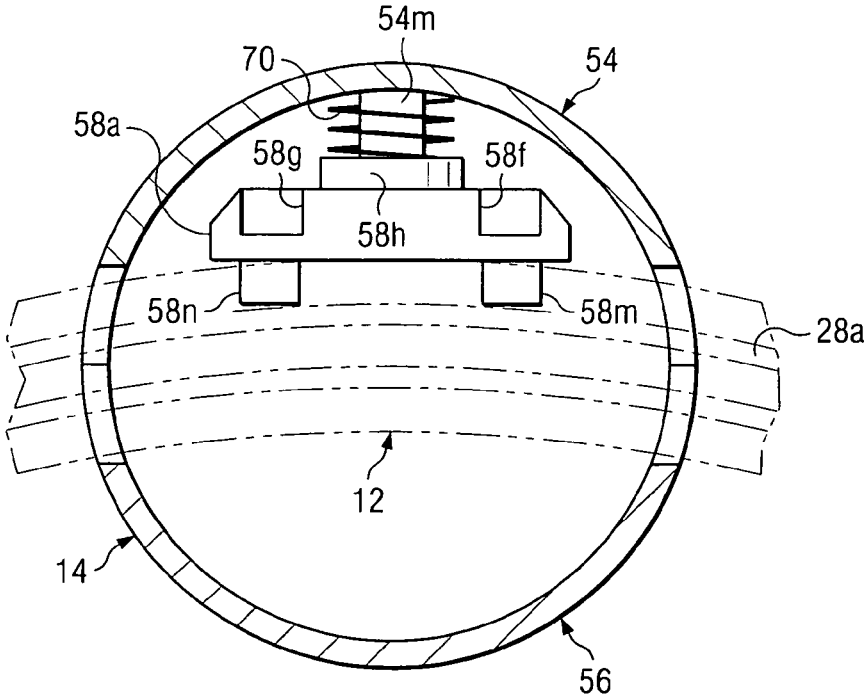
FIG. 9B is a view similar to that of FIG. 9A but depicting the track in a flexed or bent configuration.

In an exemplary embodiment, as illustrated in FIG. 9B, if the track 12 is placed in a flexed or bent configuration so that the track 12 bends towards the housing 54, the spring 70 is further compressed, and thus continues to provide a biasing force against the contact pad 58*a*, thereby maintaining the contact between the contacts 58*m* and 58*n* and the buss bars 28*a* and 28*c*, respectively, and accommodating the bending of the track 12. In an exemplary embodiment, the track 12 may be placed in an another flexed or bent configuration so that the track 12 bends away from the housing 54, in which case the spring 70 may at least partially decompress to continue to provide a biasing force against the contact pad 58*a* to force the contacts 58*m* and 58*n* against the buss bars 28*a* and 28*c*, respectively, thereby maintaining the contact therebetween.

In several exemplary embodiments, the spring 70 generally permits the contact pad 58*a* to float in response to any irregularities or slight bends along the track 12, or appreciable, intended and/or unintended bends in the track 12, thereby generally maintaining the contact between the contacts 58*m* and 58*n* and the buss bars 28*a* and 28*c*, respectively. That is, the floating contact pad 58*a* generally accommodates any deflections or bends of the track 12 such as, for example, bending and/or torsional deflections or bends, thereby generally maintaining the contact between the contacts 58*m* and 58*n* and the buss bars 28*a* and 28*c*, respectively.

In an exemplary embodiment, the above-described asymmetry of the track 12, about an imaginary horizontal center axis, and the corresponding asymmetry between the portions 54*ka* and 54*kb* of the notch 54*k*, between the portions 54*la* and 54*lb* of the notch 54*l*, between the portions 56*ia* and 56*ib* of the notch 56*i*, and between the portions 56*ja* and 56*jb* of the notch 56*j*, ensures that the track 12 is coupled to the attachment 32 in one direction only to maintain polarity. That is, the track 12 can generally only be coupled to the attachment 32 so that attachment 32 extends above, or beyond, the protrusions 20*b* and 20*c* of the track 12, thereby ensuring that the contact 58*m* always contacts either the buss bar 26*a* or 28*a*, and that the contact 58*n* always contacts either the buss bar 26*c* or 28*c*. Conversely, the attachment 32 is generally prevented from extending below, or beyond, the protrusions 20*e* and 20*f* of the track 12.

In an exemplary embodiment, the position of the track 12, relative to the power feed assembly 14, may be varied by, for example, sliding the track 12 relative to the power feed assembly 14 while the contacts 58*m* and 58*n* continue to contact the buss bars 28*a* and 28*c*, respectively, or by opening the cover 56 in the manner described above, adjusting the position of the track 12 relative to the power feed assembly 14, and closing the cover 56 in the manner described above.

In an exemplary embodiment, the position of the attachment 32 of the power feed assembly 14, relative to the track 12, may be adjusted by decoupling the track 12 from the attachment 32 by carrying out the above-described coupling therebetween in reverse, rotating the attachment 32 in place and about its longitudinal center axis by 180 degrees, and re-coupling the track 12 to the attachment 32 in a manner similar to that described above, except that the contacts 58*m* and 58*n* contact the buss bars 26*a* and 26*c*, respectively. As a result of this adjustment, the power feed assembly 14 would operate to transfer electrical power to the track 12 so that the voltage V1 would be generated across the buss bars 26*a* and 26*c*. In an exemplary embodiment, the 240V/120V 60-Hz single phase system 30*a* could supply AC electrical power to the track 12, via the wires 58*o* and 58*p*, the lugs 58*k* and 58*l* and the contacts 58*m* and 58*n* of the power feed assembly 14 so that the voltage V1 would be generated across the buss bars 26*a* and 26*c*. A ground path would be provided by the protrusion 20 of the track 12, the ground clip 60, the ground lug 64*a* and the ground wire 64 of the power feed assembly 14. In an exemplary embodiment, as a result of the electrical power carried by the power feed assembly 14 to the track 12, the voltage V1 would be 120 volts.

Figure 10:
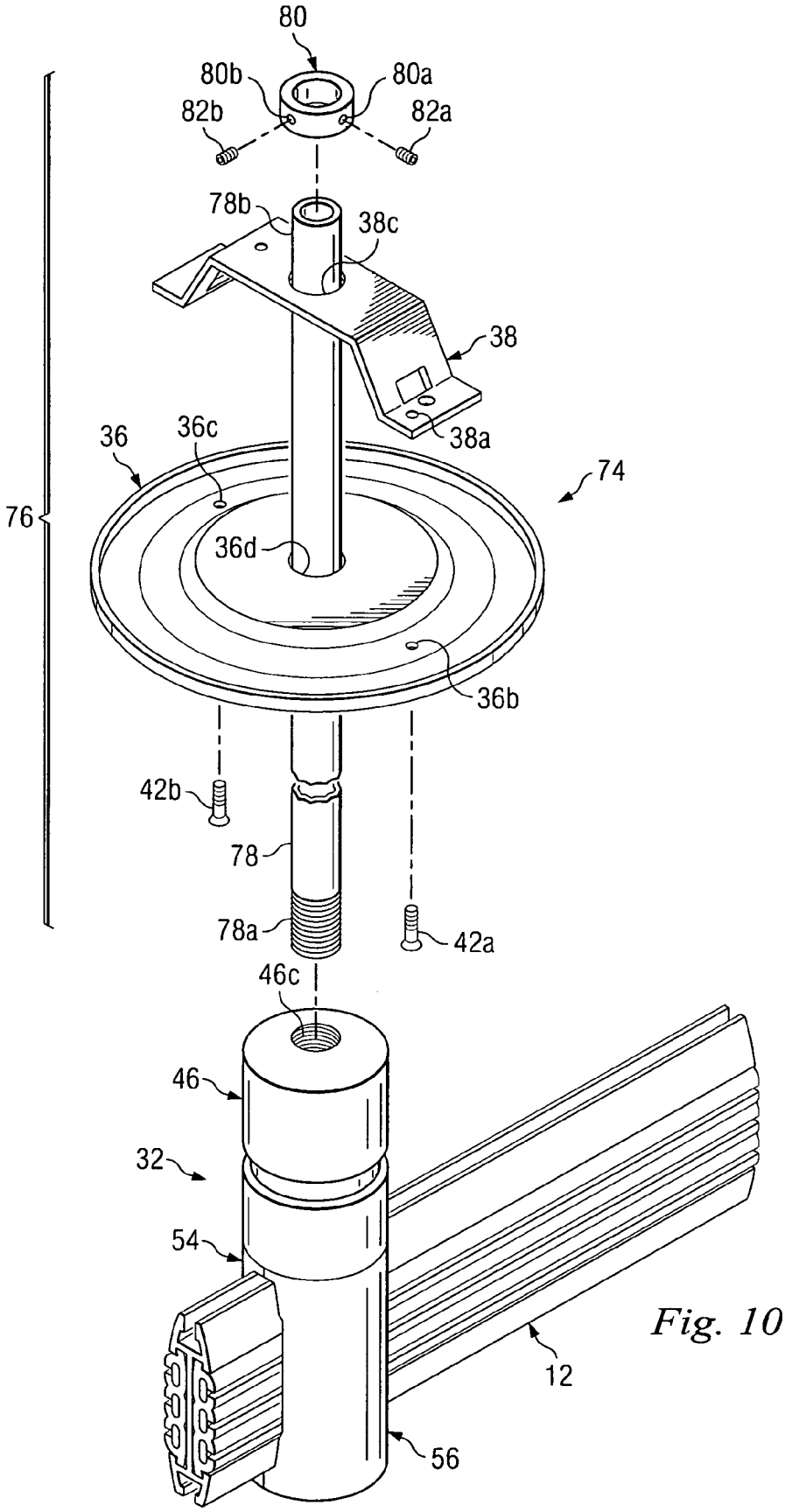
FIG. 10 is a partial exploded/partial perspective view of a power feed assembly according to another embodiment and coupled to the track of FIG. 1.

In an exemplary embodiment, as illustrated in FIG. 10, another embodiment of a power feed assembly is generally referred to by the reference numeral 74, and is similar to the power feed assembly 14 depicted in FIGS. 1 and 3 through 9B and contains several parts of the power feed assembly 14, which are given the same reference numerals. The power feed assembly 74 includes the attachment 32, which is coupled to a mounting assembly 76 which, in turn, is coupled to the ceiling 18 (not shown).

The mounting assembly 76 is similar to the mounting assembly 34 depicted in FIGS. 1 and 3 through 7 and includes several parts of the mounting assembly 34, which are given the same reference numerals. The mounting assembly 76 further includes a longitudinally-extending stem 78 having an external threaded connection 78*a* and a distal end portion 78*b*, a collar 80 having radial bores 80*a* and 80*b*, and set screws 82*a* and 82*b*.

When the mounting assembly 76 is an assembled condition and coupled to the ceiling 18 and the attachment 32, the mounting strap 38 is connected in a conventional manner to a standard junction box, which is mounted in the ceiling 18 and not shown. The fasteners 42*a* and 42*b* extend through the openings 36*b* and 36*c*, respectively, of the canopy plate 36 and extend into and threadably engage the internal threaded connections of the openings 38*a* and 38*b*, respectively, of the mounting strap 38. As a result, the canopy plate 36 is coupled to the mounting strap 38 and the canopy plate 36 abuts the ceiling 18. The stem 78 is threadably engaged with the internal threaded connection 46*c* of the housing 46 of the attachment 32, and extends upward through the opening 36*d* of the canopy plate 36, through the opening 38*c* of the mounting strap 38, and at least partially through the collar 80, which is supported by the mounting strap 38 and is positioned in the vicinity of the distal end portion 78*b* of the stem 78. The set screws 82*a* and 82*b* extend through the radial bores 80*a* and 80*b*, respectively, of the collar 80 and contact the outside surface of the stem 78, thereby coupling the collar 80 to the stem 78.

When the mounting assembly 76 is an assembled condition and coupled to the ceiling 18 and the attachment 32, the capped end portion 46*b* of the housing 46 of the attachment 32 is offset from the recess 36*a* of the canopy plate 36, and the attachment 32, and therefore the track 12, are suspended below the canopy plate 36 by a predetermined distance that is less than the longitudinal length of the stem 78. In several exemplary embodiments, the distance of suspension of the attachment 32 and the track 12 may be adjusted by, for example, adjusting the length of the stem 78 by, for example, cutting off a longitudinally-extending portion of the stem 78, including the distal end portion 78*b*, to create a new distal end portion and decrease the suspension distance of the attachment 32 and the track 12; or by coupling another device such as, for example, another stem, to the stem 78 to increase the suspension distance of the attachment 32 and the track 12; or by replacing the stem 78 with a longer or shorter stem to increase or decrease respectively, the suspension distance of the attachment 32 and the track 12.

The coupling of the track 12 to the power feed assembly 76 is substantially identical to the above-described coupling of the track 12 to the power feed assembly 14 and therefore will not be described in detail. The operation of the power feed assembly 76 is substantially identical to the above-described operation of the power feed assembly 14 and therefore will not be described in detail.

Figure 12:
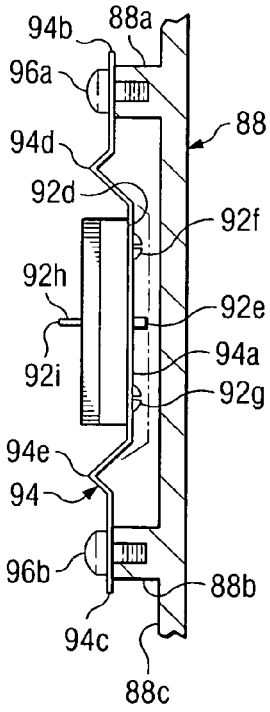
FIG. 12 is a sectional view of a portion of the power feed assembly of FIG. 11.
Figure 11:
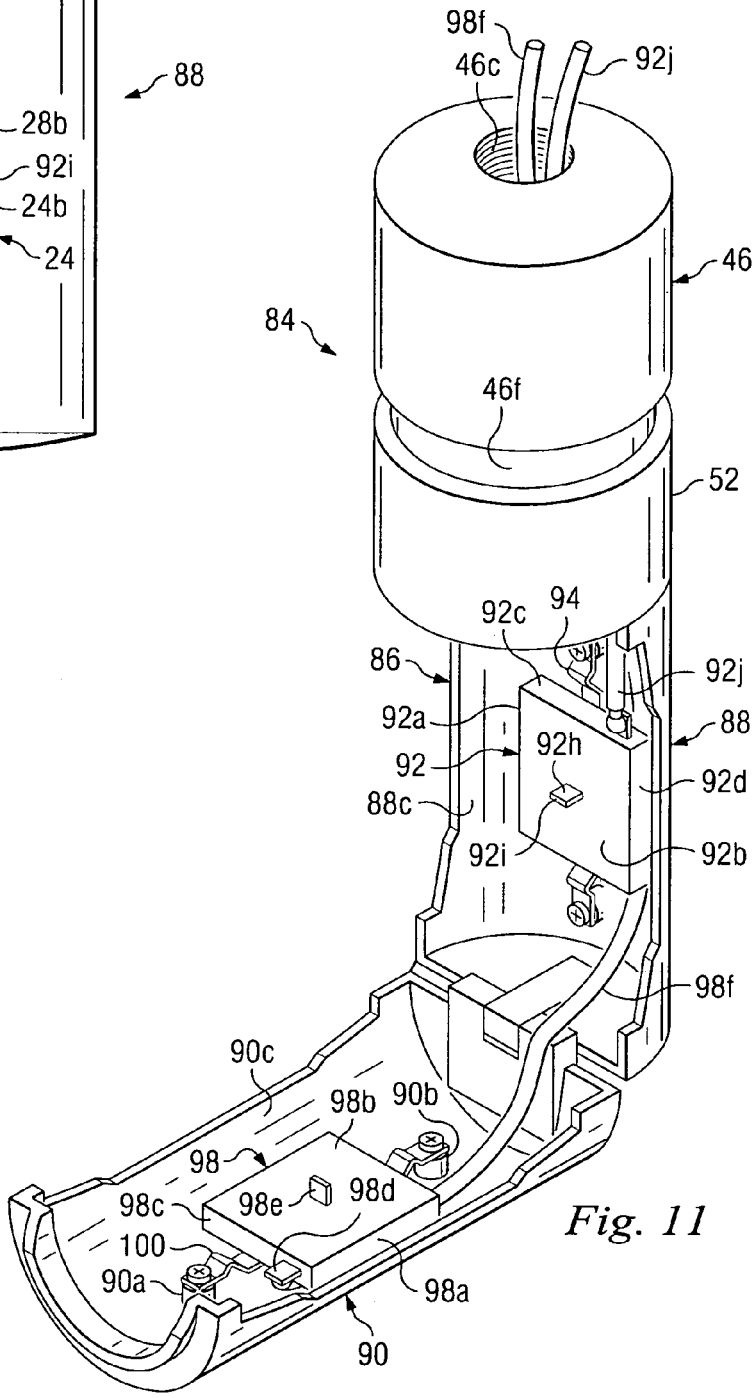
FIG. 11 is a perspective view of a power feed assembly according to another embodiment.
Figure 14:
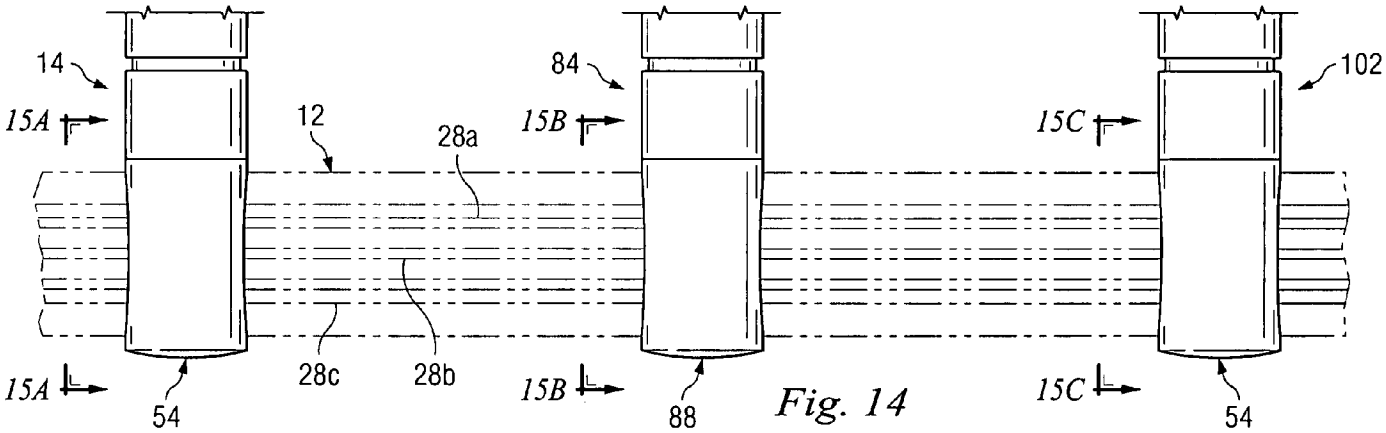
FIG. 14 is an elevational view depicting the track of FIG. 1 coupled to the power feed assembly of FIG. 1, the power feed assembly of FIG. 11 and a power feed assembly substantially identical to the power feed assembly of FIG. 1.
Figure 15C:
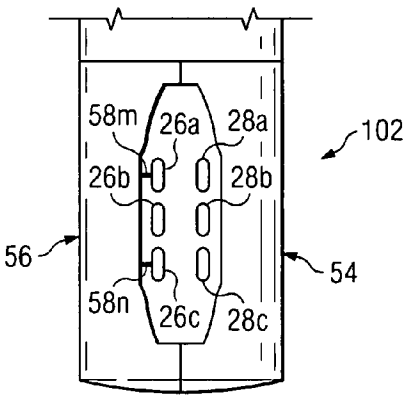
FIGS. 15A, 15B and 15C are sectional views of the track of FIG. 14 taken along lines 15A-15A, 15B-15B and 15C-15C, respectively.
Figure 15B:
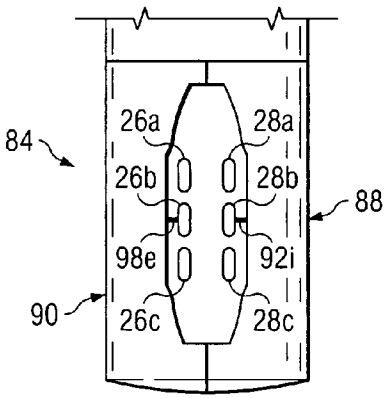
Figure 15A:
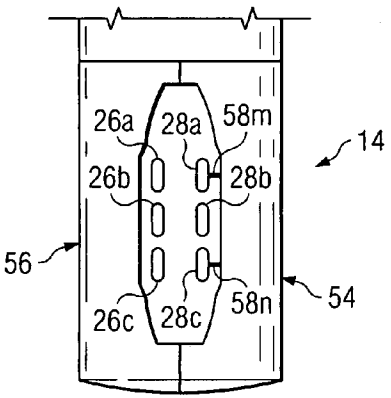

In an exemplary embodiment, as illustrated in FIGS. 11 and 12, another embodiment of a power feed assembly is generally referred to by the reference numeral 84, and is similar to the power feed assembly 14 depicted in FIGS. 1 and 3 through 9B and contains several parts of the power feed assembly 14, which are given the same reference numerals.

The power feed assembly 84 includes an attachment 86 that includes the housing 46, which is coupled to a mounting assembly (not shown) such as, for example, the mounting assembly 34, the mounting assembly 76 and/or a combination thereof, which, in turn, is coupled to the ceiling 18. The attachment 86 further includes the terminal block 48 (not shown), the spring 50 (not shown) and the sleeve 52, and these components are arranged in a manner substantially identical to the manner in which these components are arranged in the power feed assembly 14.

An arcuate shell housing 88 is coupled to the housing 46 in a manner substantially identical to the manner in which the housing 54 is coupled to the housing 46 in the power feed assembly 14. The housing 88 is substantially similar to the housing 54, except that bosses 88*a* and 88*b* having internal threaded connections extend from an inside surface 88*c* of the housing 88.

An arcuate shell cover 90 is hingedly connected to the housing 88 in a manner substantially identical to the manner in which the cover 56 is hingedly connected to the housing 54 in the power feed assembly 14. The cover 90 is substantially similar to the cover 56, except that bosses 90*a* and 90*b* having internal threaded connections extend from an inside surface 90*c* of the housing 90.

A contact pad assembly 92 is disposed in the housing 88 and includes a contact pad 92*a* defining surfaces 92*b*, 92*c* and 92*d*. A pin 92*e* and snap fasteners 92*f* and 92*g* extend from the surface 92*d* so that the pin 92*e* is positioned between the snap fasteners 92*f* and 92*g*. The respective locations of extension from the surface 92*d* of the pin 92*e* and the snap fasteners 92*f* and 92*g* are longitudinally aligned. A lug 92*h* is coupled to the contact pad 92*a*, extending through the surface 92*c*, through the interior of the contact pad 92*a*, and outwards from the surface 92*b*. The lug 92*h* has a distal end that defines a contact 92*i*. A wire 92*j* extends from the lug 92*h*.

The snap fasteners 92*f* and 92*g* extend through openings in a middle portion 94*a* of a biasing element 94, thereby coupling the contact pad assembly 92 to the biasing element 94. The pin 92*e* extends through an opening in the middle portion 94*a* of the biasing element 94. Fasteners 96*a* and 96*b* extend through tabs 94*b* and 94*c*, respectively, of the biasing element 94, and are threadably engaged with the internal threaded connections of the bosses 88*a* and 88*b*, thereby coupling the biasing element 94 to the housing 88. Peak-shaped projections 94*d* and 94*e* extend between the middle portion 94*a* and the tabs 94*b* and 94*c*, respectively.

A contact pad assembly 98 is coupled to a biasing element 100 in a manner substantially identical to the manner in which the contact pad assembly 92 is coupled to the biasing element 94, and therefore the coupling between the contact pad assembly 98 and the biasing 100 will not be described in detail. The contact pad assembly 98 includes a contact pad 98*a* that defines surfaces 98*b* and 98*c*. A lug 98*d* is coupled to the contact pad 98*a*, extending through the surface 98*c*, through the interior of the contact pad 98*a*, and outwards from the surface 98*b*. The lug 98*d* has a distal end that defines a contact 98*e*. A wire 98*f* extends from the lug 98*d*.

The wires 92*j* and 98*f* of the power feed assembly 84 extend upward and engage, and extend into, the terminal block 48 disposed in the housing 46 in the same manner in which the wires 58*o* and 58*p* engage, and extend into, the terminal block 48 in the power feed assembly 14. Moreover, in an exemplary embodiment, the wires 92*j* and 98*f* of the power feed assembly 84 may further extend through the passage 46*a* and the internal threaded connection 46*c* of the housing 46, and through the mounting assembly coupled to the housing 46 such as, for example, the mounting assembly 34, and may be electrically coupled in a conventional manner to a source of electrical power such as, for example, the power supply 31. In an exemplary embodiment, the wires 92*j* and 98*f* may instead terminate at the terminal block 48, and may be electrically coupled in a conventional manner to a source of electrical power such as, for example, the power supply 31.

Figure 13:
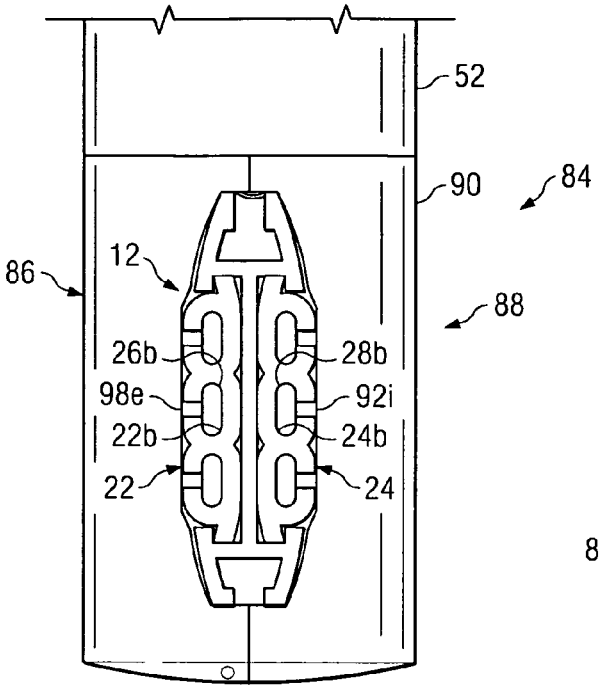
FIG. 13 is an elevational view depicting the track of FIG. 1 coupled to the power feed assembly of FIG. 11.

In an exemplary embodiment, as illustrated in FIG. 13, the track 12 is coupled to the attachment 86 in a manner substantially similar to the manner in which the track 12 is coupled to the attachment 32. As a result of the coupling of the track 12 to the attachment 86, the contact 92*i* of the contact pad assembly 92 extends into the channel 24*b* of the insulated liner 24, contacting the buss bar 28*b*, and the contact 98*e* extends into the channel 22*b* of the insulated liner 22, contacting the buss bar 26*b*. The buss bar 28*b* is urged against the contact 92*i*, urging the contact pad 92*a* towards the surface 88*c* of the housing 88 and causing the middle portion 94*a* of the biasing element 94 to flex or bend towards the surface 88*c*. The projections 94*d* and 94*e* facilitate the flexing or bending of the middle portion 94*a* towards the surface 88*c*. As a result, the middle portion 94*a* of the biasing element 94 applies a reaction or biasing force against the contact pad 92*a*, which, in turn, causes the contact 92*i* to more firmly contact the buss bar 28*b*. In a substantially similar manner, the biasing element 100 applies a reaction or biasing force against the contact pad 98*a*, which, in turn, causes the contact 98*e* to more firmly contact the buss bar 26*b*.

In an exemplary embodiment, as illustrated in FIG. 13, the power feed assembly 84 operates to transfer electrical power to the track 12 so that the voltage V3 is generated across the buss bars 26*b* and 28*b*. In an exemplary embodiment, the power supply 31 may supply DC electrical power to the track 12, via the wires 92*j* and 98*f*, the lugs 92*h* and 98*d*, the contacts 92*i* and 98*e*, and the buss bars 28*b* and 26*b* of the power feed assembly 84, so that the voltage V3 is generated across the buss bars 26*b* and 28*b*. A ground path is provided in a manner substantially similar to the manner in which a ground path is provided during the operation of the power feed assembly 14. In an exemplary embodiment, as a result of the electrical power carried by the power feed assembly 14 to the track 12, the voltage V3 is 12 volts.

In an exemplary embodiment, the power feed assembly 84 further operates to support, at least in part, the track 12, thereby permitting, at least in part, the track 12 to be suspended from the ceiling 18.

In several exemplary embodiments, the power feed assembly 84 accommodates the flexing or bending of the track towards the housing 88 or the cover 90. If the track 12 is placed in a flexed or bent configuration so that the track 12 bends towards the housing 88, the middle portion 94*a* of the biasing element 94 undergoes further flexing and deflection, and thus continues to provide a biasing force against the contact pad 92*a*, thereby maintaining the contact between the contact 92*i* and the buss bar 28*b*. Moreover, as a result of the bending of the track 12 towards the housing 88, the degree of flexing that the biasing element 100 undergoes is decreased so that the biasing element 100 also moves towards the housing 88 and continues to provide a biasing force against the contact pad 98*a*, in order to continue to force the contact 98*e* against the buss bar 26*b*. If the track 12 is placed in a flexed or bent configuration so that the track 12 bends towards the cover 90, the biasing element 100 undergoes further flexing and deflection, and thus continues to provide a biasing force against the contact pad 98*a*, thereby maintaining the contact between the contact 98*e* and the buss bar 26*b*. Moreover, as a result of the bending of the track 12 towards the cover 90, the degree of flexing that the biasing element 94 undergoes is decreased so that the biasing element 94 also moves towards the cover 90 and continues to provide a biasing force against the contact pad 92*a*, in order to continue to force the contact 92*i* against the buss bar 28*b*.

In several exemplary embodiments, the biasing element 94 generally permits the contact pad 92*a* to float, at least towards or away from the track 12, in response to any irregularities or slight bends along the track 12, or appreciable, intended and/or unintended bends in the track 12, thereby generally maintaining the contact between the contact 92*i* and the buss bar 28*b*. That is, the contact pad 92*a* generally accommodates any deflections or bends of the track 12 such as, for example, bending and/or torsional deflections or bends, thereby generally maintaining the contact between the contact 92*i* and the buss bars 28*b*. The biasing element 100 generally permits the contact pad 98*a* to float, at least towards or away from the track 12, in response to any irregularities or slight bends along the track 12, or appreciable, intended and/or unintended bends in the track 12, thereby generally maintaining the contact between the contact 98*e* and the buss bar 26*b*. That is, the contact pad 98*a* generally accommodates any deflections or bends of the track 12 such as, for example, bending and/or torsional deflections or bends, thereby generally maintaining the contact between the contact 98*e* and the buss bar 26*b*.

In an exemplary embodiment, as illustrated in FIGS. 14, 15A, 15B and 15C, the track 12 is coupled to the power feed assembly 14 so that the contacts 58*m* and 58*n* of the power feed assembly 14 contact the buss bars 28*a* and 28*c*, respectively, as described above. Moreover, the track 12 is coupled to the power feed assembly 84 so that the contacts 92*i* and 98*e* of the power feed assembly 84 contact the buss bars 28*b* and 26*b*, respectively, as described above. Moreover, the track 12 is coupled to a power feed assembly 102 that is substantially identical to the power feed assembly 14 and contains all of the parts of the power feed assembly 14 which are given the same reference numerals, except that the power feed assembly 102 is rotated about its longitudinal center axis by 180 degrees, so that the contacts 58*m* and 58*n* of the power feed assembly 102 contact the buss bars 26*a* and 26*c*, respectively, in a manner substantially identical to the manner in which the contacts 58*m* and 58*n* of the power feed assembly 14 contact the buss bars 28*a* and 28*c*, respectively.

In an exemplary embodiment, as illustrated in FIGS. 14, 15A, 15B and 15C, the power feed assembly 14 operates to transfer electrical power to the track 12 so that the voltage V2 is generated across the buss bars 28*a* and 28*c*, as described above. Moreover, the power feed assembly 84 operates to transfer electrical power to the track 12 so that the voltage V3 is generated across the buss bars 28*b* and 26*b*, as described above. Moreover, the power feed assembly 102 operates to transfer electrical power to the track 12 so that the voltage V1 is generated across the buss bars 26*a* and 26*c*, in a manner substantially identical to the manner in which the power feed assembly 14 transfers electrical power to the track 12 and generates the voltage V2 across the buss bars 28*a* and 28*c*, as described above. As a result, the voltages V1, V2 and V3 are all simultaneously present on the track 12, and the track 12 may support up to three independent electrical circuits, which may be independently switched. As a result, one or more devices designed to operate at the voltage V1 may be electrically connected to the buss bars 28*a* and 28*c* and thus may be operable at any location along the track 12, one or more devices designed to operate at the voltage V2 may be electrically connected to the buss bars 28*b* and 26*b* and thus may be operable at any location along the track 12, and one or more devices designed to operate at the voltage V3 may be electrically connected to the buss bars 26*a* and 26*c* and thus may be operable at any location along the track 12.

In several exemplary embodiments, the power feed assemblies 14, 84 and/or 102 may be modified to generate voltages across one or more other pairs of the buss bars 26*a*, 26*b*, 26*c*, 28*a*, 28*b* and 28*c*, so that electrical power may be supplied to the track 12 in a wide variety of configurations. In an exemplary embodiment, the contact pad assembly 58 of the power feed assembly 14 may be modified so that the contacts 58*m* and 58*n* of the power feed assembly 14 contact the buss bars 28*b* and 28*c*, respectively, the contact pad assemblies 92 and 98 of the power feed assembly 84 may be modified so that the contacts 92*i* and 98*e* contact the buss bars 28*a* and 26*a*, respectively, and the contact pad assembly 58 of the power feed assembly 102 may be modified so that the contacts 58*m* and 58*n* of the power feed assembly 102 contact the buss bars 26*b* and 26*c*, respectively. In an exemplary embodiment, one or more of the power feed assemblies 14, 84 and/or 102 may be removed. In an exemplary embodiment, the power feed assemblies 14 and 102 may be rotated about their respective longitudinal center axes by 180 degrees so that the power feed assembly 14 generates the voltage V1 across the buss bars 26*a* and 26*c* and the power feed assembly 102 generates the voltage V2 across the buss bars 28*a* and 28*c*.

Figure 16:
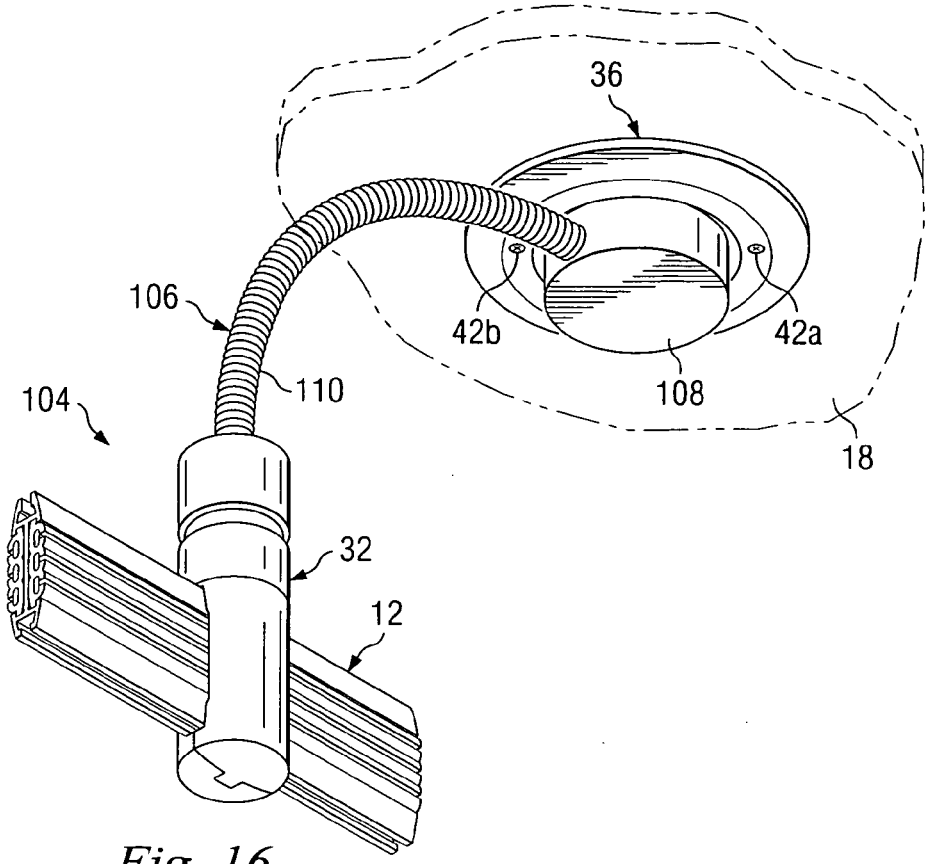
FIG. 16 is a perspective view of a power feed assembly according to another embodiment.

In an exemplary embodiment, as illustrated in FIG. 16, another embodiment of a power feed assembly is generally referred to by the reference numeral 104, and is similar to the power feed assembly 14 depicted in FIGS. 1 and 3 through 9B and contains several parts of the power feed assembly 14, which are given the same reference numerals. The power feed assembly 104 includes the attachment 32, which is coupled to a mounting assembly 106 which, in turn, is coupled to the ceiling 18. The mounting assembly 106 includes a canopy 108 and the canopy plate 36 coupled thereto, and a flexible sleeve 110 that extends from the canopy 108 and is coupled to the internal threaded connection 46*c* of the housing 46 of the attachment 32. The canopy plate 36 abuts the ceiling 18. In an exemplary embodiment, the canopy 108 may be removed from the power feed assembly 104, and the flexible sleeve 110 may extend through the opening 36*d*. In an exemplary embodiment, the internal threaded connection 46*c* may be removed from the housing 46, and may be replaced with a bore with a smooth inside wall, and the flexible sleeve 110 may extend into the bore and be coupled to the housing 46 by, for example, one or more set screws extending into the housing 46.

The coupling of the track 12 to the power feed assembly 104 is substantially identical to the above-described coupling of the track 12 to the power feed assembly 14 and therefore will not be described in detail. In an exemplary embodiment, during the coupling of the track 12 to the power feed assembly 104, the position of the flexible sleeve 110 is adjustable so that the power feed assembly 104 is able to accommodate a wide variety of positions of the track 12. The operation of the power feed assembly 104 is substantially identical to the above-described operation of the power feed assembly 14 and therefore will not be described in detail.

In an exemplary embodiment, the attachment 86 of the power feed assembly 84 depicted in FIGS. 11, 12 and 13 may be coupled to the mounting assembly 106 of the power feed assembly 104—instead of the attachment 32—so that the operation of the power feed assembly 104 is substantially identical to the above-described operation of the power feed assembly 76, instead of being substantially identical to the above-described operation of the power feed assembly 14.

Figure 17:
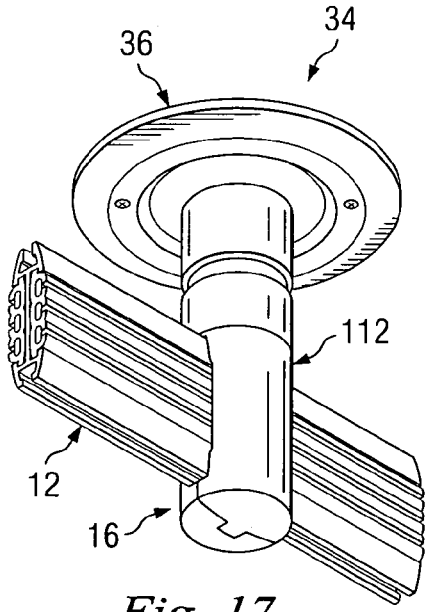
FIG. 17 is an enlarged perspective view of the support assembly of FIG. 1.
Figure 18:
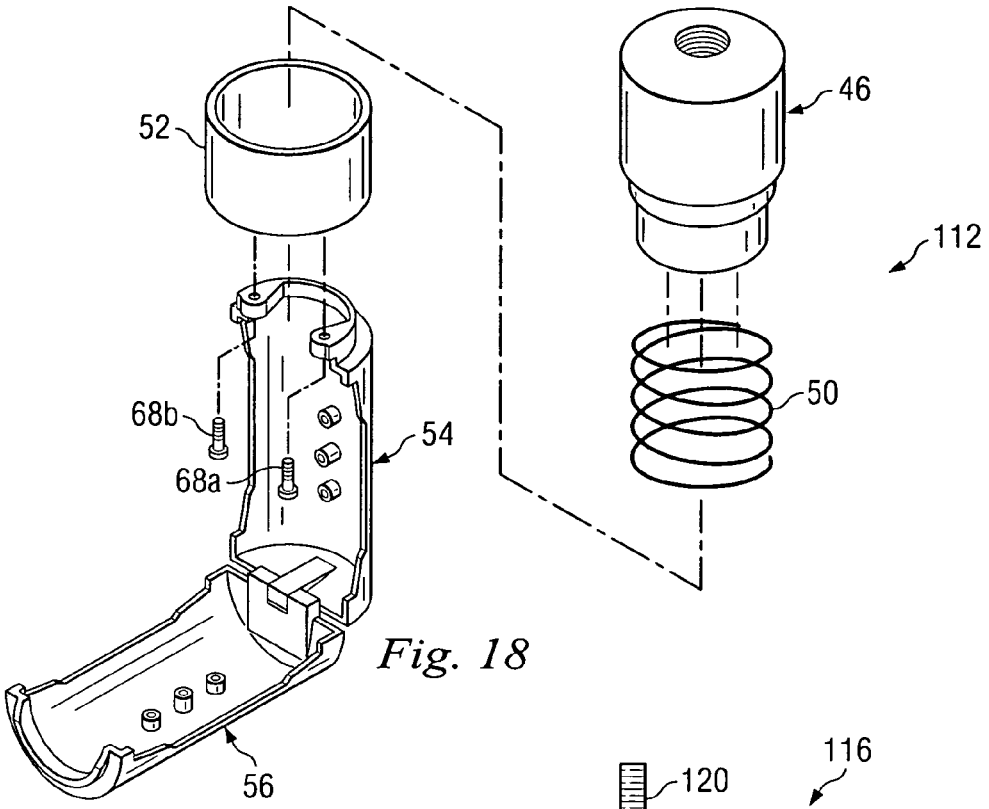
FIG. 18 is an exploded view of a portion of the support assembly of FIGS. 1 and 17.

In an exemplary embodiment, as illustrated in FIGS. 17 and 18, the support assembly 16 is similar to the power feed assembly 14 and contains several parts of the power feed assembly 14, which are given the same reference numerals. The support assembly 16 includes an attachment 112 that is coupled to the mounting assembly 34, which, in turn, is coupled to the ceiling 18 (not shown).

The attachment 112 is similar to the attachment 32 of the power feed assembly 14 and contains several parts of the attachment 32, which are given the same reference numerals. The attachment 112 includes the housing 46, the spring 50, the sleeve 52, the housing 54, the cover 56 and the fasteners 68*a* and 68*b*. In contrast to the attachment 32, the attachment 112 does not include the terminal block 48, the contact pad assembly 58, the ground clip 60, the fasteners 62*a* and 62*b* and the ground wire 64.

The mounting assembly 34 of the support assembly 16 is coupled to the ceiling 18 and the attachment 112 a manner substantially identical to the manner in which the mounting assembly 34 of the power feed assembly 14 is coupled to the ceiling 18 and the attachment 32, and therefore these couplings will not be described in detail.

The coupling of the track 12 to the support assembly 16 is substantially similar to the coupling of the track 12 to the power feed assembly 14, and therefore this coupling will not be described in detail, except that none of the buss bars 26*a*, 26*b*, 26*c*, 28*a*, 28*b* and 28*c* contacts any contact in response to the coupling of the track 12 to the support assembly 16.

In an exemplary embodiment, the support assembly 16 operates to support, at least in part, the track 12, thereby permitting, at least in part, the track 12 to be suspended from the ceiling 18.

In an exemplary embodiment, the ground clip 60, the fasteners 62*a* and 62*b* and the ground wire 64 may be added to the attachment 112 and arranged in a manner similar to the arrangement of these components in the power feed assembly 14, so that, while the support assembly 16 supports the track 12, a ground path is provided between the protrusion 20 of the track 12 and the mounting strap 38 of the mounting and/or the junction box to which the mounting strap 38 of the mounting assembly 34 is connected, via the ground clip 60, the ground lug 64*a* and the ground wire 64.

Figure 19B:
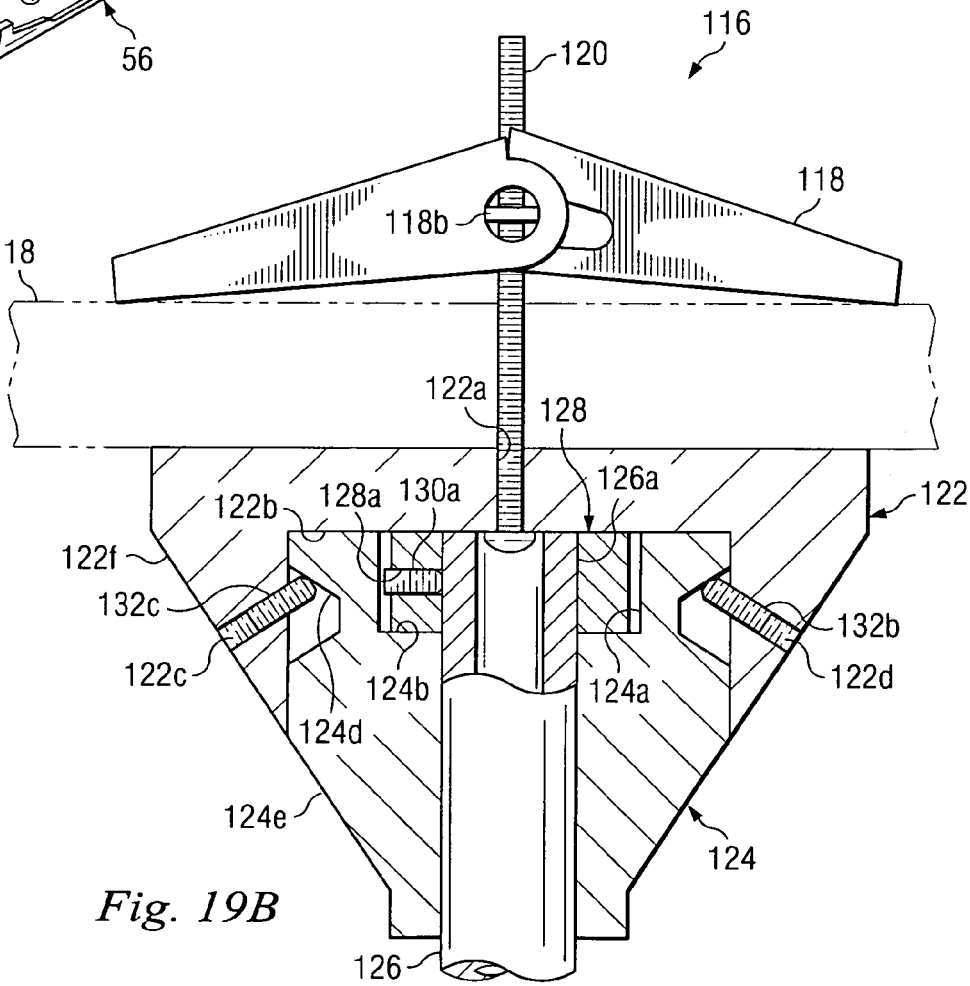
FIG. 19B is a sectional view of a portion of the support assembly of FIG. 19A.
Figure 19A:
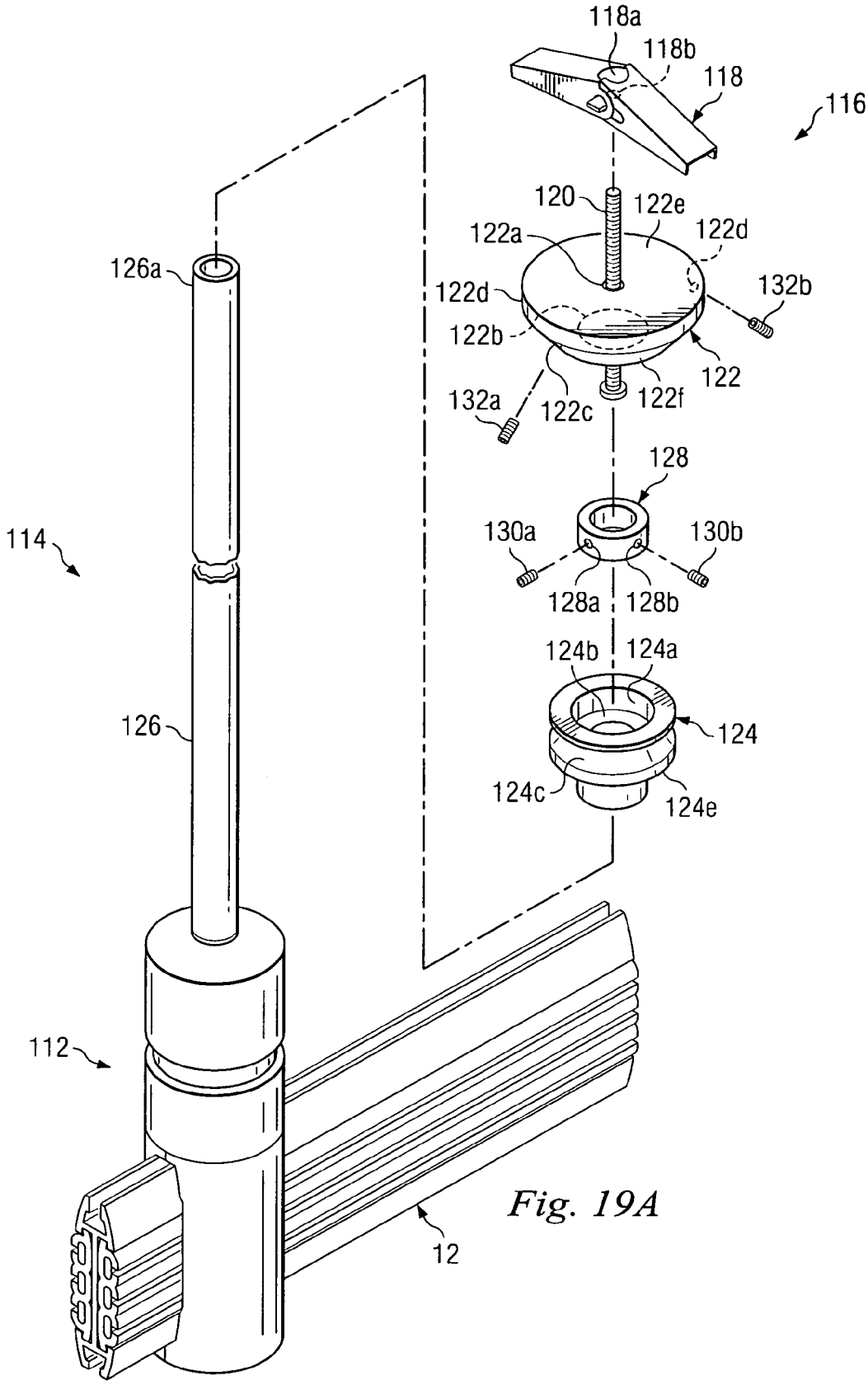
FIG. 19A is a partial perspective/partial exploded view of a support assembly according to another embodiment.
Figure 20:
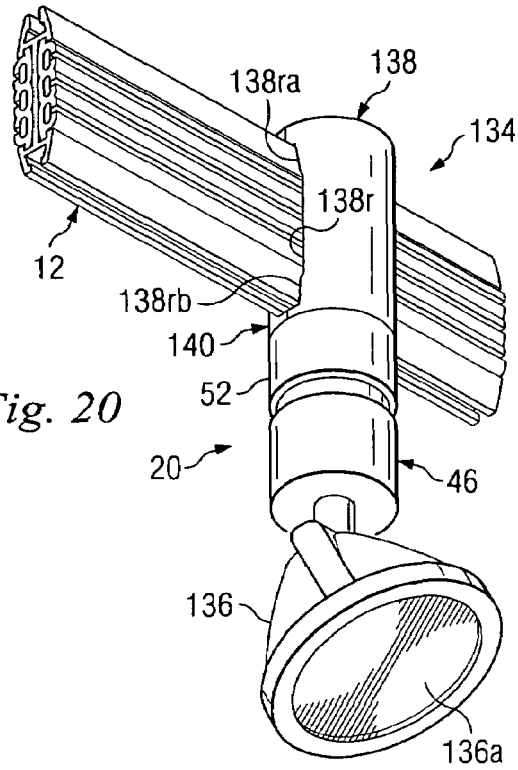
FIG. 20 is an enlarged perspective view of the lamp assembly of FIG. 1.

In an exemplary embodiment, as illustrated in FIGS. 19A and 19B, another embodiment of a support assembly is generally referred to by the reference numeral 114, and is similar to the support assembly 16 and contains several parts of the support assembly 16, which are given the same reference numerals. The support assembly 114 includes the attachment 112, which is coupled to a mounting assembly 116 which, in turn, is coupled to the ceiling 18.

The mounting assembly 116 includes a toggle bolt 118 having an opening 118*a* and an internal threaded connection 118*b*, and a toggle bolt screw 120. A ceiling coupler 122 includes a bore 122*a*, an opening 122*b* and bores 122*c* and 122*d* having respective internal threaded connections, and defines a horizontal surface 122*e* and a circumferentially-extending tapered surface 122*f*, through which the bores 122*c* and 122*d* extend. A dovetail stem 124 includes a counterbore 124*a* defining an internal shoulder 124*b*, and an external annular recess 124*c* defining a tapered surface 124*d*, and the dovetail stem 124 defines an tapered surface 124*e*. The mounting assembly 116 further includes a stem 126 having an end portion 126*a*, a collar 128 having radial bores 128*a* and 128*b*, set screws 130*a* and 130*b*, and set screws 132*a* and 132*b*.

When the mounting assembly 116 is in an assembled condition and coupled to the ceiling 18 and the attachment 112, the toggle bolt 118 is installed in the ceiling 18 in a conventional manner so that the toggle bolt 118 is supported by the ceiling 18. The toggle bolt screw 120 extends through the bore 122*a* of the ceiling coupler 122, and through the opening 118*a* of the toggle bolt 118, and is threadably engaged with the internal threaded connection 118*b* of the toggle bolt 118, thereby causing the ceiling coupler 122 to abut or nearly abut the ceiling 18.

The end portion of the stem 126 opposing the end portion 126*a* is threadably engaged with the internal threaded connection 46*c* of the housing 46 of the attachment 112, and the stem 126 extends upward through the counterbore 124*a* of the dovetail stem 124, and through the collar 128, which is supported by the internal shoulder 124*b* of the dovetail stem 124 and is positioned in the vicinity of the end portion 126*a* of the stem 126. The set screws 130*a* and 130*b* extend through the radial bores 128*a* and 128*b*, respectively, of the collar 128 and contact the outside surface of the stem 126, thereby coupling the collar 128 to the stem 126.

The end portion 126*a* of the stem 126, the collar 128 and the dovetail stem 124 are received within the opening 122*b* of the ceiling coupler 122. The set screws 132*a* and 132*b* extend through the bores 122*c* and 122*d*, respectively, of the ceiling coupler 122 and contact the tapered surface 124*d* of the dovetail stem 124, thereby coupling the dovetail stem 124 to the ceiling coupler 122. As a result, the tapered surface 122*f* of the ceiling coupler 122 and the tapered surface 124*e* of the dovetail stem 124 appear to form a continuous tapered surface.

When the mounting assembly 116 is an assembled condition and coupled to the ceiling 18 and the attachment 112, the capped end portion 46*b* of the housing 46 of the attachment 112 is offset from the ceiling 18, and therefore the track 12 is suspended below the ceiling 18 by a predetermined distance. In several exemplary embodiments, the distance of suspension of the track 12 may be adjusted by, for example, adjusting the length of the stem 126 by, for example, cutting off a longitudinally-extending portion of the stem 126, including the end portion 126*a*, to create a new end portion and decrease the suspension distance of the track 12; or by coupling another device such as, for example, another stem to the stem 126 to increase the suspension distance of the track 12; or by replacing the stem 126 with a shorter or longer stem to decrease or increase, respectively, the suspension distance of the track 12.

The coupling of the track 12 to the support assembly 114 is substantially identical to the coupling of the track 12 to the support assembly 16 and therefore will not be described in detail. The operation of the support assembly 114 is substantially identical to the above-described operation of the support assembly 16 and therefore will not be described in detail.

In several exemplary embodiments, the quantity of the support assemblies 16 and/or 114 may be increased. In several exemplary embodiments, in addition to, or instead of the support assembly 16 and/or the support assembly 114, other types of support assemblies may be used to support the track 12 and/or one or more other tracks coupled thereto including, for example, the support devices described above in connection with FIG. 2. In an exemplary embodiment, a support assembly that includes a dove tail attachment may be used to support the track 12, with the dove tail attachment being coupled to one of the above-described mounting assemblies 34, 76, 106 or 116, or another type of mounting assembly, and with one or more portions of the dove tail attachment being coupled to one or more portions of the track 12 such as, for example, the protrusions 20*b* and/or 20*c* of the track 12 via, for example, one or more set screws, and/or with at least a portion of the dove tail attachment being received by, slidably engaged with and/or extending into the channel 20*d* of the track 12. In an exemplary embodiment, a tongue-in-groove attachment may be used to support the track 12, with a portion of the tongue-in-groove attachment being received by, slidably engaged with and/or extending into the channel 20*d* of the track 12. In an exemplary embodiment, instead of using one of the above-described mounting assemblies, a support assembly may incorporate a mounting assembly that is adapted to be coupled to a grid ceiling, and such a mounting assembly may include, for example, a T-bar adapter and/or T-bar clip for clipping to one or more portions of the grid ceiling.

In an exemplary embodiment, as illustrated in FIGS. 20 and 21A, 21B, 21C, 21D and 21E, the lamp assembly 20 includes an attachment 134 that is coupled to the track 12 and a lampholder 136 having a lens 136*a* and in which a lamp is disposed (not shown).

The attachment 134 is similar to the attachment 32 and contains several parts of the attachment 32, which are given the same reference numerals and include the housing 46, the spring 50, the sleeve 52, the pin 55, the contact pad assembly 58, the ground clip 60, the fasteners 62*a* and 62*b*, the ground wire 64 and the fasteners 68*a* and 68*b*. Unlike the attachment 32, the attachment 134 does not include the terminal block 48. Unlike the attachment 32, which extends in a generally upward direction from the track 12, the attachment 134 extends in a generally downward direction from the track 12.

The attachment 134 includes a housing 138 and a cover 140 hingedly connected thereto via the pin 55. The housing 138 includes a notch 138*r* formed therein at an axially-extending edge of the housing 138, with the notch 138*r* defining a profile that substantially corresponds to the profile of approximately one half of the perimeter outline of the cross-section of the track 12, which may be defined in part by either the outside surfaces of the protrusions 20*c* and 20*f*, or the outside surfaces of the protrusions 20*b* and 20*e*. The profile of a portion 138*ra* of the notch 138*r* substantially corresponds to the perimeter outiine of the outside surface of the protrusion 20*b* or 20*c*, and the profile of a portion 138*rb* of the notch 138*r* substantially corresponds to the perimeter outline of the outside surface of the protrusion 20*f* or 20*e*. Although not shown, the housing 138 includes another notch, having a profile that is substantially identical to the profile of the notch 138*r*, that is to formed in the axially-extending edge of the housing 138 circumferentially spaced from, by about 180 degrees, the axially-extending edge in which the notch 138*r* is formed. The remainder of the housing 138 of the attachment 134 is substantially similar to the housing 54 of the attachment 32 and, in the description below, reference numerals used to refer to features of the housing 138 will correspond to the reference numerals for the features of the housing 54, except that the numeric prefix for the reference numerals used to describe the housing 54, that is, 54, will be replaced by the numeric prefix of the housing 138, that is, 138.

The cover 140 includes a notch 140*o* formed therein at an axially-extending edge of the cover 140, with the notch 140*o* defining a profile that substantially corresponds to the profile of approximately one half of the perimeter outline of the cross-section of the track 12, which may be defined in part by either the outside surfaces of the protrusions 20*c* and 20*f*, or the outside surfaces of the protrusions 20*b* and 20*e*. The profile of a portion 140*oa* of the notch 140*o* substantially corresponds to the perimeter outline of the outside surface of the protrusion 20*b* or 20*c*, and the profile of a portion 140*ob* of the notch 140*o* substantially corresponds to the perimeter outline of the outside surface of the protrusion 20*f* or 20*e*. Although not shown, the cover 140 includes another notch, having a profile that is substantially identical to the profile of the notch 140*o*, that is to formed in the axially-extending edge of the cover 140 circumferentially spaced from, by about 180 degrees, the axially-extending edge in which the notch 140*o* is formed. The remainder of the cover 140 is substantially similar to the cover 56 of the attachment 32 and, in the description below, reference numerals used to refer to features of the cover 140 will correspond to the reference numerals for the features of the cover 56, except that the numeric prefix for the reference numerals used to the describe the cover 56, that is, 56, will be replaced by the numeric prefix of the cover 140, that is, 140.

The assembled condition of the attachment 134 is substantially similar to the assembled condition of the attachment 32, except that the wires 58*o* and 58*p* (not shown) of the contact pad assembly 58 of the attachment 134 extend downward, through the passage 46*a* of the housing 46, and into the lampholder 136, and are electrically connected to the lamp in the lampholder 136 in a conventional manner.

In an exemplary embodiment, before the attachment 134 is coupled to the track 12, the cover 140 may be in a closed configuration in which the coplanar surfaces 140*c* and 140*d* of the cover 140 contact or nearly contact the coplanar surfaces 138*c* and 138*d*, respectively, of the housing 138, thereby enclosing the contact pad assembly 58. Moreover, due to the compression of the spring 50 between the shoulder 46*e* of the housing and the internal shoulder 52*a* of the sleeve 52, the spring 50 urges the sleeve 52 against the shoulder 138*f* of the housing 138 and the shoulder 140*f* of the cover 140. As a result, the external annular recess 140*e* of the cover 140 contacts or nearly contacts the sleeve 52 and is thereby locked, that is, prevented from pivoting about the pin 55 and away from the coplanar surfaces 138*c* and 138*d* of the housing 138.

Figure 21A:
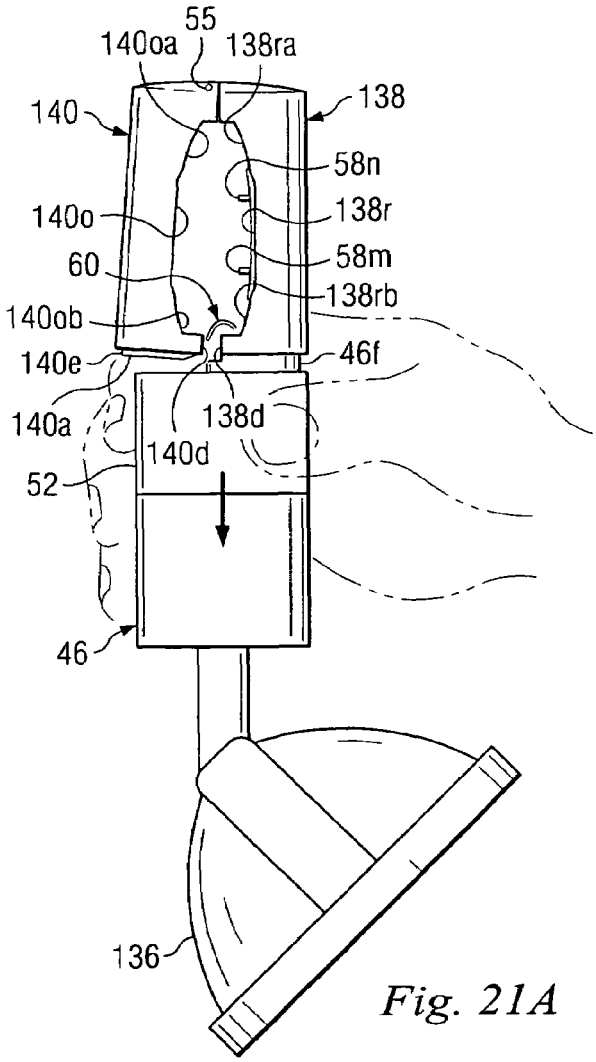
FIGS. 21A, 21B, 21C, 21D and 21E are elevational views depicting the coupling of the lamp assembly of FIGS. 1 and 20 to the track of FIG. 1.

In an exemplary embodiment, the attachment 134 of the lamp assembly 20 is coupled to the track 12 as illustrated in FIGS. 21A, 21B, 21C, 21D and 21E. As illustrated in FIG. 21A, the cover 140 is placed in an open or unlocked configuration by an operator first moving the sleeve 52 in a downward direction, as indicated by the direction of the arrow in FIG. 21A. In an exemplary embodiment, the operator may move the sleeve 52 in a downward direction using only one hand. As a result of the movement of the sleeve 52 in the downward direction, the spring 50 is further compressed due to the axial movement of the internal shoulder 52*a* of the sleeve 52 towards the shoulder 46*e* of the housing 46, and the position of the internal shoulder 52*a* of the sleeve 52 is positioned below the cover 140, including the external annular recess 140*e*. As a result, the cover 140 is free to pivot about the pin 55 and away from the coplanar surfaces 138*c* and 138*d* of the housing 138. In an exemplary embodiment, the operator may rotate the cover 140 about the pin 55 so that the cover 140 pivots about the pin 55 and away from the coplanar surfaces 138*c* and 138*d* of the housing 138. In an exemplary embodiment, the operator may rotate the cover 140 about the pin 55 while maintaining the lowered position of the sleeve 52. In an exemplary embodiment, the operator may maintain the lowered position of the sleeve 52, thereby resisting the decompression of the spring 50, and rotate the cover 140 about the pin 55, using the same one hand.

In an exemplary embodiment, the rotation of the cover 140 about the pin 55, so that the cover 140 pivots about the pin 55 and away from the housing 138, is continued until the position of at least a portion of the external annular recess 140*e* of the cover 140 is to the left of the sleeve 52, as viewed in FIG. 21A. At this point, the operator may release the sleeve 52, permitting the spring 50 to at least partially decompress and urge the sleeve 52 in an upward direction. In an exemplary embodiment, the sleeve 52 may contact the rib 140*a* of the cover 140 in response to the urging of the sleeve 52 upward by the spring 50. In response to any such contact, the rib 140*a* may ride against the sleeve 52 during the rotation of the cover 140 about the pin 55.

Figure 21C:
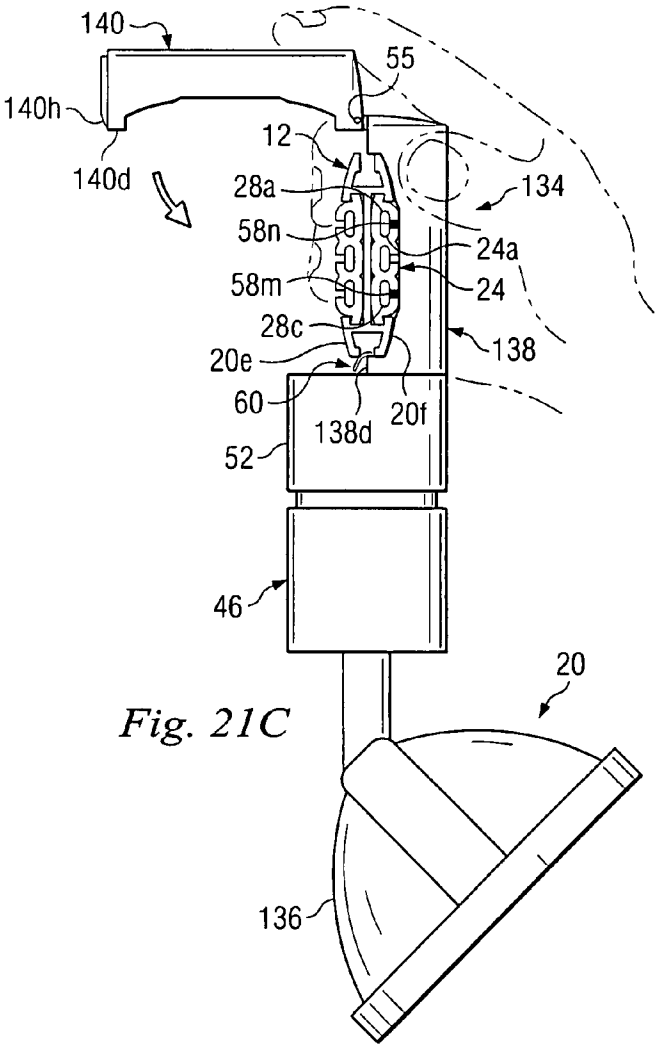
Figure 21B:
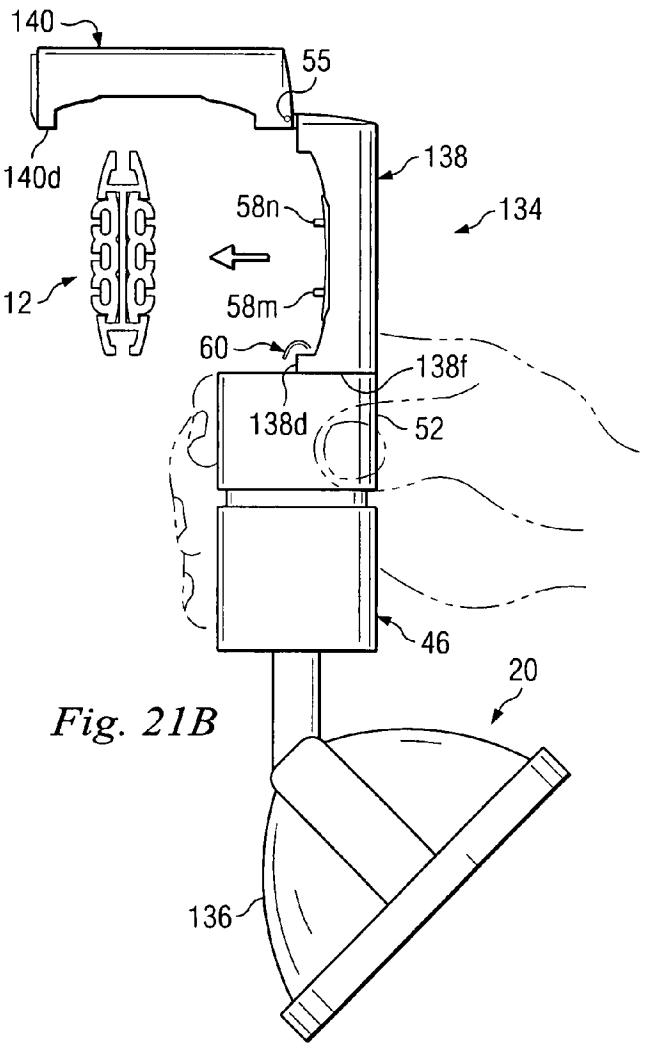

In an exemplary embodiment, as illustrated in FIG. 21B, the sleeve 52 abuts the shoulder 138*f* of the housing 138 in response to the operator's release of the sleeve 52 and the urging of the sleeve 52 upward by the spring 50, and the further rotation of the cover 140 about the pin 55 and away from the coplanar surfaces 138*c* and 138*d* of the housing 138. The cover 140 is further rotated about the pin 55, so that the cover 140 pivots about the pin 55 and away from the coplanar surfaces 138*c* and 138*d* of the housing 138, until the cover 140 is in a fully-open configuration. In an exemplary embodiment, an operator may continue to rotate the cover 140 using the same one hand that the operator uses to place the cover 140 in its open configuration and/or initiate the rotation of the cover 140, as described above.

In an exemplary embodiment, once the cover 140 is a fully-open configuration, the cover 140 has rotated at least about 90 or more degrees in a circumferential direction away from the coplanar surfaces 138*c* and 138*d* of the housing 138.

In an exemplary embodiment, as illustrated in FIGS. 21B and 21C, the attachment 134 is moved towards the track 12 so that the contacts 58*n* and 58*m* travel in a direction that is perpendicular to the direction of the nominal longitudinal extension of the buss bars 28*a*, 28*b* and 28*c*, and that is parallel to the direction of extension of the contacts 58*n* and 58*m* from the curved surface 58*b* of the contact pad 58*a* of the contact pad assembly 58, as indicated by the direction of the arrow in FIG. 21B. The position of the attachment 134 is adjusted until the buss bars 28*a* and 28*c* are vertically aligned with the contacts 58*n* and 58*m*, respectively, as viewed in FIG. 21B. This vertical position of the attachment 134 is maintained and the attachment is moved in the above-described direction until the contact 58*n* extends into the channel 24*a* and contacts or nearly contacts the buss bar 28*a*, and until the contact 58*m* extends into the channel 28*c* and contacts or nearly contacts the buss bar 28*c*, as viewed in FIG. 21C. In an exemplary embodiment, during the positioning of the attachment 134 in the above-described manner, the attachment 134 may be hooked over the track 12, and further may be hooked over the track 12 and hung from or supported by the track 12 prior the completion of the coupling of the attachment 134 to the track 12. In an exemplary embodiment, an operator may position the attachment 134 in the above-described manner using only one hand, which may be the same one hand that the operator uses to place the cover 140 in its open configuration, initiate the rotation of the cover 140, and/or further rotate the cover 140 away from the housing 138, as described above.

As a result of the contacts 58*n* and 58*m* contacting or nearly contacting the buss bars 28*a* and 28*c*, respectively, the curved portion 60*a* of the ground clip 60 contacts the protrusion 20*e* of the protrusion 20 of the track 12. In an exemplary embodiment, the curved portion 60*a* may contact the protrusion 20*f* of the protrusion 20 of the track 12. Due to the curved shape of the curved portion 60*a*, the curved portion 60*a* is compressed and applies a reaction or biasing force against the protrusion 20*e* and/or 20*f*.

As a further result of the contacts 58*n* and 58*m* contacting or nearly contacting the buss bars 28*a* and 28*c*, respectively, the protrusion 20*c* of the track 12 is positioned near or contacts the portion 138*ra* of the notch 138*r*, the protrusion 20*f* of the track 12 is positioned near or contacts the portion 138*rb* of the notch 138*r*, and the insulated liner 24 of the track 12 is positioned near or contacts the vertically-extending portion of the notch 138*r*.

After the above-described positioning of the attachment 134 relative to the housing 138, the cover 140 is rotated about the pin 55 so that the cover 140 pivots about the pin 55 and circumferentially towards the coplanar surfaces 138*c* and 138*d* of the housing 138. During this rotation, the curved ramp surfaces 140*g* and 140*h* contact the end of the sleeve 52 abutting the shoulder 138*f* of the housing 138. Continued rotation of the cover 140 after the contact between the sleeve 52 and the ramp surfaces 140*g* and 140*h* forces at least the portion of the sleeve 52 in contact with the ramp surfaces 140*g* and 140*h* downward, as indicated by the direction of the arrow in FIG. 21D, overcoming the local force exerted by the spring 50 on the sleeve 52 in the upward direction. The curved shapes of the ramp surfaces 140*g* and 140*h* facilitate the forcing of the at least a portion of the sleeve 52 in the downward direction. In an exemplary embodiment, an operator may rotate the cover 140, so that the cover 140 pivots about the pin 55 and circumferentially towards the coplanar surfaces 138*c* and 138*d* of the housing 138, using only hand, which may be the same one hand that the operator uses to place the cover 140 in its open configuration, initiate the rotation of the cover 140, further rotate the cover 140 away from the housing 138 and/or position the attachment 134 relative to the track 12, as described above.

Continued rotation of the cover 140 continues to force the at least a portion of the sleeve 52 in contact with the ramp surfaces 140*g* and 140*h* downward, as the coplanar surfaces 140*c* and 140*d* of the cover 140 continue to approach the coplanar surfaces 138*c* and 138*d*, respectively, of the housing 138. As a result, the sleeve 52 slides along the ramp surfaces 140*g* and 140*h* and on top of the rib 140*a*, during the rotation of the cover 140, until the coplanar surfaces 140*c* and 140*d* contact or nearly contact the coplanar surfaces 138*c* and 138*d*, respectively, and the external annular recess 140*e* of the cover 140 is offset radially inwardly from the shoulder 52*a* of the sleeve 52. In an exemplary embodiment, an operator may continue to rotate the cover 140, so that the cover 140 pivots about the pin 55 and circumferentially towards the coplanar surfaces 138*c* and 138*d* of the housing 138, using only hand, which may be the same one hand that the operator uses to place the cover 140 in its open configuration, initiate the rotation of the cover 140, further rotate the cover 140 away from the housing 138 and/or position the attachment 134 relative to the track 12, as described above.

Figure 21E:
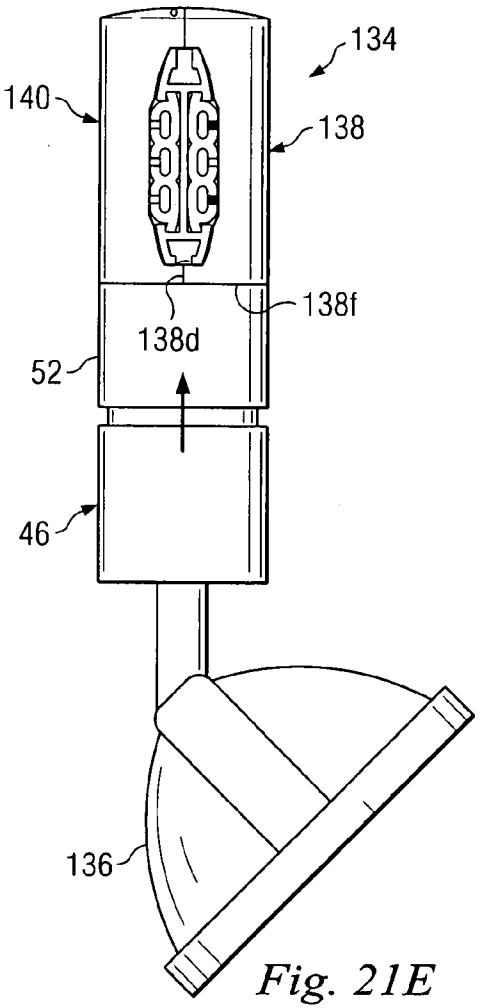
Figure 21D:
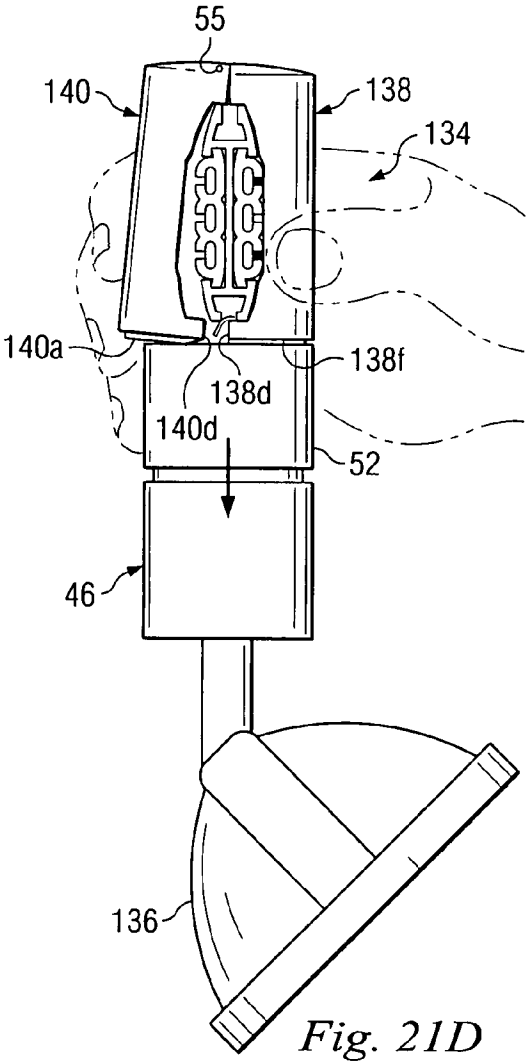

When the external annular recess 140*e* of the cover 140 is offset radially inwardly from the shoulder 52*a* of the sleeve 52, the spring 50 automatically at least partially decompresses, pushing the shoulder 52*a* of the sleeve 52, and therefore the sleeve 52, in an upward direction, as indicated by the direction of the arrow in FIG. 21E, until the sleeve 52 abuts substantially all of the shoulder 138*f* of the housing 138. As a result, the cover 140 is placed in its closed configuration and is thereby locked, that is, prevented from pivoting about the pin 55 and away from the coplanar surfaces 138*c* and 138*d* of the housing 138. In an exemplary embodiment, an operator may place the cover 140 in its closed configuration without the use of one or more tools, that is, without the use of, for example, a screwdriver, an allen wrench, another type of wrench, etc., thereby toollessly coupling the attachment 134 to the track 12.

In an exemplary embodiment, as a result of the above-described closing of the cover 140, the protrusion 20*b* of the track 12 may contact the portion 140*oa* of the notch 140*o*, the protrusion 20*e* of the track 12 may contact the portion 140*ob* of the notch 140*o*, and/or the insulated liner 22 of the track 12 may contact the vertically-extending portion of the notch 140*o*. As a result, in an exemplary embodiment, the curved portion 60*a* of the ground clip 60 may be further compressed against the protrusion 20*e*. As another result, the buss bars 28*a* and 28*c* are urged further towards the contacts 58*n* and 58*m*, respectively, contacting and pushing against the contacts.

As a result of the further urging of the buss bars 28*a* and 28*c* against the contacts 58*n* and 58*m*, respectively, the contact pad 58*a* is urged towards the surface 138*n* of the housing 138, relative to the fastener 72, thereby further compressing the spring 70 between the contact pad 58*a* and the surface 138*n*, and causing the boss 138*m* of the housing 138 to at least partially extend, or further at least partially extend, within the tubular protrusion 58*h*, and causing the pins 58*i* and 58*j* to further extend within the respective blind bores of the bosses 138*o* and 138*p*. As a result of the further compression of the spring 70, the spring 70 applies a reaction or biasing force to the contact pad 58*a* which, in turn, causes the contacts 58*n* and 58*m* to more firmly contact the buss bars 28*a* and 28*c*, respectively. The curved shape of the curved surface 58*b* of the contact pad 58*a* facilitates this firm contact between the contacts 58*n* and 58*m* and the buss bars 28*a* and 28*c*, respectively, and the conformance of the contact pad 58*a* to the insulated liner 24. In view of the foregoing, in an exemplary embodiment, an operator may couple the lamp assembly 20 to the track 12 using only one hand.

In an exemplary embodiment, after the lamp assembly 20 has been coupled to the track 12 as illustrated in FIGS. 21A, 21B, 21C, 21D and 21E, the track 12 operates to transfer electrical power to the lamp assembly 20, via the buss bars 28*a* and 28*c*, the contacts 58*n* and 58*m*, the lugs 58*l* and 58*k* and the wires 58*p* and 58*o*, so that the lamp assembly 20 operates at the voltage V2. In an exemplary embodiment, the voltage V2 may be 120 volts. In an exemplary embodiment, the voltage V2 is generated across the buss bars 28*a* and 28*c* via, for example, the system 30*b*, one or more of the power assemblies 14, 74, 102 and 104, and/or any combination thereof. In an exemplary embodiment, the at least partially compressed spring 70 provides a biasing force against the contact pad 58*a*, thereby forcing the contacts 58*n* and 58*m* against the buss bars 28*a* and 28*c*, respectively, to effect sufficient contact between the lamp assembly 20 and the track 12. In an exemplary embodiment, a ground path is provided between the lamp in the lampholder 136 and the protrusion 20 of the track 12 via the ground wire 64, the ground lug 64*a* and the ground clip 60.

In an exemplary embodiment, the lamp assembly 20, and in particular the attachment 134, is able to generally accommodate a flexed or bent configuration of the track 12, in a manner substantially similar to the manner in which the power feed assembly 14, and in particular the attachment 32, is able to generally accommodate a flexed or bent configuration of the track 12, as described above.

In several exemplary embodiments, the lamp in the lampholder 136 may be in the form of one or more different lamp types such as, for example, an incandescent lamp, a metal halide lamp, a ceramic metal halide lamp, a fluorescent lamp and/or any combination thereof. In several exemplary embodiments, the lamp in the lampholder 136 may be, for example, a 24 watt, 39 watt, 50 watt, 70 watt, 75 watt, 150 watt or 250 watt lamp. In several exemplary embodiments, the shape, design, one or more features of and/or one or more aspects of the lampholder 136 may be modified, and/or the lampholder 136 may be in a wide variety of forms, and/or may include a wide variety of types of housings such as, for example, machined, extruded and/or die-cast aluminum housings having a wide variety of shapes such as, for example, cylindrical housings. In several exemplary embodiments, the lampholder 136 may include a wide variety of electronic and/or other types of components disposed therein such as, for example, an integral electronic transformer, an integral ballast, a reflector and/or an electronic ballast. In several exemplary embodiments, the housing 46 of the attachment 134 may be modified and/or combined with the lampholder 136.

Figure 22:
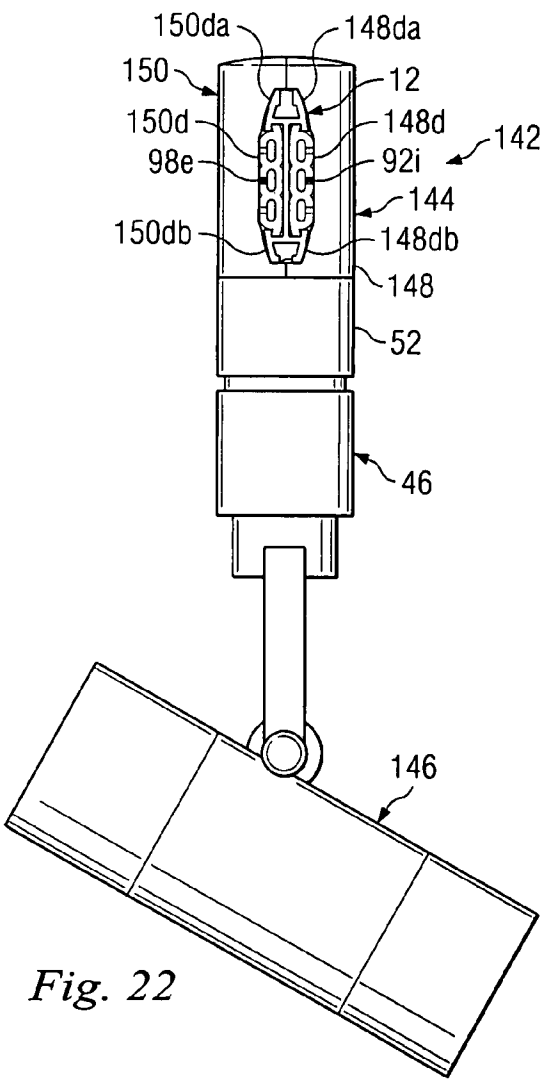
FIG. 22 is an elevational view of a lamp assembly according to another embodiment and coupled to the track of FIG. 1.

In an exemplary embodiment, as illustrated in FIG. 22, another embodiment of a lamp assembly is generally referred to by the reference numeral 142, and is similar to the lamp assembly 20 and contains several parts of the lamp assembly 20, which are given the same reference numerals. The lamp assembly 142 includes an attachment 144, which is coupled to the track 12 and to a lampholder 146 in which a lamp is disposed (not shown).

The attachment 144 is similar to the attachment 86 and contains several parts of the attachment 86, which are given the same reference numerals and include the housing 46, the spring 50, the sleeve 52, the pin 55, the contact pad assemblies 92 and 98, the ground clip 60, the fasteners 62*a* and 62*b*, the ground wire 64 and the fasteners 68*a* and 68*b*. Unlike the attachment 86, the attachment 144 does not include the terminal block 48. Unlike the attachment 86, which extends in a generally upward direction from the track 12, the attachment 144 extends in a generally downward direction from the track 12.

The attachment 144 includes a housing 148 and a cover 150 hingedly connected thereto via the pin 55. The housing 148 includes a notch 148*d* formed therein at an axially-extending edge of the housing 148, with the notch 148*d* defining a profile that substantially corresponds to the profile of approximately one half of the perimeter outline of the cross-section of the track 12, which may be defined in part by either the outside surfaces of the protrusions 20*c* and 20*f*, or the outside surfaces of the protrusions 20*b* and 20*e*. The profile of a portion 148*da* of the notch 148*d* substantially corresponds to the perimeter outline of the outside surface of the protrusion 20*b* or 20*c*, and the profile of a portion 148*db* of the notch 148*d* substantially corresponds to the perimeter outline of the outside surface of the protrusion 20*f* or 20*e*. Although not shown, the housing 148 includes another notch, having a profile that is substantially identical to the profile of the notch 148*d*, that is formed in the axially-extending edge of the housing 148 circumferentially spaced from, by about 180 degrees, the axially-extending edge in which the notch 148*d* is formed. The remainder of the housing 148 of the attachment 134 is substantially similar to the housing 88 of the attachment 86 and, in the description below, reference numerals used to refer to features of the housing 148 will correspond to the reference numerals for the features of the housing 88, except that the numeric prefix for the reference numerals used to describe the housing 88, that is, 88, will be replaced by the numeric prefix of the housing 148, that is, 148.

The cover 150 includes a notch 150*d* formed therein at an axially-extending edge of the cover 150, with the notch 150*d* defining a profile that substantially corresponds to the profile of approximately one half of the perimeter outline of the cross-section of the track 12, which may be defined in part by either the outside surfaces of the protrusions 20*c* and 20*f*, or the outside surfaces of the protrusions 20*b* and 20*e*. The profile of a portion 150*da* of the notch 150*d* substantially corresponds to the perimeter outline of the outside surface of the protrusion 20*b* or 20*c*, and the profile of a portion 150*db* of the notch 150*d* substantially corresponds to the perimeter outline of the outside surface of the protrusion 20*f* or 20*e*. Although not shown, the cover 150 includes another notch, having a profile that is substantially identical to the profile of the notch 150*d*, that is to formed in the axially-extending edge of the cover 150 circumferentially spaced from, by about 180 degrees, the axially-extending edge in which the notch 150*d* is formed. The remainder of the cover 150 is substantially similar to the cover 90 of the attachment 86 and, in the description below, reference numerals used to refer to features of the cover 150 will correspond to the reference numerals for the features of the cover 90, except that the numeric prefix for the reference numerals used to the describe the cover 90, that is, 90, will be replaced by the numeric prefix of the cover 150, that is, 150.

The assembled condition of the attachment 144 is substantially similar to the assembled condition of the attachment 86, except that the wires 92*j* and 98*f* (not shown) of the contact pad assemblies 92 and 98, respectively, of the attachment 144 extend downward, through the passage 46*a* of the housing 46, and into the lampholder 146, and are electrically connected to the lamp in the lampholder 146 in a conventional manner.

The lamp assembly 142, and in particular the attachment 144, is coupled to the track 12 in a manner substantially similar to the manner in which the lamp assembly 20, and in particular the attachment 134, is coupled to the track 12 and therefore this coupling will not be described in detail.

As a result of the coupling of the attachment 144 to the track 12, the contact 92*i* of the contact pad assembly 92 of the housing 148 of the attachment 144 extends into the channel 24*b* of the insulated liner 24 and contacts the buss bar 28*b*. Moreover, the contact 98*e* of the contact pad assembly 98 of the cover 150 of the attachment 144 extends into the channel 22*b* of the insulated liner 22 and contacts the buss bar 26*b*.

In an exemplary embodiment, after the lamp assembly 142 has been coupled to the track 12, the track 12 operates to transfer electrical power to the lamp assembly 142, via the buss bars 26*b* and 28*b*, the contacts 92*i* and 98*e*, the lugs 92*h* and 98*d* and the wires 92*j* and 98*f*, so that the lamp assembly 142 operates at the voltage V3. In an exemplary embodiment, the voltage V3 may be 12 volts. In an exemplary embodiment, the voltage V3 may be generated across the buss bars 26*b* and 28*b* via, for example, the power supply 31, the power feed assembly 84, one or more remote transformers, one or more additional power supplies and/or any combination thereof. In an exemplary embodiment, the biasing element 94 provides a biasing force against the contact pad 92*a*, thereby forcing the contact 92*i* against the buss bar 28*b*. Similarly, the biasing element 100 provides a biasing force against the contact pad 98*a*, thereby forcing the contact 98*e* against the buss bar 26*b*.

In an exemplary embodiment, the lamp assembly 142, and in particular the attachment 144, is able to generally accommodate a flexed or bent configuration of the track 12, in a manner substantially similar to the manner in which the power feed assembly 14, and in particular the attachment 32, is able to generally accommodate a flexed or bent configuration of the track 12, as described above.

In several exemplary embodiments, the lamp in the lampholder 146 may be in the form of one or more different lamp types such as, for example, a low voltage lamp such as, for example, a low voltage halogen lamp. In several exemplary embodiments, the lamp in the lampholder 146 may be, for example, a 50 watt lamp. In several exemplary embodiments, the shape, design, one or more features and/or one or more aspects of the lampholder 146 may be modified, and/or the lampholder 146 may be in a wide variety of forms, and/or may include a wide variety of types of housings such as, for example, machined, extruded and/or die-cast aluminum housings having a wide variety of shapes such as, for example, cylindrical housings. In several exemplary embodiments, the lampholder 146 may include a wide variety of electronic and/or other types of components disposed therein such as, for example, a transformer and/or reflector. In several exemplary embodiments, the housing 46 of the attachment 144 may be modified and/or combined with the lampholder 146.

In several exemplary embodiments, the lampholder 136 and/or 146 may include and/or incorporate one or more light-beam aiming devices such as, for example, a rotation lock with a graduated scale for consistent aiming of the light beam, and/or a tilt lock with a graduated scale for consistent aiming.

Figure 23:
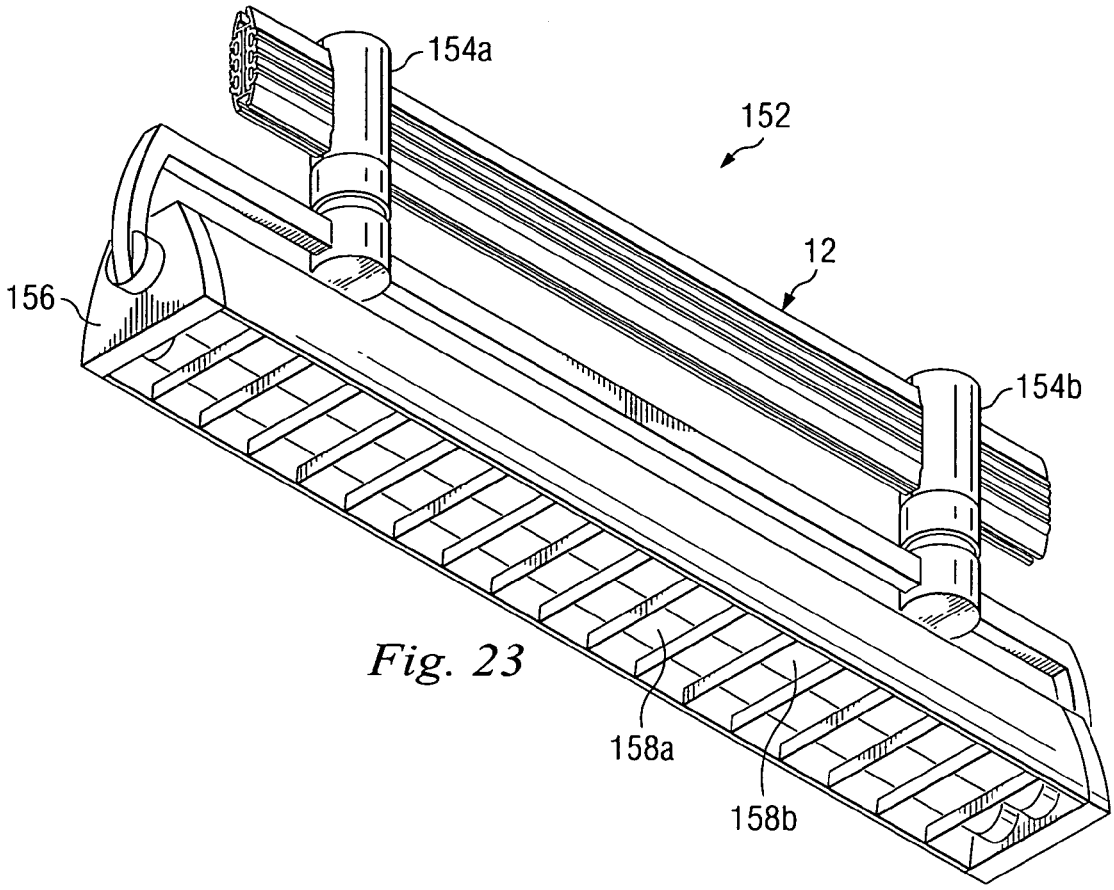
FIG. 23 is a perspective view of a lamp assembly according to another embodiment and coupled to the track of FIG. 1.

In an exemplary embodiment, as illustrated in FIG. 23, another embodiment of a lamp assembly is generally referred to by the reference numeral 152, and includes a pair of spaced attachments 154*a* and 154*b* that are coupled to the track 12. A lampholder 156 is coupled to the attachments 154*a* and 154*b*, and lamps 158*a* and 158*b* are disposed in the lampholder 156. Each of the attachments 154*a* and 154*b* is substantially identical to the attachment 134 and therefore will not be described in detail. In an exemplary embodiment, each of the lamps 158*a* and 158*b* may be in the form of, for example, a 24-watt fluorescent lamp or a 39-watt fluorescent lamp.

In an exemplary embodiment, the coupling of each of the attachments 154*a* and 154*b* to the track 12 is substantially identical to the coupling of the attachment 134 to the track 12 and therefore these couplings will not be described in detail.

In an exemplary embodiment, the track 12 operates to transfer electrical power to the lamp assembly 152, via the attachments 154*a* and 154*b*, so that the lamp assembly 152 operates at the voltage V2. In an exemplary embodiment, the voltage V2 may be 120 volts.

Figure 24:
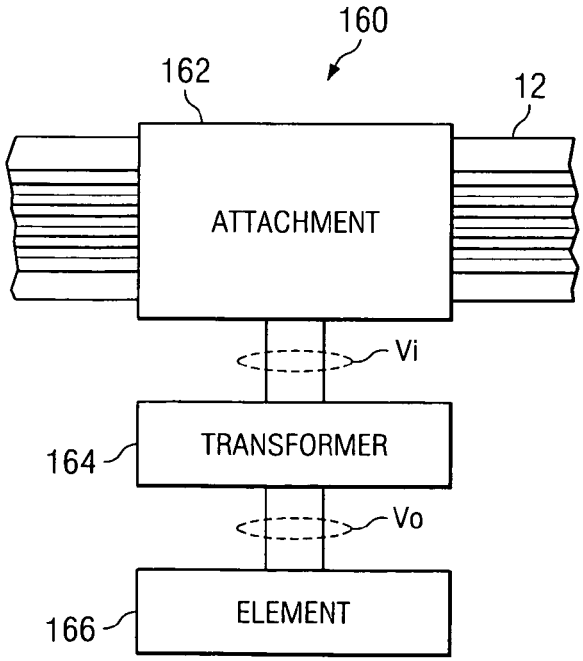
FIG. 24 is a diagrammatic view of a lighting system according to an embodiment and coupled to the track of FIG. 1.

In an exemplary embodiment, as illustrated in FIG. 24, a lighting system is generally referred to by the reference numeral 160 and includes an attachment 162 that is coupled to the track 12, and that is further coupled to a transformer 164. An element 166 is coupled to the transformer 164. In operation, the track 12 transfers electrical power to the transformer 164 via the attachment 162 at a voltage Vi. In response to the input voltage Vi, the transformer 164 outputs a voltage Vo that is different than the voltage Vi, thereby carrying electrical power to the element 166 at the voltage Vo. As a result, the element 166 is electrically powered and operates at the voltage Vo.

In an exemplary embodiment, the attachment 162 may be in the form of the attachment 134, 144 or 154. In an exemplary embodiment, the voltage Vi may be the voltage V1, V2 or V3. In an exemplary embodiment, the voltage Vi may be 120 volts or 12 volts. In an exemplary embodiment, the transformer 164 may be in the form of a step-down transformer and, as a result, the voltage Vo may be less than the voltage Vi. In an exemplary embodiment, the voltage Vi may be the voltage V1 or V2 and/or may have a voltage level of 120 volts, and the voltage Vo may have a voltage level of 12 volts. In an exemplary embodiment, the element 166 may operate at 12 volts. In several exemplary embodiments, the element 166 may be in the form of a wide variety of devices such as, for example, a lamp assembly, a clock and/or any combination thereof. In an exemplary embodiment, the element 166 may be in the form of an attachment such as, for example, the attachment 32 or 86, and may operate to transfer electrical power to another track positioned below the track 12.

Figure 25:
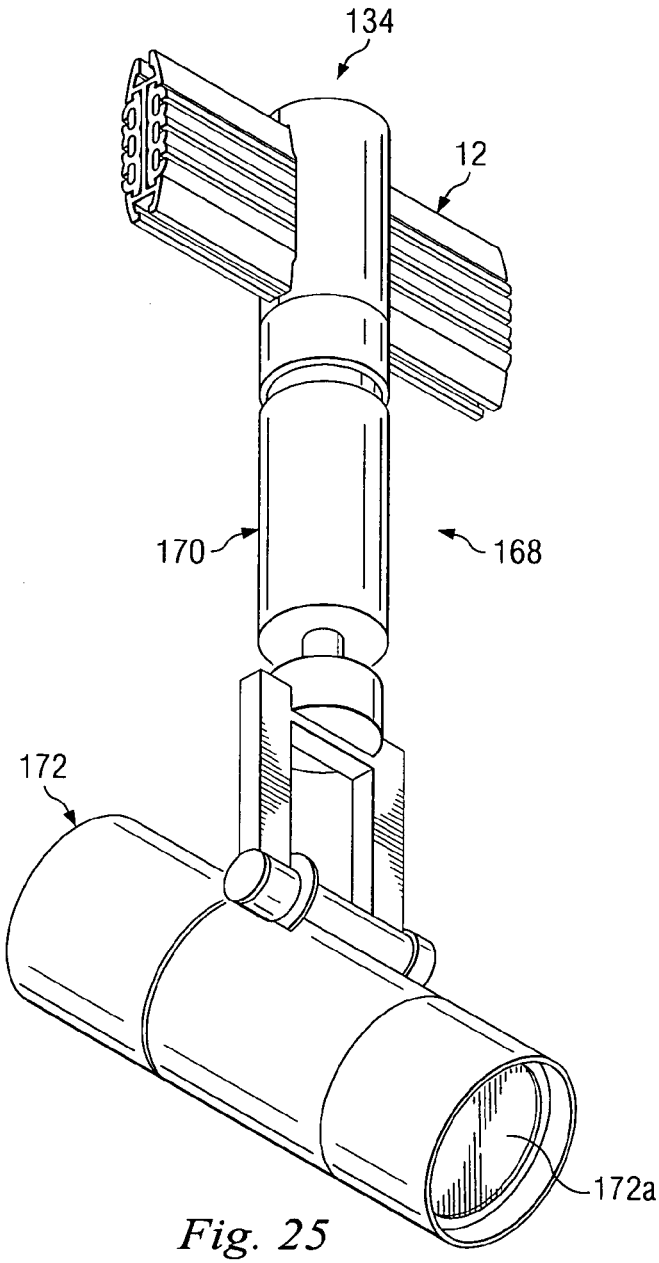
FIG. 25 is a perspective view of a lighting system according to another embodiment.

In an exemplary embodiment, as illustrated in FIG. 25, a lighting system is generally referred to by the reference numeral 168 and includes the attachment 134, which is coupled to the track 12 and to a transformer 170. An element such as, for example, a lamp assembly 172 including a lampholder 172*a* and a lamp disposed therein (not shown), is coupled to the transformer 170.

In operation, the attachment 134 transfers electrical power from the track 12 and to the transformer 170 at the voltage V2. In response to the input voltage V2, the transformer 170 outputs a voltage that is less than the voltage level of the voltage V2, thereby carrying electrical power to the lamp assembly 172 so that the lamp assembly 172 operates at the voltage that is less than the voltage level of the voltage V2. In an exemplary embodiment, the voltage V2 may be 120 volts, the transformer 170 may be a 50-watt transformer, the transformer 170 may output a voltage having a voltage level of 12 volts, and the lamp assembly 172 may operate at 12 volts.

Figure 26:
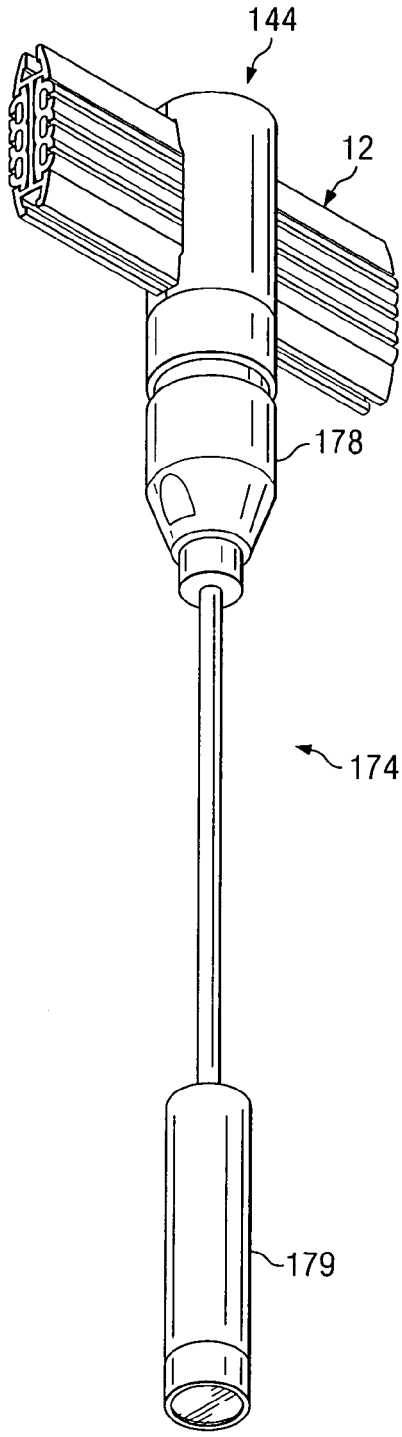
FIG. 26 is a perspective view of a lighting system according to another embodiment.

In an exemplary embodiment, as illustrated in FIG. 26, a lighting system is generally referred to by the reference numeral 174 and includes the attachment 144, which is coupled to the track 12 and to a converter 178. A low-voltage lamp assembly 179 is coupled to the converter 178. In operation, electrical power at the voltage V3 is provided to the lamp assembly 179 via the track 12, the attachment 144 and the converter 178. In an exemplary embodiment, DC electrical power is provided to the lamp assembly 179, the voltage level of the voltage V3 is 12 volts, and the lamp assembly 179 operates at 12 volts. In an exemplary embodiment, the converter 178 may transfer DC electrical power to the lamp assembly 179 at a voltage level that is different than the voltage V3 such as, for example, at a voltage level that is less than the voltage V3.

Figure 27:
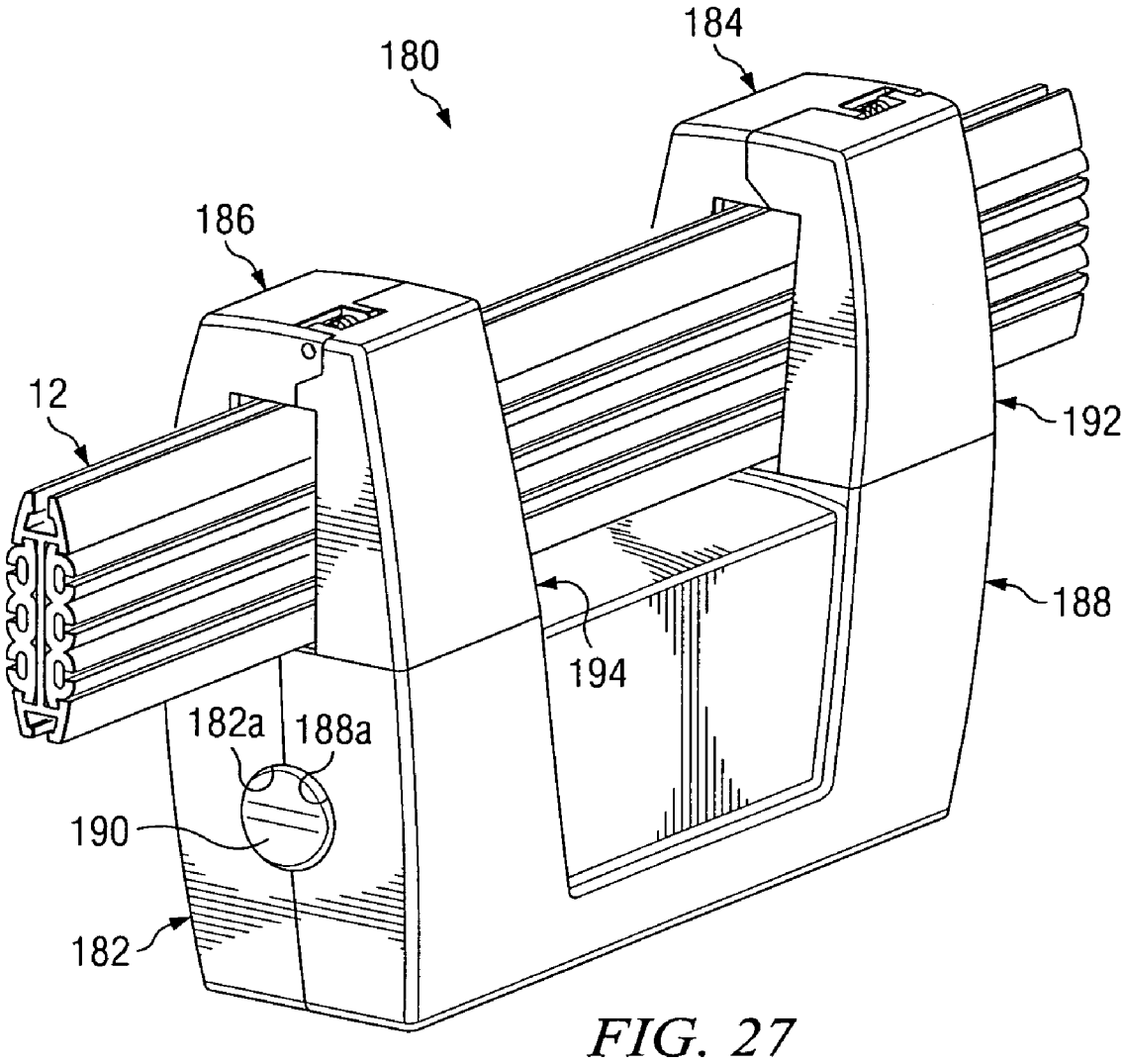
FIG. 27 is a perspective view of a transformer assembly according to an embodiment and coupled to the track of FIG. 1.
Figure 28A:
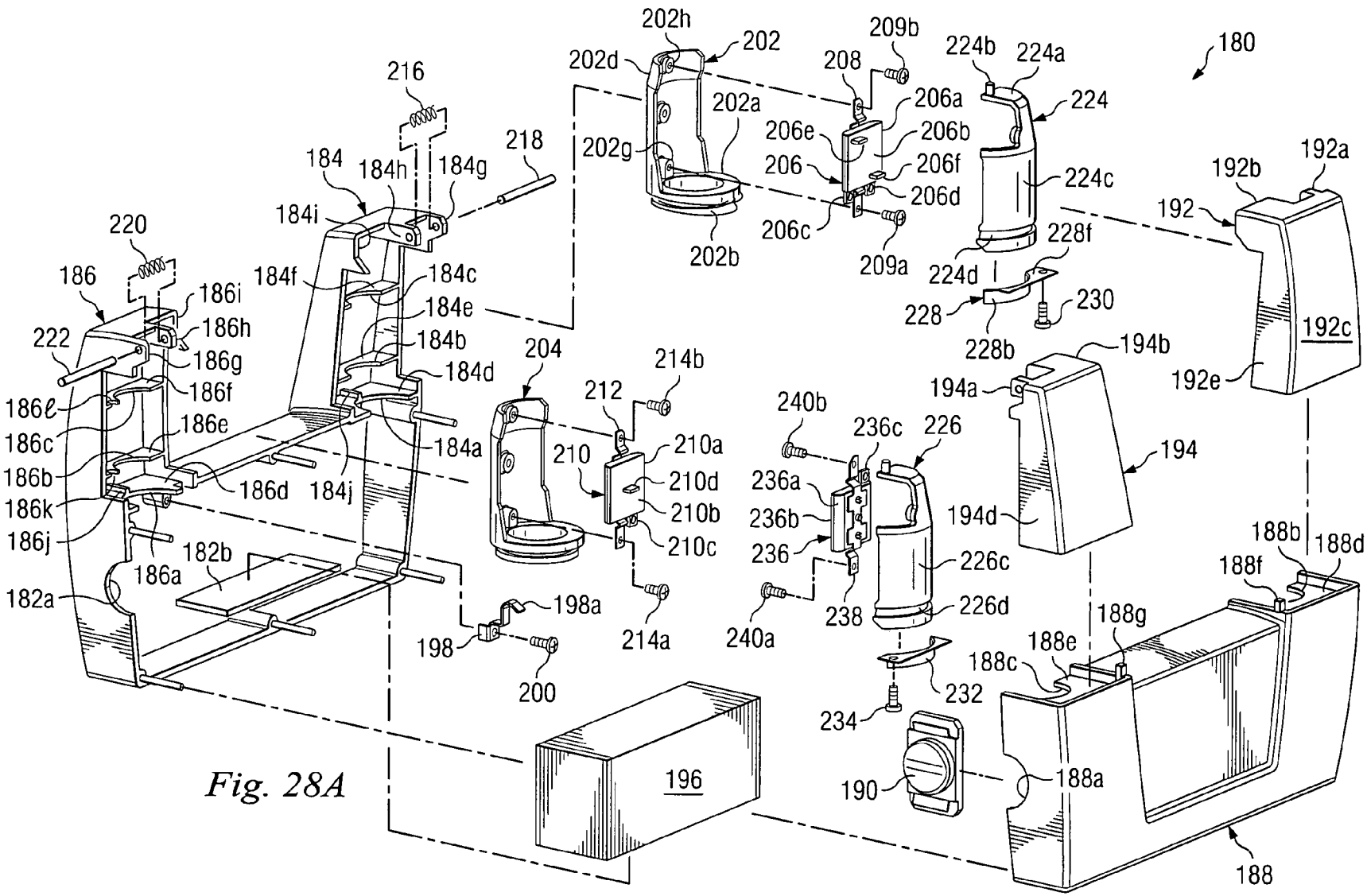
FIG. 28A is an exploded view of the transformer assembly of FIG. 27.
Figure 28B:
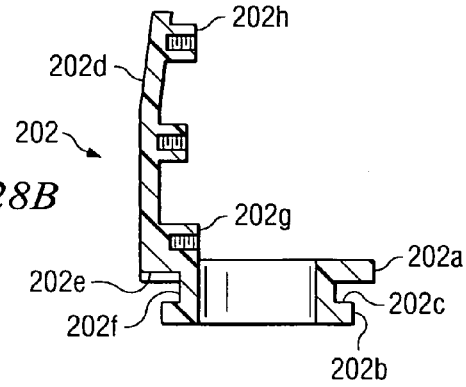
FIG. 28B is a sectional view of a track adapter of the transformer assembly of FIGS. 27 and 28A, a perspective view of which is depicted in FIG. 28A.
Figure 28C:
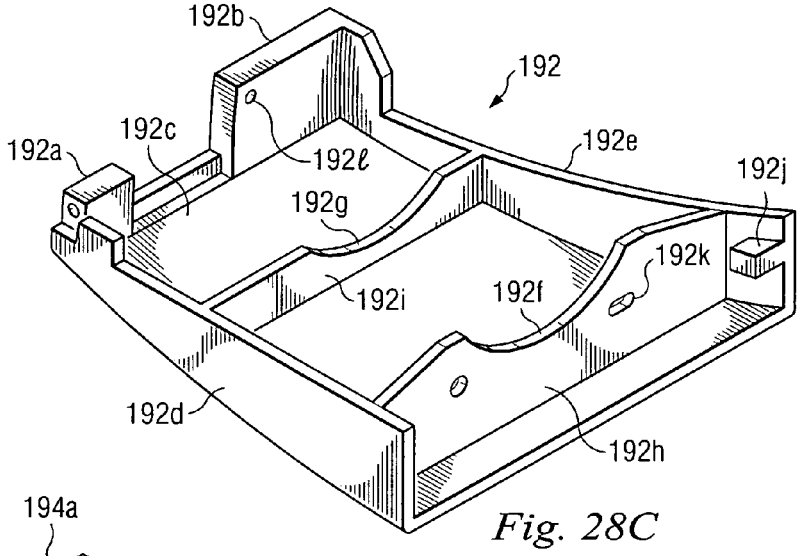
FIGS. 28C and 28D are respective perspective views of covers of the transformer assembly of FIG. 27.
Figure 28D:
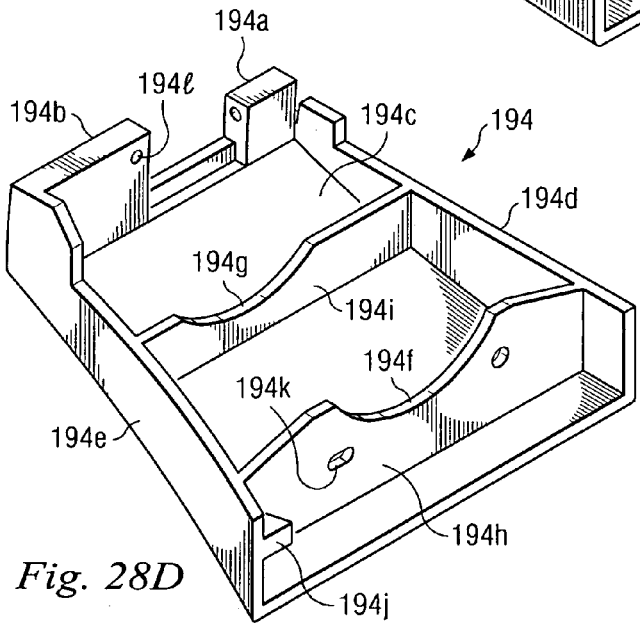
Figure 28F:
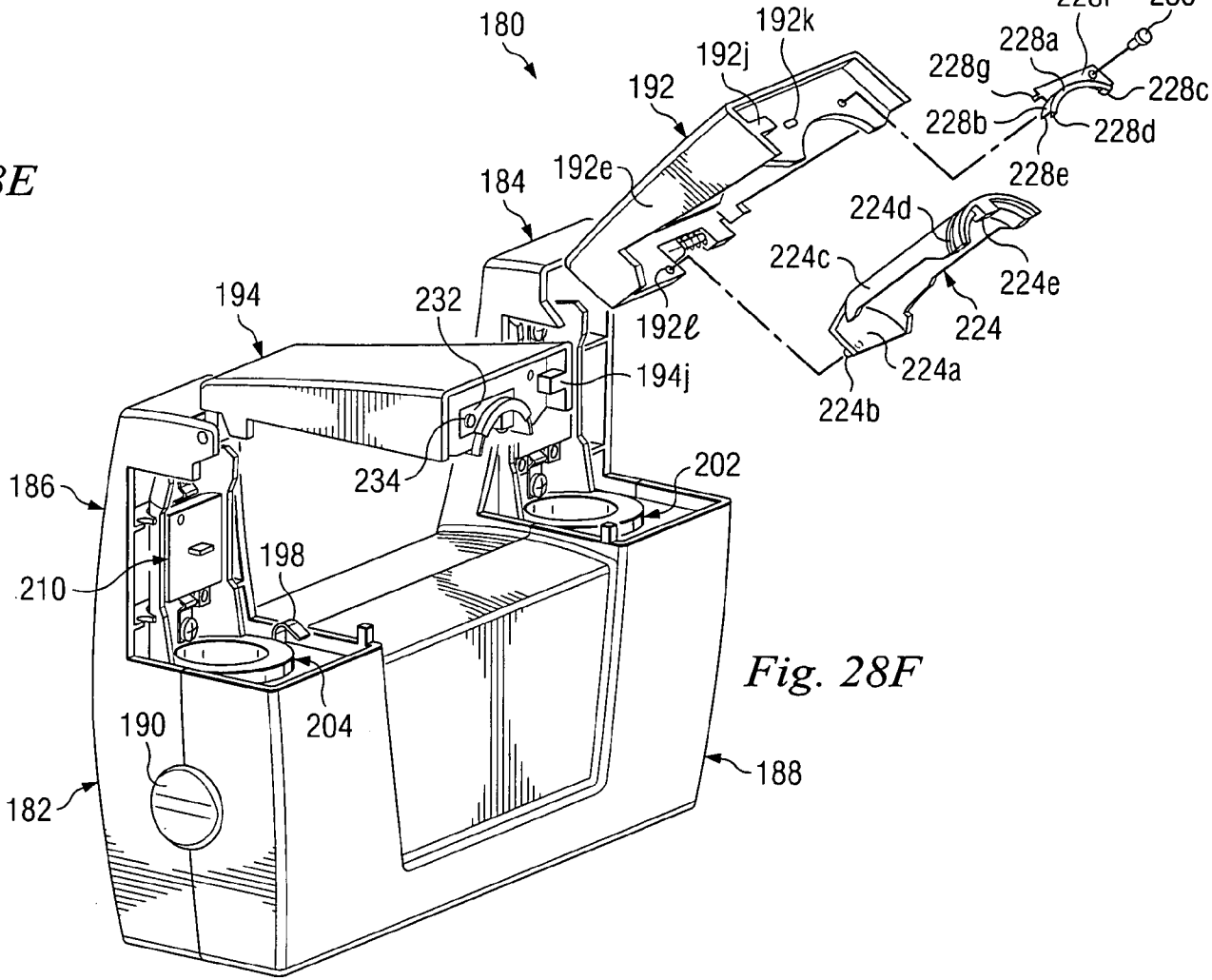
FIG. 28F is a perspective view of the transformer assembly of FIGS. 27 and 28A and depicts another operational position of the covers of FIGS. 28C and 28D.
Figure 28E:
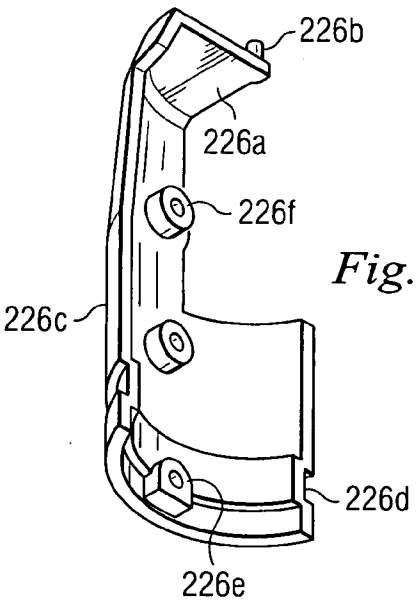
FIG. 28E is a perspective view of another track adapter of the transformer assembly of FIGS. 27 and 28A.
Figure 28H:
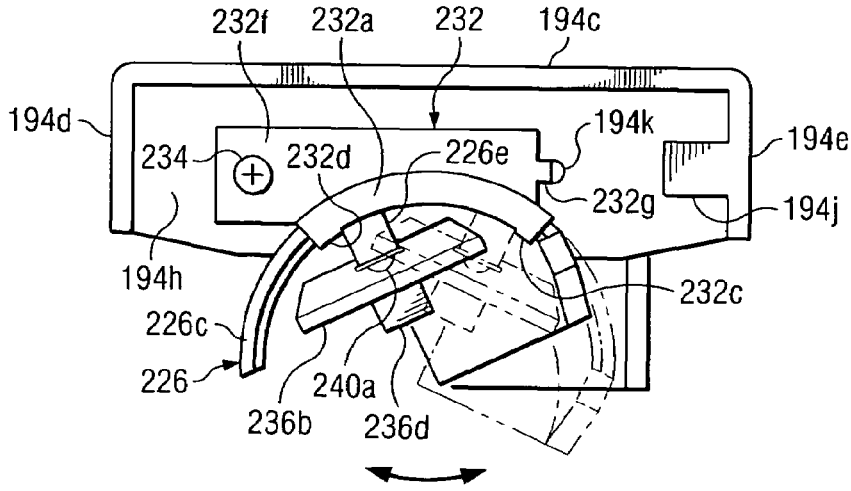
FIGS. 28G and 28H are end views of the covers of FIGS. 28C and 28D, respectively, of the transformer assembly of FIGS. 27 and 28A.
Figure 28G:
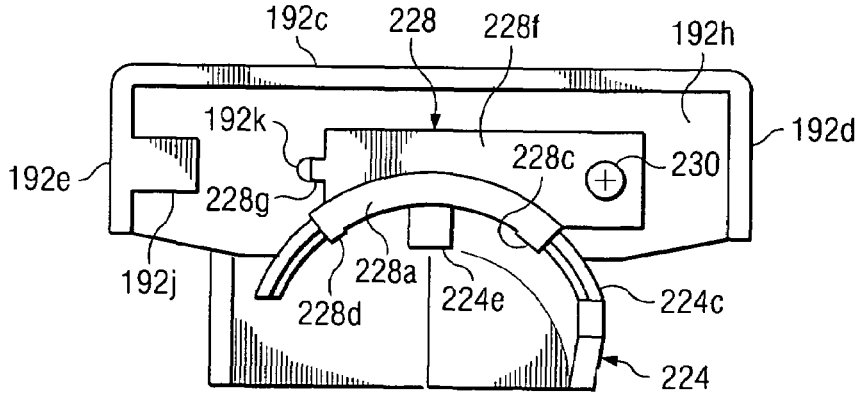

In an exemplary embodiment, as illustrated in FIG. 27, a transformer assembly is generally referred to by the reference numeral 180 and is coupled to, and supported by, the track 12. The transformer assembly 180 includes a housing 182 having ear portions 184 and 186. A housing 188 is connected to the housing 180. A toggle switch 190 is at least partially enclosed within the housings 182 and 188, and at least partially extends through arcuate notches 182*a* and 188*a* in the housings 182 and 188, respectively. Covers 192 and 194 are hingedly connected to the ear portions 184 and 186, respectively.

In an exemplary embodiment, as illustrated in FIGS. 28A, 28B, 28C, 28D, 28E, 28F, 28G and 28H, a transformer 196 is enclosed within the housings 182 and 188, and is electrically coupled to the switch 190. In an exemplary embodiment, the transformer 196 may be at least partially supported by a shelf 182*b* of the housing 182. In an exemplary embodiment, the transformer 196 may be in the form of a 300 W transformer. A ground clip 198 having a curved portion 198*a* is connected to the housing 182 via a fastener 200.

The ear portion 184 of the housing 182 includes arcuate notches 184*a*, 184*b* and 184*c* formed in horizontally-extending portions 184*d*, 184*e* and 184*f*, respectively, and further includes tabs 184*g* and 184*h* spaced in a parallel relation. A cut-out 184*i* is formed in the ear portion 184 and is adjacent the tab 184*h*. A protrusion 184*j* extends from and along the horizontally-extending portion 184*d*.

Similarly, the ear portion 186 of the housing 182 includes arcuate notches 186*a*, 186*b* and 186*c* formed in horizontally-extending portions 186*d*, 186*e* and 186*f*, respectively, and further includes tabs 186*g* and 186*h* spaced in a parallel relation. A cut-out 186*i* is formed in the ear portion 186 and is adjacent the tab 186*h*. A protrusion 186*j* extends from and along the horizontally-extending portion 186*d*. Arcuate notches 186*k* and 186*l* are also formed in the horizontally-extending portions 186*e* and 186*f*, respectively, of the ear portion 186.

Track adapters 202 and 204 are received by the ear portions 184 and 186, respectively, and by arcuate notches 188*b* and 188*c*, respectively, which are formed in horizontally-extending portions 188*d* and 188*e*, respectively, of the housing 188. More particularly, the track adapter 202 includes a ring 202*a*, an annular protrusion 202*b* extending downward from the ring 202*a* and having an external annular recess 202*c* formed therein, and an arcuate shell portion 202*d* extending upward from the ring 202*a*. A notch 202*e* is formed in the ring 202*a* and defines a surface 202*f* that is substantially flush with the circumferentially-extending surface defined by the external annular recess 202*c*. Bosses 202*g* and 202*h* extend radially inward from the inside surface of the shell portion 202*c* of the track adapter 202.

The track adapter 202 is positioned so that the ring 202*a* engages the horizontally-extending portions 184*d* and 188*d* of the ear portion 184 and the housing 188, respectively, the protrusion 184*j* of the ear portion 184 extends into the notch 202*e* of the track adapter 202, the external annular recess 202*c* receives the horizontally-extending portions 184*d* and 188*d* of the ear portion 184 and the housing 188, respectively, so that the external annular recess 202*c* extends radially into the arcuate notches 184*a* and 188*b* of the ear portion 184 and the housing 188, respectively. As a result, the track adapter 202 is captured and coupled to the housings 182 and 188: Moreover, the arcuate shell portion 202*d* extends radially into the arcuate notches 184*b* and 184*c* of the ear portion 184 of the housing 182.

The track adapter 204 is substantially identical to the track adapter 202 and therefore will not be described in detail. The receipt of the track adapter 204 by the ear portion 186 is substantially identical to the receipt of the track adapter 202 by the ear portion 184, and the capturing and coupling of the track adapter 204 to the housings 182 and 188 is substantially identical to the capturing and coupling of the track adapter 202 to the housings 182 and 188, and therefore neither the track adapter 204 nor the coupling of the track adapter 204 to the housings 182 and 188 will be described in detail.

The track adapters 202 and 204 are each permitted to at least partially rotate in place, relative to the housings 182 and 188, respectively, over a predetermined circumferential range and under conditions to be described. The predetermined circumferential range of partial rotation of the track adapter 202 is defined in part by the width of the notch 202*e*, and the rotation of the track adapter 202 past the circumferential range is prevented by the extension of the protrusion 184*j* into the notch 202*e* and the engagement between the protrusion 184*j* and a wall of the ring 202*a* defined by the notch 202*e*. The definition of the predetermined circumferential range of partial rotation of the track adapter 204, due to the engagement between the track adapter 204 and the protrusion 186*j*, is substantially similar to the definition of the predetermined circumferential range of partial rotation of the track adapter 202, and therefore will not be described in detail.

A contact pad assembly 206 is coupled to a biasing element 208, which, in turn, is connected to the track adapter 202 via fasteners 209*a* and 209*b* that extend into and threadably engage the bosses 202*g* and 202*h*, respectively, of the shell portion 202*d* of the track adapter 202. The biasing element 208 and the coupling between the contact pad assembly 206 and the biasing element 208 are similar to the biasing element 94 and the coupling between the contact pad assembly 92 and the biasing element 94, respectively, of the power feed assembly 84, and therefore neither the biasing element 208 nor the coupling between the contact pad assembly 206 and the biasing element 208 will be described in detail.

The contact pad assembly 206 includes a contact pad 206*a* defining a surface 206*b*, and lugs 206*c* and 206*d*, which extend through the interior of the contact pad 206*a* and outwards from the surface 206*b*, and have distal ends that define contacts 206*e* and 206*f*, respectively. Although not shown, respective wires extend from the lugs 206*c* and 206*d*, extend through the ring 202*a* of the track adapter 202, and are electrically coupled to the transformer 196, thereby electrically coupling each of the lugs 206*c* and 206*d* to the transformer 196. In an exemplary embodiment, one or both of the respective wires that extend from the lugs 206*c* and 206*d* may be electrically coupled to the transformer 196 via the switch 190.

A contact pad assembly 210 is coupled to a biasing element 212 which, in turn, is connected to the track adapter 204 via fasteners 214*a* and 214*b* in a manner similar to the manner in which the contact pad assembly 206 is coupled to the track adapter 202. The biasing element 212 and the coupling between the contact pad assembly 210 and the biasing element 212 are similar to the biasing element 94 and the coupling between the contact pad assembly 92 and the biasing element 94, respectively, of the power feed assembly 84, and therefore neither the biasing element 212 nor the coupling between the contact pad assembly 210 and the biasing element 212 will be described in detail.

The contact pad assembly 210 includes a contact pad 210*a* defining a surface 210*b*, and a lug 210*c*, which extends through the interior of the contact pad 210*a* and outwards from the surface 210*b*, and has a distal end that defines a contact 210*d*. Although not shown, a wire extends from the lug 210*c*, extends through the ring of the track adapter 204, and is electrically coupled to the transformer 196, thereby electrically coupling the lug 210*c* to the transformer 196. In an exemplary embodiment, the wire that extends from the lug 210*c* may be electrically coupled to the transformer 196 via the switch 190.

As noted above, the covers 192 and 194 are hingedly connected to the ear portions 184 and 186, respectively, of the housing 182. More particularly, a tab 192*a* of the cover 192 is positioned between the tabs 184*g* and 184*h* of the ear portion 184, and a spring 216 is positioned between the tab 192*a* of the cover 192 and the tab 184*h* of the ear portion 184. A pin 218 extends through the tab 184*g* of the ear portion 184, through the tab 192*a* of the cover 192, through the spring 216, through the tab 184*h* of the ear portion 184, and into an upper protuberance 192*b* of the cover 192, thereby hingedly connecting the cover 192 to the ear portion 184 of the housing 182. Similarly, a tab 194*a* of the cover 194 is positioned between the tabs 186*g* and 186*h* of the ear portion 186, and a spring 220 is positioned between the tab 194*a* of the cover 194 and the tab 186*h* of the ear portion 186. A pin 222 extends through the tab 186*g* of the ear portion 186, through the tab 194*a* of the cover 194, through the spring 222, through the tab 186*h* of the ear portion 186, and into an upper protuberance 194*b* of the cover 194, thereby hingedly connecting the cover 194 to the ear portion 186.

As a result of the above-described hinged connections between the covers 192 and 194 and the ear portions 184 and 186, respectively, the upper protuberances 192*b* and 194*b* of the covers 192 and 194, respectively, are at least partially received by the cut-outs 184*i* and 186*i*, respectively, of the housings 184 and 186, respectively, and are adapted to be fully received by the cut-outs 184*i* and 186*i*, respectively, under conditions to be described.

The cover 192 further includes a back wall 192*c* and side walls 192*d* and 192*e*, and arcuate notches 192*f* and 192*g* formed in horizontally-extending portions 192*h* and 192*i*, respectively, which each extend from the back wall 192*c* and the side walls 192*d* and 192*e*. A protrusion 192*j* extends from the distal end of the side wall 192*e* in a direction away from the cover 194, and is spaced in a parallel relation from the back wall 192*c*. A slot 192*k* is formed in the horizontally-extending portion 192*h*.

Similarly, the cover 194 further includes a back wall 194*c* and side walls 194*d* and 194*e*, and arcuate notches 194*f* and 194*g* formed in horizontally-extending portions 194*h* and 194*i*, respectively, which each extend between the back wall 194*c* and the side walls 194*d* and 194*e*. A protrusion 194*j* extends from the distal end of the side wall 194*e* in a direction away from the cover 192, and is spaced in a parallel relation from the back wall 194*c*. A slot 194*k* is formed in the horizontally-extending portion 194*h*.

Track adapters 224 and 226 are received by the covers 192 and 194, respectively. More particularly, the track adapter 224 includes a horizontally-extending portion 224*a* having a protrusion 224*b* extending upward therefrom and into a blind opening 192*l* in the upper protuberance 192*b*, and a generally arcuate shell portion 224*c* extending generally downward from the horizontally-extending portion 224*a* and radially into the arcuate notch 192*g* of the cover 192. An external arcuate recess 224*d* is formed in the shell portion 224*c* of the track adapter 224 and is positioned proximate the arcuate notch 192*f* so that the horizontally-extending portion 192*h* of the cover 192 extends into the external arcuate recess 224*d* of the track adapter 224. A boss 224*e* extends radially inward from the inside surface of the shell portion 224*c* of the track adapter 224.

Similarly, the track adapter 226 includes a horizontally-extending portion 226*a* having a protrusion 226*b* extending upward therefrom and into a blind opening 194*l* in the upper protuberance 194*b*, and a generally arcuate shell portion 226*c* extending generally downward from the horizontally-extending portion 226*a* and radially into the arcuate notch 194*g* of the cover 194. An external arcuate recess 226*d* is formed in the shell portion 226*c* of the track adapter 226 and is positioned proximate the arcuate notch 192*f* so that the horizontally-extending portion 194*h* of the cover 194 extends into the external arcuate recess 226*d* of the track adapter 226. Bosses 226*e* and 226*f* extend radially inward from the inside surface of the shell portion 226*c* of the track adapter 226.

A clip 228 is connected to the cover 192 and secures the track adapter 224 to the cover 192. More particularly, the clip 228 includes an arcuate protrusion 228*a*, and an arcuate wall 228*b* and tabs, 228*c* and 228*d*, extending upward from the arcuate protrusion 228*a*, thereby defining a channel 228*e*. A horizontally-extending portion 228*f* extends from the wall 228*b* and a tab 228*g* extends from the horizontally-extending portion 228*f*. A fastener 230 extends through the horizontally-extending portion 228*f* of the clip 228 and is threadably engaged with an opening in the horizontal portion 192*h* of the cover 192, and the tab 228*g* of the clip 228 extends into the slot 192*k* of the cover 192. As a result, the clip 228 is connected to the cover 192 and the end of the arcuate portion 224*c* of the track adapter 224, which end opposes the horizontally-extending portion 224*a*, extends into the channel 228*e* so that the boss 224*e* is positioned between the tabs 228*c* and 228*d*. As a result of the extension of the protrusion 224*b* into the opening 192*l*, and the extension of the arcuate portion 224*c* into the channel 228*e*, the track adapter 224 is secured to the cover 192.

Similarly, a clip 232 is connected to the cover 194 and secures the track adapter 226 to the cover 194. The clip 232 is the symmetric equivalent to the clip 228 and therefore will not be described in detail. The reference numerals used to refer to features of the clip 232 correspond to the reference numerals for the feature of the clip 228, except that the numeric prefix for the reference numerals used to describe the clip 228, that is, 228, are replaced by the numeric prefix of the clip 232, that is, 232. The connection between the clip 232 and the cover 194 via in part a screw 234, and the securing of the track adapter 226 to the cover 194 by the clip 232, are substantially similar to the connection between the clip 228 and the cover 192 via in part the screw 230, and the securing of the track adapter 224 to the cover 192 by the clip 228, respectively, and therefore will not be described in detail.

The track adapters 224 and 226 are each permitted to at least partially rotate in place, relative to the covers 192 and 194, respectively, over a predetermined range and under conditions to be described. The predetermined circumferential range of partial rotation of the track adapter 224 is defined in part by the circumferential length of the arcuate protrusion 228*a*, which corresponds to the circumferential length of the channel 228*e*, and the rotation of the track adapter 224 past the circumferential range is prevented by the positioning of the boss 224*e* between the tabs 228*c* and 228*d* and the engagement between the boss 224*e* and either the tab 228*c* or 228*d*, depending upon the direction of rotation of the track adapter 224. Similarly, the predetermined circumferential range of partial rotation of the track adapter 224 is defined in part by the circumferential length of the arcuate protrusion 232*a*, which corresponds to the circumferential length of the channel 232*e*, and the rotation of the track adapter 226 past the circumferential range is prevented by the positioning of the boss 226*e* between the tabs 232*c* and 232*d* and the engagement between the boss 224*e* and either the tab 228*c* or 228*d*, depending upon the direction of rotation of the track adapter 226.

A contact pad assembly 236 is coupled to a biasing element 238 which, in turn, is connected to the track adapter 226 via fasteners 240*a* and 240*b* that extend into and threadably engage the bosses 226*e* and 226*f*, respectively, of the track adapter 226. The biasing element 238 and the coupling between the contact pad assembly 236 and the biasing element 238 are similar to the biasing element 94 and the coupling between the contact pad assembly 92 and the biasing element 94, respectively, of the power feed assembly 84, and therefore neither the biasing element 238 nor the coupling between the contact pad assembly 236 and the biasing element 238 will be described in detail.

The contact pad assembly 236 includes a contact pad 236*a* defining a surface 236*b*, and a lug 236*c*, which extends through the interior of the contact pad 236*a* and outwards from the surface 236*b*, and has a distal end that defines a contact 236*d*. Although not shown, a wire extends upward from the lug 236*c* and over into the ear portion 186 of the housing 182, is received by and extends through the arcuate notches 186*l* and 186*k*, through the ring of the track adapter 204, and is electrically coupled to the transformer 196, thereby electrically coupling the lug 236*c* to the transformer 196. The arcuate notches 186*l* and 186*k* provide a guide path for the wire that extends from the lug 236*c* so that the wire does not interfere with the track adapter 204, or vice versa. In an exemplary embodiment, the wire that extends from the lug 236*c* may be electrically coupled to the transformer 196 via the switch 190.

The housing 188 further includes protrusions 188*f* and 188*g* that extend upward from the horizontally-extending portions 188*d* and 188*e*, respectively. The protrusions 188*f* and 188*g* are adapted to engage the covers 192 and 194, respectively, under conditions to be described.

Figure 29:
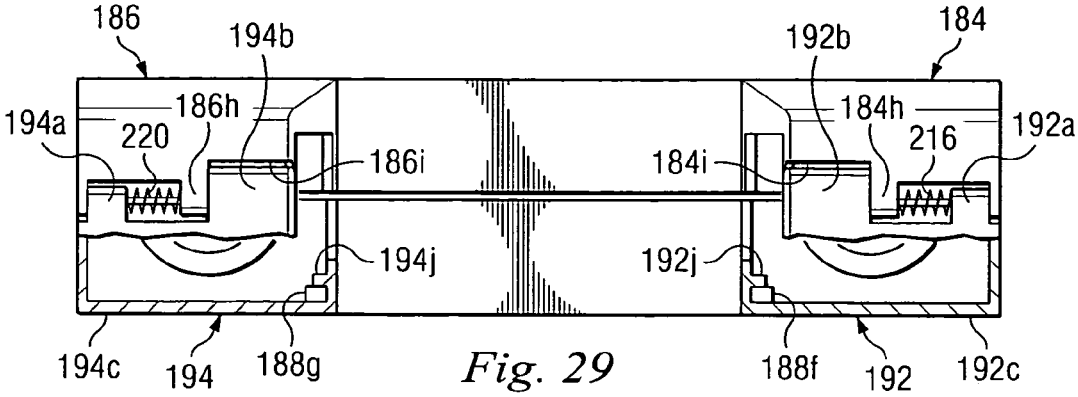
FIG. 29 is a simplified partial sectional/partial top plan view of the transformer assembly of FIGS. 27 and 28A and depicts operational positions of the covers of FIGS. 28C and 28D.

In an exemplary embodiment, the transformer assembly 180 is coupled to the track 12 as illustrated in FIGS. 29, 30A, 30B, 31A, 31B, 32 and 33. As illustrated in FIG. 29, the covers 192 and 194 may each be initially in a closed or locked configuration in which the protrusion 188*f* of the housing 188 extends between the protrusion 192*j* and the back wall 192*c* of the cover 192, and the protrusion 188*g* of the housing 188 extends between the protrusion 194*j* and the back wall 194*c* of the cover 194. As a result, the covers 192 and 194 are locked, that is, prevented from rotating in counterclockwise direction, about the pins 218 and 222, respectively, and away from the housing 188. Also, the spring 216 may be partially compressed and therefore may apply a biasing force against the tab 192*a* and against the tab 184*h*, resisting any unwanted translation or play of the cover 192 relative to the housings 182 and 188. Similarly, the spring 220 may be partially compressed and therefore may apply a biasing force against the tab 194*a* and against the tab 186*h*, resisting any unwanted translation or play of the cover 194 relative to the housings 182 and 188. Moreover, the upper protuberances 192*b* and 194*b* of the covers 192 and 194, respectively, are fully received by the cut-outs 184*i* and 186*i*, respectively.

Figure 30A:
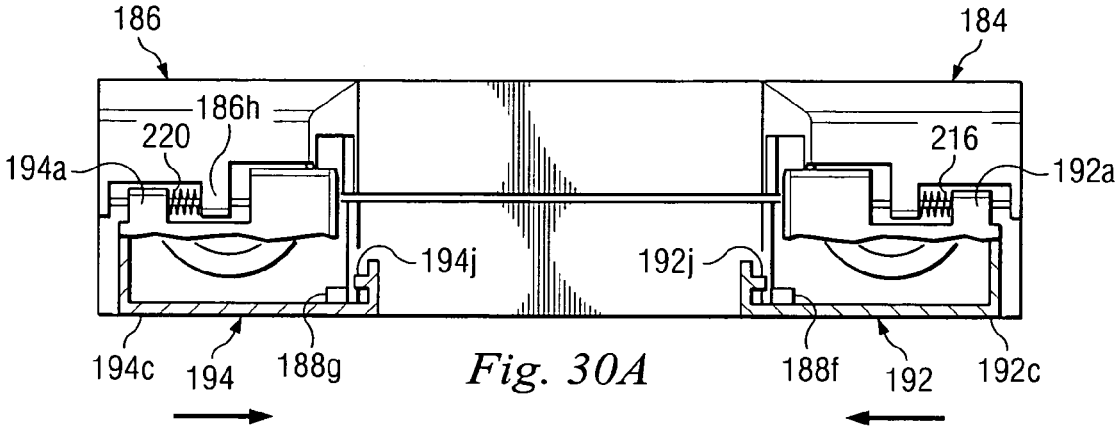
FIG. 30A is a view similar to that of FIG. 29 but depicting other operational positions of the covers of FIGS. 28C and 28D.
Figure 30B:
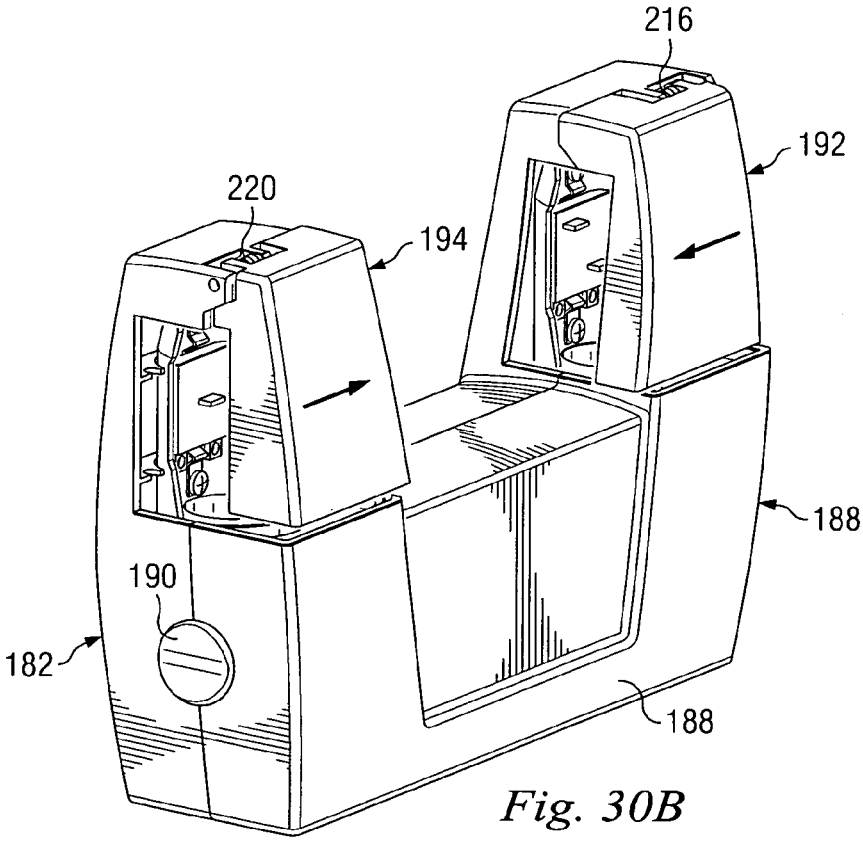
FIG. 30B is a perspective view of the transformer assembly of FIGS. 27 and 28A and depicts the same operational positions of the covers of FIGS. 28C and 28D that are depicted in FIG. 30A.

In an exemplary embodiment, as illustrated in FIGS. 30A and 30B, the covers 192 and 194 are each placed in an open or unlocked configuration by an operator first sliding or translating the covers 192 and 194 towards each other. More particularly, the cover 192 is translated in a direction towards the cover 194 so that the spring 216 is compressed or further compressed between the tab 192*a* and the tab 184*h*, and the distal end of the protrusion 192*j* of the cover 192 translates past the protrusion 188*f* of the housing 188 in the right-to-left direction, as viewed in FIG. 30A. Similarly, the cover 194 is translated in a direction towards the cover 192 so that the spring 220 is compressed or further compressed between the tab 194*a* and the tab 186*h*, and the distal end of the protrusion 194*j* of the cover 194 translates past the protrusion 188*g* of the housing 188 in the left-to-right direction, as viewed in FIG. 30A. In an exemplary embodiment, the cover 194 may be slid or translated before, during or after the translation of the cover 192.

Figure 31A:
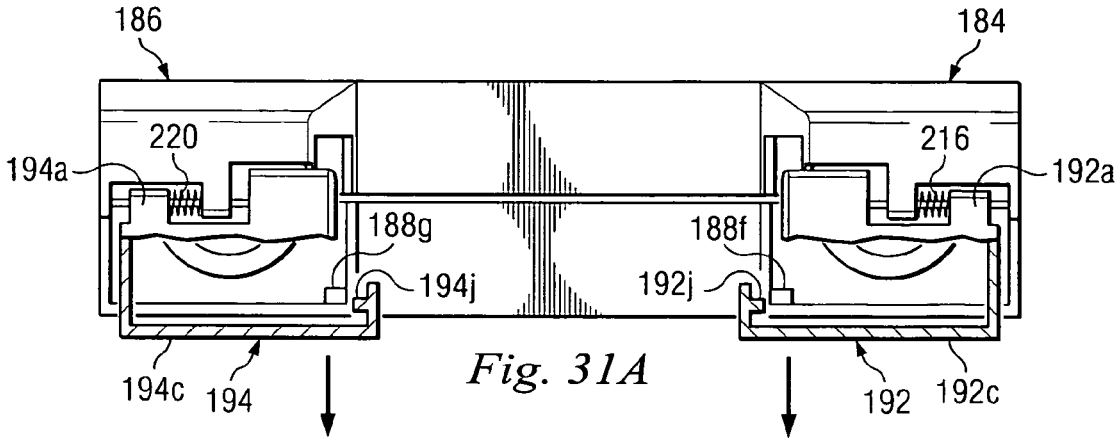
FIG. 31A is a view similar to that of FIG. 29 but depicting yet other operational positions of the covers of FIGS. 28C and 28D.
Figure 31B:
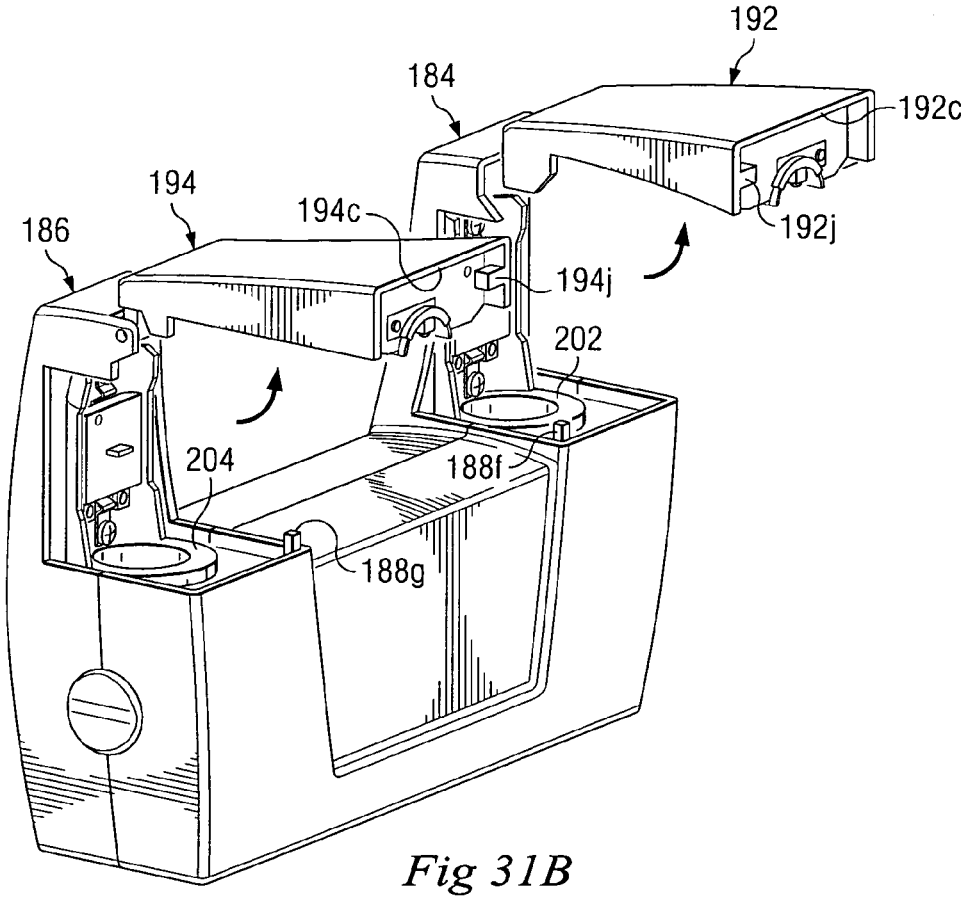
FIG. 31B is a view similar to that of FIG. 30B but depicts the same operational positions of the covers of FIGS. 28C and 28D that are depicted in FIG. 31A.

In an exemplary embodiment, as illustrated in FIGS. 31A and 31B, the operator then rotates the covers 192 and 194 in a counterclockwise direction, about the pins 218 and 222, respectively, so that the protrusions 192*j* and 194*j*, respectively, rotate past or beyond the protrusions 188*f* and 188*g*, respectively, in the top-to-bottom direction as viewed in FIG. 31A, while maintaining the compressed states of the springs 216 and 220, respectively. In an exemplary embodiment, the cover 194 may be rotated in this manner before, during or after the rotation of the cover 192 in this manner.

Once the protrusions 192*j* and 194*j* of the covers 192 and 194, respectively, have been rotated past or beyond the protrusions 188*f* and 188*g*, respectively, in the top-to-bottom direction as viewed in FIG. 31A, the rotation of the covers 192 and 194 may be continued, with or without maintaining the compressed states of the springs 216 and 220, respectively. If the cover 192 is released so that the spring 216 returns to its initial uncompressed or partially compressed state, then the extension of the spring 216 causes the cover 192 to translate back to its original position, relative to the ear portion 184, except that the cover 192 remains in an open or unlocked configuration because the protrusion 192*j* remains positioned past or beyond the protrusion 188*f*. Similarly, if the cover 194 is released so that the spring 220 returns to its initial uncompressed or partially compressed state, then the extension of the spring 220 causes the cover 194 to translate back to its original position, relative to the ear portion 186, except that the cover 194 remains in an open or unlocked configuration because the protrusion 194*j* remains positioned past or beyond the protrusion 188*g*. In an exemplary embodiment, the rotation of the cover 194 may be continued before, during or after the continued rotation of the cover 192. In an exemplary embodiment, the cover 194 may be released, and therefore the spring 220 may decompress, before, during or after the release of the cover 192, and therefore the decompression of the spring 216.

When the covers 192 and 194 are each in the open or unlocked configuration, the transformer assembly 180 is coupled to the track 12. The transformer assembly 180 is positioned against the track 12 so that the contacts 206*e* and 206*f* of the contact pad assembly 206 extend into the channels 22*a* and 22*c*, respectively, of the liner 22, and contact or nearly contact the buss bars 26*a* and 26*c*, respectively, and so that the contact 210*d* of the contact pad assembly 210 extends into the channel 22*b* of the liner 22 and contacts or nearly contacts the buss bar 26*b*. During this positioning, the covers 192 and 194 are each manipulated and/or maintained in a rotated state so as to not interfere with contact between the contacts 206*e*, 206*f* and 210*d* and the buss bars 26*a*, 26*c* and 26*b*, respectively. In an exemplary embodiment, when the transformer assembly 180 is positioned against the track 12, the transformer assembly 180 may hang from the track 12 by the ear portions 184 and 186 of the housing 182. In an exemplary embodiment, when the transformer assembly 180 is positioned against the track 12, the transformer 180 may hang from the track 12 by the ear portions 184 and 186 of the housing 182, and/or the covers 192 and 194.

After the transformer assembly 180 has been positioned against the track 12 as described above, the covers 192 and 194 are each placed in the closed or locked position by performing, in reverse, the above-described procedure for placing the covers 192 and 194 in the open or unlocked configuration. More particularly, the covers 192 and 194 are each rotated in the clockwise direction, about the pins 218 and 222, respectively. The covers 192 and 194 are each then translated towards the other so that the springs 216 and 220, respectively, compress and the protrusions 192*j* and 194*j* each extend past or beyond the protrusions 188*f* and 188*g*, respectively, in the side-to-side direction, as viewed in FIG. 30A and 31A. While maintaining the respective compressed states of the springs 216 and 220, the covers 192 and 194 are further rotated clockwise until the protrusions 192*j* and 194*j* are past or beyond the protrusions 188*f* and 188*g*, respectively, in the bottom-to-top direction, as viewed in FIG. 30A and 31A. As a result, the contact 236*d* extends into the channel 24*b* and contacts or nearly contacts the buss bar 28*b*.

At this point, the covers 192 and 194 are released, and therefore the springs 216 and 220, respectively, return to their initial, uncompressed or partially compressed states. As a result, the spring 216 applies a biasing force against the tab 192*a* of the cover 192, causing the cover 192 to slide or translate back to its initial position so that the protrusion 188*f* is again between the protrusion 192*j* and the wall 192*c*, as viewed in FIG. 29. As another result, the spring 220 applies a biasing force against the tab 194*a* of the cover 194, causing the cover 194 to slide or translate back to its initial position so that the protrusion 188*g* is between the protrusion 194*j* and the wall 194*c*, as viewed in FIG. 29. As another result, the covers 192 and 194 are in a closed or locked configuration. It is understood that, due to frictional forces generated between the contacts 206*d*, 206*e*, 210*d* and 236*d*, and the buss bars 26*a*, 26*c*, 26*b* and 28*b*, respectively, the covers 192 and 194 may not be able to automatically slide or translate back to their respective initial positions. In this event, the operator may slide or translate the covers 192 and 194 away from each other to place the covers 192 and 194 in their respective initial positions as viewed in FIG. 29.

In an exemplary embodiment, after the transformer assembly 180 has been positioned against the track 12 as described above, the cover 194 may be placed in the closed or locked configuration before, during or after the placing of the cover 192 in the closed or locked configuration. In an exemplary embodiment, an operator may place the covers 192 and 194 in their respective closed configurations without the use of one or more tools, that is, without the use of, for example, a screwdriver, an allen wrench, another type of wrench, etc., thereby toollessly coupling the transformer assembly 180 to the track 12.

Figure 32:
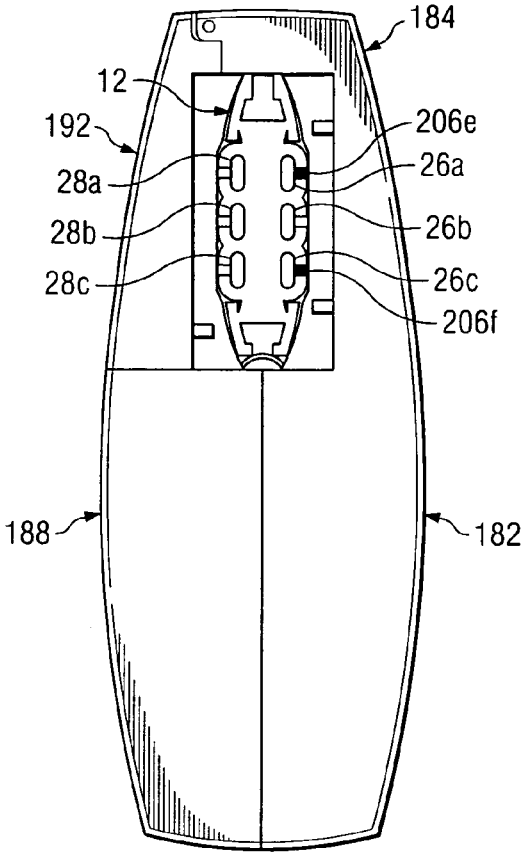
FIG. 32 is an elevational view of one end of the transformer assembly and track of FIG. 27.

In an exemplary embodiment, as illustrated in FIG. 32, after the transformer assembly 180 has been coupled to the track 12 and the covers 192 and 194 are in their respective closed or locked configurations, as described above, the contacts 206*e* and 206*f* contact the buss bars 26*a* and 26*b*, respectively. As a result, the biasing element 208 is partially compressed in a direction away from the track 12.

Figure 33:
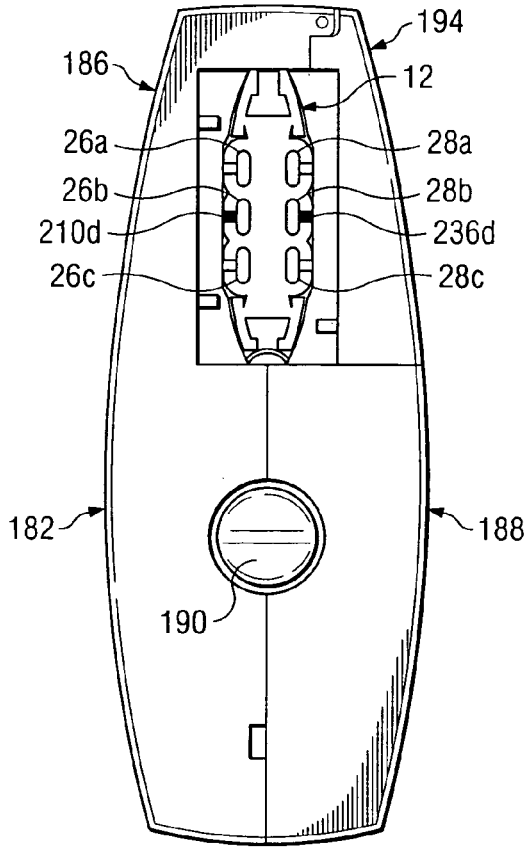
FIG. 33 is an elevational view of the other end of the transformer assembly and track of FIG. 27.

In an exemplary embodiment, as illustrated in FIG. 33, after the transformer assembly 180 has been coupled to the track 12 and the covers 192 and 194 are in their respective closed or locked configurations, as described above, the contacts 210*d* and 236*d* contact the buss bars 26*b* and 28*b*, respectively. As a result, the biasing elements 212 and 238 are partially compressed in respective directions away from the track 12. Also, the curved portion 98*a* of the ground clip 98 contacts the protrusions 20*e* and/or 20*f* of the protrusion 20 of the track 12, thereby providing a ground path between the transformer assembly 180 and the track 12.

Figure 34A:
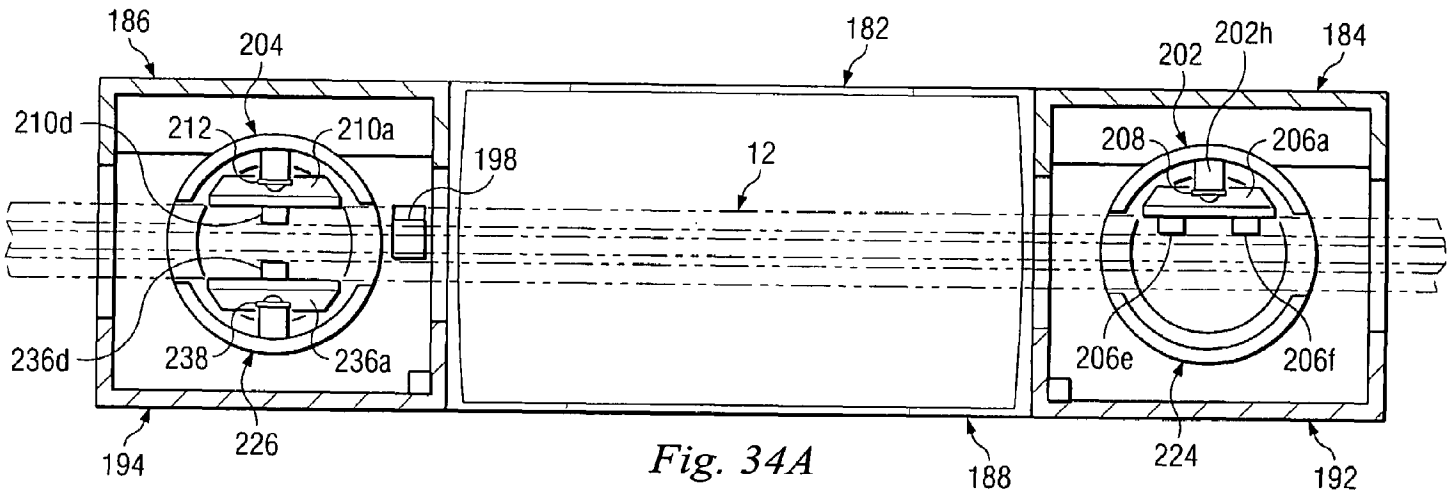
FIG. 34A is a simplified partial sectional/partial top plan view of the transformer assembly and track of FIG. 27.

In an exemplary embodiment, as illustrated in FIG. 34A, the biasing element 208 provides a biasing force against the contact pad 206*a*, thereby forcing the contacts 206*e* and 206*f* against the buss bars 26*a* and 26*c*, respectively, to effect sufficient contact therebetween. Moreover, the biasing element 212 provides a biasing force against the contact pad 210*a*, thereby forcing the contact 210*d* against the buss bar 26*b* to effect sufficient contact therebetween. Moreover, the biasing element 238 provides a biasing force against the contact pad 236*a*, thereby forcing the contact 236*d* against the buss bar 28*b* to effect sufficient contact therebetween.

Figure 34B:
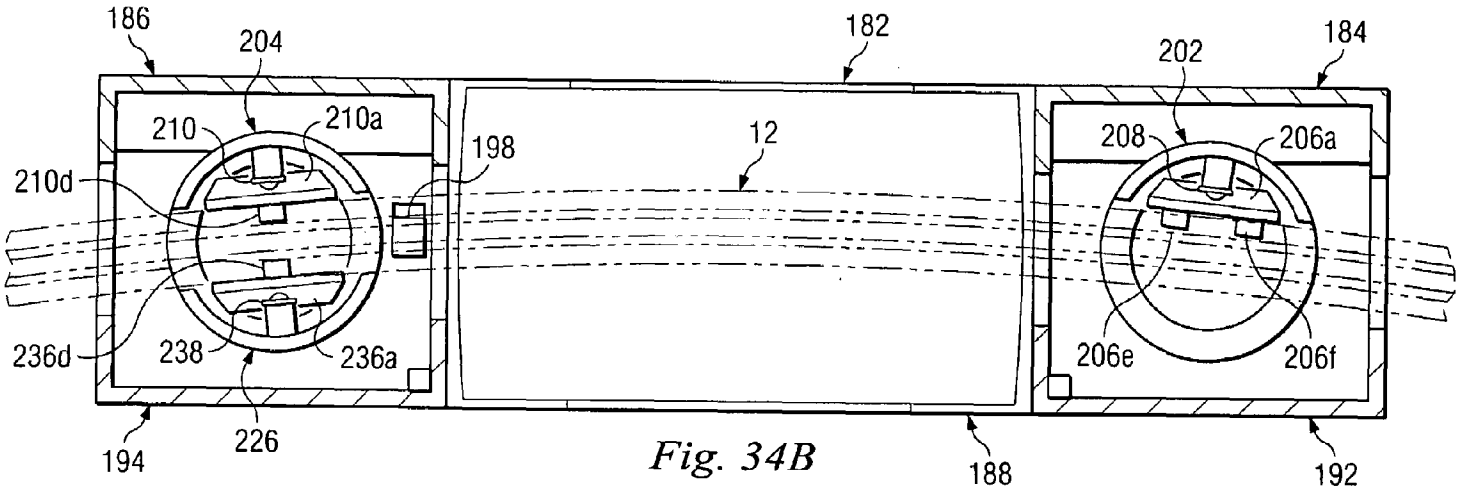
FIG. 34B is a view similar to that of FIG. 34A but depicting the track in a flexed or bent configuration.

In an exemplary embodiment, as illustrated in FIG. 34B, if the track 12 is placed in a flexed or bent configuration so that the track 12 bends towards the ear portions 184 and 186 of the housing 182, the track adapter 202 partially rotates in place in a clockwise direction to accommodate the flexed configuration of the track 12. Moreover, the track adapter 204 partially rotates in place in a counterclockwise direction to accommodate the flexed configuration of the track 12. Moreover, the track adapter 226 partially rotates in place in a counterclockwise direction to accommodate the flexed configuration of the track 12. Also, the biasing elements 208 and 212 are further compressed, and thus continue to providing biasing forces against the contact pads 206*a* and 210*a*, respectively, thereby maintaining the contact between the contacts 206*e*, 206*f* and 210*d*, and the buss bars 26*a*, 26*c* and 26*b*, respectively. Also, the biasing element 238 at least partially decompresses to continue to provide a biasing force against the contact pad 236*a*, thereby maintaining the contact between the contact 236*d* and the buss bar 28*b*.

In several exemplary embodiments, the biasing element 208 generally permits the contact pad 206*a* to float, at least towards or away from the track 12, in response to any irregularities or slight bends along the track 12, or appreciable, intended and/or unintended bends in the track 12, thereby generally maintaining the contact between the contacts 206*e* and 206*f* and the buss bars 26*a* and 26*c*, respectively. That is, the contact pad 206*a* generally accommodates any deflections or bends of the track 12 such as, for example, bending or torsional deflections or bends, thereby generally maintaining the contact between the contacts 206*e* and 206*f* and the buss bars 26*a* and 26*c*, respectively. The biasing element 212 generally permits the contact pad 210*a* to float, at least towards or away from the track 12, in response to any irregularities or slight bends along the track 12, or appreciable, intended and/or unintended bends in the track 12, thereby generally maintaining the contact between the contact 210*d* and the buss bar 26*b*. That is, the contact pad 210*a* generally accommodates any deflections or bends of the track 12 such as, for example, bending or torsional deflections or bends, thereby generally maintaining the contact between the contact 210*d* and the buss bar 26*b*. The biasing element 238 generally permits the contact pad 236*a* to float, at least towards or away from the track 12, in response to any irregularities or slight bends along the track 12, or appreciable, intended and/or unintended bends in the track 12, thereby generally maintaining the contact between the contact 236*d* and the buss bar 28*b*. That is, the contact pad 236*a* generally accommodates any deflections or bends of the track 12 such as, for example, bending or torsional deflections or bends, thereby generally maintaining the contact between the contact 236*d* and the buss bar 28*b*.

Figure 35:
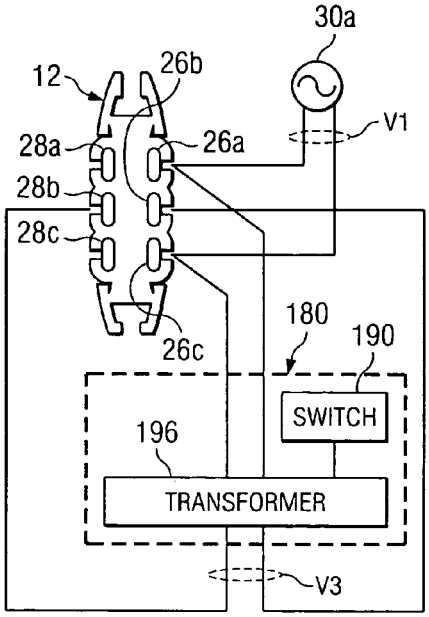
FIG. 35 is a partial sectional/partial diagrammatic view of the transformer assembly and track of FIG. 27.

In an exemplary embodiment, during operation and as illustrated in FIG. 35, the track 12 is supplied with AC electrical power by, for example, the 240V/120V 60-Hz single phase system 30*a* with grounded neutral so that the voltage V1 is generated across the buss bars 26*a* and 26*c* and is equal to a predetermined voltage level such as, for example, 120 volts. In an exemplary embodiment, the buss bar 26*a* serves as a hot conductor, the buss bar 26*c* serves as a neutral conductor, and the protrusion 20 of the track 12 in part provides a ground path. In an exemplary embodiment, the maximum capacity of each of the buss bars 26*a* and 26*c* is 20 A.

AC electrical power is transferred at the voltage V1 from the buss bars 26*a* and 26*c* of the track 12 to the transformer 196 via the contacts 206*e* and 206*f*, respectively, the lugs 206*c* and 206*d*, respectively, and the respective above-described wires that extend between the lugs, 206*c* and 206*d*, and the transformer 196. As a result, the input voltage to the transformer 196 is the voltage V1. The switch 190 is switched to an on position and the transformer 196 operates to output DC electrical power at the voltage V3 in response to the input voltage V1. As a result, the output voltage from the transformer 196 is the voltage V3. DC electrical power is transferred at the voltage V3 from the transformer 196 to the buss bars 26*b* and 28*b* via the respective above-described wires that extend between the transformer 196 and the lugs 210*c* and 236*c*, the lugs 210*c* and 236*c*, respectively, and the contacts 210*d* and 236*d*, respectively. As a result, the voltage V3 is generated across the buss bars 26*b* and 28*b*. In an exemplary embodiment, DC electrical power is transferred at the voltage V3 from the transformer 196 to the buss bars 26*b* and 28*b* so that the voltage V3 is generated across the buss bars 26*b* and 28*b* and is equal to a predetermined value such as, for example, 12 volts. In an exemplary embodiment, the maximum capacity of each of the buss bars 26*b* and 28*b* is 25 A.

Figure 36:
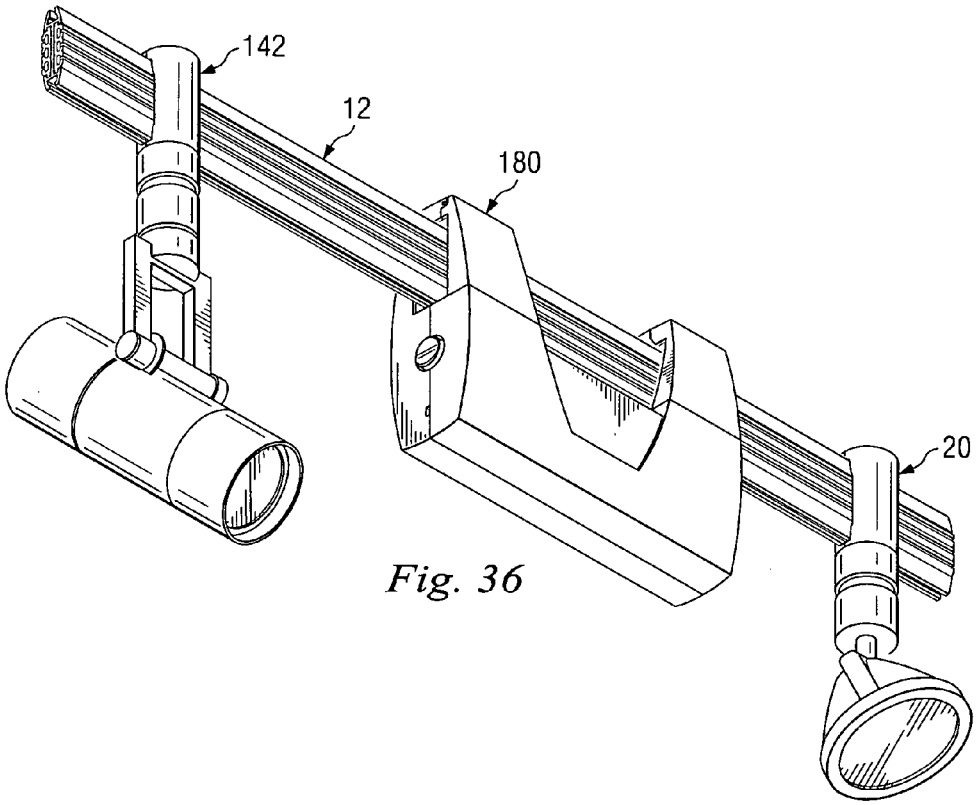
FIG. 36 is a view similar to that of FIG. 27 but depicting the lamp assembly of FIG. 1 and the lamp assembly of FIG. 25 coupled to the track.

In an exemplary embodiment, as illustrated in FIG. 36, other devices may be coupled to the track 12, in addition to the transformer assembly 180. For example, the lamp assembly 20 is coupled to the track 12 so that the contacts 58*n* and 58*m* of the attachment 134 of the lamp assembly 20 contact the buss bars 26*a* and 26*b*, respectively, in a manner similar to the above-described manner in which the lamp assembly 20 is coupled to the track 12 so that the contacts 58*n* and 58*m* contact the buss bars 28*a* and 28*c*, respectively. The lamp assembly 142 is also coupled to the track 12 so that the contacts 92*i* and 98*e* of the attachment 144 contact the buss bars 28*b* and 26*b*, respectively, as described above.

In an exemplary embodiment, during operation and as illustrated in FIG. 36, the voltage V1 is generated across the buss bars 26*a* and 26*c*, in one or more of the manners described above, or any combination thereof, and the lamp assembly 20 operates at the voltage V1. In an exemplary embodiment, the voltage V1 may be 120 volts. Moreover, the transformer assembly 196 operates in the manner described above, receiving AC electrical power at the input voltage V1 via in part the buss bars 26*a* and 26*c*, and transferring DC electrical power at the output voltage V3 to the buss bars 26*b* and 28*b*. As a result, the lamp assembly 142 operates at the voltage V3. In an exemplary embodiment, the voltage V3 may be 12 volts. In several exemplary embodiments, the voltage V1 may be generated across the buss bars 26*a* and 26*c* via, for example, the system 30*a*, one or more of the power assemblies 14, 74, 102 and 104, and/or any combination thereof.

In several exemplary embodiments, the switch 190 may be removed from the transformer assembly 180. In exemplary embodiment, the switch 190 may be removed from the transformer assembly 180 so that the transformer assembly 180 immediately operates in the above-described manner when the transformer 196 is coupled to the track 12. In an exemplary embodiment, the switch 190 may be removed from the transformer assembly 180 and the operation of the transformer 196 may be controlled in another manner such as, for example, by remote control.

In an exemplary embodiment, the transformer assembly 180 may be removed from the track 12, rotated 180 degrees about an imaginary vertical center axis, and coupled to the track 12 in a manner similar to that described above so that the contacts 206*e* and 206*f* contact the buss bars 28*a* and 28*c*, respectively, and so that the contacts 210*d* and 236 contact the buss bars 28*b* and 26*b*, respectively. As a result, during operation of the transformer assembly 180, the voltage V2 is the input voltage to the transformer 196 and the voltage V3 is the output voltage from the transformer 196. In an exemplary embodiment, the transformer assembly 180 is removed by placing the covers 192 and 194 in their respective open or unlocked configurations, as described above, and removing the transformer assembly 180 from the track 12.

Figure 37:
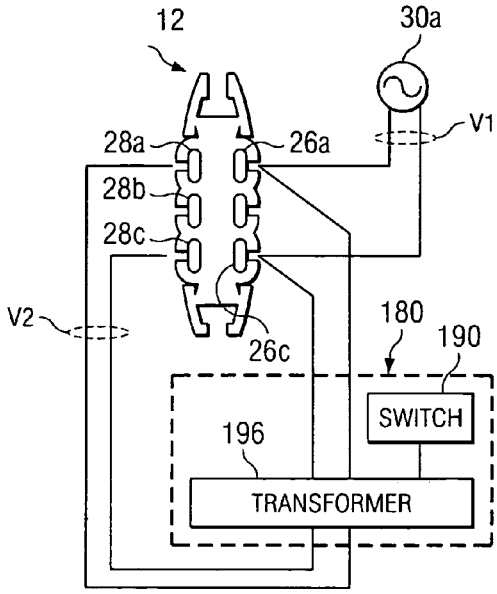
FIG. 37 is a view similar to that of FIG. 35 but depicting an alternative electrical coupling between the transformer assembly and track of FIG. 27.

In several exemplary embodiments, the positions of the contacts 206*e*, 206*f*, 210*d* and 236*d* may be modified, one or more of the contact pad assemblies 206, 210 and 236 may be removed, and/or one or more additional contact pad assemblies with contacts may be added to the transformer assembly 180, in order to vary the input voltage to the transformer 196 and/or the output voltage from the transformer 196, and/or to vary the one or more pairs of buss bars 26*a*, 26*b*, 26*c*, 28*a*, 28*b* and/or 28*c* across which a voltage is generated. Moreover, in several exemplary embodiments, the transformer 196 may be in the form of an AC-to-DC transformer, an AC-to-AC transformer or any combination thereof. In an exemplary embodiment, the transformer 196 may be in the form of a DC-to-AC power inverter or converter. For example, as illustrated in FIG. 37, the buss bars 26*a* and 26*c* may be electrically coupled to the system 30*a*, in a manner similar to that described above, so that the voltage V1 is generated across the buss bars 26*a* and 26*c*. The transformer 196 may be electrically coupled to the buss bars 28*a* and 28*c* via, for example, a contact pad assembly that is substantially similar to the contact pad assembly 206. As a result, during operation, AC electrical power is transferred at the voltage V1 from the buss bars 26*a* and 26*c* of the track 12 to the transformer 196 via the contacts 206*e* and 206*f*, respectively, the lugs 206*c* and 206*d*, respectively, and the respective above-described wires that extend between the lugs, 206*c* and 206*d*, and the transformer 196. As a result, the input voltage to the transformer 196 is the voltage V1. The switch 190 is switched to an on position and the transformer 196 operates to output, for example, AC electrical power at the voltage V2 in response to the input voltage V1. As a result, the output voltage from the transformer 196 is the voltage V2. AC electrical power is transferred at the voltage V2 from the transformer 196 to the buss bars 28*a* and 28*c*. As a result, the voltage V2 is generated across the buss bars 26*b* and 28*b*.

Figure 38:
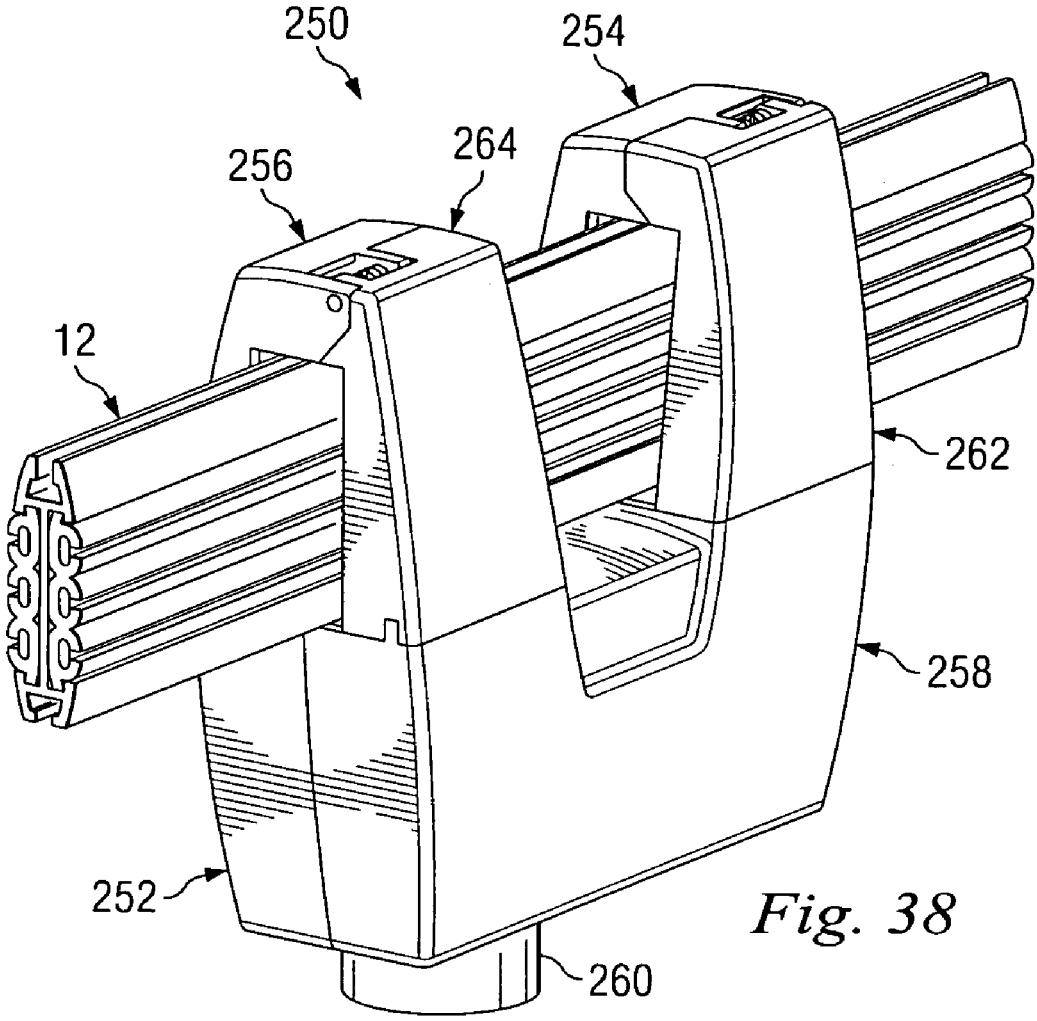
FIG. 38 is a perspective view of a transformer assembly according to an another embodiment and coupled to the track of FIG. 1, with the transformer assembly including covers in an operational position.

In an exemplary embodiment, as illustrated in FIG. 38, a transformer assembly is generally referred to by the reference numeral 250 and is coupled to the track 12. The transformer assembly 250 includes a housing 252 having ear portions 254 and 256. A housing 258 is connected to the housing 252. A connector 260 engages and extends downward from the housings 252 and 258. Covers 262 and 264 are hingedly connected to the ear portions 254 and 256, respectively.

Figure 39:
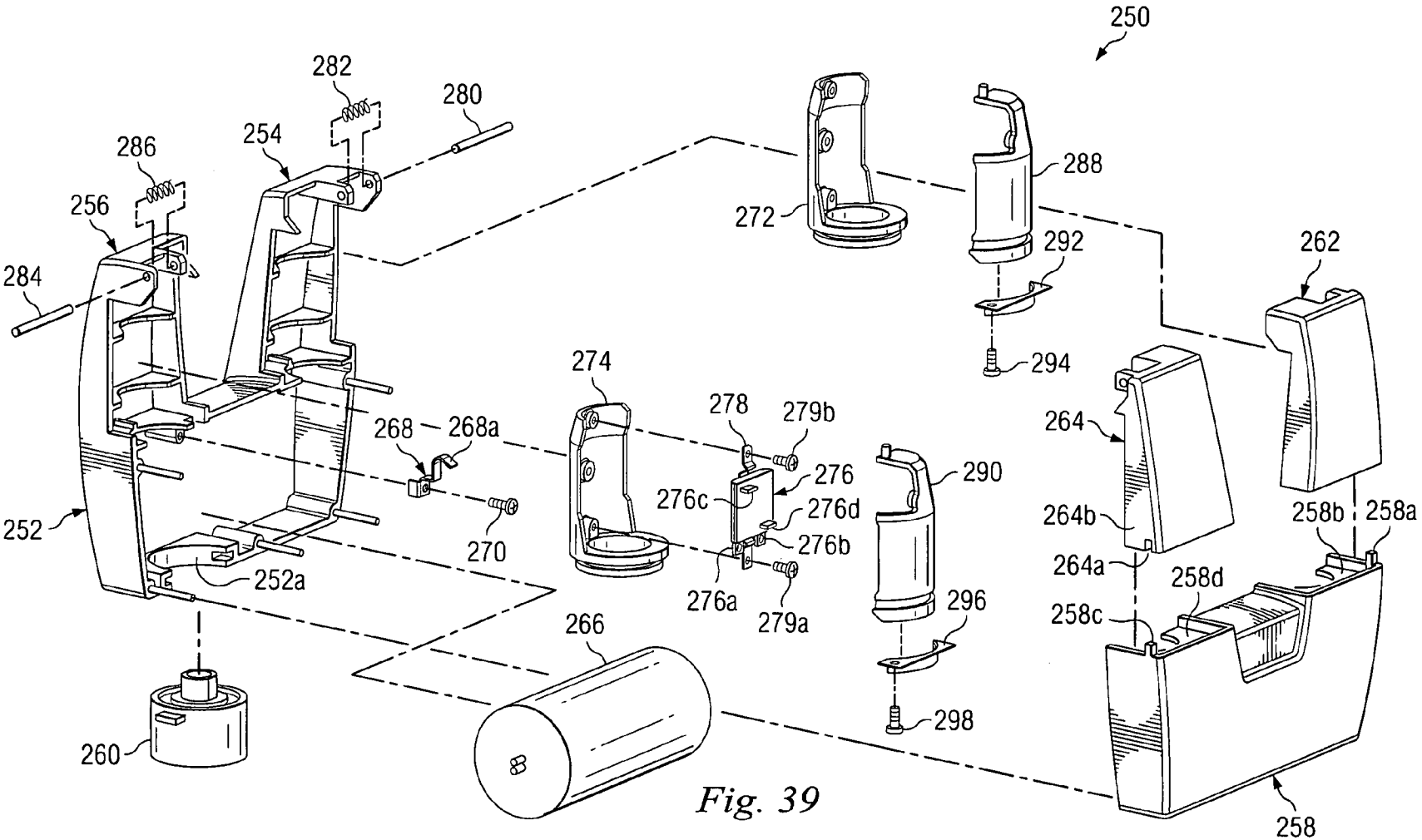
FIG. 39 is an exploded view of the transformer assembly of FIG. 38.
Figure 40A:
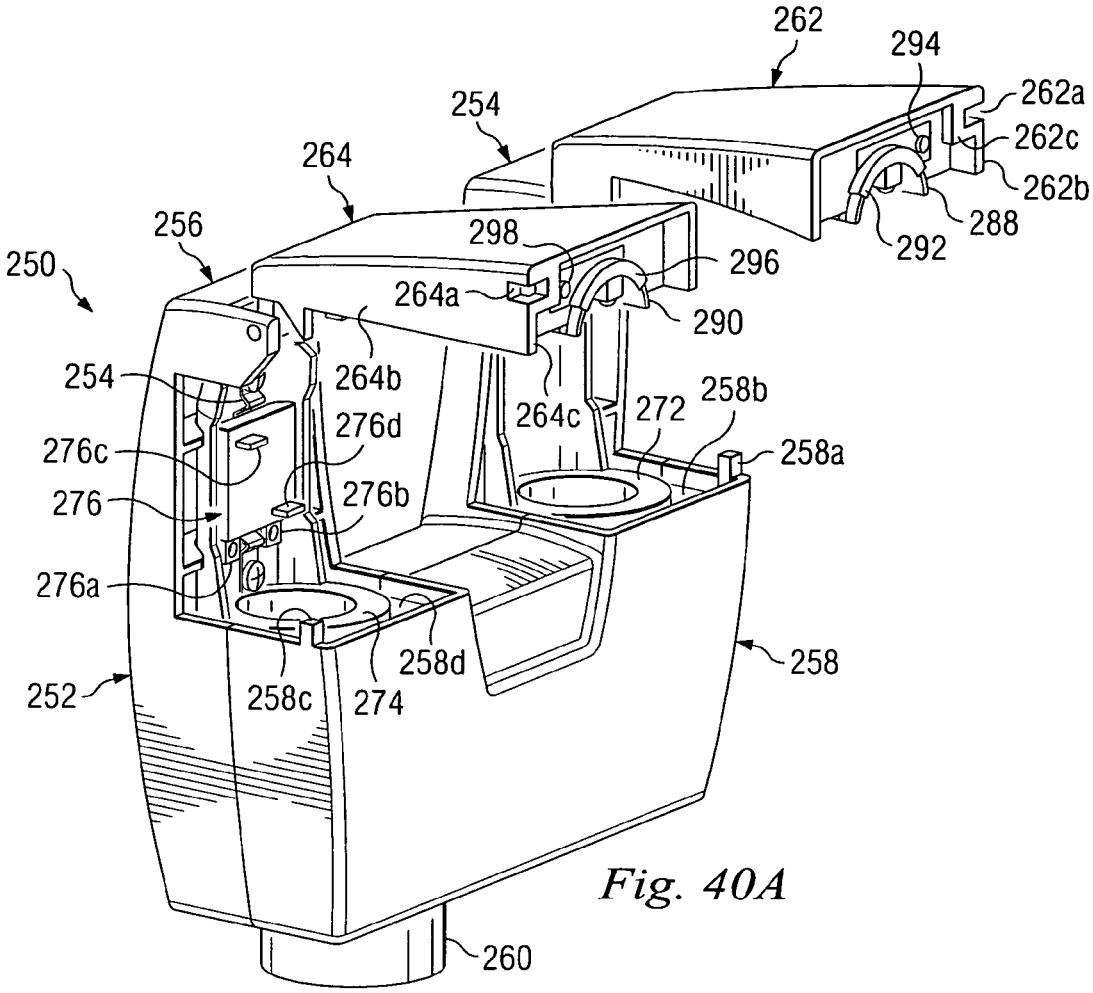
FIG. 40A is a perspective view of the transformer assembly of FIG. 38 depicting the covers in another operational position.
Figure 40B:
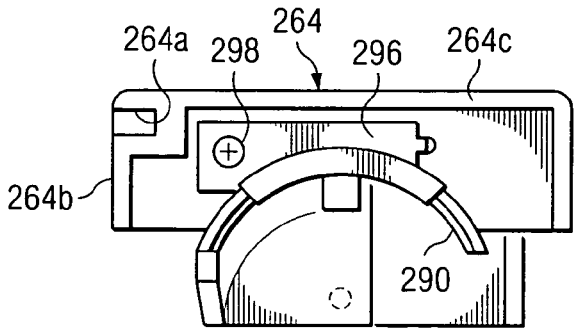
FIG. 40B is an end view of a cover of the transformer assembly of FIG. 38.
Figure 40C:
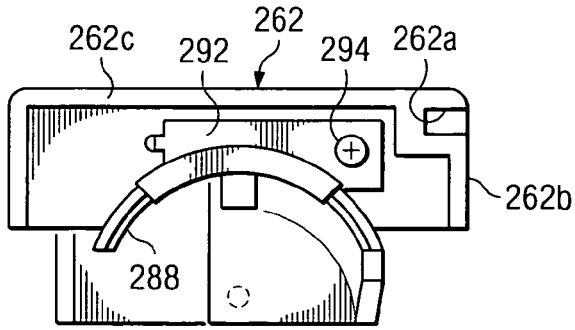
FIG. 40C is an end view of the other cover of the transformer assembly of FIG. 38.

In an exemplary embodiment, as illustrated in FIGS. 39, 40A and 40B, a transformer 266 is enclosed within the housings 252 and 258, and is electrically coupled to the connector 260, which extends within an arcuate notch 252*a* in the housing 252 and within an arcuate notch in the housing 258 that is symmetric to the arcuate notch 252*a* and not shown. In an exemplary embodiment, the transformer 266 may be in the form of a 50 W transformer. A ground clip 268 having a curved portion 268*a* is connected to the housing 252 via a fastener 270.

The ear portion 254 of the housing 252 of the transformer assembly 250 is similar to the ear portion 184 of the housing 182 of the transformer assembly 180 and therefore will not be described in detail. The ear portion 256 of the housing 252 of the transformer assembly 250 is similar to the ear portion 186 of the housing 182 of the transformer assembly 180 and therefore will not be described in detail, except that the ear portion 256 does not include arcuate notches that are similar to the arcuate notches 186*k* and 186*l* of the ear portion 186.

Track adapters 272 and 274 are received by the ear portions 254 and 256 in a manner similar to the above-described manner in which the track adapters 202 and 204 are received by the ear portions 184 and 186 of the transformer assembly 180, and therefore this receipt will not be described in detail. The track adapters 272 and 274 are similar to the track adapters 202 and 204, respectively, of the transformer assembly 180 and therefore will not be described in detail. Moreover, the capturing and coupling of the track adapters 272 and 274 to the housings 252 and 258 is substantially similar to the capturing and coupling of the track adapters 202 and 204 to the housings 182 and 188, respectively, and therefore will not be described in detail.

The track adapters 272 and 274 are each permitted to at least partially rotate in place, relative to the housings 252 and 258, over a predetermined circumferential range, in a manner similar to which the track adapters 202 and 204, respectively, of the transformer assembly 180 are each permitted to at least partially rotate in place, and therefore the definitions of the circumferential ranges of partial rotation of the track adapters 272 and 274 will not be described in detail.

A contact pad assembly 276 is coupled to a biasing element 278, which, in turn, is connected to the track adapter 274 via fasteners 279*a* and 279*b*. The contact pad assembly 276 includes lugs 276*a* and 276*b* that define contacts 276*c* and 276*d*, respectively. The contact pad assembly 276, the biasing element 278, and the coupling therebetween, are similar to the contact pad assembly 206, the biasing element 208, and the coupling therebetween, respectively, of the transformer assembly 180, and therefore will not be described in detail. Although not shown, respective wires extend from the lugs 276*a* and 276*b*, extend through the track adapter 274, and are electrically coupled to the transformer 266.

As noted above, the covers 262 and 264 are hingedly connected to the ear portions 254 and 256, respectively, of the housing 252. More particularly, the cover 262 is hingedly connected to the ear portion 254, via a pin 280 and a spring 282, in a manner similar to the manner in which the cover 192 is hingedly connected to the ear portion 184 of the transformer assembly 180, and therefore the hinged connection between the cover 262 and the ear portion 254 will not be described in detail. The cover 264 is hingedly connected to the ear portion 256, via a pin 284 and a spring 286, in a manner similar to the manner in which the cover 184 is hingedly connected to the ear portion 186 of the transformer assembly 180, and therefore the hinged connection between the cover 264 and the ear portion 256 will not be described in detail.

The cover 262 includes a notch 262*a* in a side wall 262*b* and an end wall 262*c*, and the cover 264 includes a notch 264*a* formed in a side wall 264*b* and an end wall 264*c*. The remaining features of the covers 262 and 264 are similar to corresponding features of the covers 192 and 194, respectively, of the transformer assembly 180, and therefore will not be described in detail.

The transformer assembly 250 further includes track adapters 288 and 290 that are similar to the track adapters 224 and 226, respectively, of the transformer assembly 180, and therefore will not be described in detail. The track adapters 288 and 290 are received by the covers 262 and 264, respectively, in a manner similar to the manner in which the track adapters 224 and 226 are received by the covers 192 and 194, respectively, of the transformer assembly 180.

A clip 292 is connected to the cover 262 via in part a fastener 294, in a manner similar to the manner in which the clip 228 is connected to the cover 192 via in part the fastener 230 of the transformer assembly 180, and therefore the connection between the clip 292 and the cover 262 will not be described in detail. A clip 296 is connected to the cover 264 via in part a fastener 298, in a manner similar to the manner in which the clip 232 is connected to the cover 194 via in part the fastener 234 of the transformer assembly 180, and therefore the connection between the clip 296 and the cover 264 will not be described in detail. The clips 292 and 296 are similar to the clips 228 and 232, respectively, of the transformer assembly 180 and therefore will not be described in detail.

The track adapters 288 and 290 are each permitted to at least partially rotate in place, relative to the covers 262 and 264, respectively, over a predetermined circumferential range, in a manner similar to which the track adapters 224 and 226, respectively, of the transformer assembly 180 are each permitted to at least partially rotate in place, and therefore the definitions of the circumferential ranges of partial rotation of the track adapters 288 and 290 will not be described in detail.

The housing 258 includes a protrusion 258*a* that extends upward from a horizontally-extending portion 258*b*, and a protrusion 258*c* that extends upward from a horizontally-extending portion 258*d*. The protrusions 258*a* and 258*c* are adapted to engage the covers 262 and 264, respectively, under conditions to be described.

Figure 41:
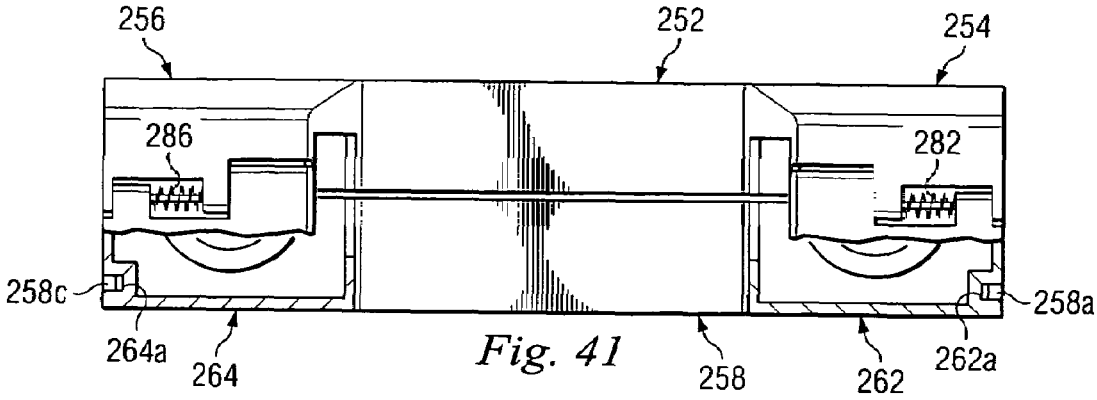
FIG. 41 is a simplified partial sectional/partial top plan view of the transformer assembly of FIG. 38, with the covers of the transformer assembly in the same operational positions as depicted in FIG. 38.

In an exemplary embodiment, the transformer assembly 250 is coupled to the track 12 as illustrated in FIGS. 41, 42A, 42B, 43A and 43B. As illustrated in FIG. 41, the covers 262 and 264 may each be initially in a closed or locked configuration in which the protrusion 258*a* extends into the notch 262*a*, and the protrusion 258*c* extends into the notch 264*a*. As a result, the covers 262 and 264 are locked, that is, prevented from rotating in a counterclockwise direction, about the pins 280 and 284, respectively, and away from the housing 258. Also, the spring 282 may be partially compressed and therefore may apply a biasing force against the both the cover 262 and the ear portion 254, resisting any unwanted translation or play of the cover 262 relative to the housings 252 and 258. Similarly, the spring 286 may be partially compressed and therefore may apply a biasing force against the cover 264 and the ear portion 256, resisting any unwanted translation or play of the cover 264 relative to the housings 252 and 258.

Figure 42A:
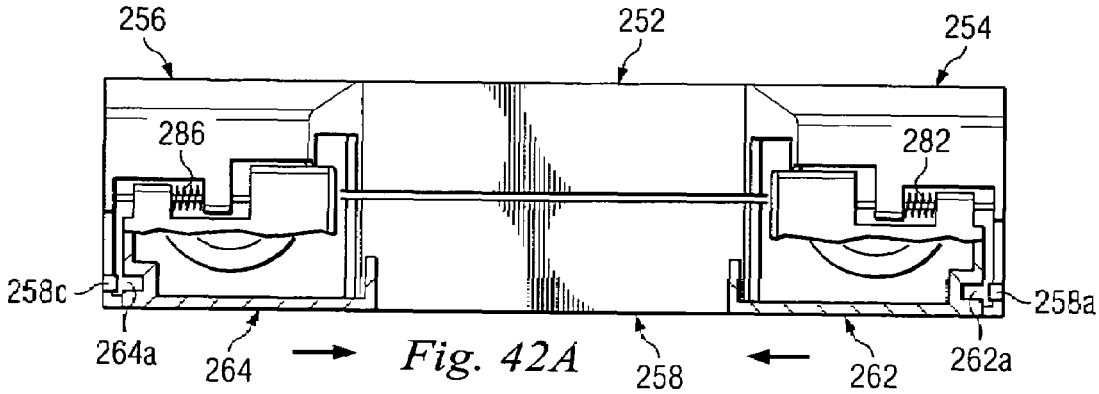
FIG. 42A is a view similar to that of FIG. 41 but depicting other operational positions of the covers of the transformer assembly of FIG. 38.
Figure 42B:
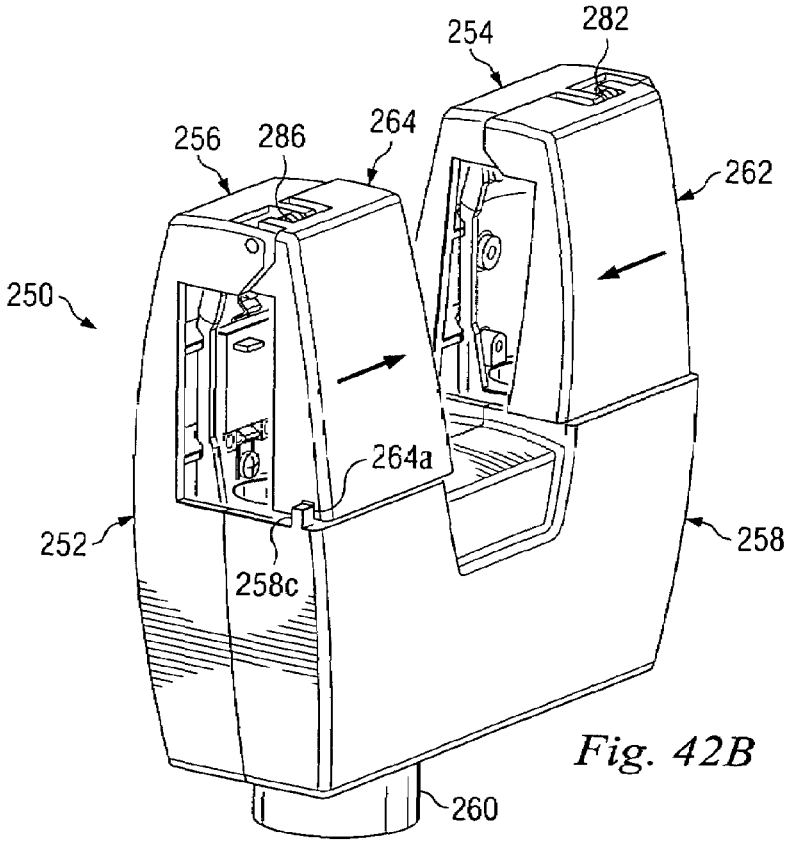
FIG. 42B is a perspective view of the transformer assembly of FIG. 38 and depicts the same operational positions of the covers that are depicted in FIG. 42A.

In an exemplary embodiment, as illustrated in FIGS. 42A and 42B, the covers 262 and 264 are each placed in an open or unlocked configuration by an operator first translating or sliding the covers 262 and 264 towards each other. More particularly, the cover 262 is translated in a direction towards the cover 264, in the right-to-left direction as viewed in FIG. 42A, so that the spring 282 is compressed or further compressed between the cover 262 and the ear portion 254, and so that the protrusion 258*a* no longer extends within the notch 262*a*. Similarly, the cover 264 is translated in a direction towards the cover 262, in the left-to-right direction as viewed in FIG. 42A, so that the spring 286 is compressed or further compressed between the cover 264 and the ear portion 256, and so that the protrusion 258*c* no longer extends within the notch 264*a*. In an exemplary embodiment, the cover 264 may be slid or translated before, during or after the translation of the cover 262.

Figure 43A:
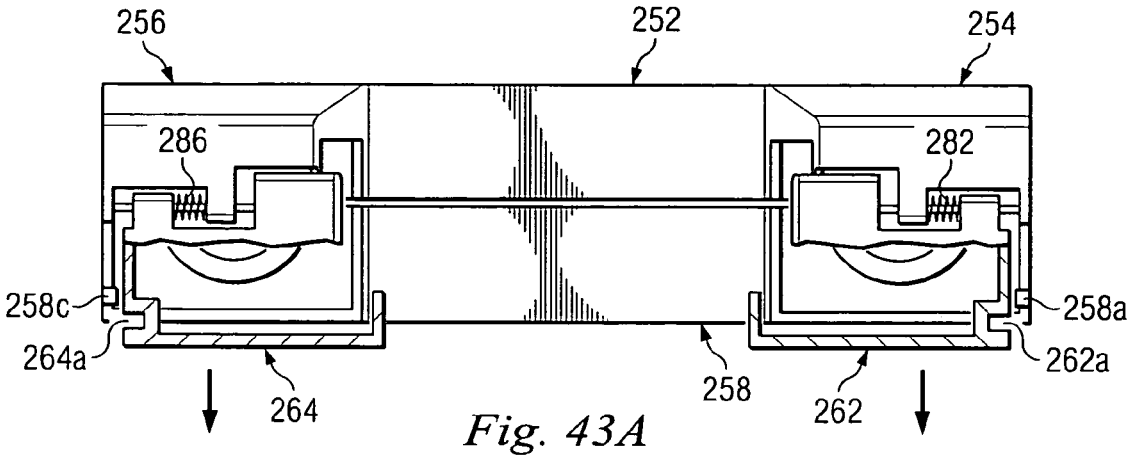
FIG. 43A is a view similar to that of FIG. 41 but depicting yet other operational positions of the covers of the transformer assembly of FIG. 38.
Figure 43B:
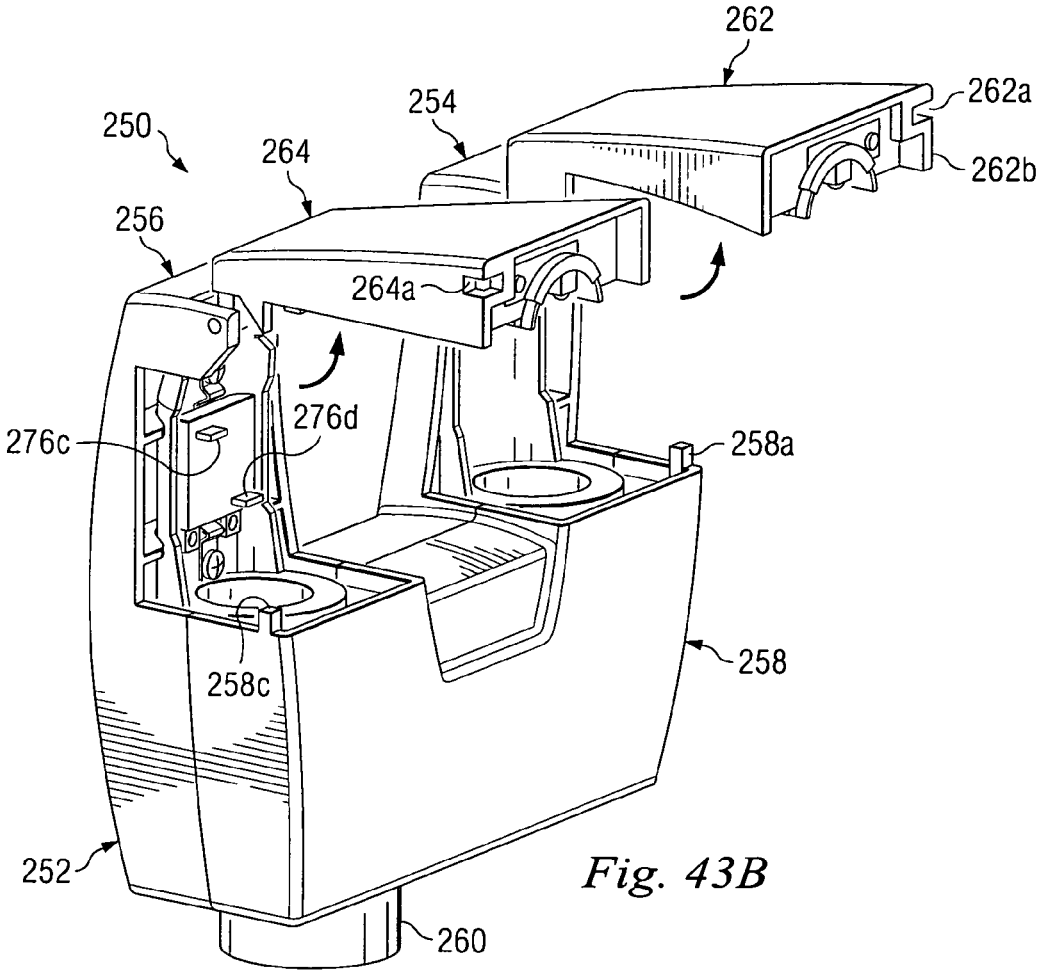
FIG. 43B is a perspective view of the transformer assembly of FIG. 38 and depicts the same operational positions of the covers that are depicted in FIG. 43A.

In an exemplary embodiment, as illustrated in FIGS. 43A and 43B, the covers 262 and 264 are then rotated in a counterclockwise direction, about the pins 280 and 284, respectively, so that the notches 262*a* and 264*a* rotate past or beyond the protrusions 258*a* and 258*c*, respectively, in the top-to-bottom direction as viewed in FIG. 43A, while maintaining the compressed states of the spring 282 and 286, respectively. In an exemplary embodiment, the cover 264 may rotated in this manner before, during or after the rotation of the cover 262 in this manner.

Once the notches 262*a* and 264*a* of the covers 262 and 264, respectively, have been rotated past or beyond the protrusions 258*a* and 258*c*, respectively, of the housing 258, the rotation of the covers 262 and 264 may be continued, with or without maintaining the compressed states of the springs 282 and 286, respectively. If the cover 262 is released so that the spring 282 returns to its initial uncompressed or partially compressed state, then the extension of the spring 282 causes the cover 262 to translate back to its original position, relative to the ear portion 254, except that the cover 262 remains in an open or unlocked configuration because the notch 262*a* remains positioned past or beyond the protrusion 258*a*. Similarly, if the cover 264 is released so that the spring 286 returns to its initial uncompressed or partially compressed state, then the extension of the spring 286 causes the cover 264 to translate back to its original position, relative to the ear portion 256, except that the cover 264 remains in an open or unlocked configuration because the notch 264*a* remains positioned past or beyond the protrusion 258*c*. In an exemplary embodiment, the rotation of the cover 264 may be continued before, during or after the continued rotation of the cover 262. In an exemplary embodiment, the cover 264 may be released, and therefore the spring 286 may decompress, before, during or after the release of the cover 262, and therefore the decompression of the spring 282.

When the covers 262 and 264 are each in the open or unlocked configuration, the transformer assembly 250 is coupled to the track 12. The transformer assembly 250 is positioned so that the contacts 276*c* and 276*d* extend into the channels 22*a* and 22*c*, respectively, of the liner 22, and contact or nearly contact the buss bars 26*a* and 26*c*, respectively. During this positioning, the covers 262 and 264 are each manipulated and/or maintained in a rotated state so as to not interfere with the contact between the contacts 276*c* and 276*d* and the buss bars 26*a* and 26*c*, respectively. In an exemplary embodiment, when the transformer assembly 250 is positioned against the track 12, the transformer assembly 250 may hang from the track 12 by the ear portions 254 and 256 of the housing 252. In an exemplary embodiment, when the transformer assembly 250 is positioned against the track 12, the transformer assembly 250 may hang from the track 12 by the ear portions 254 and 256 of the housing 252, and/or the covers 262 and 264.

After the transformer assembly 250 has been positioned against the track 12 as described above, the covers 262 and 264 are each placed in the closed or locked position by performing, in reverse, the above-described procedure for placing the covers 262 and 264 in the open or unlocked configuration. The cover 264 may be placed in the closed or locked configuration before, during or after the placing of the cover 262 in the closed or locked configuration. In an exemplary embodiment, an operator may place the covers 262 and 264 in their respective closed configurations without the use of one or more tools, that is, without the use of, for example, a screwdriver, an allen wrench, another type of wrench, etc., thereby toollessly coupling the transformer assembly 250 to the track 12.

Figure 44B:
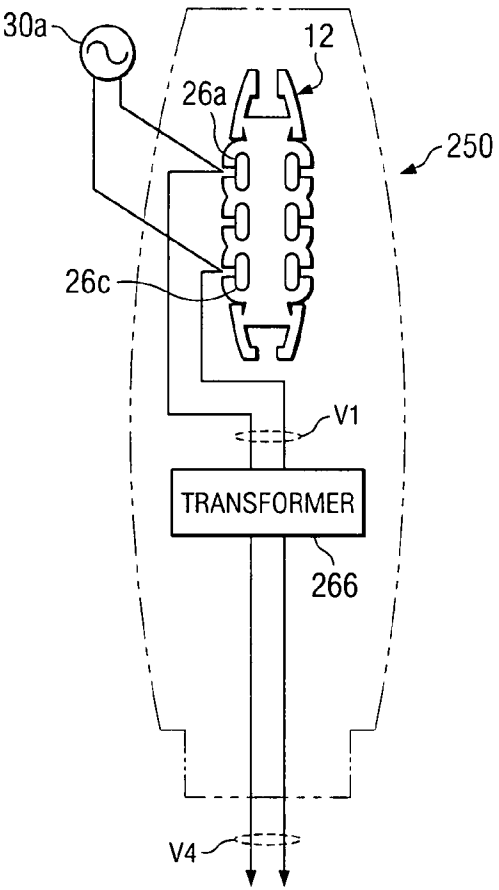
FIG. 44B is a partial sectional/partial diagrammatic view of the transformer assembly and track of FIG. 38, and is similar to FIG. 44A.
Figure 44A:
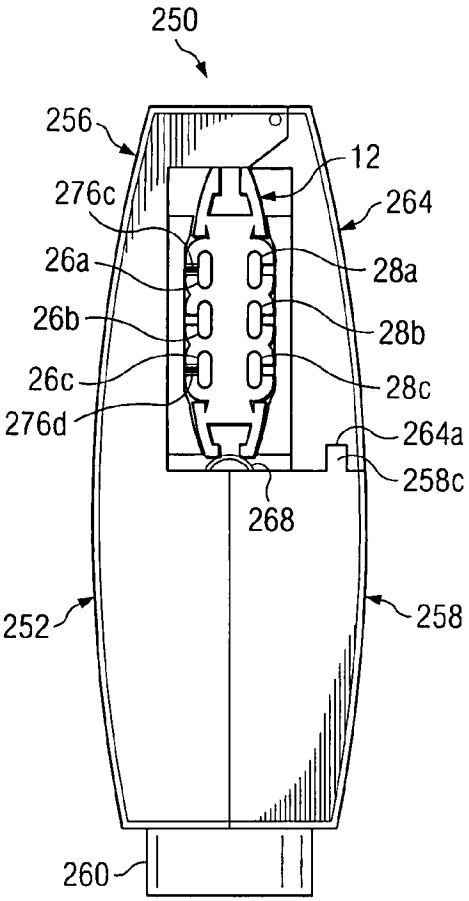
FIG. 44A is an elevational view of one end of the transformer assembly and track of FIG. 38.

In an exemplary embodiment, as illustrated in FIG. 44A, after the transformer assembly 250 has been coupled to the track 12 and the covers 262 and 264 are in their respective closed or locked configurations, the contacts 276*c* and 276*d* contact the buss bars 26*a* and 26*c*, respectively. As a result, the biasing element 278 is partially compressed in a direction away from the track 12, providing a biasing force to force the contacts 276*c* and 276*d* against the buss bars 26*a* and 26*c*, respectively, to effect sufficient contact therebetween. Also, the curved portion 268*a* of the ground clip 268 contacts the protrusions 20*e* and/or 20*f* of the protrusion 20 of the track 12, thereby providing a ground path between the transformer assembly 250 and the track 12.

If the track 12 is placed in a flexed or bent configuration, the track adapter 274 partially rotates in place, in either a clockwise or counterclockwise direction depending upon the direction in which the track 12 flexed or bent, in order to accommodate the flexed configuration of the track 12. If the track 12 is bent towards the contact pad assembly 276, then the biasing element 278 further compresses, and thus continues to provide a biasing force to maintain the contact between the contacts 276*c* and 276*d* and the buss bars 26*a* and 26*c*, respectively. If the track 12 is bent away from the contact pad assembly 276, then the biasing element 278 at least partially decompresses to continue to provide a biasing force, thereby maintaining the contact between the contacts 276*c* and 276*d* and the buss bars 26*a* and 26*c*, respectively.

In several exemplary embodiments, the biasing element 278 generally permits the contact pad of the contact pad assembly 276 to float, at least towards or away from the track 12, in response to any irregularities or slight bends along the track 12, or appreciable, intended and/or unintended bends in the track 12, thereby generally maintaining the contact between the contacts 276*c* and 276*d* and the buss bars 26*a* and 26*c*, respectively. That is, the contact pad of the contact pad assembly 276 generally accommodates any deflections or bends of the track 12 such as, for example, bending or torsional deflections or bends, thereby generally maintaining the contact between the contacts 276*c* and 276*d* and the buss bars 26*a* and 26*c*, respectively.

In an exemplary embodiment, during operation and as illustrated in FIG. 44B, the track 12 is supplied with AC electrical power by, for example, the system 30*a* so that the voltage V1 is generated across the buss bars 26*a* and 26*c* and is equal to a predetermined value such as, for example, 120 volts. AC electrical power is transferred at the voltage V1 from the buss bars 26*a* and 26*c* of the track 12 to the transformer 266 via the contacts 276*c* and 276*d*, respectively, the lugs 276*a* and 276*b*, respectively, and the respective above-described wires that extend between the lugs, 276*a* and 276*b*, and the transformer 266. As a result, the input voltage to the transformer 266 is the voltage V1. In response to the input voltage V1, the transformer 266 may operate to output DC electrical power at a voltage V4. DC electrical power may be transferred at the voltage V4 from the transformer 266 to an element, which may be coupled to the connector 260 and is not shown.

In an exemplary embodiment, the transformer assembly 250 may be removed from the track 12, rotated 180 degrees about an imaginary vertical center axis, and coupled to the track 12 in a manner similar to that described above so that the contacts 276*c* and 276*d* contact the buss bars 28*a* and 28*c*, respectively. As a result, during operation of the transformer assembly 250, the voltage V2 is the input voltage to the transformer 266. In an exemplary embodiment, the transformer assembly 180 is removed by placing the covers 192 and 194 in their respective open or unlocked configurations, as described above, and removing the transformer assembly 180 from the track 12.

In several exemplary embodiments, the positions of the contact pad assembly 276, and/or the contacts 276*c* and 276*d* may be modified. Moreover, in several exemplary embodiments, the transformer 266 may be in the form of an AC-to-DC transformer, an AC-to-AC transformer or any combination thereof. In an exemplary embodiment, the transformer 266 may be in the form of a DC-to-AC power inverter or converter.

Figure 45:
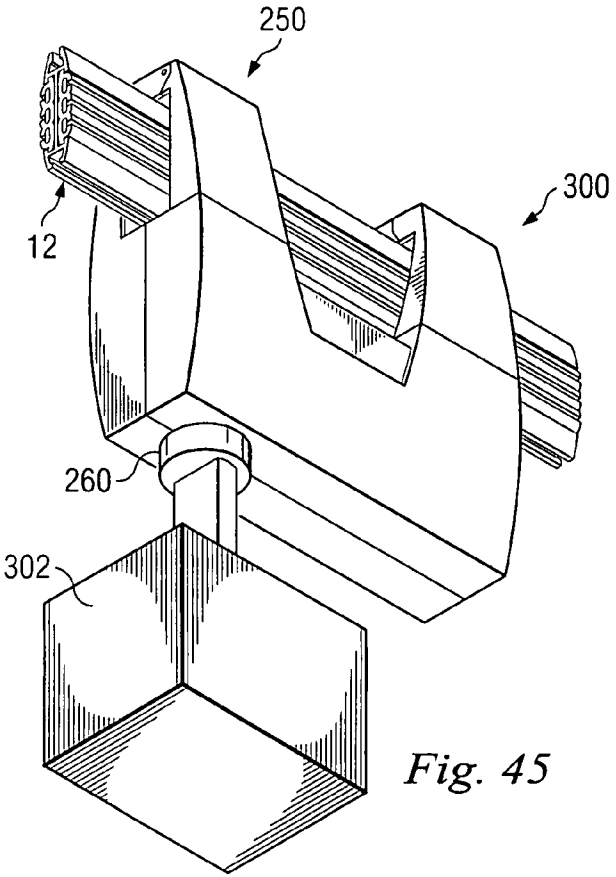
FIG. 45 is a perspective view of a lighting system according to another embodiment.

In an exemplary embodiment, as illustrated in FIG. 45, a lighting system is generally referred to by the reference numeral 300 and includes the transformer assembly 250, which is coupled to the track 12 in the above-described manner. An element 302 is coupled to the transformer assembly 250 at the connector 260. In operation, the track 12 transfers AC electrical power to the transformer 266 of the transformer assembly 250 in the above-described manner at the voltage V1. In response, the transformer 266 of the transformer assembly 250 outputs DC electrical power at the voltage V4, thereby carrying electrical power to the element 302 at the voltage V4. As a result, the element 302 is electrically powered and operates at the voltage V4. In several exemplary embodiments, the element 302 may be in the form of, for example, a lamp assembly, a clock, any of the above-described assemblies or components thereof, any other type of device, and/or any combination thereof.

Figure 46:
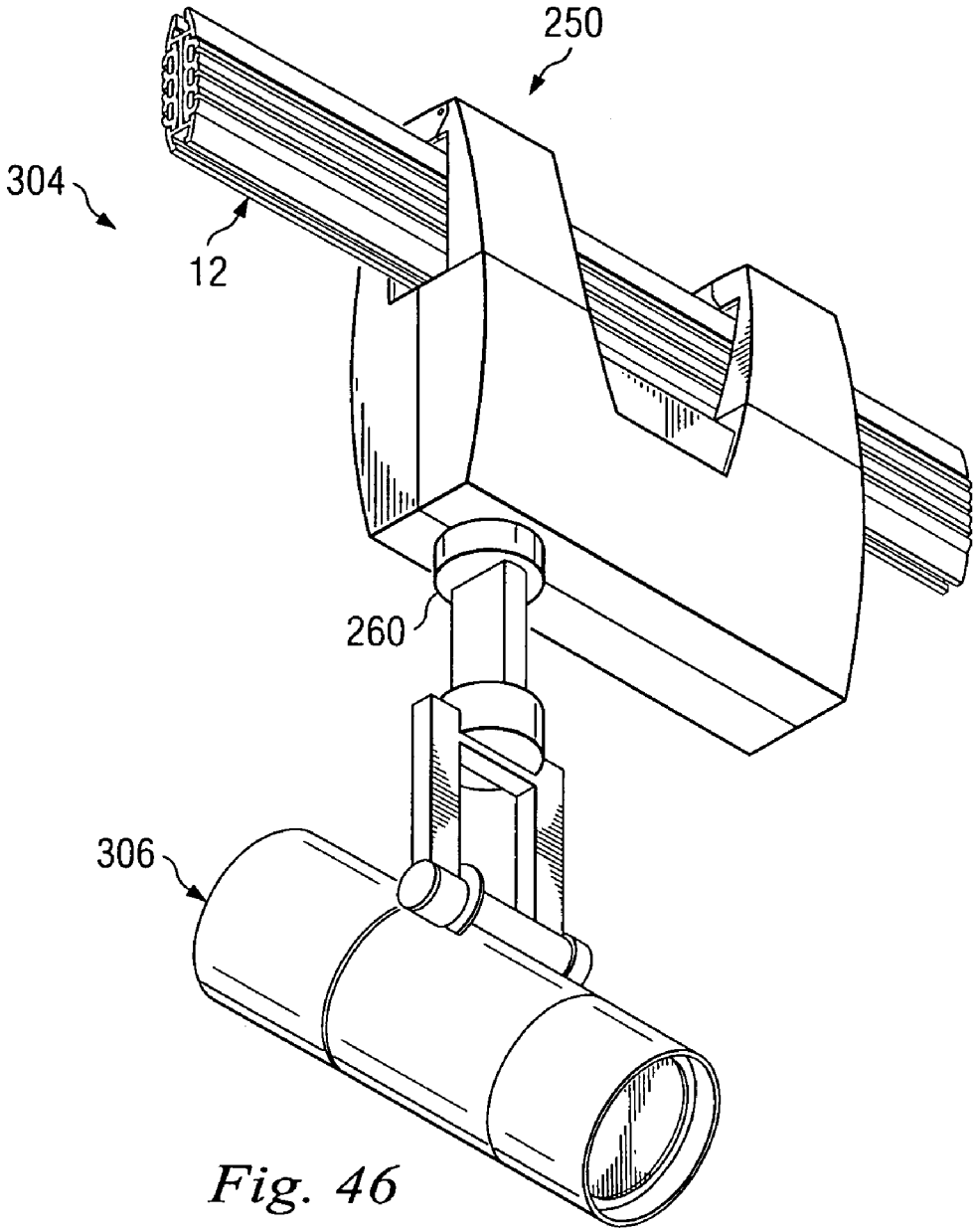
FIG. 46 is a perspective view of a lighting system according to another embodiment.

In an exemplary embodiment, as illustrated in FIG. 46, a lighting system is generally referred to by the reference numeral 304 and includes the transformer assembly 250, which is coupled to the track 12 in the above-described manner. A lamp assembly 306 is coupled to the transformer assembly 250 at the connector 260. In operation, the track 12 transfers AC electrical power to the transformer 266 of the transformer assembly 250 in the above-described manner at the voltage V1. In response, the transformer 266 of the transformer assembly 250 outputs DC electrical power at the voltage V4, thereby carrying electrical power to the lamp assembly 306 at the voltage V4. As a result, the lamp assembly 306 is electrically powered and operates at the voltage V4.

In several exemplary embodiments, the relative scale between, and/or the sizes of, the transformer assemblies 180 and 250, and any one or more components thereof, may be modified so that the size of one of the transformer assemblies is larger than the other, or vice versa. For example, the transformer assembly 250 and the components thereof, including the components that are similar to corresponding components of the transformer assembly 180 as described above, may be sized to have a smaller scale than the transformer assembly 180 and the components thereof. Also, it is understood that actual voltage levels of the above-described voltages may be less due to any power losses and/or voltage drops in the above-described electrical circuits such as, for example, power losses and/or voltage drops across any of the above-described contacts, lugs and/or wires.

In several exemplary embodiments, for one or more of the transformer assemblies 180 and 250, any one of the above-described contact pad assemblies 206, 210, 236 and 276 may be replaced by any one other of the above-described contact pad assemblies 206, 210, 236 and 276, or a modified, enlarged or scaled-down version thereof. Moreover, in several exemplary embodiments, one or more of the above-described track adapters 202, 204, 224, 226, 272, 274, 288 and 290 may receive any one of the above-described contact pad assemblies 206, 210, 236 and 276, or a modified, enlarged or scaled-down version thereof.

Figure 47:
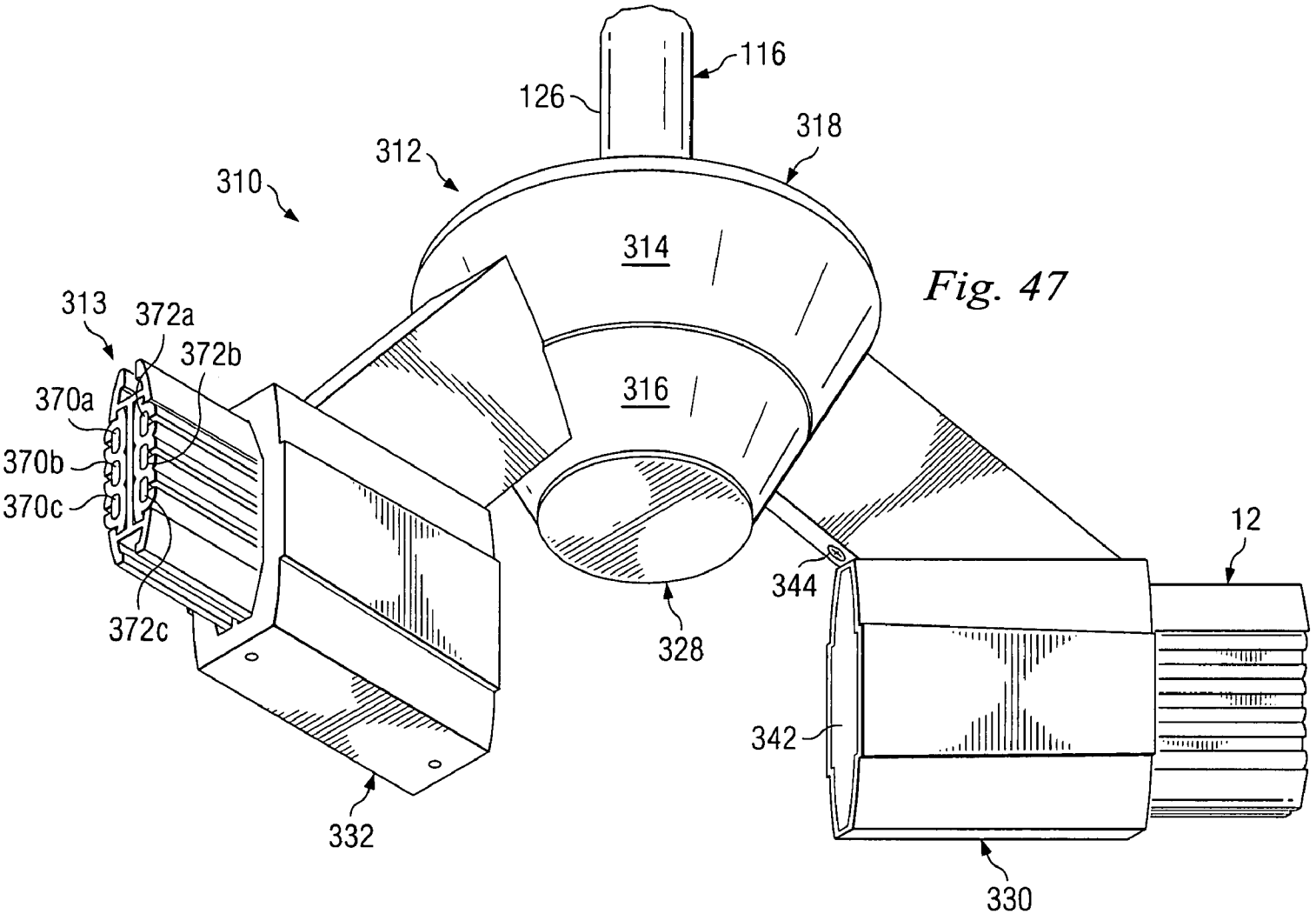
FIG. 47 is a perspective view of a track-connection system according to an embodiment.
Figure 48:
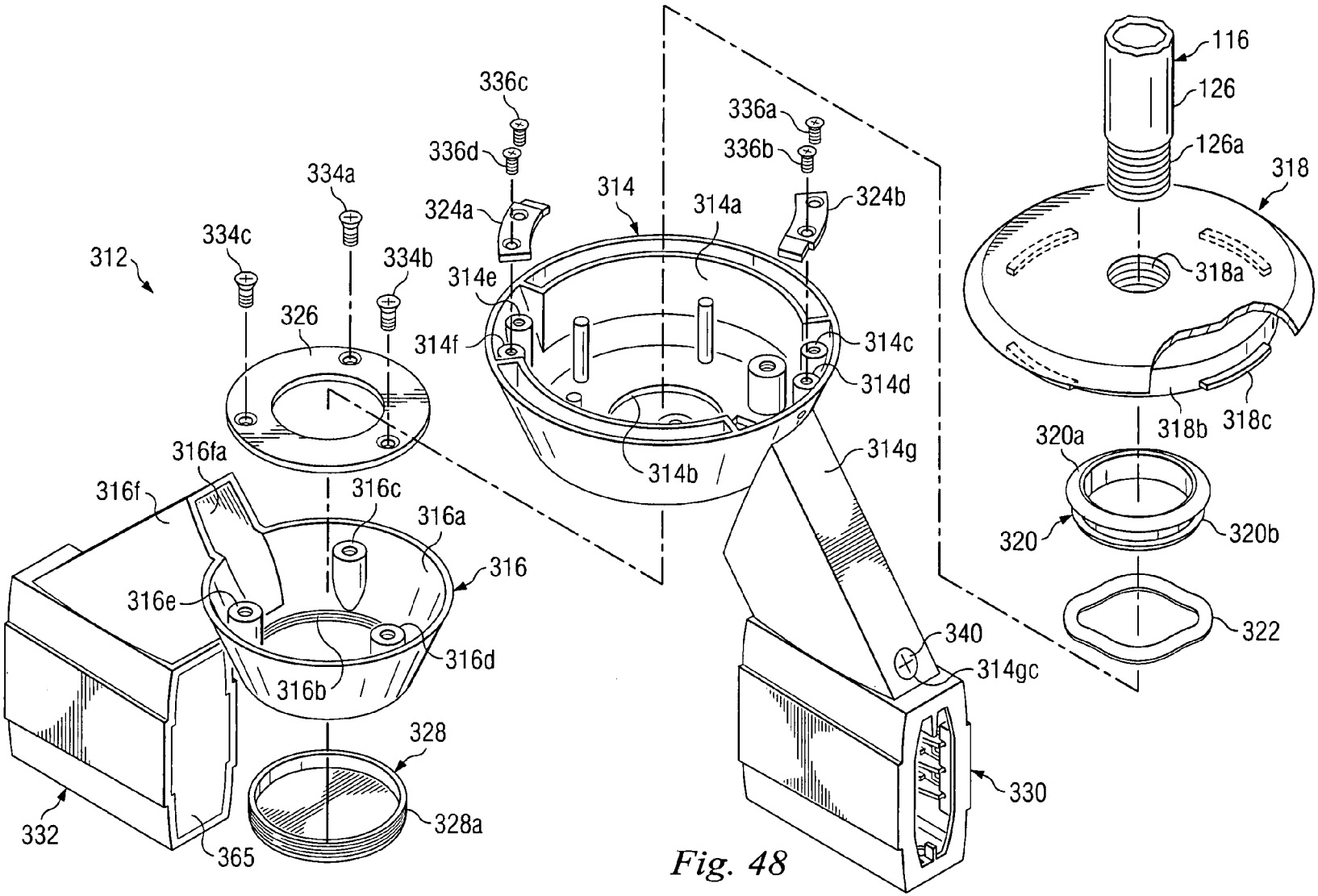
FIG. 48 is a partial exploded/partial perspective view of several components of the track-connection system of FIG. 47, including a cover, upper and lower housings, and side housings.
Figure 49:
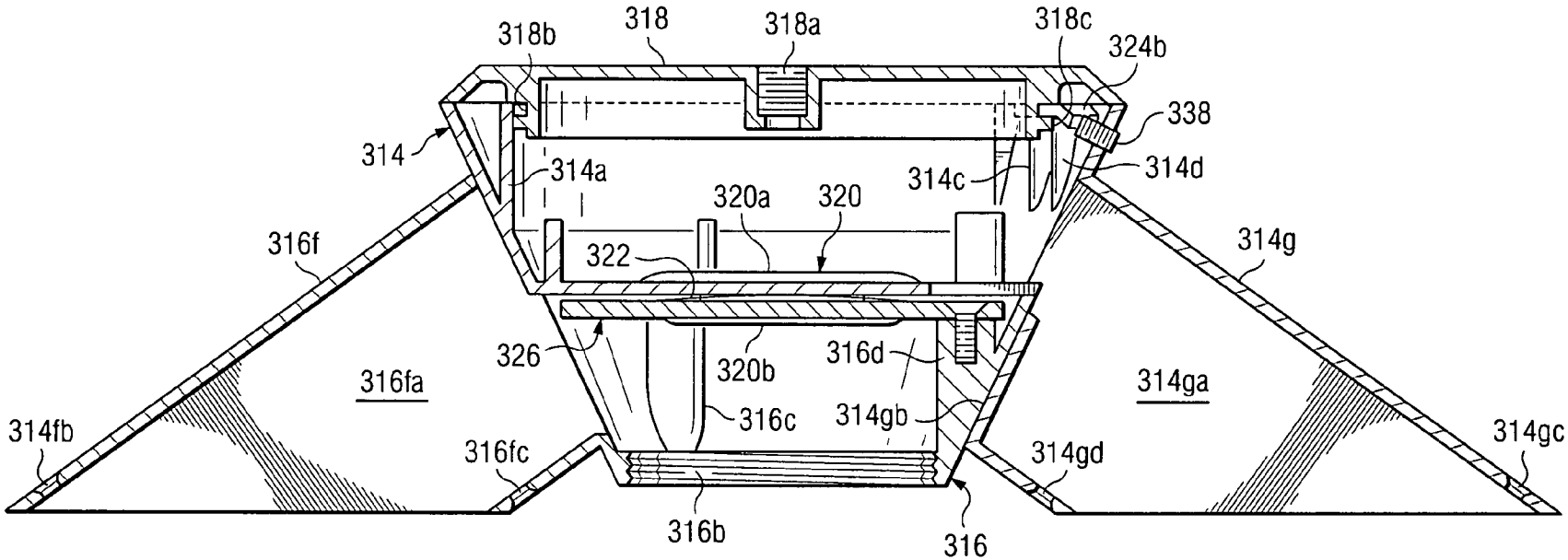
FIG. 49 is a sectional view of the cover and upper and lower housings of the track-connection system of FIG. 47.

In an exemplary embodiment, as illustrated in FIG. 47, a track-connection system is generally referred to by the reference numeral 310 and includes several parts of one or more of the above-described assemblies and/or systems, which are given the same reference numerals. In the system 310, a connector 312 is coupled to the track 12 and a track 313 so that the tracks 12 and 313 are adjustably pivotally coupled to one another via the connector 312. The connector 312 is coupled to the mounting assembly 116, which, in turn, is coupled to the ceiling 18 (not shown).

In an exemplary embodiment, as illustrated in FIGS. 47, 48, 49, 50, 51, 52 and 53, the connector 312 includes an upper housing 314 defining an internal region 314*a*, and including an opening 314*b*, bosses 314*c*, 314*d*, 314*e* and 314*f* having respective internal threaded connections, and an angularly-extending portion 314*g* defining an internal passage 314*ga*, and including an external surface 314*gb* and countersunk holes 314*gc* and 314*gd*. A lower housing 316 defines an internal region 316*a*, and includes an opening 316*b* having an internal threaded connection, bosses 316*c*, 316*d* and 316*e* having respective internal threaded connections, and an angularly-extending portion 316*f* defining an internal passage 316*fa* and including countersunk holes 316*fb* and 316*fc*.

The connector 312 further includes a top cover 318 having an internal threaded connection 318*a*, an internal annular recess 318*b* and a plurality of circumferentially-spaced protrusions 318*c* extending from the internal annular recess 318*b*, and further includes an eyelet 320 having upper and lower flared ends 320*a* and 320*b*, a washer 322, retaining protrusions 324*a* and 324*b*, a plate attachment 326, a bottom cover 328 having an external threaded connection 328*a*, and side housings 330 and 332. In an exemplary embodiment, the washer 322 may comprise a wave washer. In an exemplary embodiment, the washer 322 may comprise a fiber washer. In an exemplary embodiment, the washer 322 may comprise a Nomex® fiber washer.

When the connector 312 is in an assembled condition, the external threaded connection 328*a* of the bottom cover 328 is engaged with the internal threaded connection of the opening 316*b* of the lower housing 316. The plate attachment 326 is connected to the lower housing 316 via fasteners 334*a*, 334*b* and 334*c*, which extend into the respective internal threaded connections of the bosses 316*c*, 316*d* and 316*e*, respectively. The upper housing 314 is positioned on top of the plate attachment 326 so that the surface 314*gb* of the angularly-extending portion 314*g* contacts or nearly contacts the outside surface of the lower housing 316. The washer 322 is sandwiched between the upper housing 314 and the plate attachment 326. The eyelet 320 extends through the opening 314*b* in the upper housing 314, the washer 322 and the plate attachment 326. The upper flared end 320*a* of the eyelet 320 engages the upper housing 314, and the lower flared end 320*b* of the eyelet engages the plate attachment 326, thereby coupling the upper housing 314 to the lower housing 316.

The retaining protrusion 324*a* is connected to the upper housing 314 via fasteners 336*a* and 336*b*, which extend into the respective internal threaded connections of the bosses 314*c* and 314*d*. Similarly, the retaining protrusion 324*b* is connected to the upper housing 314 via fasteners 336*c* and 336*d*, which extend into the respective internal threaded connections of the bosses 314*e* and 314*f*. The external annular recess 318*b* of the top cover 318 extends into the region 314*a* so that one of the protrusions in the plurality of protrusions 318*c* extends underneath the retaining protrusion 324*b*, and another of the protrusions in the plurality of protrusions 318*c* extends underneath the retaining protrusion 324*a*. In an exemplary embodiment, the top cover 318 may be rotated, relative to the upper housing 314, so that at least one protrusion in the plurality of protrusions 318*c* extends beneath each of the retaining protrusions 324*a* and 324*b*. A set screw 338 extends through the upper housing 314 and prevents the cover 318 from being removed from the upper housing 314 in the event the cover 318 is rotated so that none of the protrusions in the plurality of protrusions 318*c* extends beneath either the retaining protrusion 324*a* or 324*b*. The end portion of the stem 126 opposing the end portion 126*a* is threadably engaged with the internal threaded connection 318*a* of the top cover 318.

The side housings 330 and 332 are connected to the angularly-extending portions 314*g* and 316*f*, respectively, of the housings 314 and 316, respectively. More particularly, an angularly-extending tab 330*a* of the side housing 330 extends into the passage 314*ga* of the angularly-extending portion 314*g* of the upper housing 314, and a fastener 340 extends through the hole 314*gc* and threadably engages an internal threaded connection 330*aa* in the tab 330*a*. Moreover, an angularly-extending tab 342*a* of an end plate 342 that is coupled to the side housing 330 extends into the passage 314*ga* of the angularly-extending portion 314*g* of the upper housing 314, and a fastener 344 extends through the hole 314*gd* in the angularly-extending portion 314*g* and threadably engages an internal threaded connection 342*aa* in the tab 342*a*. The side housing 332 is connected to the angularly-extending portion 316*f* of the lower housing 316 in a manner similar to the manner in which the side housing 330 is connected to the angularly-extending portion 314*g* of the upper housing 314, and therefore this connection will not be described in detail.

Figure 50:
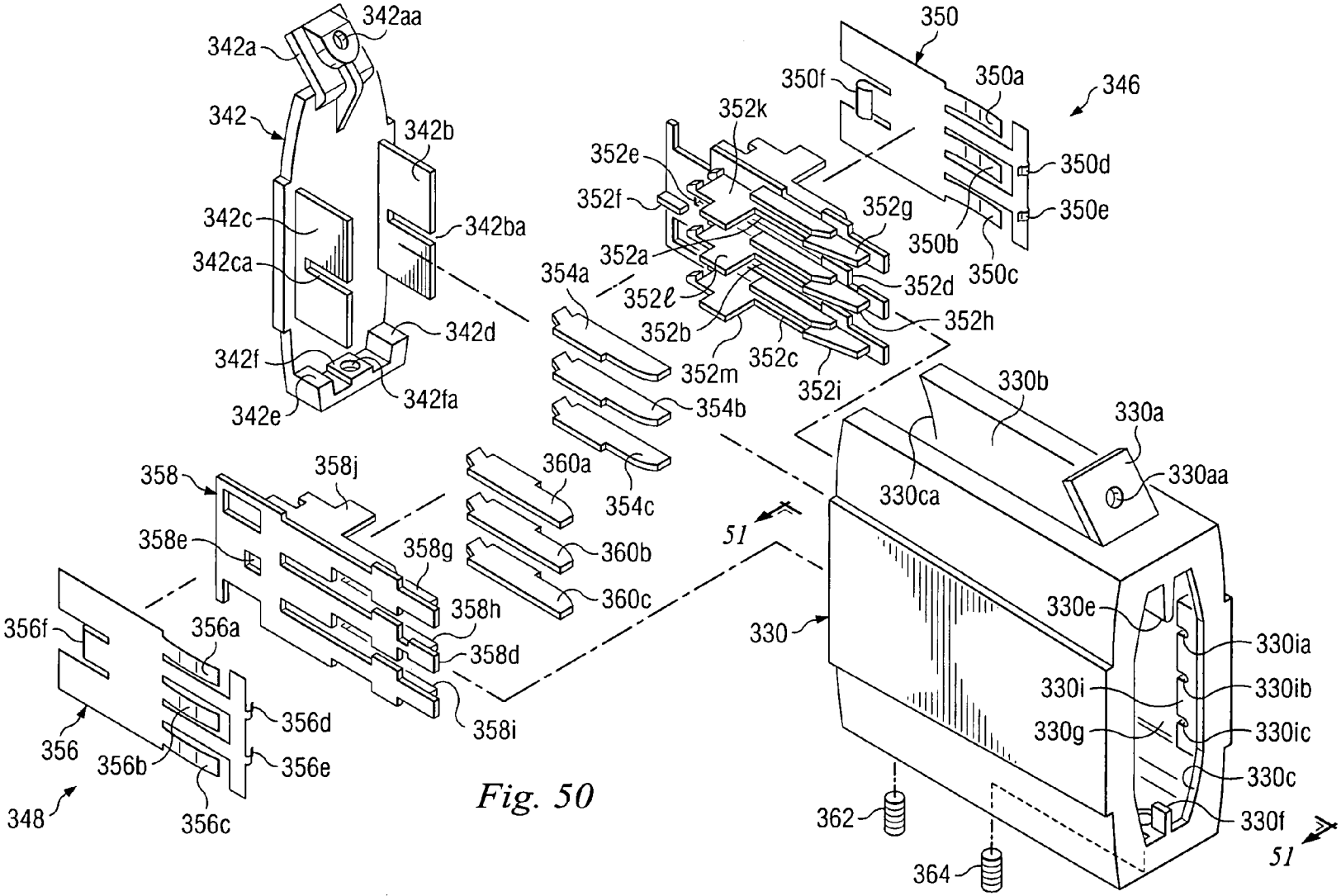
FIG. 50 is an exploded view of one of the side housings of the track-connection system of FIG. 47.
Figure 51:
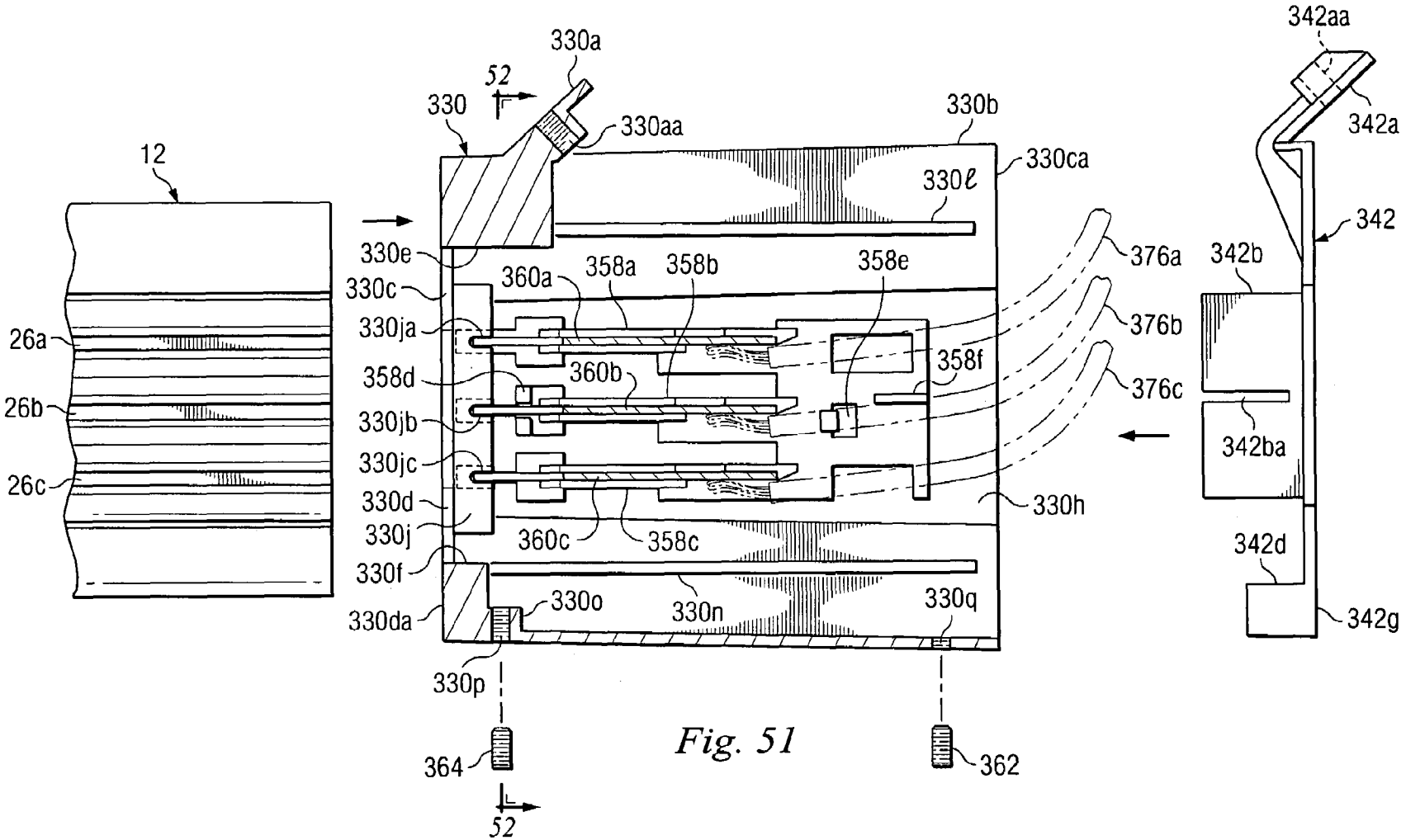
FIG. 51 is a sectional view of the side housing depicted in FIG. 50.
Figure 52:
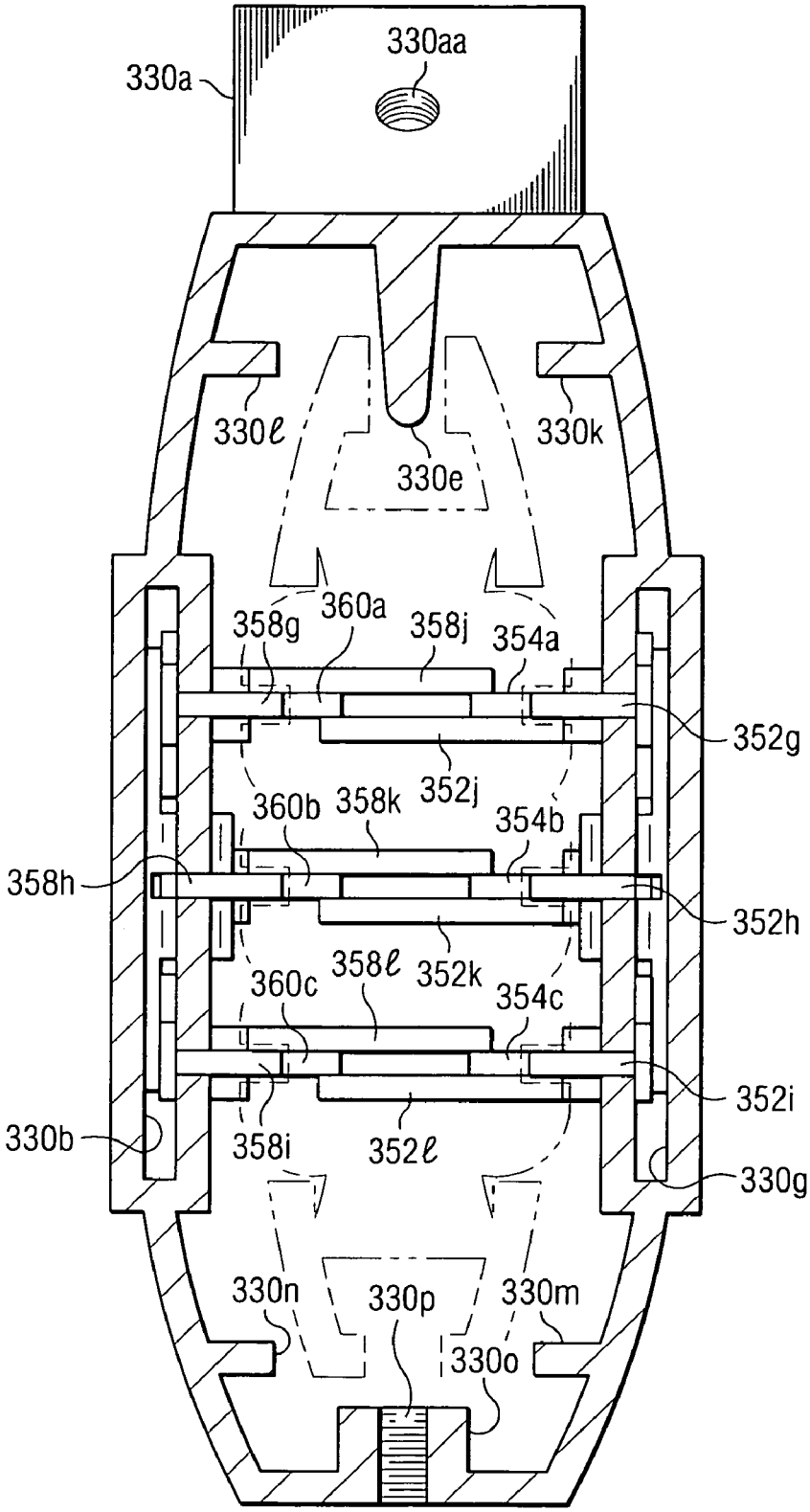
FIG. 52 is another sectional view of the side housing depicted in FIG. 50.
Figure 53:
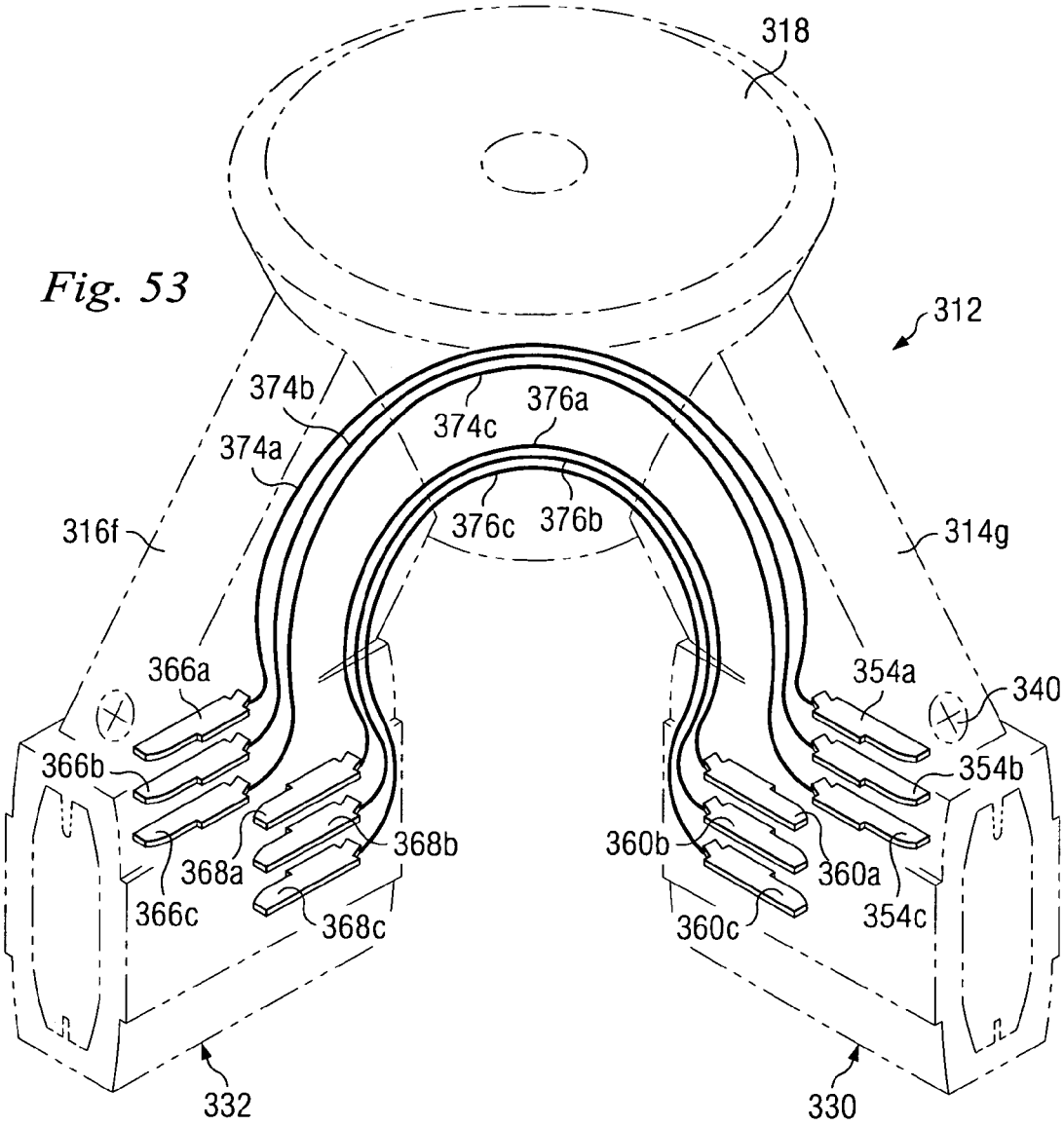
FIG. 53 is a simplified perspective view of the track-connection system of FIG. 47 depicting a wiring configuration according to an embodiment.
Figure 54:
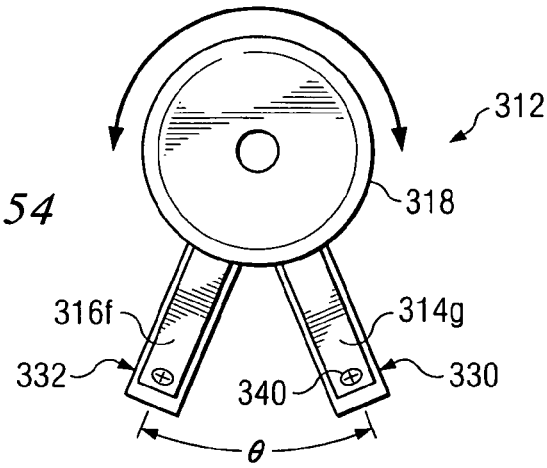
FIG. 54 is a top plan view of the track-connection system of FIG. 47.

In an exemplary embodiment, as illustrated in FIGS. 50, 51 and 52, the side housing 330 includes a top opening 330*b* that is generally equal to the cross-section of the distal end of the passage 314*ga*, a front opening 330*c* formed in a wall 330*d*, and a back opening 330*ca* that is adjacent the top opening 330*b*. The front opening 330*c* defines a profile that substantially corresponds to the perimeter outline of the cross-section of the track 12. A protrusion 330*e*, an end of which is flush with a front surface 330*da* of the front wall 330*d*, extends downward and into the opening 330*c*. A protrusion 330*f*, an end of which is also flush with the front surface 330*da* of the wall 330*d*, extends upward and into the opening 330*c*.

Symmetric and longitudinally-extending internal recesses 330*g* and 330*h* are formed in the side housing 330. Symmetric tabs 330*i* and 330*j* extend from the wall 330*d*, and include notches 330*ia*, 330*ib* and 330*ic*, and notches 330*ja*, 330*jb* and 330*jc*, respectively, formed therein. Symmetric protrusions 330*k* and 330*l* extend from the wall 330*d*, the side walls of the housing 330, and longitudinally along the majority of the length of the housing 330. Similarly, symmetric protrusions 330*m* and 330*n* extend from the wall 330*d*, the side walls of the housing 330, and longitudinally along the majority of the length of the housing 330. The side housing 330 further includes a boss 330*o* adjacent the protrusion 330*f* and through which a bore 330*p* having an internal threaded connection extends, and further includes a bore 330*q* having an internal threaded connection.

The end plate 342 further includes a pair of parallel-spaced tabs 342*b* and 342*c* having slots 342*ba* and 342*ca*, respectively, formed therein, a pair of corner protrusions 342*d* and 342*e* and a boss 342*f* including a bore 342*fa* having an internal threaded connection positioned between the corner protrusions 342*d* and 342*e*, and defines a vertically-extending surface 342*g*.

Contact assemblies 346 and 348 are disposed within the side housing 330. The contact assembly 346 includes a contact insulator spring 350 having spring portions 350*a*, 350*b* and 350*c*, and tabs 350*d* and 350*e*, and a tab 350*f*. A contact insulator 352 includes channels 352*a*, 352*b* and 352*c*, a middle tab 352*d*, an opening 352*e* and a protrusion 352*f*. Protrusions 352*g*, 352*h* and 352*i* are aligned with the channels 352*a*, 352*b* and 352*c*, respectively. The contact insulator 352 further includes tabs 352*j*, 352*k* and 352*l*. Contacts 354*a*, 354*b* and 354*c* are disposed within the channels 352*a*, 352*b* and 352*c*, respectively.

When the contact assembly 346 is in its assembled condition, the contact insulator spring 350 is coupled to the contact insulator 352, with the tabs 350*d* and 350*e* of the contact insulator spring 350 extending over the middle tab 352*d* of the contact insulator 352, and the tab 350*f* of the contact insulator spring 350 extending into the opening 352*e* of the contact insulator 352. As noted above, the contacts 354*a*, 354*b* and 354*c* are disposed within the channels 352*a*, 352*b* and 352*c*, respectively.

Similarly, the contact assembly 348 includes a contact insulator spring 356 having spring portions 356*a*, 356*b* and 356*c*, and tabs 356*d* and 356*e*, and a tab 356*f*. A contact insulator 358 includes channels 358*a*, 358*b* and 358*c*, a middle tab 358*d*, an opening 358*e* and a protrusion 358*f*. Protrusions 358*g*, 358*h* and 358*i* are aligned with the channels 358*a*, 358*b* and 358*c*, respectively. The contact insulator 358 further includes tabs 358*j*, 358*k* and 358*l*. Contacts 360*a*, 360*b* and 360*c* are disposed within the channels 358*a*, 358*b* and 358*c*, respectively.

When the contact assembly 348 is in its assembled condition, the contact insulator spring 356 is coupled to the contact insulator 358, with the tabs 356*d* and 356*e* of the contact insulator spring 356 extending over the middle tab 358*d* of the contact insulator 358, and the tab 356*f* of the contact insulator spring 356 extending into the opening 358*e* of the contact insulator 358. As noted above, the contacts 360*a*, 360*b* and 360*c* are disposed within the channels 358*a*, 358*b* and 358*c*, respectively.

The contact assembly 348 is received within the side housing 330 so that the protrusions 358*g*, 358*h* and 358*i* of the contact insulator 358 extend within the notches 330*ja*, 330*jb* and 330*jc*, respectively, of the tab 330*j* of the side housing 330. Similarly, the contact assembly 346 is received within the side housing 330 so that the protrusions 352*g*, 352*h* and 352*i* of the contact insulator 352 extend within the notches 330*ia*, 330*ib* and 330*ic*, respectively, of the tab 330*i* of the side housing 330. As a result, the tabs 352*j*, 352*k* and 352*l* of the contact insulator 352 are interleaved with, and spaced in a parallel relation from, the tabs 358*j*, 358*k* and 358*l*, respectively, of the contact insulator 358. Moreover, the contacts 354*a* and 360*a* are vertically disposed between the tabs 352*j* and 358*j*, the contacts 354*b* and 360*b* are vertically disposed between the tabs 352*k* and 358*k*, and the contacts 354*c* and 360*c* are vertically disposed between the tabs 352*l* and 358*l*.

The plate 342 is received within the back opening 330*ca* of the side housing 330, and a set screw 362 engages the internal threaded connection of the bore 330*q* and the internal threaded connection of the bore 342*fa*, thereby locking the plate 342 to the side housing 330. As a result, the surface 342*g* is flush with the end of the side housing 330 that opposes the surface 330*da* and, as noted above, the tab 342*a* extends within the passage 314*ga* of the angularly-extending portion 314*g* of the upper housing 314. Moreover, the protrusions 352*f* and 358*f* of the contact insulators 352 and 358, respectively, extend into the slots 342*ba* and 342*ca*, respectively, of the plate 342. As a result, the spring portions 350*a*, 350*b* and 350*c* of the contact insulator spring 350 engage the internal recess 330*g*, compressing the spring portions and causing the spring portions to apply a reaction or biasing force against the contact insulator 352, which in turn, engages the tab 330*i* and the tab 342*b*. As a result, the contact assembly 346 is captured within the side housing 330.

Similarly, the spring portions 356*a*, 356*b* and 356*c* of the contact insulator spring 356 engage the internal recess 330*h*, compressing the spring portions and causing the spring portions to apply a reaction or biasing force against the contact insulator 358, which in turn, engages the tab 330*j* of the side housing 330 and the tab 342*c* of the pate 342. As a result, the contact assembly 348 is captured within the side housing 330.

The track 12 is received within the side housing 330, extending through the opening 330*c* so that the contacts 354*a*, 354*b* and 354*c* contact the buss bars 26*a*, 26*b* and 26*c*, respectively, and so that the contacts 360*a*, 360*b* and 360*c* contact the buss bars 28*a*, 28*b* and 28*c*, respectively. Moreover, the protrusions 330*e* and 330*f* extend into the channels 20*d* and 20*g*, respectively, of the protrusion 20 of the track 12. In an exemplary embodiment, the correspondence between the profile defined by the opening 330*c* and the perimeter outline of the cross-section of the track 12, the protrusions 330*e* and 330*f*, and/or the protrusions 330*k*, 330*l*, 330*m* and 330*n* serve to align and/or guide the track 12 into the side housing 330 to promote the aforementioned contact between the contacts 354*a*, 354*b*, 354*c*, 360*a*, 360*b* and 360*c* and the buss bars 26*a*, 26*b*, 26*c*, 28*a*, 28*b* and 28*c*, respectively. A set screw 364 is engaged with the internal threaded connection of the bore 330*p* and extends into the channel 20*g* of the protrusion 20 of the track 12, and contacts the surface 20*k* of the protrusion 20 of the track 12, thereby locking the track 12 to the side housing 330.

The side housing 332 is substantially similar to the side housing 330 and therefore will not be described in detail. The connection between the side housing 332 and the angularly-extending portion 316*f* of the lower housing 316 is substantially identical to the connection between the side housing 330 and the angularly-extending portion 314*g* of the upper housing 314, and therefore this connection will not be described in detail. A plate 365, which is substantially identical to the plate 342, is connected to the side housing 332 and the angularly-extending portion 316*f* of the lower housing 316 in a manner substantially identical to the manner in which the plate 342 is connected to the side housing 330 and the angularly-extending portion 314*g* of the upper housing 314, respectively, and therefore these connections will not be described in detail. The side housing 332 includes a pair of contact assemblies, with one contact assembly including contacts 366*a*, 366*b* and 366*c* and the other contact assembly including contacts 368*a*, 368*b* and 368*c*.

The track 313 is substantially identical to the track 12 and therefore will not be described in detail. The track 313 is received by and locked to the side housing 332 in a manner substantially identical to the manner in which the track 12 is received by and locked to the side housing 330. As a result, the contacts 366*a*, 366*b* and 366*c* contact buss bars 370*a*, 370*b* and 370*c*, respectively, of the track 313, and the contacts 368*a*, 368*b* and 368*c* contact buss bars 372*a*, 372*b* and 372*c*, respectively, of the track 313.

Wires 374*a*, 374*b* and 374*c* are connected to and extend between the contacts 366*a* and 354*a*, 366*b* and 354*b*, and 366*c* and 354*c*, respectively. Wires 376*a*, 376*b* and 376*c* are connected to and extend between the contacts 368*a* and 360*a*,

368*b* and 360*b*, and 368*c* and 360*c*, respectively. The wires 374*a*, 374*b*, 374*c*, 376*a*, 376*b* and 376*c* extend from within the side housing 330, through the opening 330*b*, through the passage 314*ga* of the upper housing 314, through the region 314*a* of the upper housing 314, through the eyelet 320, through the washer 322, through the region 316*a* of the lower housing 316, through the passage 316*fa*, and into the side housing 332.

In an exemplary embodiment, during operation and when the tracks 12 and 313 are received by the side housings 330 and 332, respectively, as described above, the buss bar 26*a* of the track 12 is electrically coupled to the buss bar 370*a* of the track 313 via the contact 354*a*, the wire 374*a* and the contact 366*a*. The buss bar 26*b* of the track 12 is electrically coupled to the buss bar 370*b* of the track 313 via the contact 354*b*, the wire 374*b* and the contact 366*b*. The buss bar 26*c* of the track 12 is electrically coupled to the buss bar 370*c* of the track 313 via the contact 354*c*, the wire 374*c* and the contact 366*c*. The buss bar 28*a* of the track 12 is electrically coupled to the buss bar 372*a* of the track 313 via the contact 360*a*, the wire 376*a* and the contact 368*a*. The buss bar 28*b* of the track 12 is electrically coupled to the buss bar 372*b* of the track 313 via the contact 360*b*, the wire 376*b* and the contact 368*b*. The buss bar 28*c* of the track 12 is electrically coupled to the buss bar 372*c* of the track 313 via the contact 360*c*, the wire 376*c* and the contact 368*c*.

As a result of the above-described electrical couplings between the tracks 12 and 313, if the voltage V1 is present across the buss bars 26*a* and 26*c*, then electrical power is transferred at the voltage V1 from the buss bars, 26*a* and 26*c*, to the buss bars, 370*a* and 370*c*, via the connector 312. If the voltage V2 is present across the buss bars 28*a* and 28*c*, then electrical power is transferred at the voltage V2 from the buss bars, 28*a* and 28*c*, to the buss bars, 372*a* and 272*c*, via the connector 312. If the voltage V3 is present across the buss bars 26*b* and 28*b*, then electrical power is transferred at the voltage V3 from the buss bars, 26*b* and 28*b*, to the buss bars, 370*b* and 372*b*, via the connector 312. Conversely, and in an exemplary embodiment, electrical power may be transferred from the track 313 to the track 12 in a manner substantially identical to the above-described manner in which electrical power may be transferred from the track 12 to the track 313. In an exemplary embodiment, the voltages V1 and V2 may each be 120 volts and the voltage V3 may be 12 volts.

Moreover, during operation and as noted above, the connector 312 provides a pivot connection between the tracks 12 and 313. As a result of the pivot connection between the tracks 12 and 313, an angle θ is defined between the centerlines of the side housings 330 and 332, with the angle θ generally corresponding to the angle between the centerlines of the tracks 12 and 313.

In an exemplary embodiment, the connector 312 provides an adjustable pivot connection between the tracks 12 and 313. As a result, the angle θ is adjustable over a predetermined angular range. To adjust the pivot connection between the tracks 12 and 313, and therefore the angle θ, the upper housing 314 may be rotated relative to the lower housing 316, or vice versa.

If the upper housing 314 is rotated to adjust the angle θ, then the upper housing 314 and the eyelet 320 rotate relative to the plate attachment 326 and the lower housing 314. The washer 322 facilitates this rotation by limiting the degree of friction at the interface between the upper housing 314 and the plate attachment 326.

If the lower housing 316 is rotated to adjust the angle θ, then the lower housing 316 and the plate attachment 326 rotates relative to the eyelet 320 and the upper housing 314. The washer 322 facilitates this rotation by limiting the degree of friction at the interface between the upper housing 314 and the plate attachment 326.

In an exemplary embodiment, the angle θ may be adjusted in any manner described above, or in any combination thereof, over a predetermined angular range ranging from about 40 degrees to about 320 degrees. That is, in an exemplary embodiment, the minimum value for the angle θ may be about 40 degrees, and therefore the angle between the centerlines of the side housings 330 and 332, and the angle between the centerlines of the tracks 12 and 313, may be adjusted down to about 40 degrees.

After the angle θ has been adjusted to the desired value, the connector 312 maintains the angle θ, thereby holding the pivot connection between the side housings 330 and 332, and therefore the pivot connection between the tracks 12 and 313, in place. More particularly, the clamping forces provided by the eyelet 320, the friction associated with the interface between the plate attachment 326 and the upper housing 314, and/or the biasing or reaction force provided by the washer 322, maintains the angle θ, thereby holding the pivot connection between the tracks 12 and 313 in place. As a result, any free rotation of the upper housing 314 relative to the lower housing 316, or vice versa, is generally prevented.

In an exemplary embodiment, the wires 374*b* and 376*b* may be removed from the connector 312 so that electrical power may only be transferred between the buss bars, 26*a* and 26*c*, and the buss bars, 370*a* and 370*c*, at the voltage V1, and between the buss bars, 28*a* and 28*c*, and the buss bars 372*a* and 372*c*, at the voltage V2. In an exemplary embodiment, the wires 374*b* and 376*b*, the contacts 354*b* and 360*b*, and the contacts 366*b* and 368*b* may be removed from the connector 312 so that electrical power may only be transferred between the buss bars, 26*a* and 26*c*, and the buss bars, 370*a* and 370*c*, at the voltage V1, and between the buss bars, 28*a* and 28*c*, and the buss bars 372*a* and 372*c*, at the voltage V2.

In an exemplary embodiment, the wires 374*a* and 374*c* may be removed from the connector 312 so that electrical power may only be transferred between the buss bars, 26*b* and 28*b*, and the buss bars, 370*b* and 372*b*, at the voltage V3, and between the buss bars, 28*a* and 28*c*, and the buss bars 372*a* and 372*c*, at the voltage V2. In such an exemplary embodiment, the contacts 366*a*, 366*c*, 354*a* and 354*c* may also be removed from the connector 312, along with the wires 374*a* and 374*c*.

In an exemplary embodiment, the wires 376*a* and 376*c* may be removed from the connector 312 so that electrical power may only be transferred between the buss bars, 26*b* and 28*b*, and the buss bars, 370*b* and 372*b*, at the voltage V3, and between the buss bars, 26*a* and 26*c*, and the buss bars 370*a* and 370*c*, at the voltage V1. In such an exemplary embodiment, the contacts 368*a*, 368*c*, 360*a* and/or 360*c* may also be removed from the connector 312, along with the wires 376*a* and 376*c*.

In an exemplary embodiment, the wires 374*a*, 374*c*, 376*a* and 376*c* may be removed from the connector 312 so that electrical power may only be transferred between the buss bars, 26*b* and 28*b*, and the buss bars, 370*b* and 372*b*, at the voltage V3. In such an embodiment, the contacts 366*a*, 366*c*, 354*a*, 354*c*, 368*a*, 368*c*, 360*a* and 360*c* may also be removed.

In an exemplary embodiment, the wires 374*a*, 374*b*, 374*c*, 376*a*, 376*b* and 376*c* may all be removed from the connector 312 so that electrical power is not transferred between the tracks 12 and 313. In such an exemplary embodiment, the contacts 366*a*, 366*b*, 366*c*, 368*a*, 368*b*, 368*c*, 354*a*, 354*b*, 354*c*, 360*a*, 360*b* and/or 360*c* may also be removed from the connector 312, along with the wires 374*a*, 374*b*, 374*c*, 376*a*, 376*b* and 376*c*.

In several exemplary embodiments, the connector 312 permits electrical power to be passed between the tracks 12 and 313, via up to three independent circuits. In an exemplary embodiment, the connector 312 permits electrical power to be passed between the tracks 12 and 313, via up to three independent circuits and at the voltages V1, V2 and V3, or any combination thereof. In several exemplary embodiments, a wide variety of wiring configurations are possible in the system 310.

Figure 55:
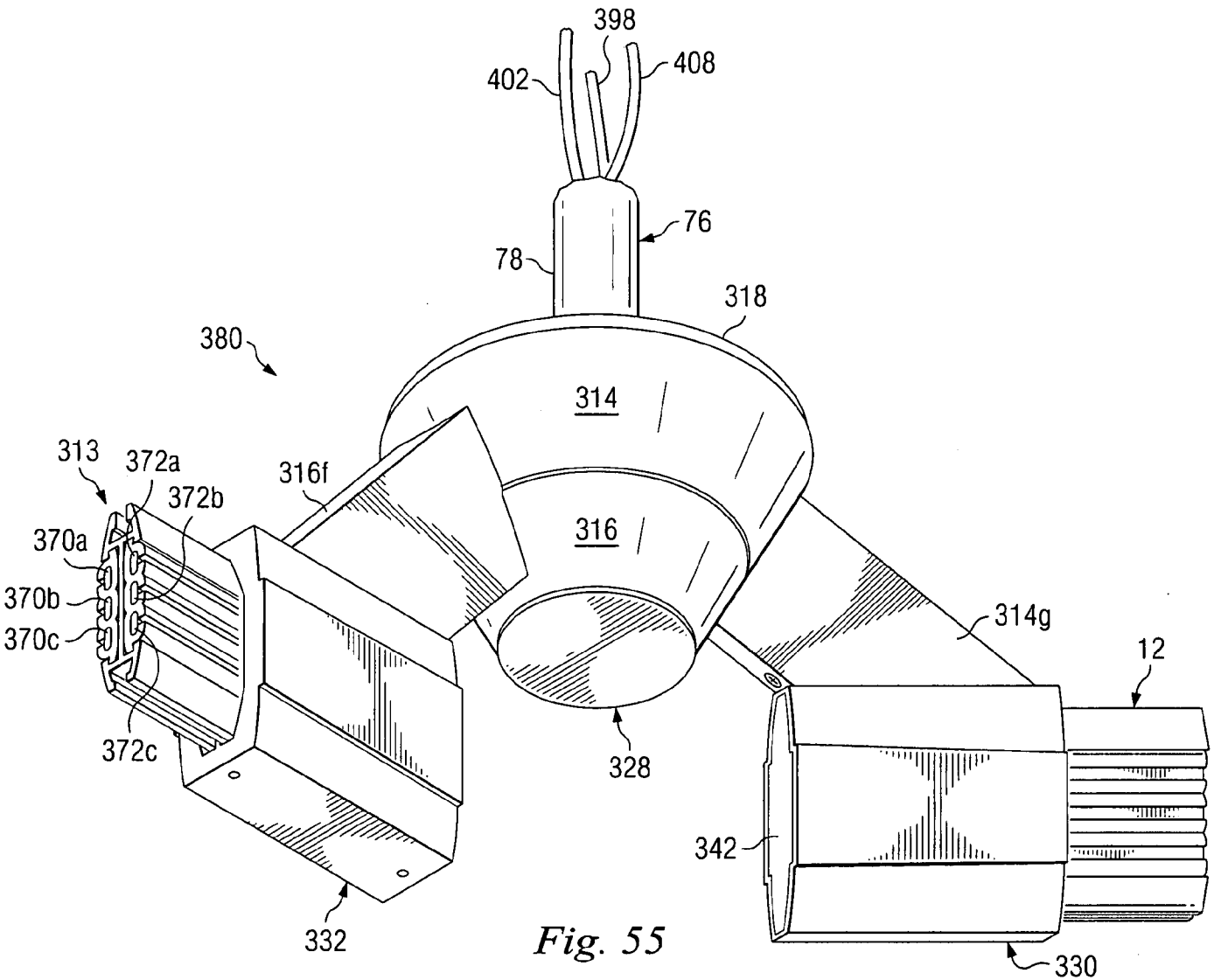
FIG. 55 is a perspective view of a track-connection system according to another embodiment.
Figure 56:
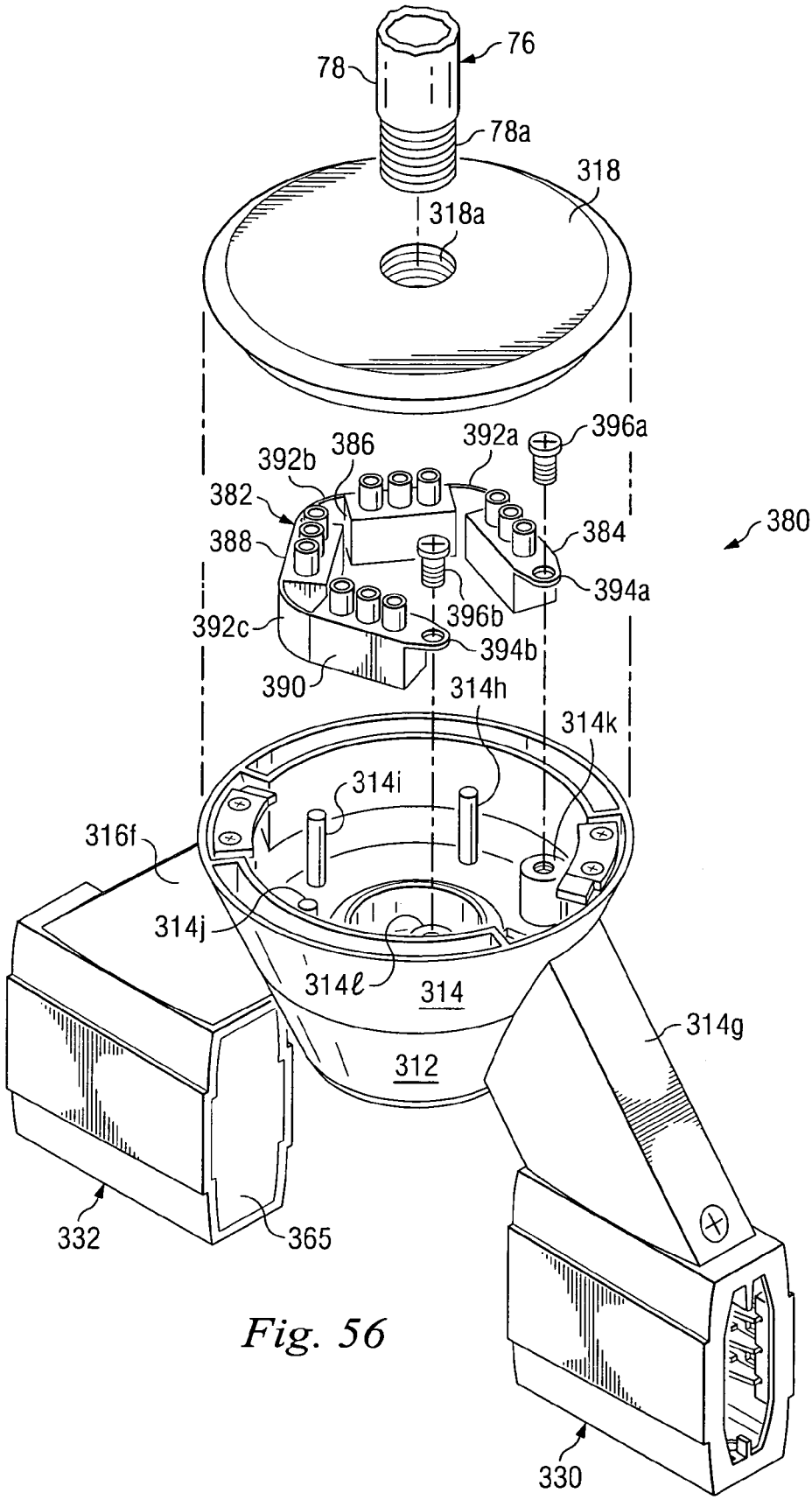
FIG. 56 is a partial exploded/partial perspective view of several components of the track-connection system of FIG. 55.
Figure 57:
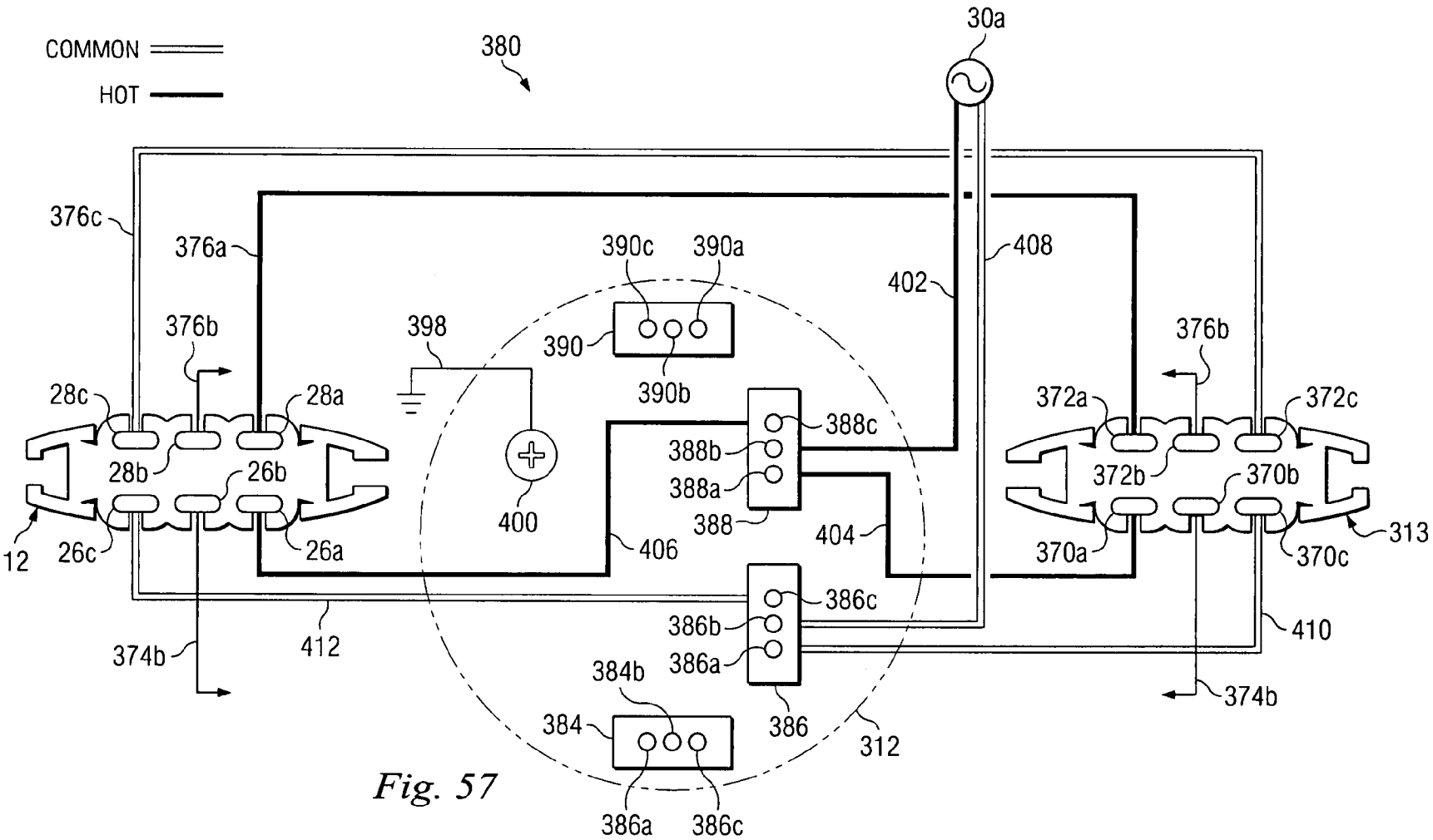
FIG. 57 is a diagrammatic view of the track-connection system of FIG. 55 depicting a wiring configuration according to an embodiment.
Figure 58:
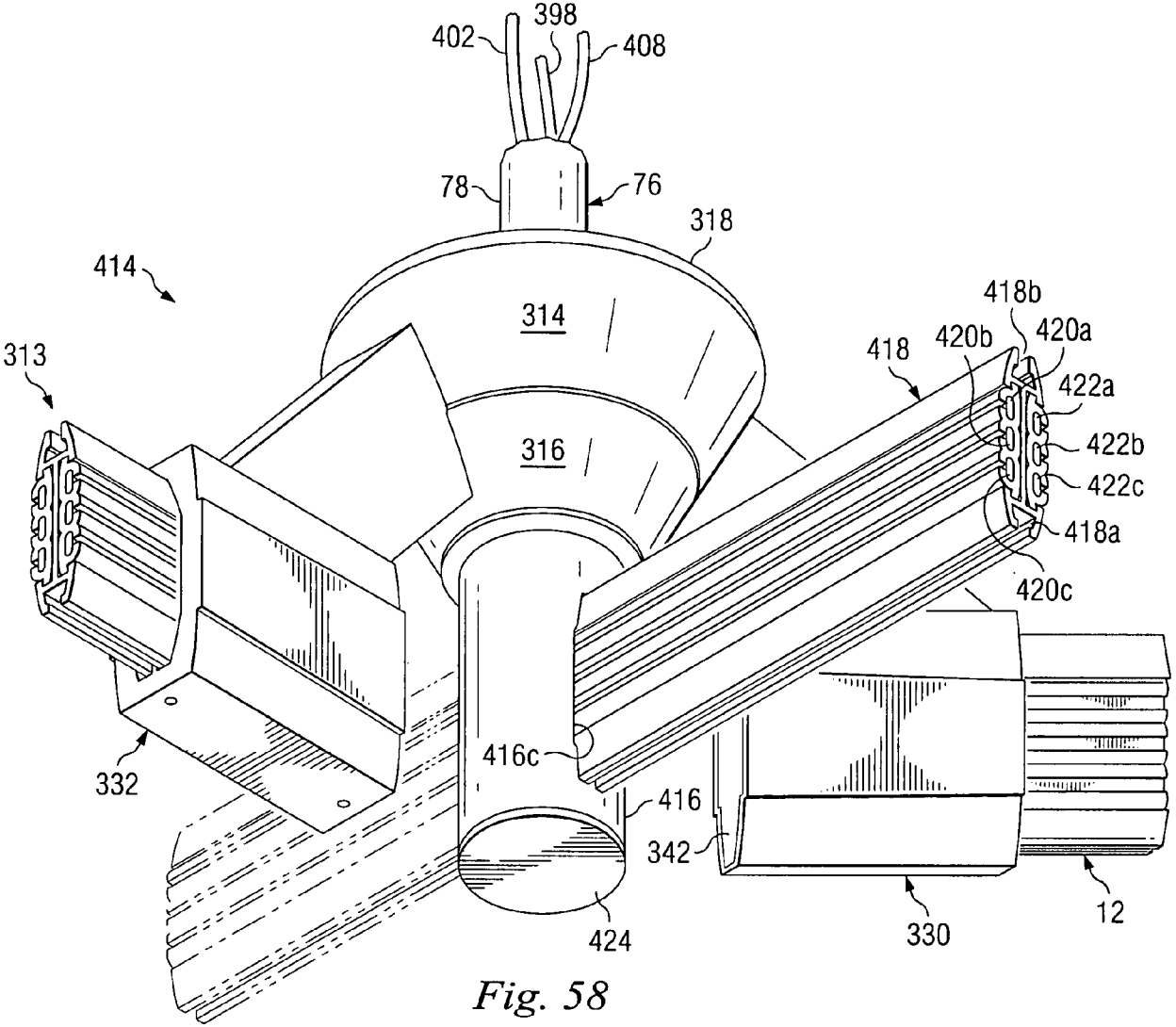
FIG. 58 is a perspective view of a track-connection system according to another embodiment.

In an exemplary embodiment, as illustrated in FIGS. 55, 56 and 57, a track-connection system is generally referred to by the reference numeral 380 and contains several parts of the system 310, which are given the same reference numerals. In the system 380, the connector 312 is coupled to the tracks 12 and 313 so that the tracks 12 and 313 are adjustably pivotally coupled to one another via the connector 312. The connector 312 is coupled to the mounting assembly 76 which, in turn, is coupled to the ceiling 18 (not shown). More particularly, the stem 78 extends downward from the ceiling 18 and the external threaded connection 78*a* of the stem 78 engages the internal threaded connection 318*a* of the top cover 318.

A terminal block assembly 382 including terminal module portions 384, 386, 388 and 390 and flexible hinge portions 392*a*, 392*b* and 392*c* connecting the terminal module portions 384 and 386, 386 and 388, and 388 and 390, respectively, is disposed in the region 314*a* of the upper housing 314 of the connector 312 so that the flexible hinges 392*a*, 392*b* and 392*c* extend about pins 314*h*, 314*i* and 314*j*, respectively, of the upper housing 314. The terminal block assembly 382 further includes eyelets 394*a* and 394*b* extending from the terminal module portions 384 and 390, respectively. Fasteners 396*a* and 396*b*, extend through the eyelets 394*a* and 394*b*, respectively, and engage the internal threaded connections of bosses 314*k* and 314*l*, respectively, thereby securing the terminal block assembly 382 to the upper housing 314.

The terminal module portions 384, 386, 388 and 390 include electrically-coupled terminals 384*a*, 384*b* and 384*c*, electrically-coupled terminals 386*a*, 386*b* and 386*c*, terminals 388*a*, 388*b* and 388*c*, and electrically-coupled terminals 390*a*, 390*b* and 390*c*, respectively. A ground wire 398 extends through the stem 78 and into the region 314*a* of the upper housing 314, and is electrically coupled to the upper housing 314 via a fastener 400. A hot wire 402 is electrically coupled to the source 30*a* and extends through the stem 78 and into the region 314*a* of the upper housing 314, and is electrically coupled to the terminal 388*b*. Wires 404 and 406 are electrically coupled to and extend from the terminals 388*a* and 388*c*, respectively, and extend and are electrically coupled to the contacts 366*a* and 354*a*, respectively, which, in turn, contact the buss bars 370*a* and 26*a*, respectively, of the tracks 313 and 12, respectively.

A neutral or common wire 408 is electrically coupled to the source 30*a* and extends through the stem 78 and into the region 314*a* of the upper housing 314, and is electrically coupled to the terminal 386*b*. Wires 410 and 412 are electrically coupled to and extend from the terminal 386*a* and 386*c*, respectively, and extend and are electrically coupled to the contacts 366*c* and 354*c*, respectively, which, in turn, contact the buss bars 370*c* and 26*c*, respectively, of the tracks 313 and 12, respectively. The system 380 further includes the wires 374*b*, 376*a*, 376*b* and 376*c*, which are wired in the same manner as in the system 310.

In an exemplary embodiment, during operation, the system 30*a* supplies AC electrical power to the connector 312, generating the voltage V1 across the terminals 388*b* and 386*b*. As a result, AC electrical power is transferred to the buss bars 26*a* and 26*c*, via the wires 406 and 412, so that the voltage V1 is generated across the buss bars 26*a* and 26*b*. As another result, AC electrical power is transferred to the buss bars 370*a* and 370*c*, via the wires 404 and 410, so that the voltage V1 is generated across the buss bars 370*a* and 370*c*.

If the voltage V2 is present across the buss bars 28*a* and 28*c*, then electrical power is transferred at the voltage V2 from the buss bars, 28*a* and 28*c*, to the buss bars, 372*a* and 372*c*, or vice versa, via the connector 312. If the voltage V3 is present across the buss bars 26*b* and 28*b*, then electrical power is transferred at the voltage V3 from the buss bars, 26*b* and 28*b*, to the buss bars, 370*b* and 372*b*, or vice versa, via the connector 312. In an exemplary embodiment, the voltages V1 and V2 may each be 120 volts and the voltage V3 may be 12 volts.

In an exemplary embodiment, the system 380 may be modified so that the wires 402 and 408 are electrically coupled to and extend from the power supply 31, and the wires 404, 406, 410 and 412 are re-wired so that, during operation, the power supply 31 supplies DC electrical power to the connector 312, generating the voltage V3 across the terminals 388*b* and 386*b*. As a result, DC electrical power may be transferred to the buss bars 26*b* and 28*b*, so that the voltage V3 is generated across the buss bars 26*b* and 28*b*. As another result, DC electrical power may be transferred to the buss bars 370*b* and 372*b*, so that the voltage V3 is generated across the buss bars 370*b* and 372*b*. Moreover, all remaining wires in the connector 312 may be removed so that connector 312 does not permit electrical power to be passed from the track 12 to the track 313, or vice versa. Moreover, in the alternative, the wires 374*a*, 374*c*, 376*a* and 376*c* may wired in the connector 312 in the same manner as in the system 310 so that electrical power is transferred at the voltage V1 from the buss bars 26*a* and 26*c* to the buss bars 370*a* and 370*c*, or vice versa, and so that electrical power is transferred at the voltage V2 from the buss bars 28*a* and 28*c* to the buss bars 372*a* and 372*c*, or vice versa.

In an exemplary embodiment, the wires 402, 404, 406, 408, 410 and 412 of the system 380 may be modified so that AC electrical power at the voltage V2 is supplied by the source 30*b* to the connector 312 and the voltage V2 is generated across the buss bars 28*a* and 28*c*, and across the buss bars 372*a* and 372*c*. In several exemplary embodiments, the connector 312 in the system 380 permits electrical power to be passed between the tracks 12 and 313, via up to two independent circuits, and transfers supplied electrical power to one of the remainder of the independent circuits of each of the tracks 12 and 313. In several exemplary embodiments, a wide variety of wiring configurations are possible in the system 380 using one or more of the wires 374*a*, 374*b*, 374*c*, 376*a*, 376*b*, 376*c*, 402, 404, 406, 408, 410 and 412.

In an exemplary embodiment, as illustrated in FIGS. 58, 59, 60, 61 and 62, a track-connection system is generally referred to by the reference numeral 414 and contains several parts of the systems 380 and 310, which are given the same reference numerals. In the system 414, a tubular member 416 including an external threaded connection 416*a* is engaged with the internal threaded connection 316*b* of the lower housing 316, and extends downward from the lower housing 316. A track 418 is coupled to the tubular member 416 and includes buss bars 420*a*, 420*b* and 420*c*, and buss bars 422*a*, 422*b* and 422*c*. The track 420 is substantially similar to the track 12 and therefore will not be described in detail.

An external threaded connection 424*a* of a cap 424 is engaged with an internal threaded connection of a bore 416*ba* formed through a lower horizontal bar 416*b*, which extends across the interior of the tubular member 416 and is connected to the inside surface of the tubular member 416 at opposing locations.

A pair of identical, opposing and aligned openings 416*c* and 416*d* are formed through the wall of the tubular member 416, and each of the openings 416*c* and 416*d* defines a profile that substantially corresponds to the perimeter outline of the cross-section of the track 420. A protrusion 416*e* extends upward from the lower horizontal bar 416*b*, and bores 416*f* and 416*g* having internal threaded connections are formed through the protrusion 416*e* and the horizontal bar 416*b*.

An upper horizontal bar 416*h* extends across the interior of the tubular member 416 and is connected to the inside surface of the tubular member at opposing locations, and is aligned with the lower horizontal bar 416*b*.

Symmetric pads 416*i* and 416*j* extend from the inside surface of the tubular member 416 and are adjacent the opening 416*c*. Similarly, symmetric pads 416*k* and 416*l* extend from the inside surface of the tubular member 416 and are adjacent the opening 416*d*. Symmetric ribs 416*m* and 416*n* extend upward from the pads 416*i* and 416*j*, respectively, and along the inside surface of the tubular member 416. Similarly, symmetric ribs 416*o* and 416*p* extend upward from the pads 416*k* and 416*l*, respectively, and along the inside surface of the tubular member 416. A protrusion 416*q* extends downward from the upper horizontal bar 416*h*.

Figure 59:
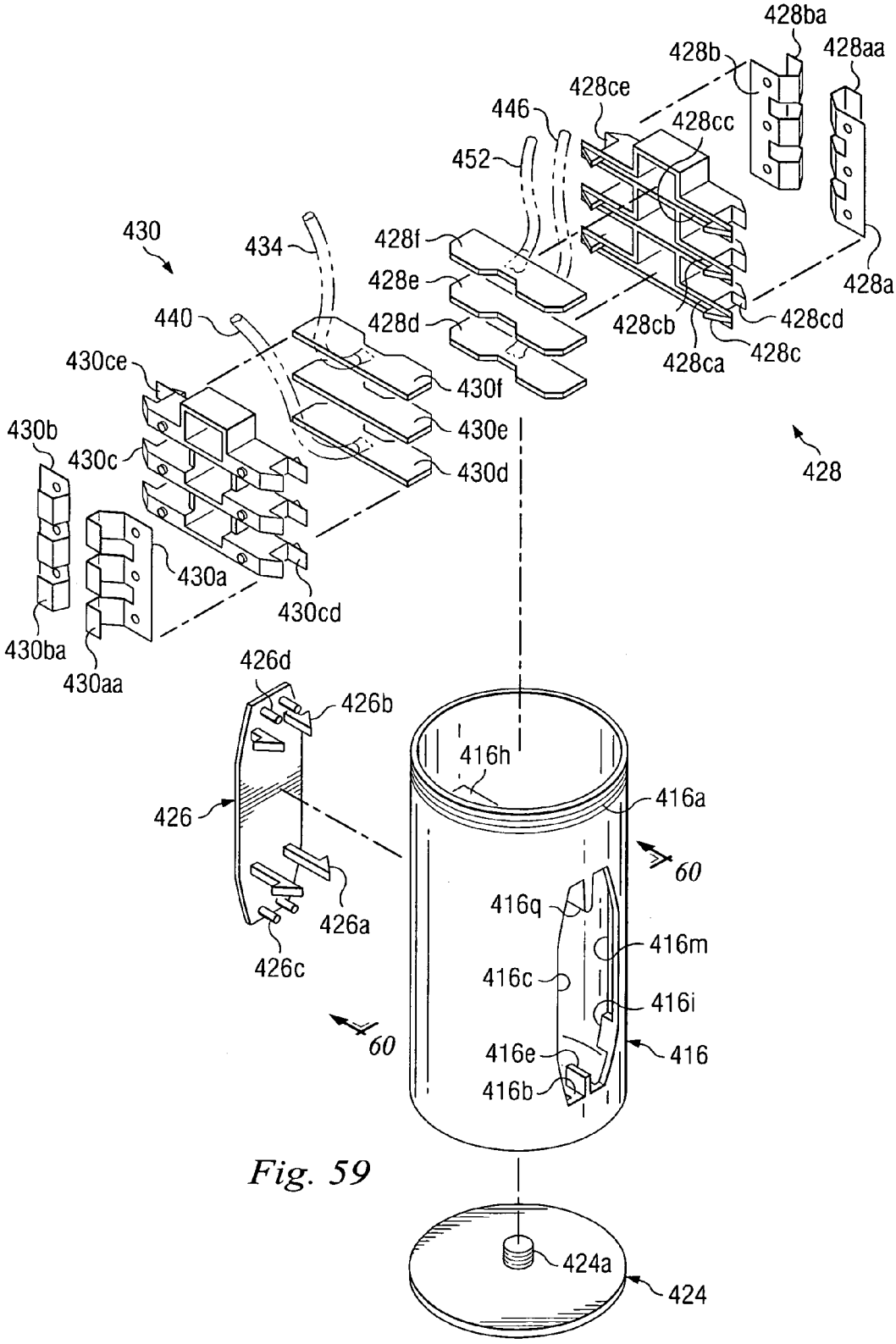
FIG. 59 is an exploded view of a portion of the track-connection system of FIG. 58.
Figure 61:
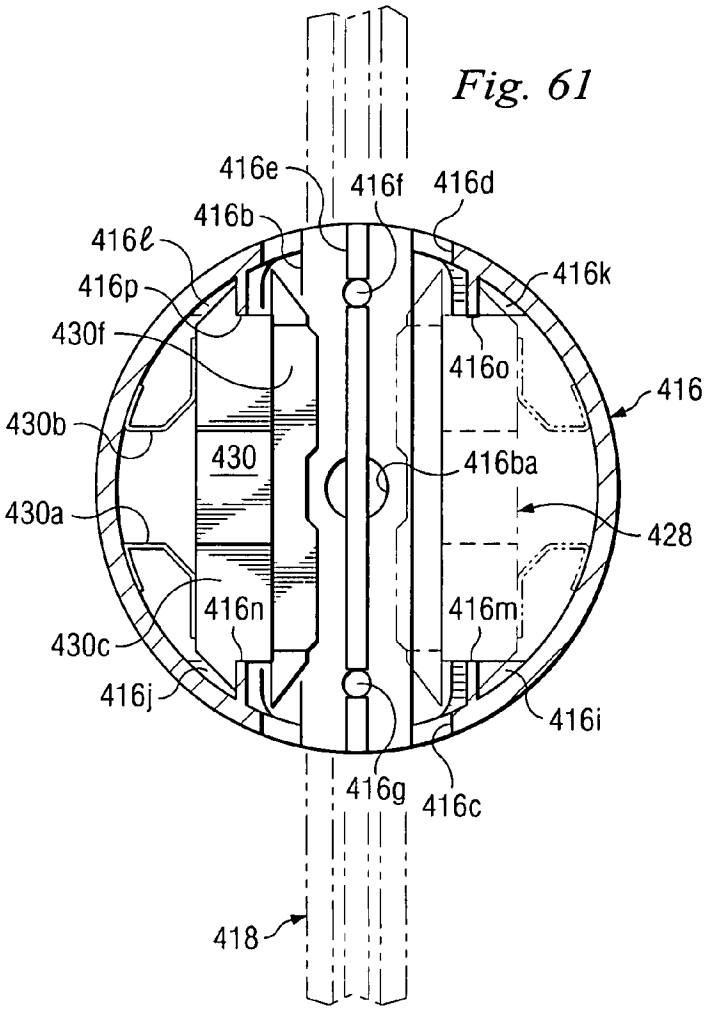
FIG. 61 is a sectional view of the portion of the track-connection system depicted in FIGS. 59 and 60 and taken along line 61-61.
Figure 60:
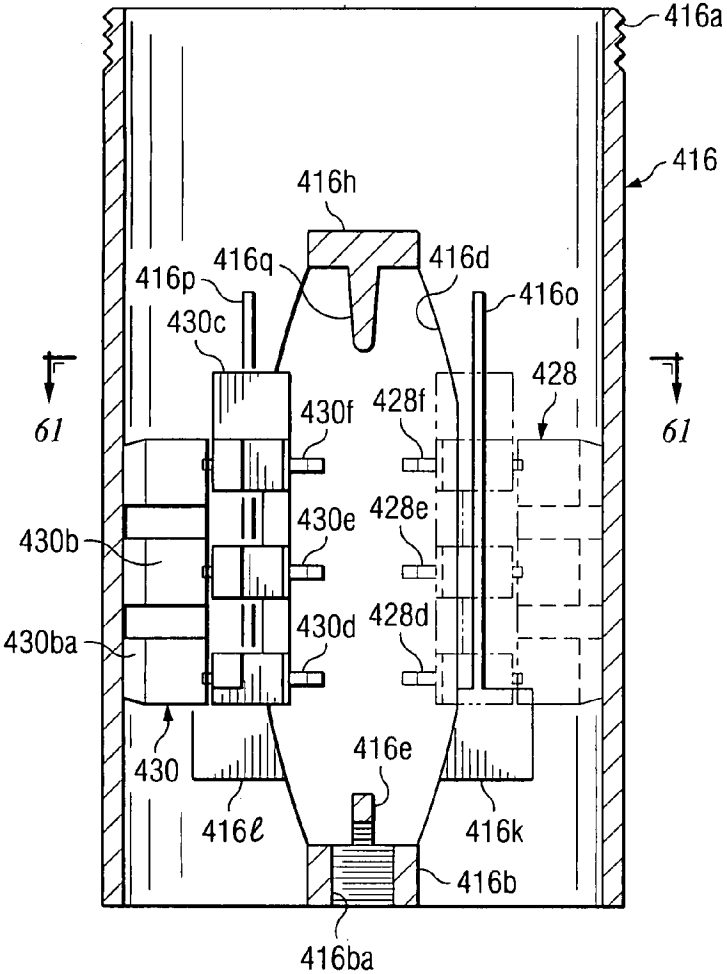
FIG. 60 is a sectional view of the portion of the track-connection system depicted in FIG. 59 taken along line 60-60.
Figure 62:
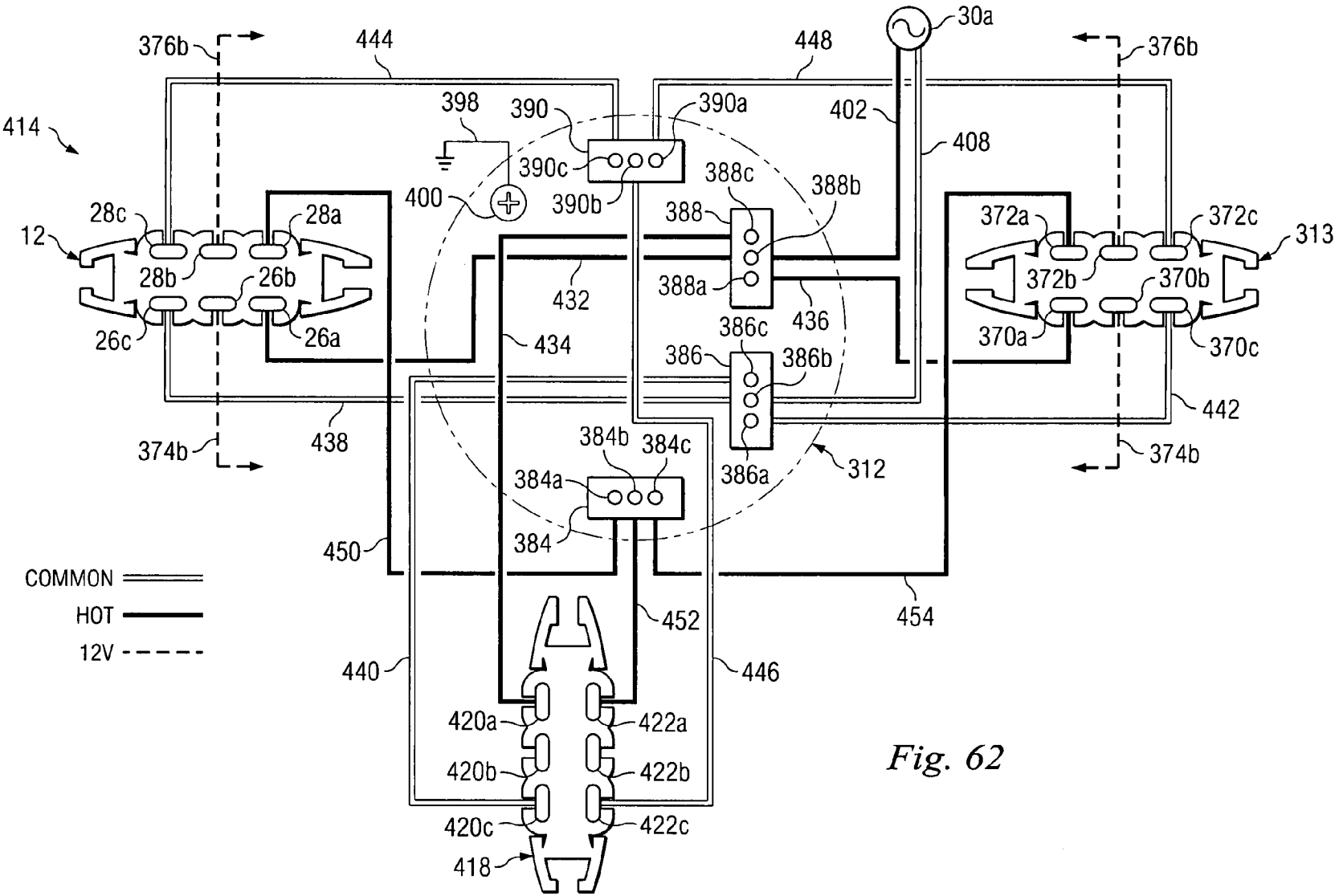
FIG. 62 is a diagrammatic view of the track-connection system of FIG. 58 depicting a wiring configuration according to an embodiment.

A cover plate 426 is adapted to be received by either the opening 416*c* or 416*d*, and includes pairs of snap fasteners 426*a* and 426*b*, and pairs of guide pins 426*c* and 426*d*. When the cover plate 426 is received by, for example, the opening 416*d* as illustrated in FIG. 59, the snap fasteners 426*a* and 426*b* snap into the opening 416*d* and engage the inside surface of the tubular member 416, the pins 426*c* extend on either side of the protrusion 416*e* and the pins 426*d* extend on either side of the protrusion 416*q*. In an exemplary embodiment, when the cover plate 426 is received by the opening 416*d*, the outside surface of the cover plate 426 and the outside surface of the tubular member 416 may appear to be a continuous surface. In an exemplary embodiment, the cover plate 426 may be curved so as to further promote the appearance of a continuous surface with the outside surface of the tubular member 416.

Symmetric contact assemblies 428 and 430 are received within the tubular member 416. The contact assembly 428 includes contact insulator springs 428*a* and 428*b*, each of which include spring portions 428*aa* and 428*ba*, respectively, and which are coupled to a contact insulator 428*c*. In an exemplary embodiment, pins may extend from the contact insulator 428*c* and into openings in the springs 428*a* and 428*b*, forming interference fits to couple the springs 428*a* and 428*b* to the insulator 428*c*. The contact insulator 428*c* includes horizontally-extending channels 428*ca*, 428*cb* and 428*cc*, and vertically-extending channels 428*cd* and 428*ce*. Contacts 428*d*, 428*e* and 428*f* are disposed within the channels 428*ca*, 428*cb* and 428*cc*, respectively, of the contact insulator 428*c*.

The contact assembly 430 is the symmetric equivalent of the contact assembly 428 and therefore will not be described in detail. Reference numerals used to refer to features of the contact assembly 430 will correspond to the reference numerals for the features of the contact assembly 428, except that the numeric prefix for the reference numerals used to describe the contact assembly 428, that is, 428, will be replaced by the numeric prefix of the contact assembly 430, that is, 430.

When the contact assembly 430 is received by the tubular member 416, the contact assembly 430 is pushed downwards and slides into the tubular member 416 so that the ribs 416*n* and 416*p* extend within the channels 430*cd* and 430*ce*, respectively, of the contact insulator 430*c*, and serve to guide the contact assembly 430 as it is being received by the tubular member 416. Moreover, as a result of the extension of the ribs 416*n* and 416*p* within the channels 430*cd* and 430*ce*, the spring portions 430*aa* and 430*ba* of the springs 430*a* and 430*b*, respectively, are compressed between the insulator 430*c* and the inside surface of the tubular member 416, and apply a reaction or biasing force against the insulator 430*c*. As a result, the contact assembly 430 is snugly fit within the tubular member 416, and any free sliding or free translation of the contact assembly 430 within the tubular member 416 is substantially prevented. The contact assembly 430 is pushed down into the tubular member 416 until the contact insulator 430*c* engages the pads 416*j* and 416*l*, which serve to stop any further downward movement of the contact assembly 430*c*.

The receipt of the contact assembly 428 by the tubular member 416 is substantially similar to the above-described receipt of the contact assembly 430 by the tubular member 416, with the ribs 416*m* and 416*o* extending within the channels 428*cd* and 428*ce*, respectively, and therefore will not be described in further detail.

As noted above, the track 418 is coupled to the tubular member 416. More particularly, the track 418 is received by the tubular member 416, extending through the opening 416*c* and into the interior of the tubular member 416 until an end of the track 418 is positioned proximate to the cover plate 426. The protrusions 416*e* and 416*q* extend into channels 418*a* and 418*b* in the track 418, which are substantially similar to the channels 20*g* and 20*e*, respectively, of the track 12. The extension of the protrusions 416*e* and 416*q* into the channels 418*a* and 418*b*, respectively, and the correspondence between the profile of the opening 416*c* and the perimeter outline of the cross-section of the track 418, serve to align and/or guide the track 418 as it is received by the tubular member 416.

In an exemplary embodiment, set screws may be engaged with the internal threaded connections of the bores 416*f* and 416*g*, extend up into the channel 418*a* of the track 418, and contact the track 418, thereby locking the track 418 to the tubular member 416.

As a result of the coupling of the track 418 to the tubular member 416, the contacts 428*d*, 428*e* and 428*f* of the contact assembly 428 contact the buss bars 422*c*, 422*b* and 422*a*, respectively, of the track 418. The contacts 430*d*, 430*e* and 430*f* of the contact assembly 430 contact the buss bars 420*c*, 420*b* and 420*a*, respectively, of the track 418.

The system 414 contains several of the same wires as in the system 380, which are given the same reference numerals. In the system 414, a wire 432 is electrically coupled to the terminal 388*b* and the contact 354*a*, which contacts the buss bar 26*a* of the track 12. A wire 434 is electrically coupled to the terminal 388*c* and the contact 430*f*, which contacts the buss bar 420*a* of the track 418. A wire 436 is electrically coupled to the terminal 388*a* and the contact 366*a*, which contacts the buss bar 370*a* of the track 313.

A wire 438 is electrically coupled to terminal 386*b* and the contact 354*c*, which contacts the buss bar 26*c* of the track 12. A wire 440 is electrically coupled to the terminal 386*c* and the contact 430*d*, which contacts the buss bar 420*c* of the track 313. A wire 442 is electrically coupled to the terminal 386*a* and the contact 366*c*, which contacts the buss bar 370*c* of the track 313. A wire 444 is electrically coupled to the terminal 390*c* and the contact 360*c*, which contacts the buss bar 28*c* of the track 12. A wire 446 is electrically coupled to the terminal 390*b* and the contact 428*d*, which contacts the buss bar 422*c* of the track 418. A wire 448 is electrically coupled to the terminal 390*a* and the contact 368*c*, which contacts the buss bar 372*c* of the track 313. A wire 450 is electrically coupled to the terminal 384*a* and the contact 360*a*, which contacts the buss bar 28*a* of the track 12. A wire 452 is electrically coupled to the terminal 384*b* and the contact 428*f*, which contacts the buss bar 422*a* of the track 418. A wire 454 is electrically coupled to the terminal 384*c* and the contact 368*a*, which contacts the buss bar 372*a* of the track 313.

In an exemplary embodiment, during operation and as a result of the above-described electrical couplings, the system 30*a* supplies AC electrical power to the connector 312 via the wires 402 and 408 so that the voltage V1 is generated across the terminals 388*b* and 386*b*. As a result, AC electrical power at the voltage V1 is supplied to the buss bars 26*a* and 26*c* of the track 12, the buss bars 420*a* and 420*b* of the track 418, and the buss bars 370*a* and 370*c* of the track 313. As a result, the voltage V1 is generated across the buss bars 26*a* and 26*c* of the track 12, the buss bars 420*a* and 420*c* of the track 418, and the buss bars 370*a* and 370*c* of the track 313.

Moreover, electrical power at the voltage V2 may be transferred between the buss bars 28*a* and 28*c* of the track 12, and the buss bars 372*a* and 372*c* of the track 313. Moreover, electrical power at the voltage V2 may be transferred between the buss bars 28*a* and 28*c* of the track 12, and the buss bars 422*a* and 422*c* of the track 418. Moreover, electrical power at the voltage V2 may be transferred between the buss bars 422*a* and 422*c* of the track 418, and the buss bars 372*a* and 372*c* of the track 313. Moreover, electrical power at the voltage V3 may be transferred between the buss bars 26*b* and 28*b* of the track 12, and the buss bars 370*b* and 372*b* of the track 313.

In an exemplary embodiment, the system 414 may be rewired so that the wires 402 and 408 are electrically coupled to and extend from the power supply 31 so that, during operation, the power supply 31 supplies DC electrical power to the connector 312, generating the voltage V3 across the terminals 388*b* and 386*b*. As a result, DC electrical power may be transferred at the voltage V3 to the buss bars 26*b* and 28*b* of the track 12, the buss bars 370*b* and 372*b* of the track 313, and the buss bars 420*b* and 422*b* of the track 418. As a result, the voltage V3 may be generated across the buss bars 26*b* and 28*b* of the track 12, the buss bars 370*b* and 372*b* of the track 313, and the buss bars 420*b* and 422*b* of the track 418. Moreover, in an exemplary embodiment, AC electrical power at the voltage V1 may also be transferred between the tracks 12 and 313, the tracks 12 and 418, and the tracks 313 and 418. Moreover, in an exemplary embodiment, AC electrical power at the voltage V2 may also be transferred between the tracks 12 and 313, the tracks 12 and 418, and the tracks 313 and 418. In an exemplary embodiment, the system 414 may be rewired so that AC electrical power at the voltage V2 is supplied by the source 30*b* to the connector 312, which then transfers the electrical power at the voltage V2 to the tracks 12, 313 and 418. In several exemplary embodiments, a wide variety of wiring configurations are possible in the system 414.

Figure 63A:
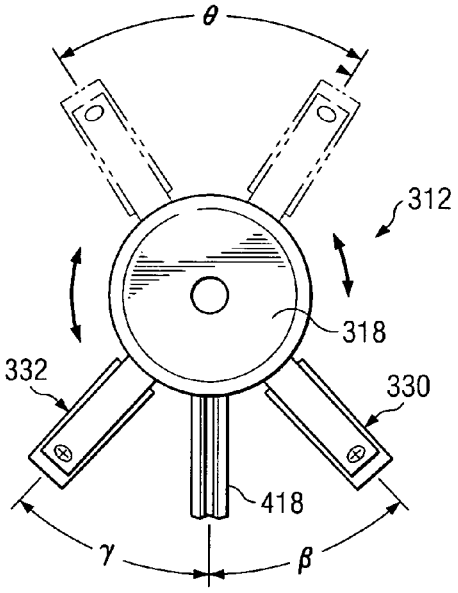
FIG. 63A is a top plan view of the track-connection system of FIG. 58.

In an exemplary embodiment, during operation and as illustrated in FIG. 63A, the adjustable pivot connection provided by the connector 312 in the system 414 defines an adjustable angle β between the centerline of the side housing 330 or the track 12 and the centerline of the track 418, and an adjustable angle γ between the centerline of the side housing 332 or the track 313 and the centerline line of the track 418, in addition to defining the above-described adjustable angle θ between the centerline of the side housing 330 or the track 12 and the centerline of the track 313. In an exemplary embodiment, the angles β and γ may each be adjusted down to about 70 degrees.

Figure 63B:
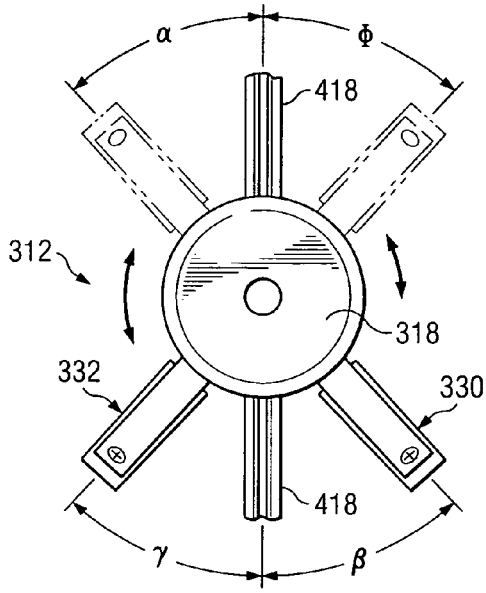
FIG. 63B is another top plan view of the track-connection system of FIG. 58 but depicting a track extending all the way through the portion of the track-connection system depicted in FIGS. 59, 60 and 61.
Figure 64:
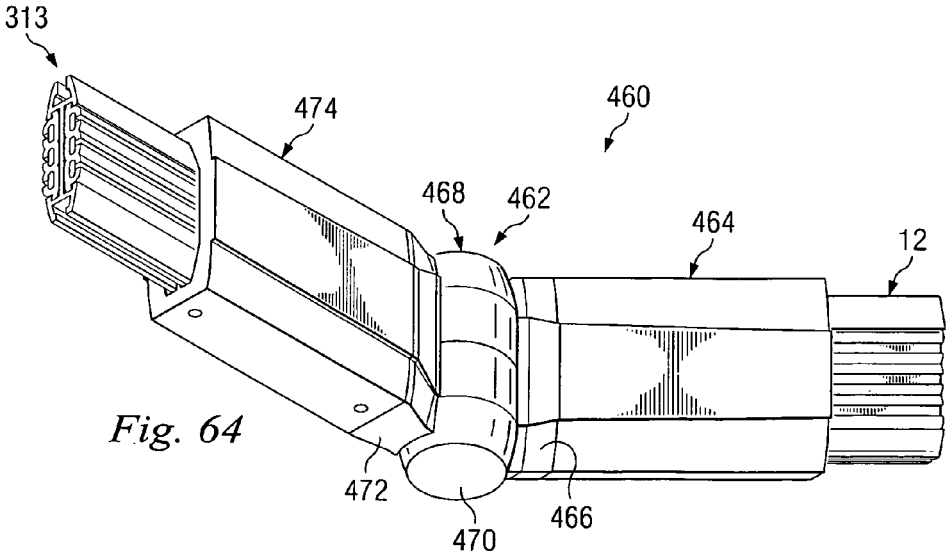
FIG. 64 is a perspective view of a track-connection system according to another embodiment.
Figure 65:
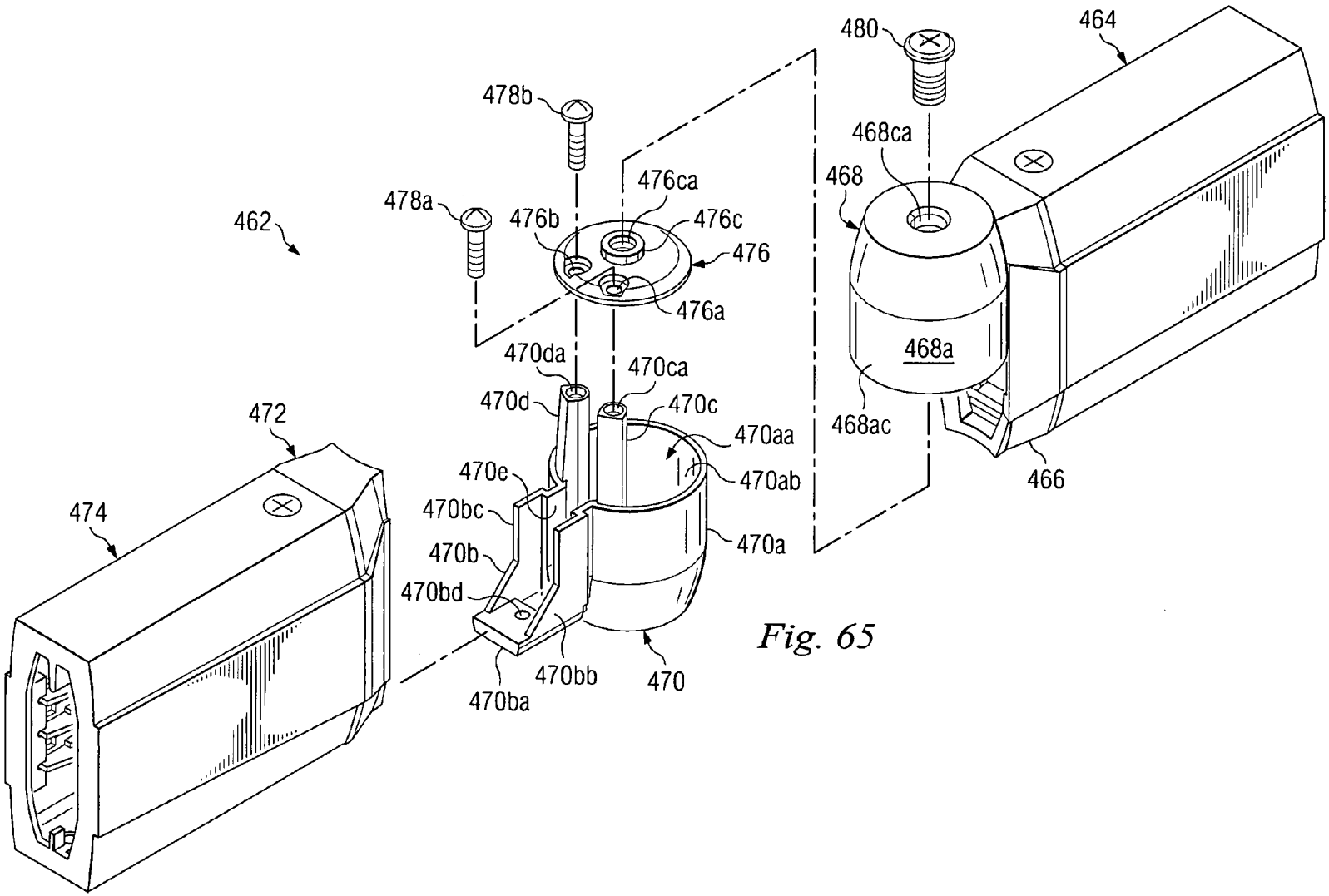
FIG. 65 is a partial exploded/partial perspective view of the track-connection system of FIG. 64.

In an exemplary embodiment, as illustrated in FIG. 63B, the cover plate 426 may be removed from the tubular member 416 and the track 418 may be positioned so that the track 418 extends completely through tubular member 416, that is, through the opening 416*c*, the interior of the tubular member 416, and the opening 416*d*.

In an exemplary embodiment, during operation and as illustrated in FIG. 63B, the adjustable pivot connection provided by the connector 312 in the system 414, when the track 418 extends all the way through the tubular member 416, defines the adjustable angle β between the centerline of the side housing 330 or the track 12 and the centerline of the track 418, and the adjustable angle γ between the centerline of the side housing 332 or the track 313 and the centerline line of the track 418. In an exemplary embodiment, the angles β and γ may each be adjusted down to about 70 degrees. Moreover, the adjustable pivot connection provided by the connector 312 in the system 414, when the track 418 extends all the way through the tubular member 416, defines an adjustable angle ϕ between the centerline of the side housing 330 or the track 12 and the centerline of the portion of the track 418 that extends through the opening 416*d* and from the tubular member 416, and defines an adjustable angle α between the centerline of the side housing 332 or the track 313 and the centerline of the portion of the track 418 that extends through the opening 416*d* and from the tubular member 416. In an exemplary embodiment, the adjustable angle β, the adjustable angle α, the adjustable angle ϕ and the adjustable angle α may each be adjusted down to about 70 degrees.

In an exemplary embodiment, as illustrated in FIGS. 64, 65, 66, 67, 68 and 69, a track-connection system is generally referred to by the reference numeral 460 and includes several parts of one or more of the above-described assemblies and/or systems, which are given the same reference numerals. In the system 460, a connector 462 is coupled to the track 12 and the track 313 so that the tracks 12 and 313 are adjustably pivotally coupled to one another via the connector 462.

In an exemplary embodiment, the connector 462 includes a side housing 464 coupled to an adapter 466, which, in turn, is coupled to an upper housing 468. A lower housing 470 is coupled to the upper housing 468, and an adapter 472 is coupled to the lower housing 470. A side housing 474 is coupled to the adapter 472.

The lower housing 470 includes a cylindrical portion 470*a* defining an internal region 470*aa*, an inside surface 470*ab* and an outside generally cylindrical surface 470*ac*, and further includes an extension portion 470*b* extending from the cylindrical portion 470*a* and including a tab 470*ba* and spaced side walls 470*bb* and 470*bc* extending upward from the tab 470*ba* and outward from the cylindrical portion 470*a*. The extension portion 470*b* further includes a bore 470*bd* having an internal threaded connection and extending through the tab 470*ba*, and a channel 470*be* defined in the tab 470*ba*. A pair of bosses 470*c* and 470*d* including bores 470*ca* and 470*da* having respective internal threaded connections extend upward from an inside surface of the cylindrical portion 470*a*. An opening 470*e* into the region 470*aa* is defined by the side walls 470*bb* and 470*bc*.

The upper housing 468 includes a cylindrical portion 468*a* defining an internal region 468*aa*, an inside surface 468*ab* and an outside generally-cylindrical surface 468*ac*, and further includes an extension portion 468*b* extending from the cylindrical portion 468*a*, and a protrusion 468*c* extending from the inside surface 468*ab* and having an countersunk bore 468*ca* formed therethrough. The extension portion 468*b* of the upper housing 468 is the symmetric equivalent to the extension portion 470*b* of the lower housing 470, about both the horizontal and vertical axes as viewed in FIG. 66, and therefore will not be described in detail. The connector 462 further includes a cap 476 having a countersunk bores 476*a* and 476*b*, and a protrusion 476*c* including bore 476*ca* having an internal threaded connection.

When the connector 462 is in its assembled condition, fasteners 478*a* and 478*b* extend through the countersunk bores 476*a* and 476*b*, respectively, of the cap 476 and engage the internal threaded connections of the bores 470*ca* and 470*da*, respectively, of the bosses 470*c* and 470*d*, respectively, of the lower housing 470, thereby coupling the cap 476 to the lower housing 470. A fastener 480 extends through the countersunk bore 468*ca* of the upper housing 468, and engages the internal threaded connection of the bore 476*ca* of the cap 476, thereby coupling the upper housing 468 to the cap 476 and the lower housing 470. As a result, the distal end of the protrusion 468*c* of the upper housing 468 contacts or nearly contacts the distal end of the protrusion 476*c* of the cap, and an end of the cylindrical portion 468*a* of the upper housing 468 contacts or nearly contacts an end of the cylindrical portion 470*a* of the lower housing 470.

The adapter 472 includes a wall 472*a* having an opening 472*aa* and defining a curved surface 472*ab*. Side portions 472*b* and 472*c* extend from the wall 472*a* and include notches 472*ba* and 472*ca*, respectively, formed therein. Top and bottom walls 472*d* and 472*e* extend between the wall 472*a* and the side walls 472*b* and 472*c*. A protrusion 472*f* extends downward from the top wall 472*d*, and a protrusion 472*g*, extends upward from the bottom wall 472*e*. A generally vertically-extending face surface 472*h* is defined by the top wall 472*d*, the bottom wall 472*e* and the side portions 472*b* and 472*c*.

The side housing 474 is substantially similar to the side housing 330 of above-described connector 312 and therefore will not be described in detail, except that the side housing 474 instead includes a top wall 474*a*, in the place of the angularly-extending tab 330*a* and the top opening 330*b* that are each found in the side housing 330, and a countersunk bore 474*b* extending through the top wall 474*a*.

Contact assemblies 482 and 484 are disposed within the side housing 474. The contact assembly 482 includes a contact insulator spring 485, a contact insulator 486 and contacts 488*a*, 488*b* and 488*c*, which are each substantially similar to the contact insulator spring 350, the contact insulator 352 and the contacts 354*a*, 354*b* and 354*c*, respectively, of the contact assembly 346 of the connector 312, and therefore will not be described in detail. The contact assembly 484 includes a contact insulator spring 490, a contact insulator 492 and contacts 494*a*, 494*b* and 494*c*, which are each substantially similar to the contact insulator spring 356, the contact insulator 358 and the contacts 360*a*, 360*b* and 360*c*, respectively, of the contact assembly 348 of the connector 312, and therefore will not be described in detail.

A bar 496 includes a bore 496*a* having an internal threaded connection, and a curved end portion 496*b*. The bar 496 extends within the side housing 474 so that the countersunk bore 474*b* of the side housing 474 is axially aligned with the bore 496*a* of the bar 496, and a fastener 498 extends through the countersunk bore 474*b* and engages the internal threaded connection of the bore 496*a*. The adapter 472 is received within the side housing 474 so that the curved end portion 496*b* of the bar 496 extends or curves around the protrusion 472*e* of the adapter 472, thereby at least in part securing the adapter 472 to the side housing 474, and so that the face surface 472*h* abuts or nearly abuts an end of the side housing 474. As a result of the side housing 474 receiving the adapter 472, the contact assemblies 482 and 484 are each captured within the side housing 474, in a manner substantially similar to the manner in which the contact assemblies 346 and 348 are captured within the side housing 330 in the system 310, with the notches 472*ba* and 472*ca* of the adapter 472 in the system 460 performing the same function as the slots 342*ba* and 342*ca* of the end plate 342 in the system 310.

The extension portion 470*b* is received within the side housing 474, extending through the opening 472*aa* in the adapter 472, so that the bore 470*bd* in the tab 470*ba* of the extension portion 470*b* is axially aligned with a bore 474*c* having an internal threaded connection in the side housing 474. A fastener 500 is engaged with the internal threaded connection of the bore 474*c* and the internal threaded connection of the bore 470*bd*, thereby locking the lower housing 470 to the side housing 474. Moreover, the protrusion 472*f* of the adapter 472 extends into the channel 470*be* defined in the tab 470*ba* of the extension portion 472*b* of the lower housing 470. As a result, the adapter 472 is captured between the side housing 474 and the lower housing 470 and the curved surface 472*ab* of the adapter 472 contacts or nearly contacts the outside surface 468*ac* of the cylindrical portion 468*a* of the upper housing 468, and the outside surface 470*ac* of the cylindrical portion 470*a* of the lower housing 470.

Figure 66:
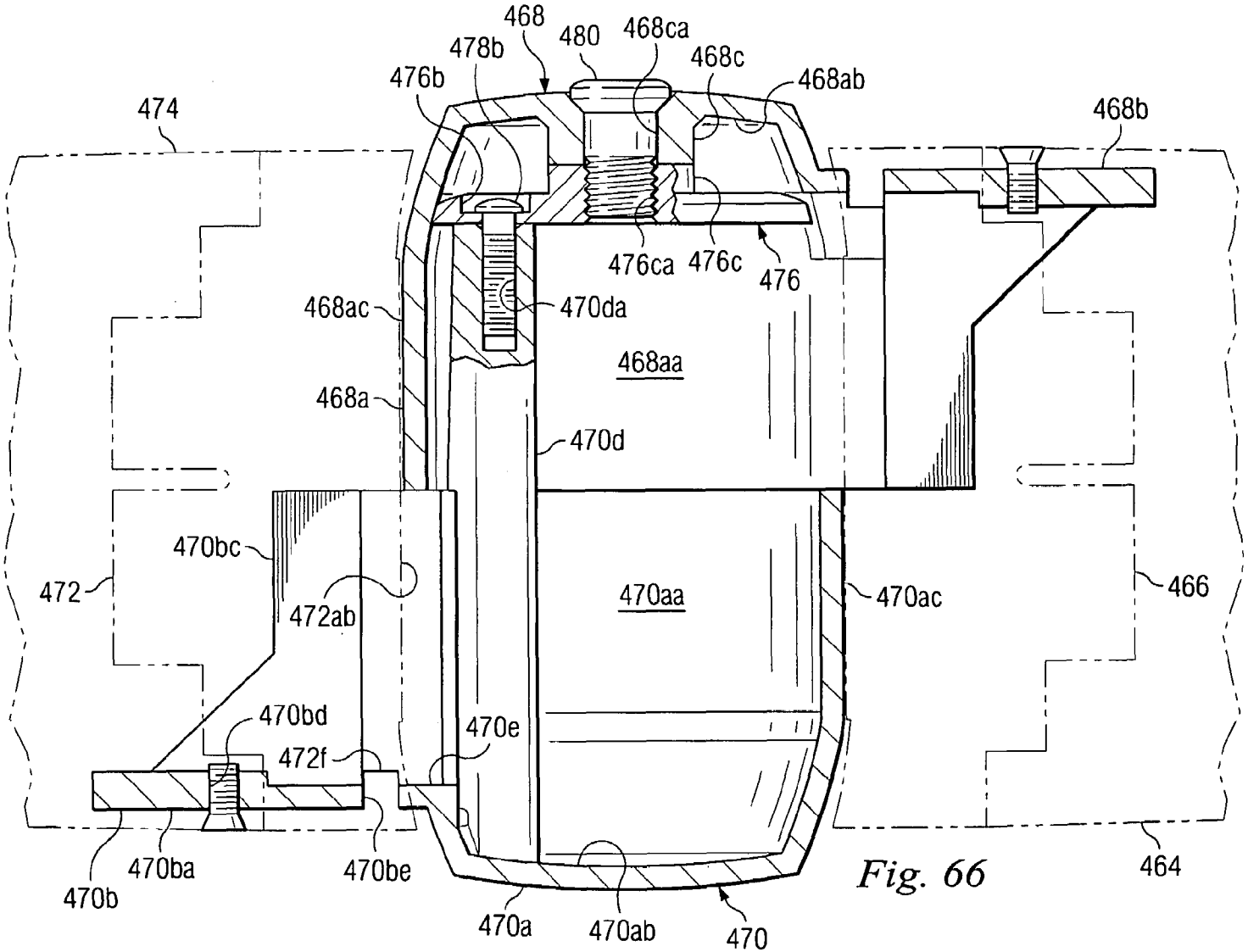
FIG. 66 is a sectional view of a portion of the track-connection system of FIG. 64.
Figure 67:
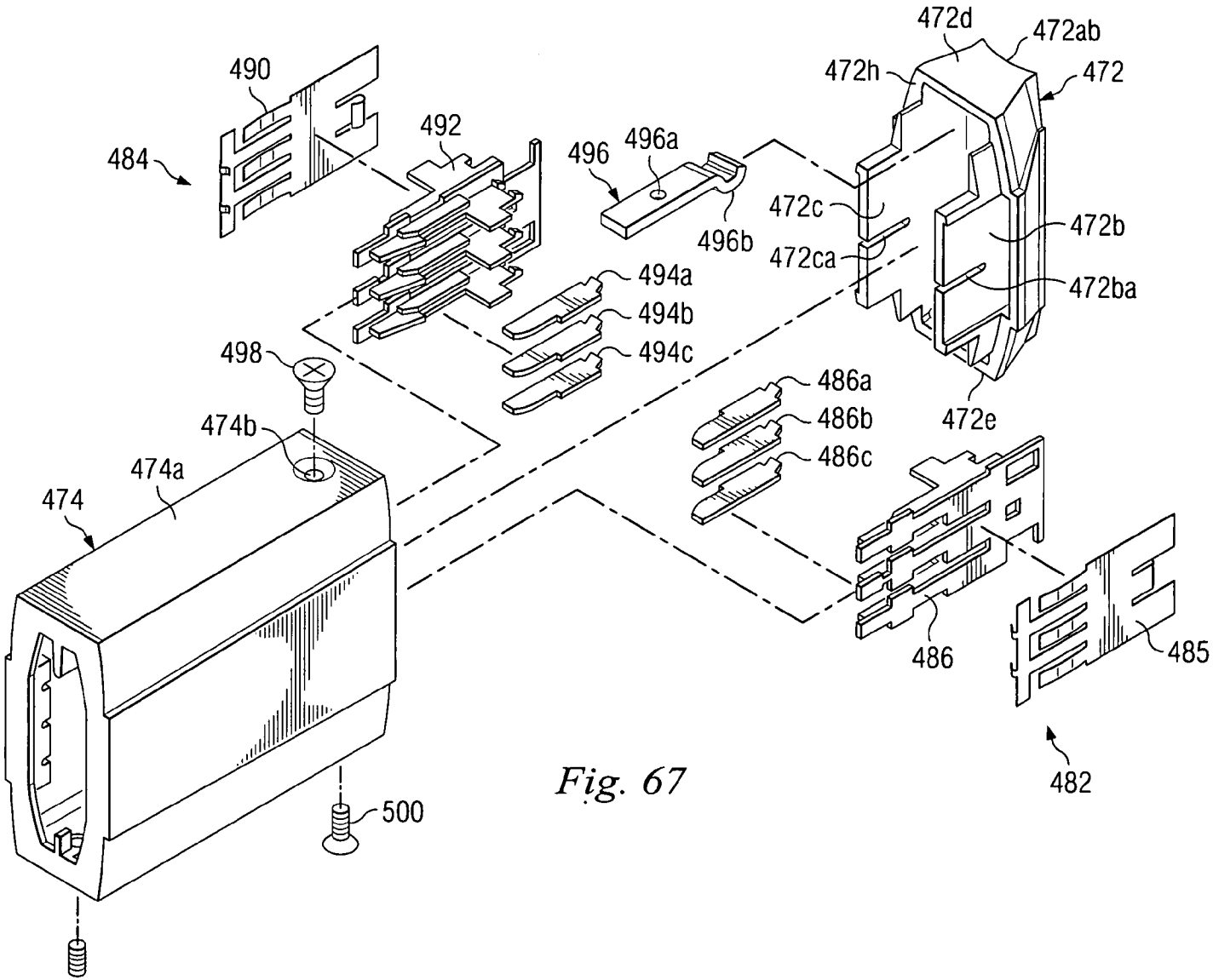
FIG. 67 is an exploded view of a side housing of the track-connection system of FIG. 64.
Figure 68:
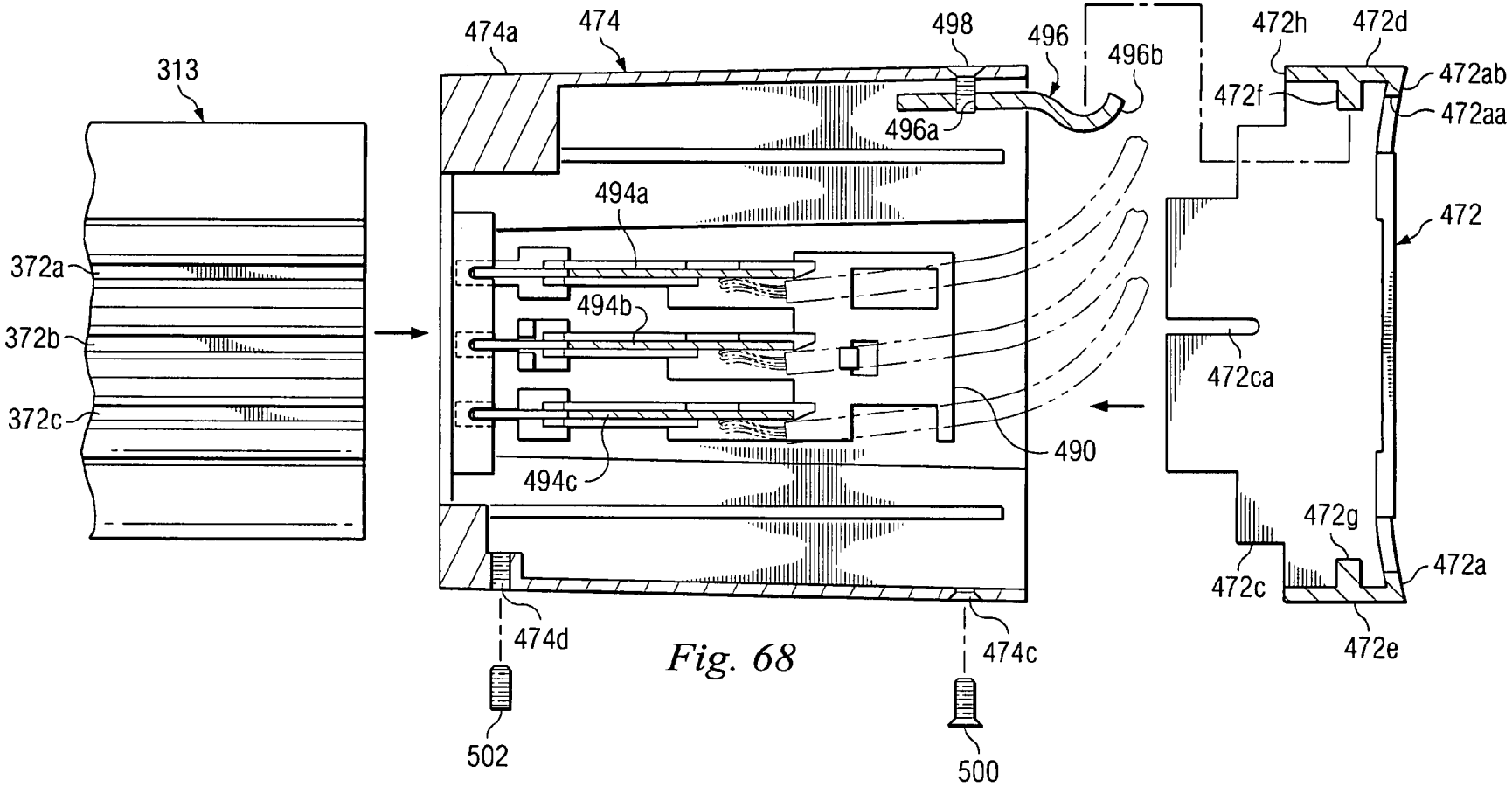
FIG. 68 is a sectional view of the side housing depicted in FIG. 67.
Figure 69:
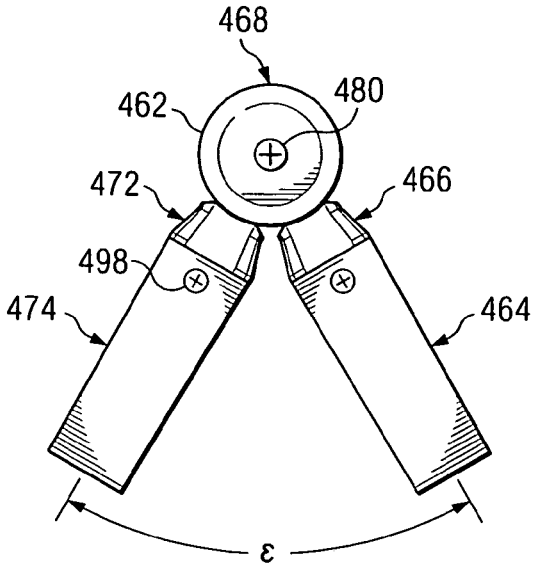
FIG. 69 is a top plan view of the track-connection system of FIG. 64.

The couplings between the upper housing 468, the adapter 466 and the side housing 464 are substantially similar and the symmetric equivalents to the couplings between the lower housing 470, the adapter 472 and the side housing 474, respectively, about the horizontal and vertical axes as viewed in FIG. 66, and therefore will not be described in detail. Although not shown, a bar substantially similar to the bar 496 at least in part secures the adapter 466 to the side housing 464.

Although not shown, two contact assemblies, which are substantially similar to the contact assemblies 482 and 484, are disposed and captured within the side housing 464 in a manner substantially similar to the manner in which the contact assemblies 482 and 484 are disposed and captured within the side housing 330. Although not shown, a wire is connected to each of the contacts 486*a*, 486*b*, 486*c*, 494*a*, 494*b* and 494*c*, and each wire extends through the opening 472*aa* in the adapter 472, through the region 470*aa* of the lower housing 470, through the region 468*aa* of the upper housing 468, through the adapter 466, and into the side housing 464, and is connected to a respective contact in the contact assemblies disposed and captured within the side housing 464.

The track 313 is received within and coupled to the side housing 474 so that the contacts 486*a*, 486*b* and 486*c* contact the buss bars 372*a*, 372*b* and 372*c*, respectively, of the track 313, and so that the contacts 494*a*, 494*b* and 494*c* contact the buss bars 370*a*, 370*b* and 370*c*, respectively, of the track 313. The track 313 is received within the side housing 474 in a manner substantially similar to the manner in which the track 12 is received within the side housing 330 in the system 380, and therefore this receipt will not be described in detail. A set screw 502 is engaged with an internal threaded connection of a bore 474*d* in the side housing 474 and contacts a surface of the track 313, thereby locking the track 313 to the side housing 474. The track 12 is received within and coupled to the side housing 464 in a manner substantially similar to the manner in which the track 313 is received within and coupled to the side housing 474 and therefore this receipt will not be described in detail.

In an exemplary embodiment, during operation and when the tracks 12 and 313 are received by the side housings 464 and 474, respectively, as described above, the buss bar 26*a* of the track 12 is electrically coupled to the buss bar 370*a* of the track 313 via the contact 494*a* and the corresponding contact in the side housing 464 and the wire extending therebetween.

The buss bar 26*b* of the track 12 is electrically coupled to the buss bar 370*b* of the track 313 via the contact 494*b* and the corresponding contact in the side housing 464 and the wire extending therebetween. The buss bar 26*c* of the track 12 is electrically coupled to the buss bar 370*c* of the track 313 via the contact 494*c* and the corresponding contact in the side housing 464 and the wire extending therebetween. The buss bar 28*a* of the track 12 is electrically coupled to the buss bar 372*a* of the track 313 via the contact 486*a* and the corresponding contact in the side housing 464 and the wire extending therebetween. The buss bar 28*b* of the track 12 is electrically coupled to the buss bar 372*b* of the track 313 via the contact 486*b* and the corresponding contact in the side housing 464 and the wire extending therebetween. The buss bar 28*c* of the track 12 is electrically coupled to the buss bar 372*c* of the track 313 via the contact 486*c* and the corresponding contact in the side housing 464 and the wire extending therebetween.

As a result of the above-described electrical couplings between the tracks 12 and 313, if the voltage V1 is present across the buss bars 26*a* and 26*c*, then electrical power is transferred at the voltage V1 from the buss bars, 26*a* and 26*c*, to the buss bars, 370*a* and 370*c*, via the connector 462. If the voltage V2 is present across the buss bars 28*a* and 28*c*, then electrical power is transferred at the voltage V2 from the buss bars, 28*a* and 28*c*, to the buss bars, 372*a* and 272*c*, via the connector 462. If the voltage V3 is present across the buss bars 26*b* and 28*b*, then electrical power is transferred at the voltage V3 from the buss bars, 26*b* and 28*b*, to the buss bars, 370*b* and 372*b*, via the connector 462. Conversely, and in an exemplary embodiment, electrical power may be transferred from the track 313 to the track 12 in a manner substantially identical to the above-described manner in which electrical power may be transferred from the track 12 to the track 313. In an exemplary embodiment, the voltages V1 and V2 may each be 120 volts and the voltage V3 may be 12 volts.

Moreover, during operation and as noted above, the connector 462 provides a pivot connection between the tracks 12 and 313. As a result of the pivot connection between the tracks 12 and 313, an angle $\epsilon$ is defined between the centerlines of the side housings 464 and 474, with the angle $\epsilon$ generally corresponding to the angle between the centerlines of the tracks 12 and 313.

In an exemplary embodiment, the connector 312 provides an adjustable pivot connection between the tracks 12 and 313. As a result, the angle $\epsilon$ is adjustable over a predetermined angular range. To adjust the pivot connection between the tracks 12 and 313, and therefore the angle $\epsilon$, the upper housing 468 may be rotated relative to the lower housing 470, or vice versa.

If the upper housing 468 is rotated to adjust the angle $\epsilon$, then the upper housing 468 rotates relative to the cap 476 and the lower housing 470. In an exemplary embodiment, the fastener 480 may be loosened before rotating the upper housing 468. In an exemplary embodiment, the curved surface of the adapter 466 that is substantially similar to the curved surface 472*ab* of the adapter 472 rotates along the outside surface 470*ac* of the lower housing 470, permitting the adapter 466 and the side housing 464 to rotate along with the upper housing 468. If the lower housing 470 is rotated to adjust the angle $\epsilon$, then the lower housing 470 and the cap 476 rotate relative to the upper housing 468. In an exemplary embodiment, the curved surface 472*ab* of the adapter 472 rotates along the outside surface 468*ac* of the upper housing 468, permitting the adapter 472 and the side housing 474 to rotate along with the lower housing 470.

In an exemplary embodiment, the angle $\epsilon$ may be adjusted in any manner described above, or in any combination thereof, over a predetermined angular range ranging from about 60 degrees to about 300 degrees. That is, in an exemplary embodiment, the minimum value for the angle $\epsilon$ may be about 60 degrees, and therefore the angle between the centerlines of the side housings 464 and 474, and the angle between the centerlines of the tracks 12 and 313, may be adjusted down to about 60 degrees.

After the angle $\epsilon$ has been adjusted to the desired value, the connector 462 maintains the angle $\epsilon$, thereby holding the pivot connection between the side housings 464 and 474, and therefore the pivot connection between the tracks 12 and 313, in place. More particularly, the forces associated with the engagement between the fastener 480 and the internal threaded connection of the bore 476*ca*, any frictional forces associated with the coupling between the upper housing 468 and the lower housing 470, and/or any forces associated with any of the above-described couplings of the connector 462, holds the pivot connection between the tracks 12 and 313 in place. In an exemplary embodiment, the fastener 480 may be tightened after the angle $\epsilon$ has been adjusted to the desired value.

In several exemplary embodiments, one or more wires extending within the connector 462 and the contacts connected thereto may be removed from the connector 462 so that electrical power may only be transferred between the buss bars, 26*a* and 26*c*, and the buss bars, 370*a* and 370*c*, at the voltage V1, between the buss bars, 28*a* and 28*c*, and the buss bars 372*a* and 372*c*, at the voltage V2, between the buss bars, 26*b* and 28*b*, and the buss bars, 370*b* and 372*b*, at the voltage V3, or any combination thereof. In an exemplary embodiment, all of the wires extending within the connector 462 may be removed from the connector 462 so that electrical power is not transferred between the tracks 12 and 313. In such an exemplary embodiment, the contacts 486*a*, 486*b*, 486*c*, 494*a*, 494*b* and 494*c*, and the corresponding contacts in the side housing 464, may also be removed from the connector 462, along with the respective wires extending therebetween, so that electrical power is not transferred between the tracks 12 and 313.

In several exemplary embodiments, the connector 462 permits electrical power to be passed between the tracks 12 and 313, via up to three independent circuits. In an exemplary embodiment, the connector 462 permits electrical power to be passed between the tracks 12 and 313, via up to three independent circuits and at the voltages V1, V2 and V3, or any combination thereof. In several exemplary embodiments, a wide variety of wiring configurations are possible in the system 460.

Figure 70:
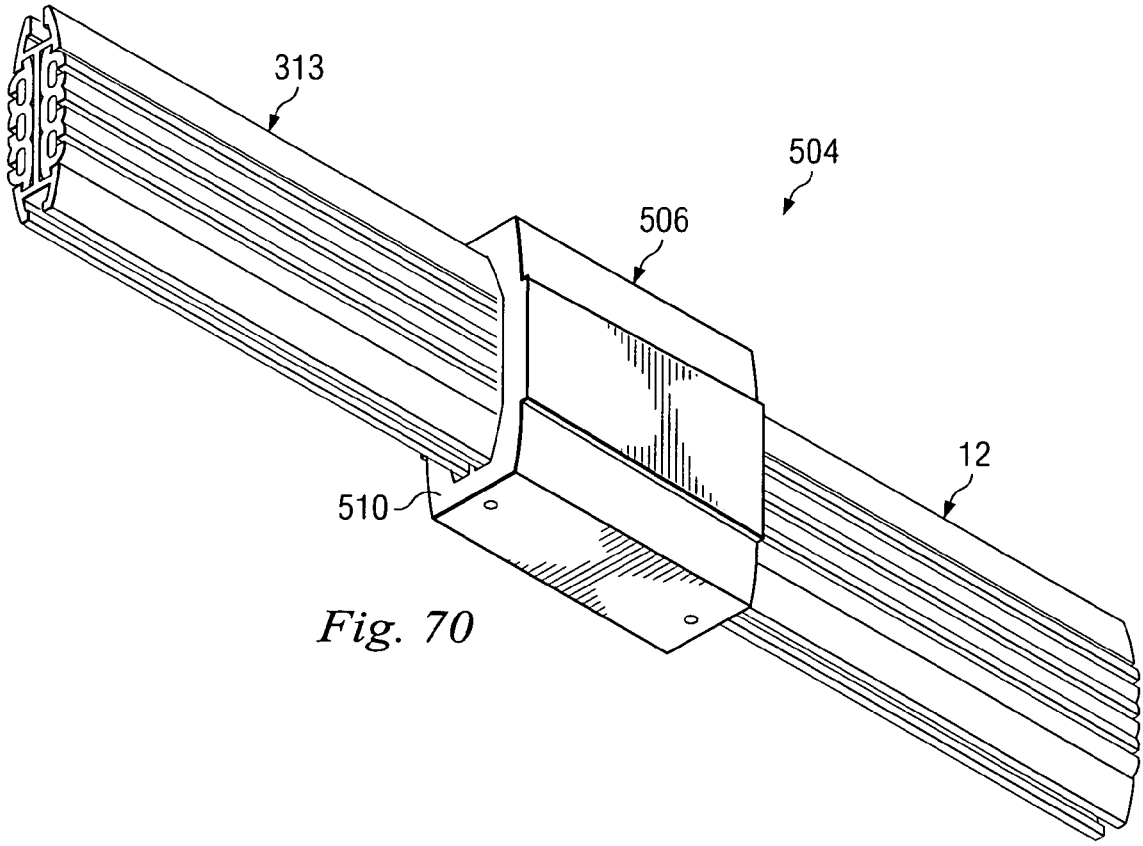
FIG. 70 is a perspective view of a track-connection system according to another embodiment.
Figure 71:
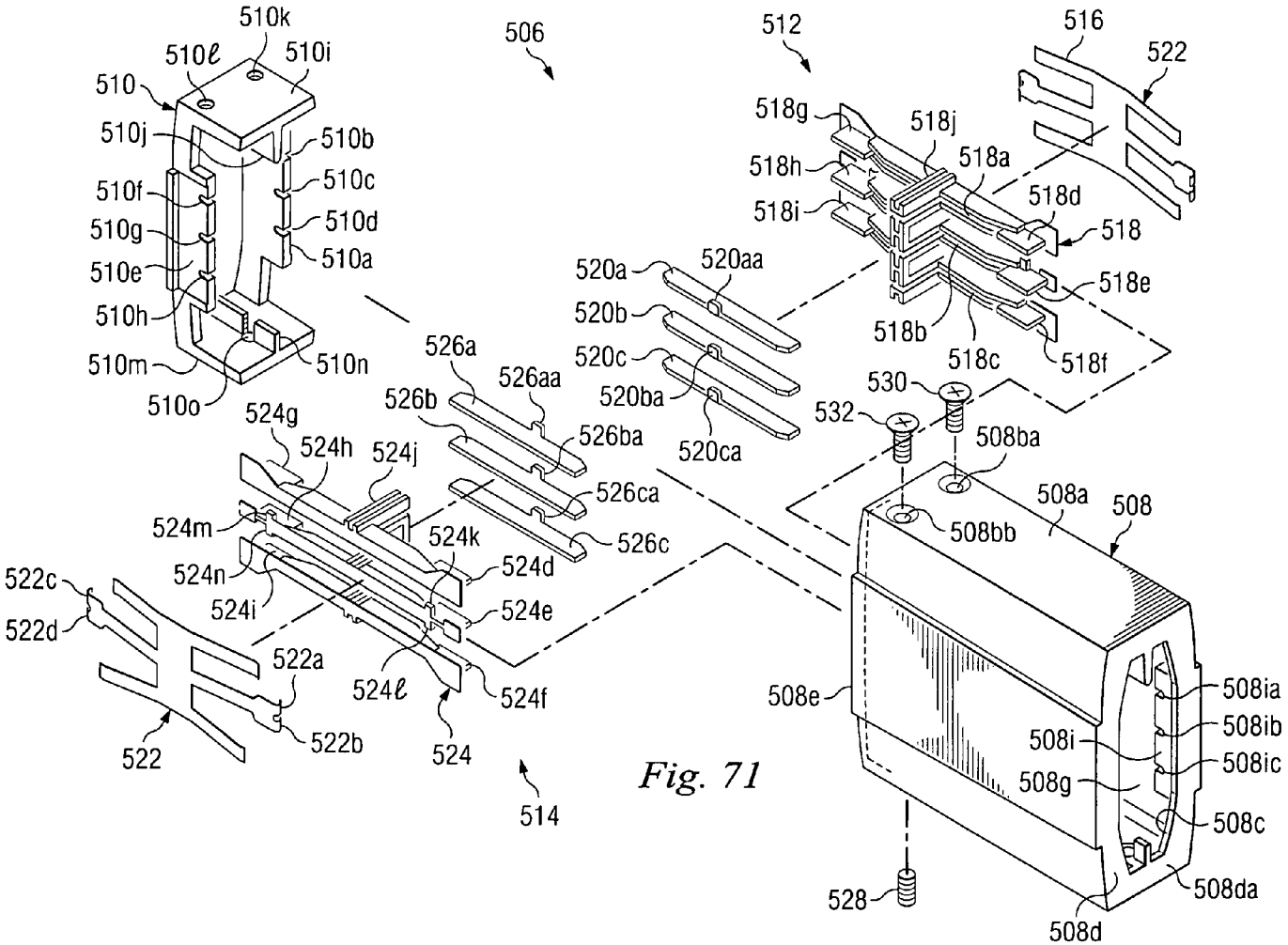
FIG. 71 is an exploded view of the track-connection system of FIG. 70.
Figure 72:
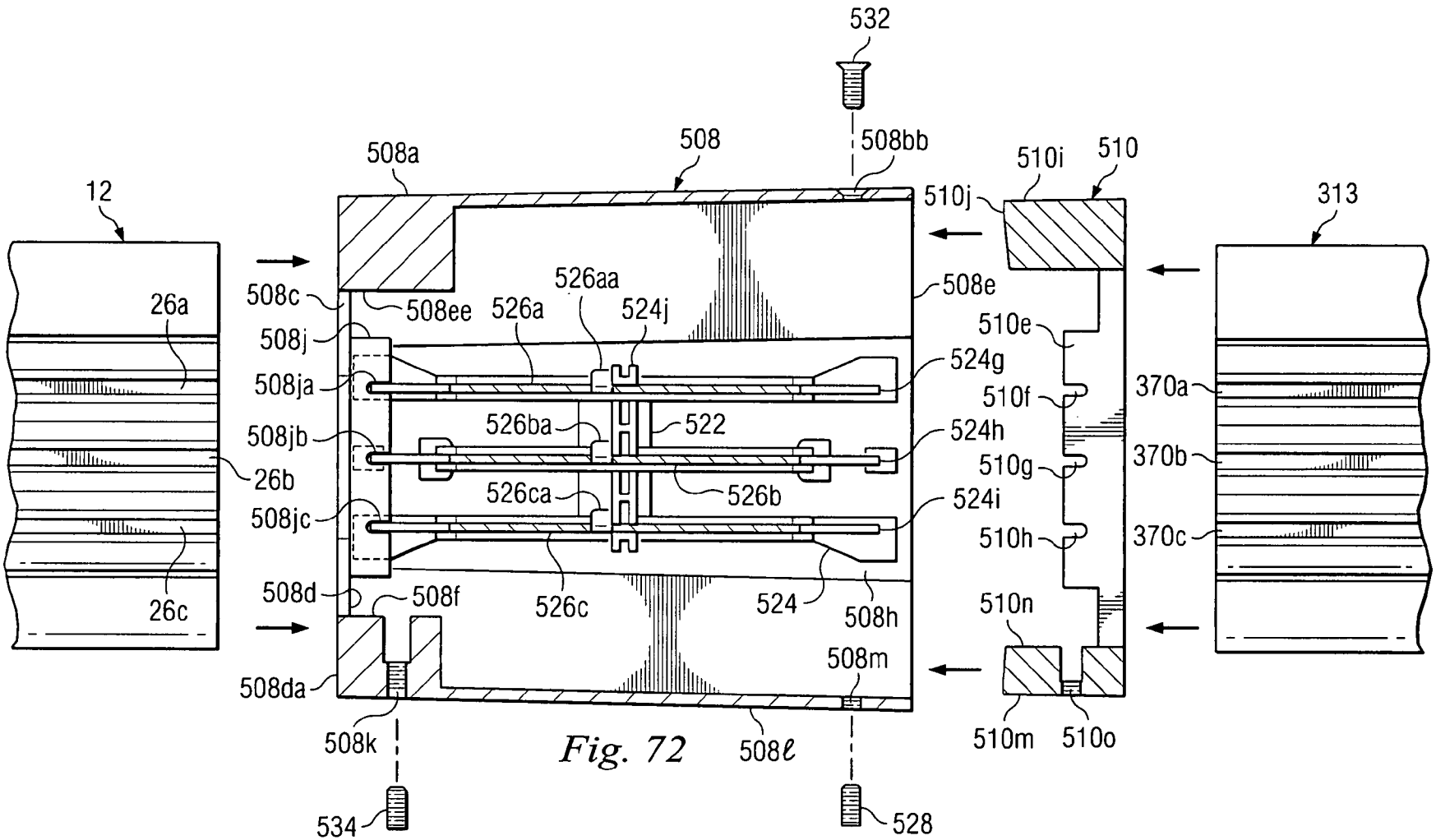
FIG. 72 is a sectional view of the track-connection system of FIG. 70.

In an exemplary embodiment, as illustrated in FIGS. 70, 71 and 72, a track-connection system is generally referred to by the reference numeral 504 and includes several parts of one or more of the above-described assemblies and/or systems, which are given the same reference numerals. In the system 504, a connector 506 is coupled to the track 12 and the track 313 so that the tracks 12 and 313 are coupled to one another via the connector 506.

The connector 506 includes a side housing 508, which receives an end plate 510, and in which contact assemblies 512 and 514 are disposed. The side housing 508 includes a top wall 508*a*, and a pair of countersunk bores 508*ba* and 508*bb* extending through the top wall 508*a*. The side housing 508 further includes a front opening 508*c* formed in a wall 508*d*, and a back opening 508*e*. The front opening 508*c* defines a profile that substantially corresponds to the perimeter outline of the cross-section of the track 12. A protrusion 508*ee*, an end of which is flush with a front surface 508*da* of the front wall 508*d*, extends downward and into the opening 508*c*. A protrusion 508*f*, an end of which is also flush with the front surface 508*da* of the wall 508*d*, extends upward and into the opening 508*c*. Symmetric and longitudinally-extending internal recesses 508*g* and 508*h* are formed in the side housing 508. Symmetric tabs 508*i* and 508*j* extend from the wall 508*d*, and include notches 508*ia*, 508*ib* and 508*ic*, and notches 508*ja*, 508*jb* and 508*jc*, respectively, formed therein. A bore 508*k* having an internal threaded connection extends upward through a bottom wall 508*l* and a protrusion 508*f*, and a bore 508*m* having an internal threaded connection extends through the bottom wall 508*l*.

The end plate 510 includes a side wall 510*a* having notches 510*b*, 510*c* and 510*d* formed therein, and a side wall 510*e* notches 510*f*, 510*g* and 510*h* formed therein. A top wall 510*i* includes a downwardly extending protrusion 510*j*, and bores 510*k* and 510*l* having respective internal threaded connections formed therethrough. A bottom wall 510*m* includes an upwardly extending protrusion 510*n*, and a bore 510*o* having an internal threaded connection formed through the wall 510*m* and the protrusion 510*n*.

The contact assembly 512 includes a contact insulator spring 516, a contact insulator 518 and contacts 520*a*, 520*b* and 520*c* having tabs 520*aa*, 520*ba* and 520*ca*, respectively. The contact insulator 518 includes channels 518*a*, 518*b* and 518*c* and tabs 518*d*, 518*e* and 518*f* aligned therewith, respectively. Tabs 518*g*, 518*h* and 518*i* are also aligned with the channels 518*a*, 518*b* and 518*c*, respectively, and the contact insulator 518 further includes a plurality of inwardly-extending protrusions 518*j*. When the contact assembly 512 is in its assembled condition, the contact insulator spring 516 is coupled to the contact insulator 518, in a manner to be described below, and the contacts 520*a*, 520*b* and 520*c* are disposed in the channels 518*a*, 518*b* and 518*c*, respectively.

The contact assembly 514 includes a contact insulator spring 522, a contact insulator 524 and contacts 526*a*, 526*b* and 526*c* having tabs 526*aa*, 526*ba* and 526*ca*, respectively. The contact insulator 524 includes channels 524*a*, 524*b* and 524*c* and tabs 524*d*, 524*e* and 524*f* aligned therewith, respectively. Tabs 524*g*, 524*h* and 524*i* are also aligned with the channels 524*a*, 524*b* and 524*c*, respectively, and the contact insulator 524 further includes a plurality of inwardly-extending protrusions 524*j*. When the contact assembly 514 is in its assembled condition, tabs 522*a* and 522*b* of the contact insulator spring 522 extend in notches 524*k* and 524*l*, respectively, of the contact insulator 524, and tabs 522*c* and 522*d* of the contact insulator spring 522 extend in notches 524*m* and 524*n*, respectively, of the contact insulator 524, thereby coupling the contact insulator spring 522 to the contact insulator 524. The contact insulator spring 516 is coupled to the contact insulator 518 in a manner substantially similar to the manner in which the contact insulator spring 522 is coupled to the contact insulator 524. Moreover, when the contact assembly 514 is in its assembled condition, the contacts 526*a*, 526*b* and 526*c* are disposed in the channels 524*a*, 524*b* and 524*c*, respectively, of the contact insulator 524.

The contact assembly 514 is received within the side housing 508 so that the tabs 524*d*, 524*e* and 524*f* extend within the notches 508*ja*, 508*jb* and 508*jc*, respectively, of the tab 508*j* of the side housing 508. Similarly, the contact assembly 512 is received within the side housing 508 so that the tabs 518*d*, 518*e* and 518*f* extend within the notches 508*ia*, 508*ib* and 508*i* respectively, of the tab 508*i* of the side housing 508. As a result, the distal ends of the protrusions 518*j* of the contact assembly 512 abut the tabs 526*aa*, 526*ba* and 526*ca* of the contacts 526*a*, 526*b* and 526*c*, respectively, of the contact assembly 514. As another result, the distal ends of the protrusions 524*j* of the contact assembly 514 abut the tabs 520*aa*, 520*ba* and 520*ca* of the contacts 520*a*, 520*b* and 520*c*, respectively, of the contact assembly 512.

The plate 510 is received within the back opening 508*e* of the side housing 508, and a set screw 528 engages the internal threaded connection of the bore 508*m* and the internal threaded connection of the bore 510*o*. Moreover, countersunk screws 530 and 532 extend through the countersunk bores 508*ba* and 508*bb*, respectively, and engage the internal threaded connections of the bores 510*k* and 510*l*, respectively. As a result, the plate 510 is locked to the side housing 508. As another result, the contact insulator springs 516 and 522 engage the internal recesses 508*g* and 508*h*, respectively, causing the springs 516 and 522 to apply a reaction or biasing force against the contact insulators 518 and 524, respectively, which, in turn, engage the pairs of tabs 508*i* and 510*a*, and 508*j* and 510*e*, respectively. As a result, the contact assemblies 512 and 514 are captured within the side housing 508.

The track 12 is received within the side housing 508, extending through the opening 508*c* so that the contacts 520*a*, 520*b* and 520*c* contact the buss bars 26*a*, 26*b* and 26*c*, respectively, and so that the contacts 526*a*, 526*b* and 526*c* contact the buss bars 28*a*, 28*b* and 28*c*, respectively. A set screw 534 engages the internal threaded connection of the bore 508*k* and extends into the channel 20*g* of the protrusion 20 of the track 12, thereby locking the track 12 to the side housing 508. An end of the track 12 may abut the protrusions 518*j*.

The track 313 is also received within the side housing 508, extending through the plate 510 so that the contacts 520*a*, 520*b* and 520*c* contact the buss bars 370*a*, 370*b* and 370*c*, respectively, and so that the contacts 524*a*, 524*b* and 524*c* contact the buss bars 372*a*, 372*b* and 372*c*, respectively. One or more of the set screw 528 and the countersunk screws 530 and 532 contact the track 313, thereby locking the track 313 to the side housing 508. An end of the track 313 may abut the protrusions 524*j*. As a result of the abutment of the track 12 to the protrusions 518*j*, and the abutment of the track 313 to the protrusions 524*j*, the tracks 12 and 313 are generally insulated from each other, being generally prevented from directly contacting each other.

In an exemplary embodiment, during operation and when the tracks 12 and 313 are received by the side housing 508 as described above, the buss bar 26*a* of the track 12 is electrically coupled to the buss bar 370*a* of the track 313 via the contact 520*a*. The buss bar 26*b* of the track 12 is electrically coupled to the buss bar 370*b* of the track 313 via the contact 520*b*. The buss bar 26*c* of the track 12 is electrically coupled to the buss bar 370*c* of the track 313 via the contact 520*c*. The buss bar 28*a* of the track 12 is electrically coupled to the buss bar 372*a* of the track 313 via the contact 526*a*. The buss bar 28*b* of the track 12 is electrically coupled to the buss bar 372*b* of the track 313 via the contact 526*b*. The buss bar 28*c* of the track 12 is electrically coupled to the buss bar 372*c* of the track 313 via the contact 526*c*.

As a result of the above-described electrical couplings between the tracks 12 and 313, if the voltage V1 is present across the buss bars 26*a* and 26*c*, then electrical power is transferred at the voltage V1 from the buss bars, 26*a* and 26*c*, to the buss bars, 370*a* and 370*c*, via the connector 506. If the voltage V2 is present across the buss bars 28*a* and 28*c*, then electrical power is transferred at the voltage V2 from the buss bars, 28*a* and 28*c*, to the buss bars, 372*a* and 272*c*, via the connector 506. If the voltage V3 is present across the buss bars 26*b* and 28*b*, then electrical power is transferred at the voltage V3 from the buss bars, 26*b* and 28*b*, to the buss bars, 370*b* and 372*b*, via the connector 506. Conversely, and in an exemplary embodiment, electrical power may be transferred from the track 313 to the track 12 in a manner substantially identical to the above-described manner in which electrical power may be transferred from the track 12 to the track 313. In an exemplary embodiment, the voltages V1 and V2 may each be 120 volts and the voltage V3 may be 12 volts.

In an exemplary embodiment, the contacts 520*b* and 526*b* may be removed from the connector 506 so that electrical power may only be transferred between the buss bars, 26*a* and 26*c*, and the buss bars, 370*a* and 370*c*, at the voltage V1, and between the buss bars, 28*a* and 28*c*, and the buss bars 372*a* and 372*c*, at the voltage V2. In an exemplary embodiment, the contacts 520*a* and 520*c* may be removed from the connector 506 so that electrical power may only be transferred between the buss bars, 26*b* and 28*b*, and the buss bars, 370*b* and 372*b*, at the voltage V3, and between the buss bars, 28*a* and 28*c*, and the buss bars 372*a* and 372*c*, at the voltage V2. In an exemplary embodiment, the contacts 526*a* and 526*c* may be removed from the connector 506 so that electrical power may only be transferred between the buss bars, 26*b* and 28*b*, and the buss bars, 370*b* and 372*b*, at the voltage V3, and between the buss bars, 26*a* and 26*c*, and the buss bars 370*a* and 370*c*, at the voltage V1. In an exemplary embodiment, the contacts 520*a*, 520*c*, 526*a* and 526*c* may be removed from the connector 506 so that electrical power may only be transferred between the buss bars, 26*b* and 28*b*, and the buss bars, 370*b* and 372*b*, at the voltage V3. In an exemplary embodiment, the contacts 520*a*, 520*b*, 520*c*, 526*a*, 526*b* and 526*c* may all be removed from the connector 506 so that electrical power is not transferred between the tracks 12 and 313. In several exemplary embodiments, the connector 506 permits electrical power to be passed between the tracks 12 and 313, via up to three independent circuits. In an exemplary embodiment, the connector 312 permits electrical power to be passed between the tracks 12 and 313, via up to three independent circuits and at the voltages V1, V2 and V3, or any combination thereof.

In several exemplary embodiments, one or more of the tracks 12, 313 and 418 may be coupled to one or more other tracks, which may be substantially similar to one or more of the tracks 12, 313 and 418, using, for example, any one or more of the above-described track-connection systems and/or connectors 310, 312, 380, 414, 460, 462, 504 and 506, and/or any combination thereof. In several exemplary embodiments, one or more of the tracks 12, 313 and 418 may be removed from any one or more of the above-described systems and/or connectors.

Figure 73:
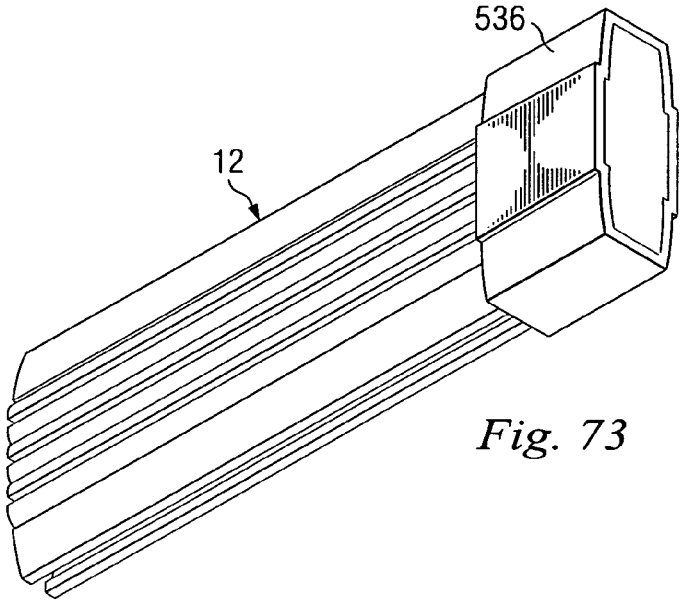
FIG. 73 is a perspective view of an end cap coupled to the track of FIG. 1.

In an exemplary embodiment, as illustrated in FIG. 73, an end cap 536 is coupled to an end of the track 12. The end cap 536 defines a region shaped to correspond to the perimeter outline of the cross-section of the track 12, and into which the track 12 extends so that the end cap 536 fits over the end of the track 12, forming a snug fit. In an exemplary embodiment, the end cap 536 may be composed of a plastic material.

In several exemplary embodiments, as illustrated in FIGS. 74A through 74I, a wide variety of lighting systems may be formed using one or more of the above-described embodiments and/or systems.

Figure 74A:
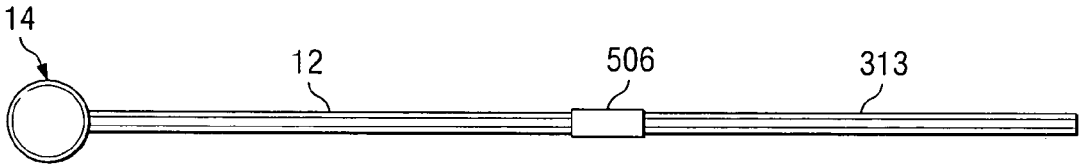
FIGS. 74A, 74B, 74C, 74D, 74E, 74F, 74G, 74H and 74I are top plan views of lighting systems according to various embodiments.
Figure 74B:
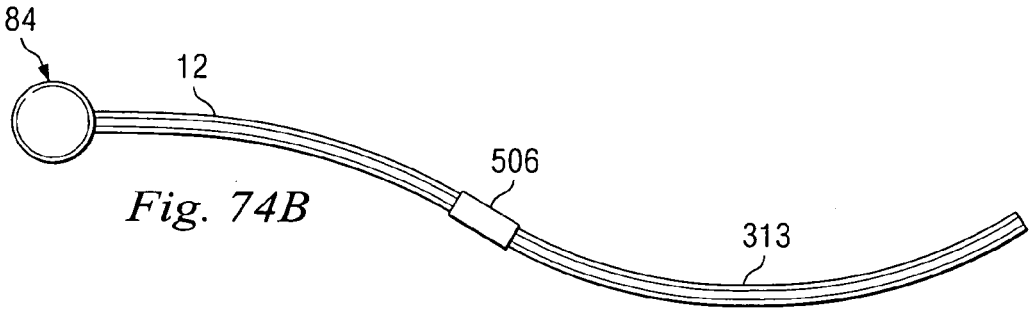

In an exemplary embodiment, as illustrated in FIG. 74A, the power feed assembly 14 is coupled to the track 12, which, in turn, is coupled to the connector 506. The track 313 is coupled to the connector 506. The tracks 12 and 313 extend in a straight configuration. In an exemplary embodiment, as illustrated in FIG. 74B, the power feed assembly 84 is coupled to the track 12, which, in turn, is coupled to the connector 506. The track 313 is coupled to the connector 506. The tracks 12 and 313 are each in a flexed or bent configuration.

Figure 74C:
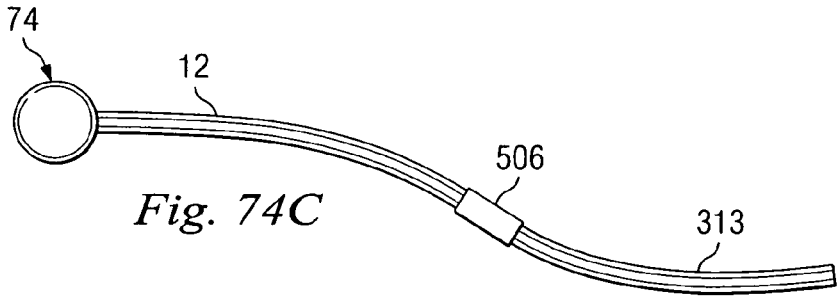
Figure 74D:
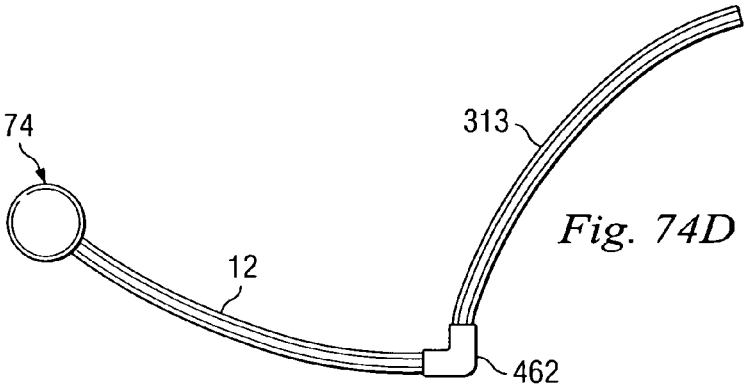

In an exemplary embodiment, as illustrated in FIG. 74C, the power feed assembly 74 is coupled to the track 12, which, in turn, is coupled to the connector 506. The track 313 is coupled to the connector 506. The tracks 12 and 313 are each in a flexed or bent configuration. In an exemplary embodiment, as illustrated in FIG. 74D, the power feed assembly 74 is coupled to the track 12, which, in turn, is coupled to the connector 462. The track 313 is coupled to the connector 462. The tracks 12 and 313 are each in a flexed or bent configuration.

Figure 74E:
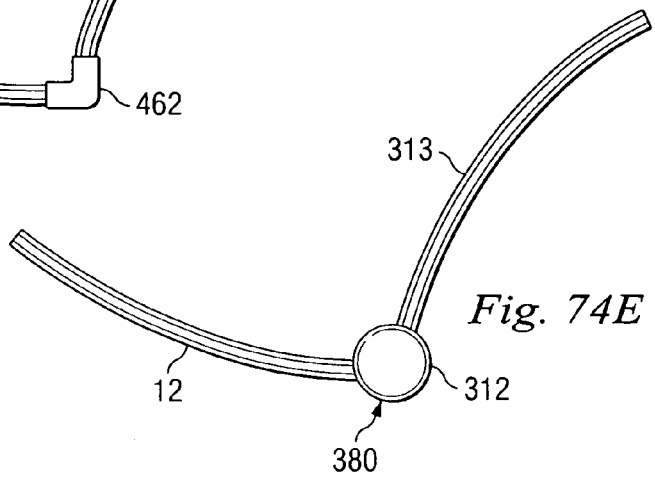
Figure 74F:
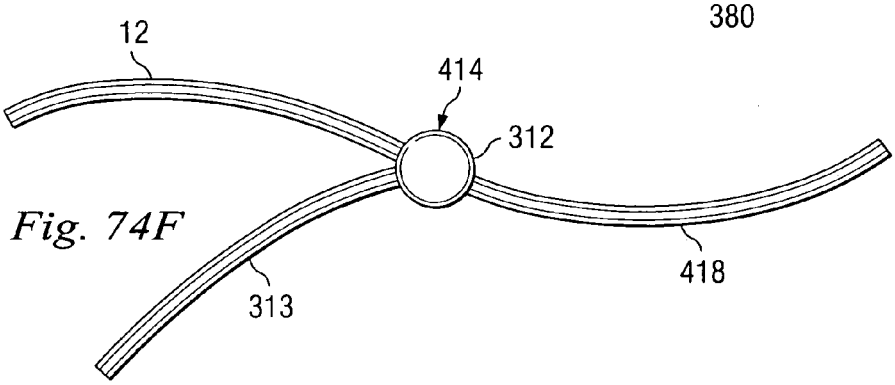

In an exemplary embodiment, as illustrated in FIG. 74E, the track-connection system 380 is depicted with each of the tracks 12 and 313 in a flexed or bent configuration. In an exemplary embodiment, as illustrated in FIG. 74F, the track-connection system 414 is depicted with each of the tracks 12, 313 and 418 in a flexed or bent configuration. Although not shown in FIG. 74F, the cover plate 426 is coupled to the tubular member 416.

Figure 74G:
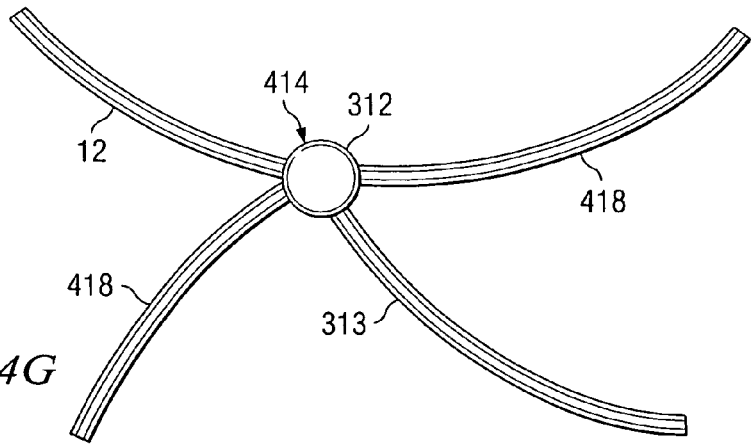
Figure 74H:
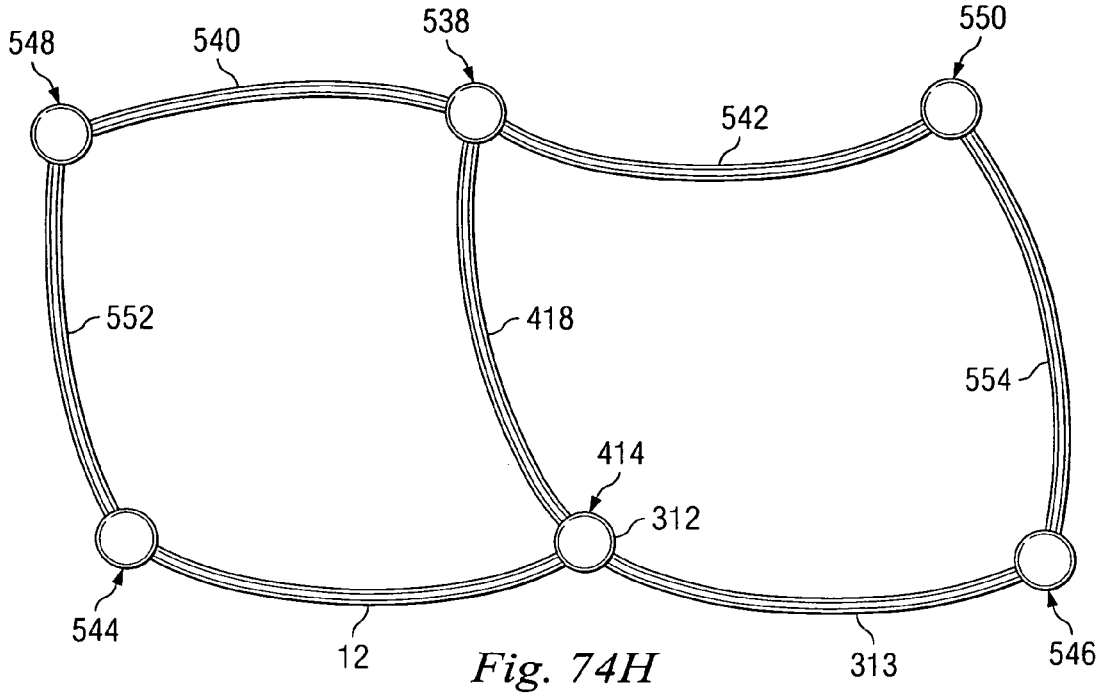

In an exemplary embodiment, as illustrated in FIG. 74G, the track-connection system 414 is depicted with each of the tracks 12, 313 and 418 in a flexed or bent configuration. The cover plate 426 is removed from the tubular member 416 and the track 418 extends all the way through the tubular member 416. In an exemplary embodiment, as illustrated in FIG. 74H, the track-connection system 414 is depicted with each of the tracks 12, 313 and 418 in a flexed or bent configuration. A track-connection system 538, which includes tracks 540 and 542, is coupled to the track 418 and is substantially identical to the track-connection system 414, so that the track 418 is shared between the track-connection systems 414 and 538. Track-connection systems 544 and 546, which are each substantially similar to the track-connection system 310, are coupled to the track-connection system 414, with the track-connection systems 544 and 414 sharing the track 12 and the track-connection systems 414 and 546 sharing the track 313. Track-connection systems 548 and 550, which are each substantially similar to the track-connection system 310, are coupled to the track-connection system 538, with the track-connection systems 548 and 538 sharing the track 540 and the track-connection systems 538 and 550 sharing the track 542. A track 552 is shared by the track-connection systems 544 and 548, and a track 554 is shared by the track-connection systems 546 and 550. One or more of the track-connection systems 544, 546, 548 and 550 may be replaced with a track-connection system that is substantially similar to the track-connection system 504.

Figure 74I:
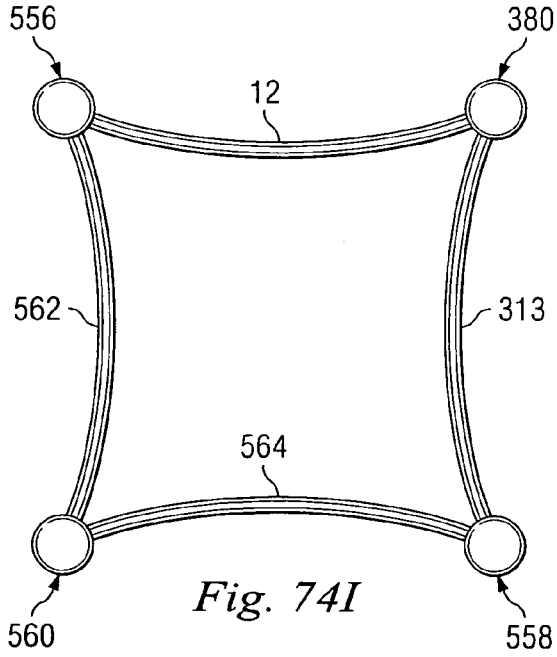

In an exemplary embodiment, as illustrated in FIG. 74I, the track-connection system 380 is depicted with each of the tracks 12 and 313 in a flexed or bent configuration. Track-connection systems 556 and 558, which are each substantially similar to the track-connection system 310, are coupled to the track-connection system 380, with the track-connection systems 556 and 380 sharing the track 12 and the track-connection systems 380 and 558 sharing the track 313. A track-connection system 560, which is substantially similar to the track-connection system 310, is coupled to the track-connection systems 556 and 558, with the track-connection systems 556 and 560 sharing a track 562 and the track-connection systems 560 and 558 sharing a track 564. One or more of the track-connection systems 556, 558 and 560 may be replaced with a track-connection system that is substantially similar to the track connection system 504.

In each of the lighting-system embodiments depicted in FIGS. 74A through 74I, one or more of the support assemblies 16 and/or 114, one or more supports with dove-tail attachments, one or more supports with tongue-in-groove attachment and/or one or more other support structures may be used to support tracks 12, 313 and/or 418. Moreover, one or more other elements may be coupled to the tracks 12, 313 and/or 418 such as, for example, one or more of the above-described lamp assemblies, transformer assemblies and/or other elements.

Figure 75:
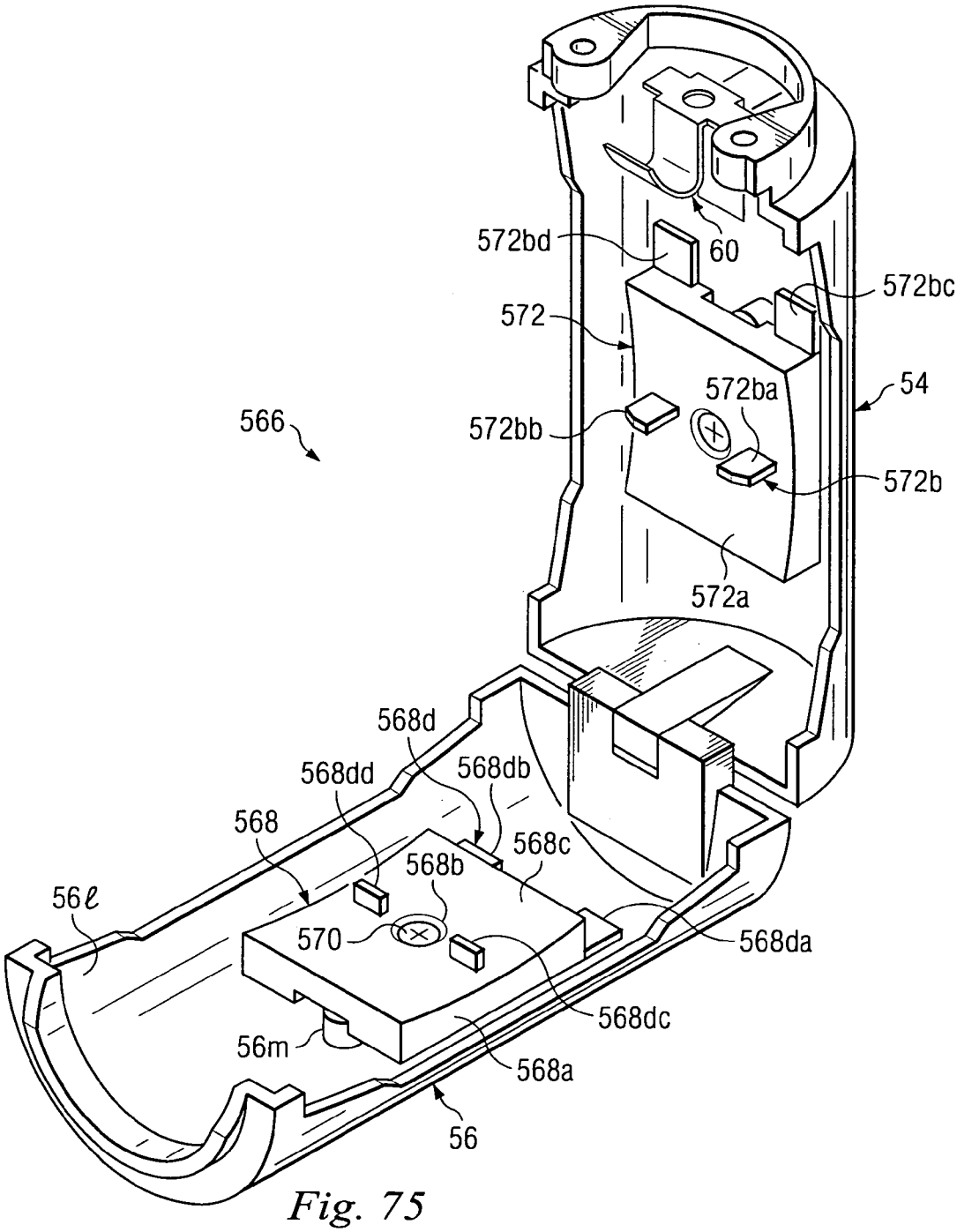
FIG. 75 is a perspective view of a power feed assembly according to another embodiment.

In an exemplary embodiment, as illustrated in FIG. 75, another embodiment of a power feed assembly is generally referred to by the reference numeral 566, and is similar to the power feed assembly 14 depicted in FIGS. 1 and 3 through 9B and contains several parts of the power feed assembly 14, which are given the same reference numerals. In the embodiment of FIG. 75, a contact pad assembly 568 including a contact pad 568*a* is coupled to the cover 56 in a manner substantially similar to the manner in which the contact pad assembly 58 is coupled to the housing 54 of the power feed assembly 14, with a fastener 570 extending through a counterbore 568*b* formed through the contact pad 568*a* and threadably engaging the internal threaded connection of the boss 56*k* of the cover. A biasing element or spring, which is not shown but is substantially similar to the spring 70 of the power feed assembly 14, extends about the boss 56*k* and contacts the surface 56*l* and extends within a tubular protrusion of the contact pad 568*a*, which is not shown but is substantially similar to the tubular protrusion 58*h* of the power feed assembly 14. The contact pad 568*a* defines a curved surface 568*c*, which is similar to the curved surface 58*b* of the power feed assembly 14. A lug 568*d* extends within the interior of the contact pad 568*a*, and includes portions 568*da* and 568*db*, which extend from the contact pad 568*a*, and distal ends that define contacts 568*dc* and 568*dd* and extend from the contact pad 568*a*. In an exemplary embodiment, the lug 568*d* may be H-shaped within the interior of the contact pad 568*a*. Wires (not shown) extend from the portions 568*da* and 568*db*, respectively, and join together and terminate at the terminal block 48, and are electrically coupled in a conventional manner to a source of electrical power such as, for example, the power supply 31. A contact pad assembly 572 is coupled to the housing 54 in a manner substantially similar to the manner in which the contact pad assembly 568 is coupled to the cover 56. The contact pad assembly 572 is substantially similar to the contact pad 568 and therefore will not be described in detail, with the contact pad assembly 572 including a contact pad 572*a* and a lug 572*b* extending within the interior of the contact pad 572*a* and having distal ends defining contacts 572*ba* and 572*bb*, which extend from the contact pad 572*a*. In an exemplary embodiment, the lug 572*b* may be H-shaped within the interior of the contact pad 572*a*. Wires (not shown) extend from portions 572*bc* and 527*bd*, respectively, of the lug 572*b*, and join together and terminate at the terminal block 48, and are electrically coupled in a conventional manner to a source of electrical power such as, for example, the power supply 31. In an exemplary embodiment, the power feed assembly 566 contains several other parts of the power feed assembly 14, including the housing 46, the spring 50 and the sleeve 52, resulting in an attachment that is similar to the attachment 32 of the power feed assembly 14. In an exemplary embodiment, the housing 46 of the power feed assembly 566 is coupled to the mounting assembly 34, which, in turn, is coupled to the ceiling 18. In an exemplary embodiment, the housing 46 may instead be coupled to the mounting assembly 76 which, in turn, may be coupled to the ceiling 18.

In an exemplary embodiment, the track 12 may be coupled to the power feed assembly 566 in a manner substantially similar to the manner in which the track 12 is coupled to the power feed assembly 14. As a result, the contacts 568*dc* and 568*dd* contact the buss bar 26*b*, and the contacts 572*ba* and 572*bb* contact the buss bar 28*b*. The respective biasing elements or springs engaged with the contact pads 568*a* and 572*a*, which are not shown but are each similar to the spring 70, apply respective reaction or biasing forces against the contact pads 568*a* and 572*a*, and further accommodate the flexing or bending of the track 12, thereby maintaining contact between the buss bar 26*b* and the contacts 568*dc* and 568*dd*, and between the buss bar 28*b* and the contacts 572*ba* and 572*bb*. The contact pads 568*a* and 572*a* are each permitted to float in a manner similar to the above-described manner in which the contact pad 58*a* of the power feed assembly 14 is permitted to float.

In an exemplary embodiment, the power feed assembly 566 operates to transfer electrical power to the track 12 so that the voltage V3 is generated across the buss bars 26*b* and 28*b*. In an exemplary embodiment, the power supply 31 may supply DC electrical power to the track 12, via in part the contacts 568*dc*, 568*dd*, 572*ba* and 572*bb*, and the wires electrically coupled thereto. In an exemplary embodiment, as a result of the electrical power carried by the power feed assembly 566 to the track 12, the voltage V3 may be 12 volts. In an exemplary embodiment, the power feed assembly 566 operates to support, at least in part, the track 12, thereby permitting, at least in part, the track 12 to be suspended from the ceiling 18.

A system has been described that includes a lighting track comprising first, second and third pairs of buss bars; wherein the first, second and third pairs of buss bars are electrically isolated from one another. In an exemplary embodiment, the lighting track comprises an I-beam protrusion defining first and second channels. In an exemplary embodiment, the lighting track comprises first and second insulated liners extending within the first and second channels, respectively, of the I-beam protrusion. In an exemplary embodiment, each of the first and second insulated liners comprises first, second and third channels. In an exemplary embodiment, one buss bar in the first pair of buss bars extends in the first channel of the first insulated liner and the other buss bar in the first pair of buss bars extends in the third channel of the first insulated liner. In an exemplary embodiment, one buss bar in the second pair of buss bars extends in the first channel of the second insulated liner and the other buss bar in the second pair of buss bars extends in the third channel of the second insulated liner. In an exemplary embodiment, one buss bar in the third pair of buss bars extends in the second channel of the first insulated liner and the other buss bar in the third pair of buss bars extends in the second channel of the second insulated liner. In an exemplary embodiment, the lighting track further comprises first and second protrusions extending from the I-beam protrusion and at least partially defining a channel. In an exemplary embodiment, at least one of the first protrusion, the second protrusion, and the channel at least partially defined by the first and second protrusions, is adapted to engage a dove-tail attachment used to at least partially support the lighting track. In an exemplary embodiment, the channel at least partially defined by the first and second protrusions is adapted to engage a tongue-in-groove attachment used to at least partially support the lighting track. In an exemplary embodiment, the lighting track further comprises third and fourth protrusions extending from the I-beam protrusion and at least partially defining a channel. In an exemplary embodiment, the channel at least partially defined by the third and fourth protrusions is adapted to engage a tongue-in-groove attachment so that the lighting track at least partially supports a device coupled to the tongue-in-groove attachment. In an exemplary embodiment, the first, second, third and fourth protrusions are sized so that the lighting track is symmetric about a vertical center axis and asymmetric about a horizontal center axis to provide polarity. In an exemplary embodiment, the lighting track has a minimum bend radius of about 24 inches. In an exemplary embodiment, the system further comprises a first source of electrical power electrically coupled to the first pair of buss bars; wherein the first source of electrical power is adapted to generate a first voltage across the first pair of buss bars. In an exemplary embodiment, the system further comprises a second source of electrical power electrically coupled to the second pair of buss bars; wherein the second source of electrical power is adapted to generate a second voltage across the second pair of buss bars. In an exemplary embodiment, the system further comprises a third source of electrical power electrically coupled to the third pair of buss bars; wherein the third source of electrical power is adapted to generate a third voltage across the third pair of buss bars. In an exemplary embodiment, the maximum current-carrying capacity of each of the buss bars in one or more of the first, second and third pairs of buss bars is about 20 A. In an exemplary embodiment, the maximum current-carrying capacity of each of the buss bars in one or more of the first, second and third pairs of buss bars is about 25 A. In an exemplary embodiment, the maximum current-carrying capacity of each of the buss bars in the first and third pairs of buss bars is about 20 A; and wherein the maximum current-carrying capacity of each of the buss bars in the second pair of buss bars is about 25 A. In an exemplary embodiment, the system further comprises a first power feed assembly toollessly coupled to the lighting track for transferring electrical power to the first pair of buss bars so that a first voltage is generated across the first pair of buss bars. In an exemplary embodiment, the first power feed assembly is coupled to a support structure and at least partially supports the lighting track. In an exemplary embodiment, the system further comprises a second power feed assembly toollessly coupled to the lighting track for transferring electrical power to the second pair of buss bars so that a second voltage is generated across the second pair of buss bars. In an exemplary embodiment, the second power feed assembly is coupled to the support structure and at least partially supports the lighting track. In an exemplary embodiment, the system further comprises a third power feed assembly toollessly coupled to the lighting track for transferring electrical power to the third pair of buss bars so that a third voltage is generated across the third pair of buss bars. In an exemplary embodiment, the third power feed assembly is coupled to the support structure and at least partially supports the lighting track. In an exemplary embodiment, the system further comprises a support assembly toollessly coupled to the lighting track and coupled to a support structure for at least partially supporting the lighting track. In an exemplary embodiment, the system further comprises a transformer assembly toollessly coupled to the lighting track; wherein the transformer assembly comprises a transformer electrically coupled to one of the first, second and third pairs of buss bars. In an exemplary embodiment, the system further comprises a load coupled to the transformer; wherein electrical power is adapted to be transferred to the transformer from the one of the first, second and third pairs of buss bars at a first voltage; and wherein electrical power is adapted to be transferred to the load at a second voltage using the transformer. In an exemplary embodiment, the system further comprises a lampholder toollessly coupled to the lighting track and comprising a lamp; wherein the lamp is electrically coupled to one of the first, second and third pairs of buss bars. In an exemplary embodiment, the system further comprises a converter electrically coupled to one of the first, second and third pairs of buss bars; and a lamp electrically coupled to the converter. In an exemplary embodiment, the system further comprises a transformer assembly coupled to the lighting track, the transformer assembly comprising a transformer electrically coupled to the first pair of buss bars. In an exemplary embodiment, the transformer is electrically coupled to the third pair of buss bars; wherein electrical power at a first voltage is adapted to be transferred to the transformer from the first pair of buss bars; and wherein electrical power at a second voltage is adapted to be transferred to the second pair of buss bars using the transformer. In an exemplary embodiment, the transformer is electrically coupled to the third pair of buss bars; wherein electrical power at a first voltage is adapted to be transferred to the transformer from the first pair of buss bars; and wherein electrical power at a second voltage is adapted to be transferred to the third pair of buss bars using the transformer. In an exemplary embodiment, the system further comprises a transformer assembly coupled to the lighting track, the transformer assembly comprising a transformer electrically coupled to one of the first, second and third pairs of buss bars; and a connector electrically coupled to the transformer. In an exemplary embodiment, the system further comprises a load electrically coupled to the connector. In an exemplary embodiment, the system further comprises a connector coupled to the lighting track for coupling the lighting track to another lighting track. In an exemplary embodiment, the system further comprises the another lighting track coupled to the connector. In an exemplary embodiment, the connector pivotally couples the lighting track to the another lighting track. In an exemplary embodiment, the connector comprises a terminal block assembly for transferring electrical power to at least one of the first, second and third pairs of buss bars of the lighting track. In an exemplary embodiment, the connector comprises a tubular member for coupling the lighting track to one other lighting track. In an exemplary embodiment, the connector comprises a terminal block assembly for transferring electrical power to at least one of the first, second and third pairs of buss bars of the lighting track.

A system has been described that includes a flexible lighting track comprising a straight configuration; and a flexed configuration in which the flexible lighting track comprises a bend. In an exemplary embodiment, the flexible lighting track comprises first, second and third pairs of buss bars; wherein the first, second and third pairs of buss bars are electrically isolated from one another. In an exemplary embodiment, the flexible lighting track comprises an I-beam protrusion defining first and second channels. In an exemplary embodiment, the flexible lighting track comprises first and second insulated liners extending within the first and second channels, respectively, of the I-beam protrusion. In an exemplary embodiment, each of the first and second insulated liners comprises first, second and third channels. In an exemplary embodiment, one buss bar in the first pair of buss bars extends in the first channel of the first insulated liner and the other buss bar in the first pair of buss bars extends in the third channel of the first insulated liner. In an exemplary embodiment, one buss bar in the second pair of buss bars extends in the first channel of the second insulated liner and the other buss bar in the second pair of buss bars extends in the third channel of the second insulated liner. In an exemplary embodiment, one buss bar in the third pair of buss bars extends in the second channel of the first insulated liner and the other buss bar in the third pair of buss bars extends in the second channel of the second insulated liner. In an exemplary embodiment, the flexible lighting track further comprises first and second protrusions extending from the I-beam protrusion and at least partially defining a channel. In an exemplary embodiment, at least one of the first protrusion, the second protrusion, and the channel at least partially defined by the first and second protrusions, is adapted to engage a dove-tail attachment used to at least partially support the flexible lighting track. In an exemplary embodiment, the channel at least partially defined by the first and second protrusions is adapted to engage a tongue-in-groove attachment used to at least partially support the flexible lighting track. In an exemplary embodiment, the flexible lighting track further comprises third and fourth protrusions extending from the I-beam protrusion and at least partially defining a channel. In an exemplary embodiment, the channel at least partially defined by the third and fourth protrusions is adapted to engage a tongue-in-groove attachment so that the flexible lighting track at least partially supports a device coupled to the tongue-in-groove attachment. In an exemplary embodiment, the first, second, third and fourth protrusions are sized so that the flexible lighting track is symmetric about a vertical center axis and asymmetric about a horizontal center axis to provide polarity. In an exemplary embodiment, the flexible lighting track has a minimum bend radius of about 24 inches. In an exemplary embodiment, the system further comprises a first source of electrical power electrically coupled to the first pair of buss bars; wherein the first source of electrical power is adapted to generate a first voltage across the first pair of buss bars. In an exemplary embodiment, the system further comprises a second source of electrical power electrically coupled to the second pair of buss bars; wherein the second source of electrical power is adapted to generate a second voltage across the second pair of buss bars. In an exemplary embodiment, the system further comprises a third source of electrical power electrically coupled to the third pair of buss bars; wherein the third source of electrical power is adapted to generate a third voltage across the third pair of buss bars. In an exemplary embodiment, the maximum current-carrying capacity of each of the buss bars in one or more of the first, second and third pairs of buss bars is about 20 A. In an exemplary embodiment, the maximum current-carrying capacity of each of the buss bars in one or more of the first, second and third pairs of buss bars is about 25 A. In an exemplary embodiment, the maximum current-carrying capacity of each of the buss bars in the first and third pairs of buss bars is about 20 A; and wherein the maximum current-carrying capacity of each of the buss bars in the second pair of buss bars is about 25 A. In an exemplary embodiment, the system further comprises a first power feed assembly toollessly coupled to the flexible lighting track for transferring electrical power to the first pair of buss bars so that a first voltage is generated across the first pair of buss bars, comprising a floating contact pad assembly for accommodating the flexed configuration of the flexible lighting track. In an exemplary embodiment, the first power feed assembly is coupled to a support structure and at least partially supports the flexible lighting track. In an exemplary embodiment, the system further comprises a second power feed assembly toollessly coupled to the flexible lighting track for transferring electrical power to the second pair of buss bars so that a second voltage is generated across the second pair of buss bars, comprising a floating contact pad assembly for accommodating the flexed configuration of the flexible lighting track. In an exemplary embodiment, the second power feed assembly is coupled to the support structure and at least partially supports the flexible lighting track. In an exemplary embodiment, the system further comprises a third power feed assembly toollessly coupled to the flexible lighting track for transferring electrical power to the third pair of buss bars so that a third voltage is generated across the third pair of buss bars, comprising a floating contact pad assembly for accommodating the flexed configuration of the flexible lighting track. In an exemplary embodiment, the third power feed assembly is coupled to the support structure and at least partially supports the flexible lighting track. In an exemplary embodiment, the system further comprises a support assembly toollessly coupled to the flexible lighting track and coupled to a support structure for at least partially supporting the flexible lighting track. In an exemplary embodiment, the system further comprises a transformer assembly toollessly coupled to the flexible lighting track; wherein the transformer assembly comprises a transformer electrically coupled to one of the first, second and third pairs of buss bars. In an exemplary embodiment, the system further comprises a load coupled to the transformer; wherein electrical power is adapted to be transferred to the transformer from the one of the first, second and third pairs of buss bars at a first voltage; and wherein electrical power is adapted to be transferred to the load at a second voltage using the transformer. In an exemplary embodiment, the system further comprises a lampholder toollessly coupled to the flexible lighting track and comprising a lamp; wherein the lamp is electrically coupled to one of the first, second and third pairs of buss bars. In an exemplary embodiment, the system further comprises a converter electrically coupled to one of the first, second and third pairs of buss bars; and a lamp electrically coupled to the converter. In an exemplary embodiment, the system further comprises a transformer assembly coupled to the flexible lighting track, the transformer assembly comprising a transformer electrically coupled to the first pair of buss bars; and one or more track adapters for accommodating the flexed configuration of the flexible lighting track. In an exemplary embodiment, the transformer is electrically coupled to the third pair of buss bars; wherein electrical power at a first voltage is adapted to be transferred to the transformer from the first pair of buss bars; and wherein electrical power at a second voltage is adapted to be transferred to the third pair of buss bars using the transformer. In an exemplary embodiment, the transformer is electrically coupled to the second pair of buss bars; wherein electrical power at a first voltage is adapted to be transferred to the transformer from the first pair of buss bars; and wherein electrical power at a second voltage is adapted to be transferred to the second pair of buss bars using the transformer. In an exemplary embodiment, the system further comprises a transformer assembly coupled to the flexible lighting track, the transformer assembly comprising a transformer electrically coupled to one of the first, second and third pairs of buss bars; a connector electrically coupled to the transformer; and one or more track adapters for accommodating the flexed configuration of the flexible lighting track. In an exemplary embodiment, the system further comprises a load electrically coupled to the connector. In an exemplary embodiment, the system further comprises a connector coupled to the flexible lighting track for coupling the flexible lighting track to another flexible lighting track. In an exemplary embodiment, the system further comprises the another flexible lighting track coupled to the connector. In an exemplary embodiment, the connector pivotally couples the flexible lighting track to the another flexible lighting track. In an exemplary embodiment, the connector comprises a terminal block assembly for transferring electrical power to at least one of the first, second and third pairs of buss bars of the flexible lighting track. In an exemplary embodiment, the connector comprises a tubular member for coupling the flexible lighting track to one other flexible lighting track. In an exemplary embodiment, the connector comprises a terminal block assembly for transferring electrical power to at least one of the first, second and third pairs of buss bars of the flexible lighting track.

A system has been described that includes a flexible lighting track comprising a straight configuration; and a flexed configuration in which the flexible lighting track comprises a bend; first, second and third pairs of buss bars, wherein the first, second and third pairs of buss bars are electrically isolated from one another; an I-beam protrusion defining first and second channels; first and second insulated liners extending within the first and second channels, respectively, of the I-beam protrusion; wherein each of the first and second insulated liners comprises first, second and third channels; wherein one buss bar in the first pair of buss bars extends in the first channel of the first insulated liner and the other buss bar in the first pair of buss bars extends in the third channel of the first insulated liner; wherein one buss bar in the second pair of buss bars extends in the first channel of the second insulated liner and the other buss bar in the second pair of buss bars extends in the third channel of the second insulated liner; wherein one buss bar in the third pair of buss bars extends in the second channel of the first insulated liner and the other buss bar in the third pair of buss bars extends in the second channel of the second insulated liner; wherein the flexible lighting track further comprises first and second protrusions extending from the I-beam protrusion and at least partially defining a channel; wherein the channel at least partially defined by the first and second protrusions is adapted to engage a tongue-in-groove attachment; wherein the flexible lighting track further comprises third and fourth protrusions extending from the I-beam protrusion and at least partially defining a channel; wherein the channel at least partially defined by the third and fourth protrusions is adapted to engage a tongue-in-groove attachment so that the flexible lighting track is adapted to at least partially support a device coupled to the tongue-in-groove attachment; wherein the first, second, third and fourth protrusions are sized so that the flexible lighting track is symmetric about a vertical center axis and asymmetric about a horizontal center axis to provide polarity; wherein the flexible lighting track has a minimum bend radius of about 24 inches; wherein the maximum current-carrying capacity of each of the buss bars in the first and third pairs of buss bars is about 20 A; and wherein the maximum current-carrying capacity of each of the buss bars in the second pair of buss bars is about 25 A.

A method has been described that includes providing a flexible lighting track; placing the flexible lighting track in a flexed configuration so that the flexible lighting track comprises a bend. In an exemplary embodiment, the flexible lighting track comprises first, second and third pairs of buss bars; wherein the first, second and third pairs of buss bars are electrically isolated from one another. In an exemplary embodiment, the flexible lighting track comprises an I-beam protrusion defining first and second channels. In an exemplary embodiment, the method further comprises extending first and second insulated liners within the first and second channels, respectively, of the I-beam protrusion. In an exemplary embodiment, each of the first and second insulated liners comprises first, second and third channels. In an exemplary embodiment, the method further comprises extending one buss bar in the first pair of buss bars in the first channel of the first insulated liner and extending the other buss bar in the first pair of buss bars in the third channel of the first insulated liner. In an exemplary embodiment, the method further comprises extending one buss bar in the second pair of buss bars in the first channel of the second insulated liner and extending the other buss bar in the second pair of buss bars in the third channel of the second insulated liner. In an exemplary embodiment, the method further comprises extending one buss bar in the third pair of buss bars in the second channel of the first insulated liner and extending the other buss bar in the third pair of buss bars in the second channel of the second insulated liner. In an exemplary embodiment, the flexible lighting track further comprises first and second protrusions extending from the I-beam protrusion and at least partially defining a channel. In an exemplary embodiment, the method further comprises engaging a dove-tail attachment with at least one of the first protrusion, the second protrusion, and the channel at least partially defined by the first and second protrusions, to at least partially support the flexible lighting track. In an exemplary embodiment, the method further comprises engaging a tongue-in-groove attachment with the channel at least partially defined by the first and second protrusions to at least partially support the flexible lighting track. In an exemplary embodiment, the flexible lighting track further comprises third and fourth protrusions extending from the I-beam protrusion and at least partially defining a channel. In an exemplary embodiment, the method further comprises engaging a tongue-in-groove attachment with the channel at least partially defined by the third and fourth protrusions so that the flexible lighting track at least partially supports a device coupled to the tongue-in-groove attachment. In an exemplary embodiment, the first, second, third and fourth protrusions are sized so that the flexible lighting track is symmetric about a vertical center axis and asymmetric about a horizontal center axis to provide polarity. In an exemplary embodiment, the flexible lighting track has a minimum bend radius of about 24 inches. In an exemplary embodiment, the method further comprises electrically coupling a first source of electrical power to the first pair of buss bars; generating a first voltage across the first pair of buss bars using the first source of electrical power. In an exemplary embodiment, the method further comprises electrically coupling a second source of electrical power to the second pair of buss bars; generating a second voltage across the second pair of buss bars using the second source of electrical power. In an exemplary embodiment, the method further comprises electrically coupling a third source of electrical power to the third pair of buss bars; generating a third voltage across the second pair of buss bars using the third source of electrical power. In an exemplary embodiment, the maximum current-carrying capacity of each of the buss bars in one or more of the first, second and third pairs of buss bars is about 20 A. In an exemplary embodiment, the maximum current-carrying capacity of each of the buss bars in one or more of the first, second and third pairs of buss bars is about 25 A. In an exemplary embodiment, the maximum current-carrying capacity of each of the buss bars in the first and third pairs of buss bars is about 20 A; and the maximum current-carrying capacity of each of the buss bars in the second pair of buss bars is about 25 A. In an exemplary embodiment, the method further comprises transferring electrical power to the first pair of buss bars so that a first voltage is generated across the first pair of buss bars; and accommodating the flexed configuration of the flexible lighting track during transferring electrical power to the first pair of buss bars so that the first voltage is generated across the first pair of buss bars. In an exemplary embodiment, the method further comprises at least partially supporting the flexible lighting track during transferring electrical power to the first pair of buss bars so that the first voltage is generated across the first pair of buss bars. In an exemplary embodiment, the method further comprises transferring electrical power to the second pair of buss bars so that a second voltage is generated across the second pair of buss bars; and accommodating the flexed configuration of the flexible lighting track during transferring electrical power to the second pair of buss bars so that the second voltage is generated across the second pair of buss bars. In an exemplary embodiment, the method further comprises at least partially supporting the flexible lighting track during transferring electrical power to the second pair of buss bars so that the second voltage is generated across the second pair of buss bars. In an exemplary embodiment, the method further comprises transferring electrical power to the third pair of buss bars so that a third voltage is generated across the third pair of buss bars; and accommodating the flexed configuration of the flexible lighting track during transferring electrical power to the third pair of buss bars so that the third voltage is generated across the third pair of buss bars. In an exemplary embodiment, the method further comprises at least partially supporting the flexible lighting track during transferring electrical power to the third pair of buss bars so that the third voltage is generated across the third pair of buss bars. In an exemplary embodiment, the method further comprises supporting the flexible lighting track. In an exemplary embodiment, the method further comprises toollessly coupling a transformer to the flexible lighting track so that the transformer is electrically coupled to one of the first, second and third pairs of buss bars. In an exemplary embodiment, the method further comprises coupling a load to the transformer; transferring electrical power to the transformer at a first voltage; and transferring electrical power to the load at a second voltage using the transformer. In an exemplary embodiment, the method further comprises toollessly coupling a lampholder comprising a lamp to the flexible lighting track so that the lamp is electrically coupled to one of the first, second and third pairs of buss bars. In an exemplary embodiment, the method further comprises electrically coupling a converter to one of the first, second and third pairs of buss bars; and electrically coupling a lamp to the converter. In an exemplary embodiment, the method further comprises coupling a transformer assembly comprising a transformer to the flexible lighting track so that the transformer of the transformer assembly is electrically coupled to the first pair of buss bars; and accommodating the flexed configuration of the flexible lighting track during coupling the transformer assembly to the flexible lighting track. In an exemplary embodiment, the method further comprises electrically coupling the transformer to the third pair of buss bars; transferring electrical power at a first voltage to the transformer from the first pair of buss bars; and transferring electrical power at a second voltage to the third pair of buss bars using the transformer. In an exemplary embodiment, the method further comprises electrically coupling the transformer to the second pair of buss bars; transferring electrical power at a first voltage to the transformer from the first pair of buss bars; and transferring electrical power at a second voltage to the second pair of buss bars using the transformer. In an exemplary embodiment, the method further comprises toollessly coupling a transformer assembly to the flexible lighting track. In an exemplary embodiment, the method further comprises accommodating the flexed configuration of the flexible lighting track during toollessly coupling the transformer assembly to the flexible lighting track. In an exemplary embodiment, the transformer assembly comprises a connector and the method further comprises electrically coupling a load to the connector of the transformer assembly. In an exemplary embodiment, the method further comprises coupling the flexible lighting track to another flexible lighting track. In an exemplary embodiment, coupling the flexible lighting track to the another flexible lighting track comprises pivotally coupling the flexible lighting track to the another flexible lighting track. In an exemplary embodiment, the method further comprises coupling the flexible lighting track to one other flexible lighting track.

A method has been described that includes providing a flexible lighting track; placing the flexible lighting track in a flexed configuration so that the flexible lighting track comprises a bend; wherein the flexible lighting track comprises first, second and third pairs of buss bars; wherein the first, second and third pairs of buss bars are electrically isolated from one another; wherein the flexible lighting track comprises an I-beam protrusion defining first and second channels; wherein the method further comprises extending first and second insulated liners within the first and second channels, respectively, of the I-beam protrusion; wherein each of the first and second insulated liners comprises first, second and third channels; wherein the method further comprises extending one buss bar in the first pair of buss bars in the first channel of the first insulated liner and extending the other buss bar in the first pair of buss bars in the third channel of the first insulated liner; extending one buss bar in the second pair of buss bars in the first channel of the second insulated liner and extending the other buss bar in the second pair of buss bars in the third channel of the second insulated liner; and extending one buss bar in the third pair of buss bars in the second channel of the first insulated liner and extending the other buss bar in the third pair of buss bars in the second channel of the second insulated liner; wherein the flexible lighting track further comprises first and second protrusions extending from the I-beam protrusion and at least partially defining a channel; wherein the flexible lighting track further comprises third and fourth protrusions extending from the I-beam protrusion and at least partially defining a channel; wherein the first, second, third and fourth protrusions are sized so that the flexible lighting track is symmetric about a vertical center axis and asymmetric about a horizontal center axis to provide polarity; wherein the flexible lighting track has a minimum bend radius of about 24 inches; wherein the maximum current-carrying capacity of each of the buss bars in the first and third pairs of buss bars is about 20 A; and wherein the maximum current-carrying capacity of each of the buss bars in the second pair of buss bars is about 25 A.

A system has been described that includes a flexible lighting track; and means for placing the flexible lighting track in a flexed configuration so that the flexible lighting track comprises a bend. In an exemplary embodiment, the flexible lighting track comprises first, second and third pairs of buss bars; wherein the first, second and third pairs of buss bars are electrically isolated from one another. In an exemplary embodiment, the system comprises means for electrically coupling a first source of electrical power to the first pair of buss bars; means for generating a first voltage across the first pair of buss bars using the first source of electrical power; means for electrically coupling a second source of electrical power to the second pair of buss bars; means for generating a second voltage across the second pair of buss bars using the second source of electrical power; means for electrically coupling a third source of electrical power to the third pair of buss bars; and means for generating a third voltage across the second pair of buss bars using the third source of electrical power. In an exemplary embodiment, the system comprises means for transferring electrical power to the first pair of buss bars so that a first voltage is generated across the first pair of buss bars; means for accommodating the flexed configuration of the flexible lighting track during transferring electrical power to the first pair of buss bars so that the first voltage is generated across the first pair of buss bars; means for transferring electrical power to the second pair of buss bars so that a second voltage is generated across the second pair of buss bars; means for accommodating the flexed configuration of the flexible lighting track during transferring electrical power to the second pair of buss bars so that the second voltage is generated across the second pair of buss bars; means for transferring electrical power to the third pair of buss bars so that a third voltage is generated across the third pair of buss bars; and means for accommodating the flexed configuration of the flexible lighting track during transferring electrical power to the third pair of buss bars so that the third voltage is generated across the third pair of buss bars.

A system has been described that includes a flexible lighting track; and means for placing the flexible lighting track in a flexed configuration so that the flexible lighting track comprises a bend; wherein the flexible lighting track comprises first, second and third pairs of buss bars; wherein the first, second and third pairs of buss bars are electrically isolated from one another; wherein the flexible lighting track comprises an I-beam protrusion defining first and second channels; wherein the system further comprises means for extending first and second insulated liners within the first and second channels, respectively, of the I-beam protrusion; wherein each of the first and second insulated liners comprises first, second and third channels; and wherein the system further comprises means for extending one buss bar in the first pair of buss bars in the first channel of the first insulated liner and extending the other buss bar in the first pair of buss bars in the third channel of the first insulated liner; means for extending one buss bar in the second pair of buss bars in the first channel of the second insulated liner and extending the other buss bar in the second pair of buss bars in the third channel of the second insulated liner; and means for extending one buss bar in the third pair of buss bars in the second channel of the first insulated liner and extending the other buss bar in the third pair of buss bars in the second channel of the second insulated liner.

A system has been described that includes a flexible lighting track; and means for placing the flexible lighting track in a flexed configuration so that the flexible lighting track comprises a bend; wherein the flexible lighting track comprises first, second and third pairs of buss bars; wherein the first, second and third pairs of buss bars are electrically isolated from one another; wherein the flexible lighting track comprises an I-beam protrusion defining first and second channels; wherein the system further comprises means for extending first and second insulated liners within the first and second channels, respectively, of the I-beam protrusion; wherein each of the first and second insulated liners comprises first, second and third channels; wherein the system further comprises means for extending one buss bar in the first pair of buss bars in the first channel of the first insulated liner and extending the other buss bar in the first pair of buss bars in the third channel of the first insulated liner; means for extending one buss bar in the second pair of buss bars in the first channel of the second insulated liner and extending the other buss bar in the second pair of buss bars in the third channel of the second insulated liner; and means for extending one buss bar in the third pair of buss bars in the second channel of the first insulated liner and extending the other buss bar in the third pair of buss bars in the second channel of the second insulated liner; wherein the flexible lighting track further comprises first and second protrusions extending from the I-beam protrusion and at least partially defining a channel; wherein the flexible lighting track further comprises third and fourth protrusions extending from the I-beam protrusion and at least partially defining a channel; wherein the first, second, third and fourth protrusions are sized so that the flexible lighting track is symmetric about a vertical center axis and asymmetric about a horizontal center axis to provide polarity; wherein the flexible lighting track has a minimum bend radius of about 24 inches; wherein the maximum current-carrying capacity of each of the buss bars in the first and third pairs of buss bars is about 20 A; and wherein the maximum current-carrying capacity of each of the buss bars in the second pair of buss bars is about 25 A.

A method has been described that includes providing a lighting track comprising a first pair of buss bars; coupling a transformer assembly comprising a transformer to the lighting track, comprising electrically coupling the transformer to the first pair of buss bars of the lighting track. In an exemplary embodiment, the lighting track further comprises a second pair of buss bars; and wherein coupling the transformer assembly to the lighting track further comprises electrically coupling the transformer to the second pair of buss bars of the lighting track. In an exemplary embodiment, the method further comprises generating a first voltage across the first pair of buss bars of the lighting track. In an exemplary embodiment, the method further comprises generating a second voltage across the second pair of buss bars of the lighting track using the transformer. In an exemplary embodiment, the first voltage comprises AC voltage and the second voltage comprises DC voltage. In an exemplary embodiment, generating the second voltage across the second pair of buss bars of the lighting track using the transformer comprises operating a switch electrically coupled to the transformer. In an exemplary embodiment, the lighting track comprises a flexed configuration and coupling the transformer assembly to the lighting track further comprises accommodating the flexed configuration of the lighting track when the lighting track is in the flexed configuration; and maintaining the electrical coupling between the transformer and each of the first and second pairs of buss bars when the lighting track is in the flexed configuration. In an exemplary embodiment, the method further comprises coupling a connector to the transformer assembly, comprising electrically coupling the connector to the transformer. In an exemplary embodiment, the method further comprises generating a first voltage across the first pair of buss bars of the lighting track. In an exemplary embodiment, the method further comprises transferring electrical power to the transformer at the first voltage. In an exemplary embodiment, the method further comprises transferring electrical power to the connector at a second voltage using the transformer. In an exemplary embodiment, the method further comprises electrically coupling a load to the connector; and transferring electrical power to the load at the second voltage via the connector. In an exemplary embodiment, the method further comprises the load comprises a lamp. In an exemplary embodiment, transferring electrical power to the transformer at the first voltage comprises transferring AC electrical power to the transformer at the first voltage; and wherein transferring electrical power to the load at the second voltage via the connector comprises transferring DC electrical power to the load at the second voltage via the connector. In an exemplary embodiment, the lighting track comprises a flexed configuration and coupling the transformer assembly to the lighting track further comprises accommodating the flexed configuration of the lighting track when the lighting track is in the flexed configuration; and maintaining the electrical coupling between the transformer and the first pair of buss bars when the lighting track is in the flexed configuration. In an exemplary embodiment, the method further comprises forming a grounding coupling between the transformer assembly and the lighting track. In an exemplary embodiment, the transformer assembly comprises at least one cover; and wherein coupling the transformer assembly to the lighting track further comprises locking the at least one cover of the transformer assembly. In an exemplary embodiment, the transformer assembly comprises a housing within which the transformer is at least partially positioned; and wherein coupling the transformer assembly to the lighting track further comprises hingedly coupling at least one cover to the housing of the transformer assembly; and placing the at least one cover in a closed configuration. In an exemplary embodiment, placing the at least one cover in the closed configuration comprises rotating the at least one cover relative to the housing so that a portion of the track is positioned between a portion of the housing and the at least one cover; and translating the at least one cover relative to the housing. In an exemplary embodiment, placing the at least one cover in the closed configuration further comprises generally preventing the at least one cover from rotating relative to the housing; and resisting unwanted translation of the at least one cover during generally preventing the at least one cover from rotating relative to the housing. In an exemplary embodiment, coupling the transformer assembly to the lighting track further comprises placing the at least one cover in an open configuration, comprising translating the at least one cover relative to the housing; and rotating the at least one cover relative to the housing. In an exemplary embodiment, coupling the transformer assembly to the lighting track further comprises toollessly coupling the transformer assembly to the lighting track. In an exemplary embodiment, the transformer comprises an AC-to-DC transformer. In an exemplary embodiment, the transformer comprises an AC-to-AC transformer. In an exemplary embodiment, the transformer comprises a DC-to-DC transformer. In an exemplary embodiment, the transformer comprises an inverter. In an exemplary embodiment, the transformer comprises a converter.

A method has been described that includes providing a lighting track comprising a first pair of buss bars; toollessly coupling a transformer assembly to the lighting track, the transformer assembly comprising a transformer and a housing within which the transformer is at least partially positioned; wherein toollessly coupling the transformer assembly to the lighting track comprises electrically coupling the transformer to the first pair of buss bars of the lighting track; hingedly coupling at least one cover to the housing of the transformer assembly; placing the at least one cover in an open configuration, comprising translating the at least one cover relative to the housing; and rotating the at least one cover relative to the housing; placing the at least one cover in a closed configuration, comprising rotating the at least one cover relative to the housing so that a portion of the track is positioned between a portion of the housing and the at least one cover; translating the at least one cover relative to the housing generally preventing the at least one cover from rotating relative to the housing; and resisting unwanted translation of the at least one cover during generally preventing the at least one cover from rotating relative to the housing; coupling a connector to the transformer assembly, comprising electrically coupling the connector to the transformer; forming a grounding coupling between the transformer assembly and the lighting track; generating a first voltage across the first pair of buss bars of the lighting track; transferring AC electrical power to the transformer at the first voltage; transferring DC electrical power to the connector at a second voltage using the transformer; wherein the lighting track comprises a flexed configuration and toollessly coupling the transformer assembly to the lighting track further comprises accommodating the flexed configuration of the lighting track when the lighting track is in the flexed configuration; and maintaining the electrical coupling between the transformer and the first pair of buss bars when the lighting track is in the flexed configuration; and wherein the transformer comprises an AC-to-DC transformer.

A method has been described that includes providing a lighting track comprising first and second pairs of buss bars; toollessly coupling a transformer assembly to a lighting track, the transformer assembly comprising a transformer and a housing within which the transformer is at least partially positioned; wherein toollessly coupling a transformer assembly to a lighting track comprises electrically coupling the transformer to the first pair of buss bars of the lighting track; electrically coupling the transformer to the second pair of buss bars of the lighting track; and hingedly coupling at least one cover to the housing of the transformer assembly; placing the at least one cover in an open configuration, comprising translating the at least one cover relative to the housing; and rotating the at least one cover relative to the housing; placing the at least one cover in a closed configuration, comprising rotating the at least one cover relative to the housing so that a portion of the track is positioned between a portion of the housing and the at least one cover; translating the at least one cover relative to the housing; generally preventing the at least one cover from rotating relative to the housing; and resisting unwanted translation of the at least one cover during generally preventing the at least one cover from rotating relative to the housing; forming a grounding coupling between the transformer assembly and the lighting track; generating a first voltage across the first pair of buss bars of the lighting track; generating a second voltage across the second pair of buss bars of the lighting track using the transformer, wherein generating the second voltage across the second pair of buss bars of the lighting track using the transformer comprises operating a switch electrically coupled to the transformer; wherein the lighting track comprises a flexed configuration and toollessly coupling the transformer assembly to the lighting track further comprises accommodating the flexed configuration of the lighting track when the lighting track is in the flexed configuration; and maintaining the electrical coupling between the transformer and each of the first and second pairs of buss bars when the lighting track is in the flexed configuration; wherein the transformer comprises an AC-to-DC transformer; and wherein the first voltage comprises AC voltage and the second voltage comprises DC voltage.

An apparatus adapted to be coupled to a lighting track has been described that includes a housing; a first cover hingedly coupled to the housing, the first cover comprising an open configuration in which the first cover is generally permitted to rotate relative to the housing; and a closed configuration in which the first cover is generally prevented from rotating relative to the housing. In an exemplary embodiment, at least a portion of the lighting track is adapted to be positioned between the first cover and a portion of the housing when the first cover is in its closed configuration. In an exemplary embodiment, the apparatus further comprises a protrusion wherein, when the first cover is in its closed configuration, the first cover is positioned relative to the protrusion so that the protrusion generally prevents the first cover from rotating relative to the housing. In an exemplary embodiment, the first cover comprises a wall and another protrusion spaced from the wall; wherein, when the first cover is in its closed configuration, the protrusion extends between the wall and the another protrusion of the first cover. In an exemplary embodiment, the first cover comprises a notch into which the protrusion extends when the first cover is in its closed configuration. In an exemplary embodiment, the apparatus further comprises a spring engaged with the housing and the first cover; wherein, when the cover is in its closed configuration, the spring generally maintains the position of the first cover relative to the protrusion. In an exemplary embodiment, the housing comprises a first ear portion to which the first cover is hingedly coupled; and wherein at least a portion of the lighting track is adapted to be positioned between the first cover and the first ear portion when apparatus is coupled to the lighting track and the first cover is in its closed configuration. In an exemplary embodiment, the apparatus further comprises a first pin coupled to the first ear portion and the first cover, wherein the first cover is adapted to rotate about the pin when the first cover is in the open configuration. In an exemplary embodiment, the apparatus further comprises a first spring engaged with the first ear portion and the first cover, wherein the first pin extends through the first spring and the first spring resists translation of the first cover relative to the housing. In an exemplary embodiment, the apparatus further comprises a first track adapter engaged with the first ear portion and adapted to at least partially rotate in place, relative to the housing, to accommodate a flexed configuration of the lighting track. In an exemplary embodiment, the lighting track comprises a first buss bar and wherein the apparatus further comprises a transformer at least partially positioned within the housing; a first contact pad assembly coupled to the first track adapter, the first contact pad assembly comprising a first contact pad; and at least one contact extending from the first contact pad and electrically coupled to the transformer; wherein the at least one contact is adapted to be electrically coupled to the first buss bar of the lighting track when the apparatus is coupled to the lighting track and the first cover is in its closed configuration. In an exemplary embodiment, the apparatus further comprises a first biasing element coupled to the first track adapter and the first contact pad; wherein the first biasing element is adapted to provide a biasing force against the first contact pad to effect sufficient electrical coupling between the at least one contact of the first contact pad assembly and the first buss bar when the apparatus is coupled to the lighting track and the first cover is in its closed configuration. In an exemplary embodiment, the first biasing element is adapted to maintain sufficient electrical coupling between the at least one contact of the first contact pad assembly and the first buss bar when the apparatus is coupled to the lighting track and the lighting track is in the flexed configuration. In an exemplary embodiment, the apparatus further comprises a second track adapter engaged with the first cover and adapted to at least partially rotate in place, relative to the first cover, to accommodate the flexed configuration of the lighting track. In an exemplary embodiment, the lighting track comprises a second buss bar and wherein the apparatus further comprises a second contact pad assembly coupled to the second track adapter, the second contact pad assembly comprising a second contact pad; and at least one contact extending from the second contact pad and electrically coupled to the transformer; wherein the at least one contact of the second contact pad assembly is adapted to be electrically coupled to the second buss bar of the lighting track when the apparatus is coupled to the lighting track and the first cover is in its closed configuration. In an exemplary embodiment, the apparatus further comprises a second biasing element coupled to the second track adapter and the second contact pad; wherein the second biasing element is adapted to provide a biasing force against the second contact pad to effect sufficient electrical coupling between the at least one contact of the second contact pad assembly and the second buss bar when the apparatus is coupled to the lighting track and the first cover is in its closed configuration. In an exemplary embodiment, the second biasing element is adapted to maintain sufficient electrical coupling between the at least one contact of the second contact pad assembly and the second buss bar when the apparatus is coupled to the lighting track and the lighting track is in the flexed configuration. In an exemplary embodiment, the apparatus further comprises a connector engaged with the housing and electrically coupled to the transformer. In an exemplary embodiment, the connector is adapted to be coupled to a load so that the transformer is electrically coupled to the load. In an exemplary embodiment, the at least one contact of the first contact pad assembly and the at least one contact of the second contact pad assembly are adapted to transfer electrical power to the transformer at a first voltage when the apparatus is coupled to the lighting track and the first cover is in its closed configuration; and wherein the transformer is adapted to transfer electrical power to the connector at a second voltage. In an exemplary embodiment, the housing comprises a second ear portion; and wherein the apparatus further comprises a second cover hingedly coupled to the second ear portion of the housing, the second cover comprising an open configuration in which the second cover is generally permitted to rotate relative to the housing, and a closed configuration in which the second cover is generally prevented from rotating relative to the housing, wherein at least another portion of the lighting track is adapted to be positioned between the second cover and the second ear portion when the apparatus is coupled to the lighting track and the second cover is in its closed configuration; a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track. In an exemplary embodiment, the housing comprises a second ear portion; and wherein the apparatus further comprises a second cover hingedly coupled to the second ear portion of the housing, the second cover comprising an open configuration in which the second cover is generally permitted to rotate relative to the housing, and a closed configuration in which the second cover is generally prevented from rotating relative to the housing; wherein at least another portion of the lighting track is adapted to be positioned between the second cover and the second ear portion when the second cover is in its closed configuration. In an exemplary embodiment, the apparatus further comprises a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track. In an exemplary embodiment, the lighting track comprises third and fourth buss bars and wherein the apparatus further comprises a third contact assembly coupled to the third track adapter, the third contact assembly comprising a third contact pad; and first and second contacts extending from the third contact pad and electrically coupled to the transformer; wherein the first and second contacts of the third contact assembly are adapted to be electrically coupled to the third and fourth buss bars, respectively, of the lighting track when the apparatus is coupled to the lighting track and the second cover is in its closed configuration. In an exemplary embodiment, the apparatus further comprises a third biasing element coupled to the third track adapter and the third contact pad; wherein the third biasing element is adapted to provide a biasing force against the third contact pad to effect sufficient electrical coupling between the first and second contacts of the third contact pad assembly and the third and fourth buss bars, respectively, when the apparatus is coupled to the lighting track and the second cover is in its closed configuration; wherein the third biasing element is adapted to maintain sufficient electrical coupling between the first and second contacts of the first contact pad assembly and the third and fourth buss bars, respectively, when the apparatus is coupled to the lighting track and the lighting track is in the flexed configuration. In an exemplary embodiment, the first and second contacts of the third contact assembly are adapted to transfer electrical power to the transformer at a first voltage when the apparatus is coupled to the lighting track and the second cover is in its closed configuration; and wherein the transformer is adapted to transfer electrical power to the first and second buss bars at a second voltage and via the at least one contact of the first contact pad assembly and the at least one contact of the second contact pad assembly, respectively, when the apparatus is coupled to the lighting track and the first cover is in its closed configuration. In an exemplary embodiment, the apparatus further comprises a switch electrically coupled to the transformer wherein the transformer is adapted to transfer electrical power to the first and second buss bars at the second voltage in response to the operation of the switch. In an exemplary embodiment, the lighting track comprises a first buss bar and the wherein the apparatus further comprises a transformer at least partially positioned within the housing; a first contact pad assembly coupled to the housing, the first contact pad assembly comprising a first contact pad; and at least one contact extending from the first contact pad and electrically coupled to the transformer; wherein the at least one contact is adapted to be electrically coupled to the first buss bar of the lighting track when the apparatus is coupled to the lighting track. In an exemplary embodiment, the apparatus further comprises a first biasing element coupled to the first track adapter and the first contact pad; wherein the first biasing element is adapted to provide a biasing force against the first contact pad to effect sufficient electrical coupling between the at least one contact of the first contact pad assembly and the first buss bar when the apparatus is coupled to the lighting track. In an exemplary embodiment, the first biasing element is adapted to maintain sufficient electrical coupling between the at least one contact of the first contact pad assembly and the first buss bar when the apparatus is coupled to the lighting track and the lighting track is in the flexed configuration.

An apparatus adapted to be coupled to a lighting track has been described that includes a housing; a first cover coupled to the housing wherein at least a portion of the lighting track is adapted to be positioned between the first cover and at least a portion of the housing when the apparatus is coupled to the lighting track; and a first track adapter engaged with the at least a portion of the housing and adapted to at least partially rotate in place, relative to the housing, to accommodate a flexed configuration of the lighting track. In an exemplary embodiment, the apparatus further comprises a second track adapter engaged with the first cover and adapted to at least partially rotate in place, relative to the first cover, to accommodate the flexed configuration of the lighting track. In an exemplary embodiment, the at least a portion of the housing comprises a first ear portion; and wherein the at least a portion of the lighting track is adapted to be positioned between the first cover and the first ear portion when the apparatus is coupled to the lighting track. In an exemplary embodiment, the housing comprises a second ear portion and wherein the apparatus further comprises a second cover coupled to the second ear portion wherein at least another portion of the lighting track is adapted to be positioned between the second cover and the second ear portion when the apparatus is coupled to the lighting track. In an exemplary embodiment, the apparatus further comprises a third track adapter engaged with the second ear portion and adapted to at least partially rotate in place, relative to the housing, to accommodate the flexed configuration of the lighting track. In an exemplary embodiment, the apparatus further comprises a fourth track adapter engaged with the second cover and adapted to at least partially rotate in place, relative to the second cover, to accommodate the flexed configuration of the lighting track. In an exemplary embodiment, the housing comprises a first ear portion; wherein the first cover is hingedly coupled to the first ear portion and comprises an open configuration in which the first cover is generally permitted to rotate relative to the housing, and a closed configuration in which the first cover is generally prevented from rotating relative to the housing. In an exemplary embodiment, the housing comprises a second ear portion and wherein the apparatus further comprises a second cover hingedly coupled to the second ear portion wherein at least another portion of the lighting track is adapted to be positioned between the second cover and the second ear portion when the apparatus is coupled to the lighting track. In an exemplary embodiment, the second cover comprises an open configuration in which the second cover is generally permitted to rotate relative to the housing, and a closed configuration in which the second cover is generally prevented from rotating relative to the housing. In an exemplary embodiment, the lighting track comprises a first buss bar and wherein the apparatus further comprises a transformer at least partially positioned within the housing; a first contact pad assembly coupled to the first track adapter, the first contact pad assembly comprising a first contact pad; and at least one contact extending from the first contact pad and electrically coupled to the transformer; wherein the at least one contact is adapted to be electrically coupled to the first buss bar of the lighting track when the apparatus is coupled to the lighting track and the first cover is in its closed configuration. In an exemplary embodiment, the apparatus further comprises a first biasing element coupled to the first track adapter and the first contact pad; wherein the first biasing element is adapted to provide a biasing force against the first contact pad to effect sufficient electrical coupling between the at least one contact of the first contact pad assembly and the first buss bar when the apparatus is coupled to the lighting track and the first cover is in its closed configuration. In an exemplary embodiment, the first biasing element is adapted to maintain sufficient electrical coupling between the at least one contact of the first contact pad assembly and the first buss bar when the apparatus is coupled to the lighting track and the lighting track is in the flexed configuration. In an exemplary embodiment, the apparatus further comprises a second track adapter engaged with the first cover and adapted to at least partially rotate in place, relative to the first cover, to accommodate the flexed configuration of the lighting track. In an exemplary embodiment, the lighting track comprises a second buss bar and the apparatus further comprises a second contact pad assembly coupled to the second track adapter, the second contact pad assembly comprising a second contact pad; and at least one contact extending from the second contact pad and electrically coupled to the transformer; wherein the at least one contact of the second contact pad assembly is adapted to be electrically coupled to the second buss bar of the lighting track when the apparatus is coupled to the lighting track and the first cover is in its closed configuration. In an exemplary embodiment, the apparatus further comprises a second biasing element coupled to the second track adapter and the second contact pad; wherein the second biasing element is adapted to provide a biasing force against the second contact pad to effect sufficient electrical coupling between the at least one contact of the second contact pad assembly and the second buss bar when the apparatus is coupled to the lighting track and the first cover is in its closed configuration. In an exemplary embodiment, the second biasing element is adapted to maintain sufficient electrical coupling between the at least one contact of the second contact pad assembly and the second buss bar when the apparatus is coupled to the lighting track and the lighting track is in the flexed configuration. In an exemplary embodiment, the apparatus further comprises a connector engaged with the housing and electrically coupled to the transformer. In an exemplary embodiment, the connector is adapted to be coupled to a load so that the transformer is electrically coupled to the load. In an exemplary embodiment, the at least one contact of the first contact pad assembly and the at least one contact of the second contact pad assembly are adapted to transfer electrical power to the transformer at a first voltage when the apparatus is coupled to the lighting track and the first cover is in its closed configuration; and wherein the transformer is adapted to transfer electrical power to the connector at a second voltage. In an exemplary embodiment, the apparatus further comprises a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track. In an exemplary embodiment, the housing comprises a second ear portion; and wherein the apparatus further comprises a second cover hingedly coupled to the second ear portion of the housing, the second cover comprising an open configuration in which the second cover is generally permitted to rotate relative to the housing, and a closed configuration in which the second cover is generally prevented from rotating relative to the housing; wherein at least another portion of the lighting track is adapted to be positioned between the second cover and the second ear portion when the second cover is in its closed configuration. In an exemplary embodiment, the apparatus further comprises a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track. In an exemplary embodiment, the lighting track comprises third and fourth buss bars and wherein the apparatus further comprises a third contact assembly coupled to the third track adapter, the third contact assembly comprising a third contact pad; and first and second contacts extending from the third contact pad and electrically coupled to the transformer; wherein the first and second contacts of the third contact assembly are adapted to be electrically coupled to the third and fourth buss bars, respectively, of the lighting track when the apparatus is coupled to the lighting track and the second cover is in its closed configuration. In an exemplary embodiment, the apparatus further comprises a third biasing element coupled to the third track adapter and the third contact pad; wherein the third biasing element is adapted to provide a biasing force against the third contact pad to effect sufficient electrical coupling between the first and second contacts of the third contact pad assembly and the third and fourth buss bars, respectively, when the apparatus is coupled to the lighting track and the second cover is in its closed configuration; wherein the third biasing element is adapted to maintain sufficient electrical coupling between the first and second contacts of the first contact pad assembly and the third and fourth buss bars, respectively, when the apparatus is coupled to the lighting track and the lighting track is in the flexed configuration. In an exemplary embodiment, the first and second contacts of the third contact assembly are adapted to transfer electrical power to the transformer at a first voltage when the apparatus is coupled to the lighting track and the second cover is in its closed configuration; and wherein the transformer is adapted to transfer electrical power to the first and second buss bars at a second voltage and via the at least one contact of the first contact pad assembly and the at least one contact of the second contact pad assembly, respectively, when the apparatus is coupled to the lighting track and the first cover is in its closed configuration. In an exemplary embodiment, the apparatus further comprises a switch electrically coupled to the transformer wherein the transformer is adapted to transfer electrical power to the first and second buss bars at the second voltage in response to the operation of the switch. In an exemplary embodiment, the lighting track comprises a first buss bar and wherein the apparatus further comprises a transformer at least partially positioned within the housing; a first contact pad assembly coupled to the first track adapter, the first contact pad assembly comprising a first contact pad; and at least one contact extending from the first contact pad and electrically coupled to the transformer; wherein the at least one contact is adapted to be electrically coupled to the first buss bar of the lighting track when the apparatus is coupled to the lighting track. In an exemplary embodiment, the apparatus further comprises a first biasing element coupled to the first track adapter and the first contact pad; wherein the first biasing element is adapted to provide a biasing force against the first contact pad to effect sufficient electrical coupling between the at least one contact of the first contact pad assembly and the first buss bar when the apparatus is coupled to the lighting track. In an exemplary embodiment, the first biasing element is adapted to maintain sufficient electrical coupling between the at least one contact of the first contact pad assembly and the first buss bar when the apparatus is coupled to the lighting track and the lighting track is in the flexed configuration.

An apparatus adapted to be coupled to a lighting track has been described that includes a first buss bar, the apparatus comprising a housing; a transformer at least partially positioned within the housing; a first contact pad assembly coupled to the housing, the first contact pad assembly comprising a first contact pad; and at least one contact extending from the first contact pad and electrically coupled to the transformer; wherein the at least one contact is adapted to be electrically coupled to the first buss bar of the lighting track. In an exemplary embodiment, the apparatus further comprises a first biasing element coupled to the first contact pad; wherein the first biasing element is adapted to provide a biasing force against the first contact pad to effect sufficient electrical coupling between the at least one contact of the first contact pad assembly and the first buss bar when the apparatus is coupled to the lighting track. In an exemplary embodiment, the first biasing element is adapted to maintain sufficient electrical coupling between the at least one contact of the first contact pad assembly and the first buss bar when the apparatus is coupled to the lighting track and the lighting track is in a flexed configuration. In an exemplary embodiment, the apparatus further comprises a first cover coupled to the housing wherein at least a portion of the lighting track is adapted to be positioned between the first cover and a portion of the housing when the apparatus is coupled to the lighting track. In an exemplary embodiment, the lighting track comprises a second buss bar and wherein the apparatus further comprises a second contact pad assembly coupled to the first cover, the second contact pad assembly comprising a second contact pad; and at least one contact extending from the second contact pad and electrically coupled to the transformer; wherein the at least one contact of the second contact pad assembly is adapted to be electrically coupled to the second buss bar of the lighting track when the apparatus is coupled to the lighting. In an exemplary embodiment, the apparatus further comprises a second biasing element coupled to the second contact pad; wherein the second biasing element is adapted to provide a biasing force against the second contact pad to effect sufficient electrical coupling between the at least one contact of the second contact pad assembly and the second buss bar when the apparatus is coupled to the lighting track. In an exemplary embodiment, the second biasing element is adapted to maintain sufficient electrical coupling between the at least one contact of the second contact pad assembly and the second buss bar when the apparatus is coupled to the lighting track and the lighting track is in the flexed configuration. In an exemplary embodiment, the apparatus further comprises a connector engaged with the housing and electrically coupled to the transformer. In an exemplary embodiment, the connector is adapted to be coupled to a load so that the transformer is electrically coupled to the load. In an exemplary embodiment, the at least one contact of the first contact pad assembly and the at least one contact of the second contact pad assembly are adapted to transfer electrical power to the transformer at a first voltage when the apparatus is coupled to the lighting track; and wherein the transformer is adapted to transfer electrical power to the connector at a second voltage. In an exemplary embodiment, the lighting track comprises third and fourth buss bars and wherein the apparatus further comprises a third contact assembly coupled to the housing, the third contact assembly comprising a third contact pad; and first and second contacts extending from the third contact pad and electrically coupled to the transformer; wherein the first and second contacts of the third contact assembly are adapted to be electrically coupled to the third and fourth buss bars, respectively, of the lighting track when the apparatus is coupled to the lighting track. In an exemplary embodiment, the apparatus further comprises a third biasing element coupled to the third contact pad; wherein the third biasing element is adapted to provide a biasing force against the third contact pad to effect sufficient electrical coupling between the first and second contacts of the third contact pad assembly and the third and fourth buss bars, respectively, when the apparatus is coupled to the lighting track. In an exemplary embodiment, the third biasing element is adapted to maintain sufficient electrical coupling between the first and second contacts of the first contact pad assembly and the third and fourth buss bars, respectively, when the apparatus is coupled to the lighting track and the lighting track is in the flexed configuration. In an exemplary embodiment, the first and second contacts of the third contact assembly are adapted to transfer electrical power to the transformer at a first voltage when the apparatus is coupled to the lighting track; and wherein the transformer is adapted to transfer electrical power to the first and second buss bars at a second voltage and via the at least one contact of the first contact pad assembly and the at least one contact of the second contact pad assembly, respectively, when the apparatus is coupled to the lighting track. In an exemplary embodiment, the apparatus further comprising a switch electrically coupled to the transformer wherein the transformer is adapted to transfer electrical power to the first and second buss bars at the second voltage in response to the operation of the switch. In an exemplary embodiment, the housing comprises an ear portion; and wherein the apparatus further comprises a cover coupled to the ear portion wherein at least a portion of the lighting track is adapted to be positioned between the cover and the ear portion when apparatus is coupled to the lighting track; and a first track adapter engaged with the ear portion and adapted to at least partially rotate in place, relative to the housing, to accommodate a flexed configuration of the lighting track. In an exemplary embodiment, the apparatus further comprises a second track adapter engaged with the cover and adapted to at least partially rotate in place, relative to the cover, to accommodate the flexed configuration of the lighting track. In an exemplary embodiment, the apparatus further comprises a cover hingedly coupled to the housing, the cover comprising an open configuration in which the cover is generally permitted to rotate relative to the housing, and a closed configuration in which the first cover is generally prevented from rotating relative to the housing. In an exemplary embodiment, at least a portion of the lighting track is adapted to be positioned between the first cover and a portion of the housing when the first cover is in its closed configuration.

An apparatus adapted to be coupled to a lighting track has been described that includes first and second buss bars, the apparatus comprising a housing; a first cover hingedly coupled to the housing, the first cover comprising an open configuration in which the first cover is generally permitted to rotate relative to the housing; and a closed configuration in which the first cover is generally prevented from rotating relative to the housing; a protrusion wherein, when the first cover is in its closed configuration, the first cover is positioned relative to the protrusion so that the protrusion generally prevents the first cover from rotating relative to the housing; wherein the first cover comprises a notch into which the protrusion extends when the first cover is in its closed configuration; wherein the housing comprises a first ear portion to which the first cover is hingedly coupled; wherein at least a portion of the lighting track is adapted to be positioned between the first cover and the first ear portion when the apparatus is coupled to the lighting track and the first cover is in its closed configuration; wherein the apparatus further comprises a first pin coupled to the first ear portion and the first cover, wherein the first cover is adapted to rotate about the pin when the first cover is in the open configuration; a first spring engaged with the first ear portion and the first cover, wherein the first pin extends through the first spring and the first spring resists translation of the first cover relative to the housing; a first track adapter engaged with the first ear portion and adapted to at least partially rotate in place, relative to the housing, to accommodate a flexed configuration of the lighting track; a transformer at least partially positioned within the housing; a first contact pad assembly coupled to the first track adapter, the first contact pad assembly comprising a first contact pad; and at least one contact extending from the first contact pad and electrically coupled to the transformer wherein the at least one contact is adapted to be electrically coupled to the first buss bar of the lighting track when the apparatus is coupled to the lighting track and the first cover is in its closed configuration; a first biasing element coupled to the first track adapter and the first contact pad wherein the first biasing element is adapted to provide a biasing force against the first contact pad to effect sufficient electrical coupling between the at least one contact of the first contact pad assembly and the first buss bar when the apparatus is coupled to the lighting track and the first cover is in its closed configuration, and wherein the first biasing element is adapted to maintain sufficient electrical coupling between the at least one contact of the first contact pad assembly and the first buss bar when the apparatus is coupled to the lighting track and the lighting track is in the flexed configuration; a second track adapter engaged with the first cover and adapted to at least partially rotate in place, relative to the first cover, to accommodate the flexed configuration of the lighting track; a second contact pad assembly coupled to the second track adapter, the second contact pad assembly comprising a second contact pad; and at least one contact extending from the second contact pad and electrically coupled to the transformer wherein the at least one contact of the second contact pad assembly is adapted to be electrically coupled to the second buss bar of the lighting track when the apparatus is coupled to the lighting track and the first cover is in its closed configuration; a second biasing element coupled to the second track adapter and the second contact pad wherein the second biasing element is adapted to provide a biasing force against the second contact pad to effect sufficient electrical coupling between the at least one contact of the second contact pad assembly and the second buss bar when the apparatus is coupled to the lighting track and the first cover is in its closed configuration, and wherein the second biasing element is adapted to maintain sufficient electrical coupling between the at least one contact of the second contact pad assembly and the second buss bar when the apparatus is coupled to the lighting track and the lighting track is in the flexed configuration; a connector engaged with the housing and electrically coupled to the transformer wherein the connector is adapted to be coupled to a load so that the transformer is electrically coupled to the load; wherein the at least one contact of the first contact pad assembly and the at least one contact of the second contact pad assembly are adapted to transfer electrical power to the transformer at a first voltage when the apparatus is coupled to the lighting track and the first cover is in its closed configuration; wherein the transformer is adapted to transfer electrical power to the connector at a second voltage; and wherein the housing comprises a second ear portion; and wherein the apparatus further comprises a second cover hingedly coupled to the second ear portion of the housing, the second cover comprising an open configuration in which the second cover is generally permitted to rotate relative to the housing, and a closed configuration in which the second cover is generally prevented from rotating relative to the housing, wherein at least another portion of the lighting track is adapted to be positioned between the second cover and the second ear portion when the apparatus is coupled to the lighting track and the second cover is in its closed configuration; a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track.

An apparatus adapted to be coupled to a lighting track has been described that includes first, second, third and fourth buss bars, the apparatus comprising a housing; a first cover hingedly coupled to the housing, the first cover comprising an open configuration in which the first cover is generally permitted to rotate relative to the housing; and a closed configuration in which the first cover is generally prevented from rotating relative to the housing; and a protrusion wherein, when the first cover is in its closed configuration, the first cover is positioned relative to the protrusion so that the protrusion generally prevents the first cover from rotating relative to the housing; wherein the first cover comprises a wall and another protrusion spaced from the wall wherein, when the first cover is in its closed configuration, the protrusion extends between the wall and the another protrusion of the first cover; wherein the housing comprises a first ear portion to which the first cover is hingedly coupled; wherein at least a portion of the lighting track is adapted to be positioned between the first cover and the first ear portion when the apparatus is coupled to the lighting track and the first cover is in its closed configuration; wherein the apparatus further comprises a first pin coupled to the first ear portion and the first cover, wherein the first cover is adapted to rotate about the pin when the first cover is in the open configuration; a first spring engaged with the first ear portion and the first cover, wherein the first pin extends through the first spring and the first spring resists translation of the first cover relative to the housing; a first track adapter engaged with the first ear portion and adapted to at least partially rotate in place, relative to the housing, to accommodate a flexed configuration of the lighting track; a transformer at least partially positioned within the housing; a first contact pad assembly coupled to the first track adapter, the first contact pad assembly comprising a first contact pad; and at least one contact extending from the first contact pad and electrically coupled to the transformer wherein the at least one contact is adapted to be electrically coupled to the first buss bar of the lighting track when the apparatus is coupled to the lighting track and the first cover is in its closed configuration; a first biasing element coupled to the first track adapter and the first contact pad wherein the first biasing element is adapted to provide a biasing force against the first contact pad to effect sufficient electrical coupling between the at least one contact of the first contact pad assembly and the first buss bar when the apparatus is coupled to the lighting track and the first cover is in its closed configuration, and wherein the first biasing element is adapted to maintain sufficient electrical coupling between the at least one contact of the first contact pad assembly and the first buss bar when the apparatus is coupled to the lighting track and the lighting track is in the flexed configuration; a second track adapter engaged with the first cover and adapted to at least partially rotate in place, relative to the first cover, to accommodate the flexed configuration of the lighting track; a second contact pad assembly coupled to the second track adapter, the second contact pad assembly comprising a second contact pad; and at least one contact extending from the second contact pad and electrically coupled to the transformer wherein the at least one contact of the second contact pad assembly is adapted to be electrically coupled to the second buss bar of the lighting track when the apparatus is coupled to the lighting track and the first cover is in its closed configuration; a second biasing element coupled to the second track adapter and the second contact pad wherein the second biasing element is adapted to provide a biasing force against the second contact pad to effect sufficient electrical coupling between the at least one contact of the second contact pad assembly and the second buss bar when the apparatus is coupled to the lighting track and the first cover is in its closed configuration, and wherein the second biasing element is adapted to maintain sufficient electrical coupling between the at least one contact of the second contact pad assembly and the second buss bar when the apparatus is coupled to the lighting track and the lighting track is in the flexed configuration; wherein the housing comprises a second ear portion; wherein the apparatus further comprises a second cover hingedly coupled to the second ear portion of the housing, the second cover comprising an open configuration in which the second cover is generally permitted to rotate relative to the housing, and a closed configuration in which the second cover is generally prevented from rotating relative to the housing; wherein at least another portion of the lighting track is adapted to be positioned between the second cover and the second ear portion when the second cover is in its closed configuration; wherein the apparatus further comprises a third track adapter engaged with the second ear portion and adapted to at least partially rotate in place, relative to the housing, to accommodate the flexed configuration of the lighting track; and a fourth track adapter engaged with the second cover and adapted to at least partially rotate in place, relative to the second cover, to accommodate the flexed configuration of the lighting track, a third contact assembly coupled to the third track adapter, the third contact assembly comprising a third contact pad; and first and second contacts extending from the third contact pad and electrically coupled to the transformer wherein the first and second contacts of the third contact assembly are adapted to be electrically coupled to the third and fourth buss bars, respectively, of the lighting track when the apparatus is coupled to the lighting track and the second cover is in its closed configuration; a third biasing element coupled to the third track adapter and the third contact pad wherein the third biasing element is adapted to provide a biasing force against the third contact pad to effect sufficient electrical coupling between the first and second contacts of the third contact pad assembly and the third and fourth buss bars, respectively, when the apparatus is coupled to the lighting track and the second cover is in its closed configuration, and wherein the third biasing element is adapted to maintain sufficient electrical coupling between the first and second contacts of the first contact pad assembly and the third and fourth buss bars, respectively, when the apparatus is coupled to the lighting track and the lighting track is in the flexed configuration; wherein the first and second contacts of the third contact assembly are adapted to transfer electrical power to the transformer at a first voltage when the apparatus is coupled to the lighting track and the second cover is in its closed configuration; wherein the transformer is adapted to transfer electrical power to the first and second buss bars at a second voltage and via the at least one contact of the first contact pad assembly and the at least one contact of the second contact pad assembly, respectively, when the apparatus is coupled to the lighting track and the first cover is in its closed configuration; and wherein the apparatus further comprises a switch electrically coupled to the transformer wherein the transformer is adapted to transfer electrical power to the first and second buss bars at the second voltage in response to the operation of the switch.

A system has been described that includes a lighting track comprising a first pair of buss bars; means for coupling a transformer assembly comprising a transformer to the lighting track, comprising means for electrically coupling the transformer to the first pair of buss bars of the lighting track. In an exemplary embodiment, the lighting track further comprises a second pair of buss bars; and wherein means for coupling the transformer assembly to the lighting track further comprises means for electrically coupling the transformer to the second pair of buss bars of the lighting track. In an exemplary embodiment, the system further comprises means for generating a first voltage across the first pair of buss bars of the lighting track. In an exemplary embodiment, the system further comprises means for generating a second voltage across the second pair of buss bars of the lighting track using the transformer. In an exemplary embodiment, the first voltage comprises AC voltage and the second voltage comprises DC voltage. In an exemplary embodiment, means for generating the second voltage across the second pair of buss bars of the lighting track using the transformer comprises means for operating a switch electrically coupled to the transformer. In an exemplary embodiment, the lighting track comprises a flexed configuration and means for coupling the transformer assembly to the lighting track further comprises means for accommodating the flexed configuration of the lighting track when the lighting track is in the flexed configuration; and means for maintaining the electrical coupling between the transformer and each of the first and second pairs of buss bars when the lighting track is in the flexed configuration. In an exemplary embodiment, the system further comprises means for coupling a connector to the transformer assembly, comprising means for electrically coupling the connector to the transformer. In an exemplary embodiment, the system further comprises means for generating a first voltage across the first pair of buss bars of the lighting track. In an exemplary embodiment, the system further comprises means for transferring electrical power to the transformer at the first voltage. In an exemplary embodiment, the system further comprises means for transferring electrical power to the connector at a second voltage using the transformer. In an exemplary embodiment, the system further comprises means for electrically coupling the load to the connector; and means for transferring electrical power to the load at the second voltage via the connector. In an exemplary embodiment, the load comprises a lamp. In an exemplary embodiment, means for transferring electrical power to the transformer at the first voltage comprises means for transferring AC electrical power to the transformer at the first voltage; and wherein means for transferring electrical power to the load at the second voltage via the connector comprises means for transferring DC electrical power to the load at the second voltage via the connector. In an exemplary embodiment, the lighting track comprises a flexed configuration and means for coupling the transformer assembly to the lighting track further comprises means for accommodating the flexed configuration of the lighting track when the lighting track is in the flexed configuration; and means for maintaining the electrical coupling between the transformer and the first pair of buss bars when the lighting track is in the flexed configuration. In an exemplary embodiment, the system further comprises means for forming a grounding coupling between the transformer assembly and the lighting track. In an exemplary embodiment, the transformer assembly comprises at least one cover; and wherein means for coupling the transformer assembly to the lighting track further comprises means for locking the at least one cover of the transformer assembly. In an exemplary embodiment, the transformer assembly comprises a housing within which the transformer is at least partially positioned; and wherein means for coupling the transformer assembly to the lighting track further comprises means for hingedly coupling at least one cover to the housing of the transformer assembly; and means for placing the at least one cover in a closed configuration. In an exemplary embodiment, means for placing the at least one cover in the closed configuration comprises means for rotating the at least one cover relative to the housing so that a portion of the track is positioned between a portion of the housing and the at least one cover; and means for translating the at least one cover relative to the housing. In an exemplary embodiment, means for placing the at least one cover in the closed configuration further comprises means for generally preventing the at least one cover from rotating relative to the housing; and means for resisting unwanted translation of the at least one cover during generally preventing the at least one cover from rotating relative to the housing. In an exemplary embodiment, means for coupling the transformer assembly to the lighting track further comprises means for placing the at least one cover in an open configuration, comprising means for translating the at least one cover relative to the housing; and means for rotating the at least one cover relative to the housing. In an exemplary embodiment, means for coupling the transformer assembly to the lighting track further comprises means for toollessly coupling the transformer assembly to the lighting track. In an exemplary embodiment, the transformer comprises an AC-to-DC transformer. In an exemplary embodiment, the transformer comprises an AC-to-AC transformer. In an exemplary embodiment, the transformer comprises a DC-to-DC transformer. In an exemplary embodiment, the transformer comprises an inverter. In an exemplary embodiment, the transformer comprises a converter.

A system has been described that includes a lighting track comprising a first pair of buss bars; means for toollessly coupling a transformer assembly to the lighting track, the transformer assembly comprising a transformer and a housing within which the transformer is at least partially positioned; wherein means for toollessly coupling the transformer assembly to the lighting track comprises means for electrically coupling the transformer to the first pair of buss bars of the lighting track; means for hingedly coupling at least one cover to the housing of the transformer assembly; means for placing the at least one cover in an open configuration, comprising means for translating the at least one cover relative to the housing; and means for rotating the at least one cover relative to the housing; placing the at least one cover in a closed configuration, comprising means for rotating the at least one cover relative to the housing so that a portion of the track is positioned between a portion of the housing and the at least one cover; means for translating the at least one cover relative to the housing; means for generally preventing the at least one cover from rotating relative to the housing; and means for resisting unwanted translation of the at least one cover during generally preventing the at least one cover from rotating relative to the housing; means for coupling a connector to the transformer assembly, comprising means for electrically coupling the connector to the transformer; means for forming a grounding coupling between the transformer assembly and the lighting track; means for generating a first voltage across the first pair of buss bars of the lighting track; means for transferring AC electrical power to the transformer at the first voltage; means for transferring DC electrical power to the connector at a second voltage using the transformer; wherein the lighting track comprises a flexed configuration and means for toollessly coupling the transformer assembly to the lighting track further comprises means for accommodating the flexed configuration of the lighting track when the lighting track is in the flexed configuration; and means for maintaining the electrical coupling between the transformer and the first pair of buss bars when the lighting track is in the flexed configuration; and wherein the transformer comprises an AC-to-DC transformer.

A system has been described that includes a lighting track comprising first and second pairs of buss bars; means for toollessly coupling a transformer assembly to a lighting track, the transformer assembly comprising a transformer and a housing within which the transformer is at least partially positioned; wherein means for toollessly coupling a transformer assembly to a lighting track comprises means for electrically coupling the transformer to the first pair of buss bars of the lighting track; means for electrically coupling the transformer to the second pair of buss bars of the lighting track; and means for hingedly coupling at least one cover to the housing of the transformer assembly; means for placing the at least one cover in an open configuration, comprising means for translating the at least one cover relative to the housing; and means for rotating the at least one cover relative to the housing; placing the at least one cover in a closed configuration, comprising means for rotating the at least one cover relative to the housing so that a portion of the track is positioned between a portion of the housing and the at least one cover; means for translating the at least one cover relative to the housing; generally preventing the at least one cover from rotating relative to the housing; and resisting unwanted translation of the at least one cover during generally preventing the at least one cover from rotating relative to the housing; means for forming a grounding coupling between the transformer assembly and the lighting track; means for generating a first voltage across the first pair of buss bars of the lighting track; means for generating a second voltage across the second pair of buss bars of the lighting track using the transformer, wherein generating the second voltage across the second pair of buss bars of the lighting track using the transformer comprises operating a switch electrically coupled to the transformer; wherein the lighting track comprises a flexed configuration and means for toollessly coupling the transformer assembly to the lighting track further comprises means for accommodating the flexed configuration of the lighting track when the lighting track is in the flexed configuration; and means for maintaining the electrical coupling between the transformer and each of the first and second pairs of buss bars when the lighting track is in the flexed configuration; wherein the transformer comprises an AC-to-DC transformer; and wherein the first voltage comprises AC voltage and the second voltage comprises DC voltage.

A method has been described that includes providing a lighting track; toollessly coupling an attachment to the lighting track; and coupling an assembly to the attachment. In an exemplary embodiment, the attachment is adapted to be toollessly coupled to the lighting track using only one hand. In an exemplary embodiment, the attachment comprises a housing and wherein toollessly coupling the attachment to the lighting track comprises hingedly coupling a cover to the housing of the attachment; and placing the cover in a closed configuration. In an exemplary embodiment, placing the cover in the closed configuration comprises rotating the cover relative to the housing so that at least a portion of the lighting track is positioned between the cover and the housing; and locking the cover to the housing so that the cover is generally prevented from rotating relative to the housing. In an exemplary embodiment, wherein the cover is locked in response to rotating the cover relative to the housing so that the at least a portion of the lighting track is positioned between the cover and the housing. In an exemplary embodiment, the assembly comprises a mounting assembly; and wherein coupling the assembly to the attachment comprises coupling the mounting assembly to the attachment; and wherein the method further comprises coupling the mounting assembly to a support structure. In an exemplary embodiment, the method further comprises at least partially supporting the lighting track using the attachment and the mounting assembly. In an exemplary embodiment, the lighting track is suspended from the support structure by the attachment and the mounting assembly. In an exemplary embodiment, the lighting track comprises a pair of buss bars and wherein the assembly comprises a lamp; wherein coupling the assembly to the attachment comprises electrically coupling the lamp to the attachment; and wherein toollessly coupling the attachment to the lighting track comprises electrically coupling the attachment to the pair of buss bars of the lighting track. In an exemplary embodiment, the method further comprises generating a voltage across the pair of buss bars of the lighting track. In an exemplary embodiment, the method further comprises transferring electrical power at the voltage from the pair of buss bars to the lamp. In an exemplary embodiment, the lamp operates at the voltage in response to transferring electrical power at the voltage from the pair of buss bars to the lamp. In an exemplary embodiment, transferring electrical power at the voltage from the pair of buss bars to the lamp comprises transferring AC electrical power at the voltage from the pair of buss bars to the lamp. In an exemplary embodiment, transferring electrical power at the voltage from the pair of buss bars to the lamp comprises transferring DC electrical power at the voltage from the pair of buss bars to the lamp. In an exemplary embodiment, toollessly coupling the attachment to the lighting track comprises forming a grounding coupling between the attachment and the lighting track. In an exemplary embodiment, the lighting track comprises a flexed configuration and toollessly coupling the attachment to the lighting track further comprises maintaining the electrical coupling between the attachment and the pair of buss bars when the lighting track is in the flexed configuration. In an exemplary embodiment, toollessly coupling the attachment to the lighting track further comprises accommodating a bend in the lighting track; wherein the electrical coupling between the attachment and the pair of buss bars is maintained in response to accommodating the bend in the lighting track. In an exemplary embodiment, the lighting track comprises a pair of buss bars and wherein the assembly comprises a transformer; wherein coupling the assembly to the attachment comprises electrically coupling the transformer to the attachment; and wherein toollessly coupling the attachment to the lighting track comprises electrically coupling the attachment to the pair of buss bars of the lighting track. In an exemplary embodiment, the method further comprises generating a first voltage across the pair of buss bars. In an exemplary embodiment, the method further comprises transferring electrical power at the first voltage from the pair of buss bars to the transformer. In an exemplary embodiment, the method further comprises electrically coupling a load to the transformer. In an exemplary embodiment, the method further comprises transferring electrical power to the load at a second voltage using the transformer. In an exemplary embodiment, transferring electrical power at the first voltage from the pair of buss bars to the transformer comprises transferring AC electrical power at the first voltage from the pair of buss bars to the transformer; and wherein transferring electrical power to the load at a second voltage using the transformer comprises transferring DC electrical power to the load at a second voltage using the transformer. In an exemplary embodiment, the load comprises a lamp. In an exemplary embodiment, toollessly coupling the attachment to the lighting track comprises forming a grounding coupling between the attachment and the lighting track. In an exemplary embodiment, the lighting track comprises a flexed configuration and toollessly coupling the attachment to the lighting track further comprises maintaining the electrical coupling between the attachment and the pair of buss bars when the lighting track is in the flexed configuration. In an exemplary embodiment, toollessly coupling the attachment to the lighting track further comprises accommodating a bend in the lighting track; wherein the electrical coupling between the attachment and the pair of buss bars is maintained in response to accommodating the bend in the lighting track. In an exemplary embodiment, the lighting track comprises a pair of buss bars and wherein the assembly comprises a converter; wherein coupling the assembly to the attachment comprises electrically coupling the converter to the attachment; wherein toollessly coupling the attachment to the lighting track comprises electrically coupling the attachment to the pair of buss bars of the lighting track; and wherein the method further comprises electrically coupling a lamp to the converter. In an exemplary embodiment, the lighting track comprises a pair of buss bars and wherein toollessly coupling the attachment to the lighting track comprises electrically coupling the attachment to the pair of buss bars of the lighting track. In an exemplary embodiment, the method further comprises electrically coupling the attachment to a source of electrical power. In an exemplary embodiment, a voltage is generated across the pair of buss bars in response to electrically coupling the attachment to the source of electrical power. In an exemplary embodiment, the voltage is in the form of AC voltage. In an exemplary embodiment, the voltage is in the form of DC voltage. In an exemplary embodiment, the assembly comprises a mounting assembly; and wherein coupling the assembly to the attachment comprises coupling the mounting assembly to the attachment; and wherein the method further comprises coupling the mounting assembly to a support structure. In an exemplary embodiment, the method further comprises forming a grounding coupling between the attachment and the lighting track. In an exemplary embodiment, the lighting track comprises a flexed configuration and toollessly coupling the attachment to the lighting track further comprises maintaining the electrical coupling between the attachment and the pair of buss bars when the lighting track is in the flexed configuration. In an exemplary embodiment, toollessly coupling the attachment to the lighting track further comprises accommodating a bend in the lighting track; wherein the electrical coupling between the attachment and the pair of buss bars is maintained in response to accommodating the bend in the lighting track.

A method has been described that includes providing a lighting track; toollessly coupling an attachment comprising a housing to the lighting track, comprising hingedly coupling a cover to the housing of the attachment; and placing the cover in a closed configuration, comprising rotating the cover relative to the housing so that at least a portion of the lighting track is positioned between the cover and the housing; and locking the cover to the housing so that the cover is generally prevented from rotating relative to the housing; wherein the cover is locked in response to rotating the cover relative to the housing so that the at least a portion of the lighting track is positioned between the cover and the housing; and coupling an assembly to the attachment.

A method has been described that includes providing a lighting track comprising a pair of buss bars and a flexed configuration; coupling an attachment to the lighting track, comprising electrically coupling the attachment to the pair of buss bars of the lighting track; and maintaining the electrical coupling between the attachment and the pair of buss bars when the lighting track is in the flexed configuration. In an exemplary embodiment, maintaining the electrical coupling between the attachment and the lighting track when the lighting track is in the flexed configuration comprises accommodating a bend in the lighting track. In an exemplary embodiment, the method further comprises forming a grounding coupling between the attachment and the lighting track. In an exemplary embodiment, coupling the attachment to the lighting track comprises toollessly coupling the attachment to the lighting track. In an exemplary embodiment, the attachment is adapted to be toollessly coupled to the lighting track using only one hand. In an exemplary embodiment, the attachment comprises a housing and wherein toollessly coupling the attachment to the lighting track comprises hingedly coupling a cover to the housing of the attachment; and placing the cover in a closed configuration. In an exemplary embodiment, placing the cover in the closed configuration comprises rotating the cover relative to the housing so that at least a portion of the lighting track is positioned between the cover and the housing; and locking the cover to the housing so that the cover is generally prevented from rotating relative to the housing. In an exemplary embodiment, the cover is locked in response to rotating the cover relative to the housing so that the at least a portion of the lighting track is positioned between the cover and the housing.

A method has been described that includes providing a lighting track comprising a pair of buss bars and a flexed configuration; toollessly coupling an attachment comprising a housing to the lighting track, comprising electrically coupling the attachment to the pair of buss bars of the lighting track; hingedly coupling a cover to the housing of the attachment; placing the cover in a closed configuration, comprising rotating the cover relative to the housing so that at least a portion of the lighting track is positioned between the cover and the housing; and locking the cover to the housing so that the cover is generally prevented from rotating relative to the housing; wherein the cover is locked in response to rotating the cover relative to the housing so that the at least a portion of the lighting track is positioned between the cover and the housing; maintaining the electrical coupling between the attachment and the pair of buss bars when the lighting track is in the flexed configuration, comprising accommodating a bend in the lighting track; and forming a grounding coupling between the attachment and the lighting track.

An apparatus adapted to be coupled to a lighting track has been described that includes a first housing; a second housing coupled to the first housing; and a cover hingedly coupled to the second housing and comprising a first configuration in which the cover is permitted to rotate relative to the second housing; and a second configuration in which the cover is generally prevented from rotating relative to the second housing. In an exemplary embodiment, at least a portion of the lighting track is adapted to be positioned between the cover and the second housing when the cover is in the second configuration. In an exemplary embodiment, the first housing comprises an external annular recess; and wherein the apparatus further comprises a sleeve within which the external annular recess at least partially extends to define an annular region therebetween; and a spring extending within the annular region and about the external annular recess. In an exemplary embodiment, the external annular recess of the first housing defines an external shoulder; wherein the sleeve defines an internal shoulder; and wherein the spring engages and is at least partially compressed between the external shoulder of the first housing and the internal shoulder of the sleeve. In an exemplary embodiment, the spring applies a biasing force against the internal shoulder of the sleeve to urge the sleeve towards the second housing; and wherein the spring is adapted to further compress in response to movement of the sleeve away from the second housing. In an exemplary embodiment, when the cover is in its second configuration, the sleeve engages the cover and the second housing in response to the biasing force applied by the spring. In an exemplary embodiment, the cover comprises an external annular recess defining an external shoulder; wherein the second housing comprises an external annular recess defining an external shoulder; and wherein, when the cover is in its second configuration, the sleeve engages the respective external shoulders of the cover and the second housing in response to the biasing force applied by the spring. In an exemplary embodiment, the cover is rotated to place the cover in its second configuration from its first configuration; wherein the cover comprises at least one ramp surface for engaging at least a portion of the sleeve during the rotation of the cover to place the cover in its second configuration from its first configuration. In an exemplary embodiment, the at least a portion of the sleeve is temporarily displaced in response to the engagement between the at least one ramp surface and the at least a portion of the sleeve. In an exemplary embodiment, the apparatus further comprises a mounting assembly coupled to the first housing; wherein the mounting assembly is adapted to be coupled to a support structure to at least partially support the lighting track. In an exemplary embodiment, wherein the lighting track comprises a first buss bar and wherein the apparatus further comprises a first contact pad assembly coupled to the second housing, the first contact pad assembly comprising a first contact pad; and at least one contact extending from the first contact pad and adapted to be electrically coupled to the first buss bar of the lighting track when the apparatus is coupled to the lighting track and the cover is in its second configuration. In an exemplary embodiment, the apparatus further comprises a first biasing element coupled to the first contact pad; wherein the first biasing element is adapted to provide a biasing force against the first contact pad to effect sufficient electrical coupling between the at least one contact of the first contact pad assembly and the first buss bar when the apparatus is coupled to the lighting track and the cover is in its second configuration. In an exemplary embodiment, the lighting track comprises a flexed configuration; and wherein the first biasing element is adapted to maintain sufficient electrical coupling between the at least one contact of the first contact pad assembly and the first buss bar when the apparatus is coupled to the lighting track and the lighting track is in the flexed configuration. In an exemplary embodiment, the first biasing element permits the first contact pad to float to accommodate a bend in the lighting track. In an exemplary embodiment, the first biasing element comprises a spring engaged with and extending between the first contact pad and an inside wall of the second housing. In an exemplary embodiment, the first biasing element is coupled to the second housing and comprises a middle portion to which the first contact pad is coupled; and opposing peak-shaped projections between which the middle portion extends. In an exemplary embodiment, the lighting track comprises a second buss bar and wherein the apparatus further comprises another contact extending from the first contact pad and adapted to be electrically coupled to the second buss bar of the lighting track when the apparatus is coupled to the lighting track and the cover is in its second configuration. In an exemplary embodiment, electrical power is adapted to be transferred between the first and second buss bars and the at least one contact and the another contact, respectively. In an exemplary embodiment, the apparatus further comprises a mounting assembly coupled to the first housing and adapted to be coupled to a support structure. In an exemplary embodiment, the electrical power is adapted to be transferred from a source of electrical power to the first and second buss bars when the apparatus is coupled to the lighting track, the cover is in its closed configuration and the mounting assembly is coupled to the support structure. In an exemplary embodiment, the apparatus further comprises a lampholder coupled to the first housing; and a lamp disposed in the lampholder and electrically coupled to the at least one contact and the another contact. In an exemplary embodiment, the electrical power is adapted to be transferred to the lamp from the first and second buss bars when the apparatus is coupled to the lighting track and the cover is in its closed configuration. In an exemplary embodiment, the apparatus further comprises a transformer coupled to the first housing. In an exemplary embodiment, the lighting track comprises a second buss bar and wherein the apparatus further comprises a second contact pad assembly coupled to the cover, the second contact pad assembly comprising a second contact pad; and at least one contact extending from the second contact pad and adapted to be electrically coupled to the second buss bar of the lighting track when the apparatus is coupled to the lighting track and the cover is in its second configuration. In an exemplary embodiment, the apparatus further comprising a second biasing element coupled to the second contact pad; wherein the second biasing element is adapted to provide a biasing force against the second contact pad to effect sufficient electrical coupling between the at least one contact of the second contact pad assembly and the second buss bar when the apparatus is coupled to the lighting track and the cover is in its second configuration. In an exemplary embodiment, electrical power is adapted to be transferred between the first and second buss bars and the at least one contact of the first contact pad assembly and the at least one contact of the second contact pad assembly, respectively. In an exemplary embodiment, the apparatus further comprises a mounting assembly coupled to the first housing and adapted to be coupled to a support structure. In an exemplary embodiment, the electrical power is adapted to be transferred from a source of electrical power to the first and second buss bars when the apparatus is coupled to the lighting track, the cover is in its closed configuration and the mounting assembly is coupled to the support structure. In an exemplary embodiment, the apparatus further comprises a lampholder coupled to the first housing; and a lamp disposed in the lampholder and electrically coupled to the at least one contact of the first contact pad assembly and the at least one contact of the second contact pad assembly. In an exemplary embodiment, the electrical power is adapted to be transferred to the lamp from the first and second buss bars when the apparatus is coupled to the lighting track and the cover is in its closed configuration. In an exemplary embodiment, the apparatus further comprises a transformer coupled to the first housing.

An apparatus adapted to be coupled to a lighting track has been described that includes a first housing; a second housing coupled to the first housing; and a cover hingedly coupled to the second housing and comprising a first configuration in which the cover is permitted to rotate relative to the second housing; and a second configuration in which the cover is generally prevented from rotating relative to the second housing; wherein at least a portion of the lighting track is adapted to be positioned between the cover and the second housing when the cover is in the second configuration; wherein the first housing comprises an external annular recess; wherein the apparatus further comprises a sleeve within which the external annular recess at least partially extends to define an annular region therebetween; and a spring extending within the annular region and about the external annular recess; wherein the external annular recess of the first housing defines an external shoulder; wherein the sleeve defines an internal shoulder; wherein the spring engages and is at least partially compressed between the external shoulder of the first housing and the internal shoulder of the sleeve; wherein the spring applies a biasing force against the internal shoulder of the sleeve to urge the sleeve towards the second housing; wherein the spring is adapted to further compress in response to movement of the sleeve away from the second housing; wherein, when the cover is in its second configuration, the sleeve engages the cover and the second housing in response to the biasing force applied by the spring; wherein the cover comprises an external annular recess defining an external shoulder; wherein the second housing comprises an external annular recess defining an external shoulder; wherein, when the cover is in its second configuration, the sleeve engages the respective external shoulders of the cover and the second housing in response to the biasing force applied by the spring; wherein the cover is rotated to place the cover in its second configuration from its first configuration; wherein the cover comprises at least one ramp surface for engaging at least a portion of the sleeve during the rotation of the cover to place the cover in its second configuration from its first configuration; and wherein the at least a portion of the sleeve is temporarily displaced in response to the engagement between the at least one ramp surface and the at least a portion of the sleeve.

An apparatus adapted to be coupled to a lighting track has been described that includes a housing; a cover coupled to the housing wherein at least a portion of the lighting track is adapted to be positioned between the cover and the housing when the apparatus is coupled to the lighting track; and a floating first contact pad assembly coupled to the housing. In an exemplary embodiment, the lighting track comprises a first buss bar and wherein the floating contact pad assembly comprises a first contact pad; and at least one contact extending from the first contact pad and adapted to be electrically coupled to the first buss bar of the lighting track when the apparatus is coupled to the lighting track. In an exemplary embodiment, the apparatus further comprises a first biasing element coupled to the first contact pad; wherein the first biasing element is adapted to provide a biasing force against the first contact pad to effect sufficient electrical coupling between the at least one contact of the first contact pad assembly and the first buss bar when the apparatus is coupled to the lighting track. In an exemplary embodiment, the lighting track comprises a flexed configuration; and wherein the first biasing element is adapted to maintain sufficient electrical coupling between the at least one contact of the first contact pad assembly and the first buss bar when the apparatus is coupled to the lighting track and the lighting track is in the flexed configuration. In an exemplary embodiment, the first biasing element comprises a spring engaged with and extending between the first contact pad and an inside wall of the housing. In an exemplary embodiment, the first biasing element is coupled to the housing and comprises a middle portion to which the first contact pad is coupled; and opposing peak-shaped projections between which the middle portion extends. In an exemplary embodiment, the lighting track comprises a second buss bar and wherein the apparatus further comprises another contact extending from the first contact pad and adapted to be electrically coupled to the second buss bar of the lighting track when the apparatus is coupled to the lighting track. In an exemplary embodiment, electrical power is adapted to be transferred between the first and second buss bars and the at least one contact and the another contact, respectively. In an exemplary embodiment, the lighting track comprises a second buss bar and the apparatus further comprises a second contact pad assembly coupled to the cover, the second contact pad assembly comprising a second contact pad; and at least one contact extending from the second contact pad and adapted to be electrically coupled to the second buss bar of the lighting track when the apparatus is coupled to the lighting track. In an exemplary embodiment, the apparatus further comprising a second biasing element coupled to the second contact pad; wherein the second biasing element is adapted to provide a biasing force against the second contact pad to effect sufficient electrical coupling between the at least one contact of the second contact pad assembly and the second buss bar when the apparatus is coupled to the lighting track. In an exemplary embodiment, electrical power is adapted to be transferred between the first and second buss bars and the at least one contact of the first contact pad assembly and the at least one contact of the second contact pad assembly, respectively. In an exemplary embodiment, the cover is hingedly coupled to the housing and comprises a first configuration in which the cover is permitted to rotate relative to the second housing; and a second configuration in which the cover is generally prevented from rotating relative to the second housing. In an exemplary embodiment, the apparatus further comprises another housing coupled to the first-mentioned housing; wherein the another housing comprises an external annular recess; and wherein the apparatus further comprises a sleeve within which the external annular recess at least partially extends to define an annular region therebetween; a spring extending within the annular region and about the external annular recess. In an exemplary embodiment, the external annular recess of the another housing defines an external shoulder; wherein the sleeve defines an internal shoulder; and wherein the spring engages and is at least partially compressed between the external shoulder of the first housing and the internal shoulder of the sleeve. In an exemplary embodiment, the spring applies a biasing force against the internal shoulder of the sleeve to urge the sleeve towards the first-mentioned housing; and wherein the spring is adapted to further compress in response to movement of the sleeve away from the first-mentioned housing. In an exemplary embodiment, when the cover is in its second configuration, the sleeve engages the cover and the first-mentioned housing in response to the biasing force applied by the spring. In an exemplary embodiment, the cover comprises an external annular recess defining an external shoulder; wherein the first-mentioned housing comprises an external annular recess defining an external shoulder; and wherein, when the cover is in its second configuration, the sleeve engages the respective external shoulders of the cover and the first-mentioned housing in response to the biasing force applied by the spring. In an exemplary embodiment, the cover is rotated to place the cover in its second configuration from its first configuration; wherein the cover comprises at least one ramp surface for engaging at least a portion of the sleeve during the rotation of the cover to place the cover in its second configuration from its first configuration. In an exemplary embodiment, the at least a portion of the sleeve is temporarily displaced in response to the engagement between the at least one ramp surface and the at least a portion of the sleeve.

An apparatus adapted to be coupled to a lighting track has been described that includes a buss bar, the apparatus comprising a first housing; a second housing coupled to the first housing; and a cover hingedly coupled to the second housing and comprising a first configuration in which the cover is permitted to rotate relative to the second housing; and a second configuration in which the cover is generally prevented from rotating relative to the second housing; wherein at least a portion of the lighting track is adapted to be positioned between the cover and the second housing when the cover is in the second configuration; wherein the first housing comprises an external annular recess; wherein the apparatus further comprises a sleeve within which the external annular recess at least partially extends to define an annular region therebetween; and a spring extending within the annular region and about the external annular recess; wherein the external annular recess of the first housing defines an external shoulder; wherein the sleeve defines an internal shoulder; wherein the spring engages and is at least partially compressed between the external shoulder of the first housing and the internal shoulder of the sleeve; wherein the spring applies a biasing force against the internal shoulder of the sleeve to urge the sleeve towards the second housing; wherein the spring is adapted to further compress in response to movement of the sleeve away from the second housing; wherein, when the cover is in its second configuration, the sleeve engages the cover and the second housing in response to the biasing force applied by the spring; wherein the cover comprises an external annular recess defining an external shoulder; wherein the second housing comprises an external annular recess defining an external shoulder; wherein, when the cover is in its second configuration, the sleeve engages the respective external shoulders of the cover and the second housing in response to the biasing force applied by the spring; wherein the cover is rotated to place the cover in its second configuration from its first configuration; wherein the cover comprises at least one ramp surface for engaging at least a portion of the sleeve during the rotation of the cover to place the cover in its second configuration from its first configuration; wherein the at least a portion of the sleeve is temporarily displaced in response to the engagement between the at least one ramp surface and the at least a portion of the sleeve; wherein the apparatus further comprises a floating contact pad assembly coupled to the second housing, the floating contact pad assembly comprising a contact pad; and at least one contact extending from the contact pad and adapted to be electrically coupled to the buss bar of the lighting track when the apparatus is coupled to the lighting track and the cover is in its second configuration; and a biasing element coupled to the contact pad; wherein the biasing element is adapted to provide a biasing force against the contact pad to effect sufficient electrical coupling between the at least one contact of the floating contact pad assembly and the buss bar when the apparatus is coupled to the lighting track and the cover is in its second configuration; wherein the lighting track comprises a flexed configuration; and wherein the biasing element is adapted to maintain sufficient electrical coupling between the at least one contact of the floating contact pad assembly and the buss bar when the apparatus is coupled to the lighting track and the lighting track is in the flexed configuration.

A system has been described that includes a lighting track; means for toollessly coupling an attachment to the lighting track; and means for coupling an assembly to the attachment. In an exemplary embodiment, the attachment is adapted to be toollessly coupled to the lighting track using only one hand. In an exemplary embodiment, the attachment comprises a housing and wherein means for toollessly coupling the attachment to the lighting track comprises means for hingedly coupling a cover to the housing of the attachment; and means for placing the cover in a closed configuration. In an exemplary embodiment, means for placing the cover in the closed configuration comprises means for rotating the cover relative to the housing so that at least a portion of the lighting track is positioned between the cover and the housing; and means for locking the cover to the housing so that the cover is generally prevented from rotating relative to the housing. In an exemplary embodiment, the cover is locked in response to rotating the cover relative to the housing so that the at least a portion of the lighting track is positioned between the cover and the housing. In an exemplary embodiment, the assembly comprises a mounting assembly; and wherein means for coupling the assembly to the attachment comprises means for coupling the mounting assembly to the attachment; and wherein the system further comprises means for coupling the mounting assembly to a support structure. In an exemplary embodiment, the system further comprises means for at least partially supporting the lighting track using the attachment and the mounting assembly. In an exemplary embodiment, the lighting track is suspended from the support structure by the attachment and the mounting assembly. In an exemplary embodiment, the lighting track comprises a pair of buss bars and wherein the assembly comprises a lamp; wherein means for coupling the assembly to the attachment comprises means for electrically coupling the lamp to the attachment; and wherein means for toollessly coupling the attachment to the lighting track comprises means for electrically coupling the attachment to the pair of buss bars of the lighting track. In an exemplary embodiment, the system further comprises means for generating a voltage across the pair of buss bars of the lighting track. In an exemplary embodiment, the system further comprises means for transferring electrical power at the voltage from the pair of buss bars to the lamp. In an exemplary embodiment, the lamp operates at the voltage in response to transferring electrical power at the voltage from the pair of buss bars to the lamp. In an exemplary embodiment, means for transferring electrical power at the voltage from the pair of buss bars to the lamp comprises means for transferring AC electrical power at the voltage from the pair of buss bars to the lamp. In an exemplary embodiment, means for transferring electrical power at the voltage from the pair of buss bars to the lamp comprises means for transferring DC electrical power at the voltage from the pair of buss bars to the lamp. In an exemplary embodiment, means for toollessly coupling the attachment to the lighting track comprises means for forming a grounding coupling between the attachment and the lighting track. In an exemplary embodiment, the lighting track comprises a flexed configuration and means for toollessly coupling the attachment to the lighting track further comprises means for maintaining the electrical coupling between the attachment and the pair of buss bars when the lighting track is in the flexed configuration. In an exemplary embodiment, means for toollessly coupling the attachment to the lighting track further comprises means for accommodating a bend in the lighting track; wherein the electrical coupling between the attachment and the pair of buss bars is maintained in response to accommodating the bend in the lighting track. In an exemplary embodiment, the lighting track comprises a pair of buss bars and wherein the assembly comprises a transformer; wherein means for coupling the assembly to the attachment comprises means for electrically coupling the transformer to the attachment; and wherein means for toollessly coupling the attachment to the lighting track comprises means for electrically coupling the attachment to the pair of buss bars of the lighting track. In an exemplary embodiment, the system further comprises means for generating a first voltage across the pair of buss bars. In an exemplary embodiment, the system further comprises means for transferring electrical power at the first voltage from the pair of buss bars to the transformer. In an exemplary embodiment, the system further comprises means for electrically coupling a load to the transformer. In an exemplary embodiment, the system further comprises means for transferring electrical power to the load at a second voltage using the transformer. In an exemplary embodiment, means for transferring electrical power at the first voltage from the pair of buss bars to the transformer comprises means for transferring AC electrical power at the first voltage from the pair of buss bars to the transformer; and wherein means for transferring electrical power to the load at a second voltage using the transformer comprises means for transferring DC electrical power to the load at a second voltage using the transformer. In an exemplary embodiment, the load comprises a lamp. In an exemplary embodiment, means for toollessly coupling the attachment to the lighting track comprises means for forming a grounding coupling between the attachment and the lighting track. In an exemplary embodiment, the lighting track comprises a flexed configuration and means for toollessly coupling the attachment to the lighting track further comprises means for maintaining the electrical coupling between the attachment and the pair of buss bars when the lighting track is in the flexed configuration. In an exemplary embodiment, means for toollessly coupling the attachment to the lighting track further comprises means for accommodating a bend in the lighting track; wherein the electrical coupling between the attachment and the pair of buss bars is maintained in response to accommodating the bend in the lighting track. In an exemplary embodiment, the lighting track comprises a pair of buss bars and wherein the assembly comprises a converter; wherein means for coupling the assembly to the attachment comprises means for electrically coupling the converter to the attachment; wherein means for toollessly coupling the attachment to the lighting track comprises means for electrically coupling the attachment to the pair of buss bars of the lighting track; and wherein the system further comprises means for electrically coupling a lamp to the converter. In an exemplary embodiment, the lighting track comprises a pair of buss bars and wherein means for toollessly coupling the attachment to the lighting track comprises means for electrically coupling the attachment to the pair of buss bars of the lighting track. In an exemplary embodiment, the system further comprises means for electrically coupling the attachment to a source of electrical power. In an exemplary embodiment, a voltage is generated across the pair of buss bars in response to electrically coupling the attachment to the source of electrical power. In an exemplary embodiment, the voltage is in the form of AC voltage. In an exemplary embodiment, the voltage is in the form of DC voltage. In an exemplary embodiment, the assembly comprises a mounting assembly; and wherein means for coupling the assembly to the attachment comprises means for coupling the mounting assembly to the attachment; and wherein the system further comprises means for coupling the mounting assembly to a support structure. In an exemplary embodiment, the system further comprises means for forming a grounding coupling between the attachment and the lighting track. In an exemplary embodiment, the lighting track comprises a flexed configuration and means for toollessly coupling the attachment to the lighting track further comprises means for maintaining the electrical coupling between the attachment and the pair of buss bars when the lighting track is in the flexed configuration. In an exemplary embodiment, means for toollessly coupling the attachment to the lighting track further comprises means for accommodating a bend in the lighting track; wherein the electrical coupling between the attachment and the pair of buss bars is maintained in response to accommodating the bend in the lighting track.

A system has been described that includes a lighting track; means for toollessly coupling an attachment comprising a housing to the lighting track, comprising means for hingedly coupling a cover to the housing of the attachment; and means for placing the cover in a closed configuration, comprising means for rotating the cover relative to the housing so that at least a portion of the lighting track is positioned between the cover and the housing; and means for locking the cover to the housing so that the cover is generally prevented from rotating relative to the housing; wherein the cover is locked in response to rotating the cover relative to the housing so that the at least a portion of the lighting track is positioned between the cover and the housing; and means for coupling an assembly to the attachment.

A system has been described that includes a lighting track comprising a pair of buss bars and a flexed configuration; means for coupling an attachment to the lighting track, comprising means for electrically coupling the attachment to the pair of buss bars of the lighting track; and means for maintaining the electrical coupling between the attachment and the pair of buss bars when the lighting track is in the flexed configuration. In an exemplary embodiment, means for maintaining the electrical coupling between the attachment and the lighting track when the lighting track is in the flexed configuration comprises means for accommodating a bend in the lighting track. In an exemplary embodiment, the system further comprises means for forming a grounding coupling between the attachment and the lighting track. In an exemplary embodiment, means for coupling the attachment to the lighting track comprises means for toollessly coupling the attachment to the lighting track. In an exemplary embodiment, the attachment is adapted to be toollessly coupled to the lighting track using only one hand. In an exemplary embodiment, the attachment comprises a housing and wherein means for toollessly coupling the attachment to the lighting track comprises means for hingedly coupling a cover to the housing of the attachment; and means for placing the cover in a closed configuration. In an exemplary embodiment, means for placing the cover in the closed configuration comprises means for rotating the cover relative to the housing so that at least a portion of the lighting track is positioned between the cover and the housing; and means for locking the cover to the housing so that the cover is generally prevented from rotating relative to the housing. In an exemplary embodiment, the cover is locked in response to rotating the cover relative to the housing so that the at least a portion of the lighting track is positioned between the cover and the housing.

A system has been described that includes a lighting track comprising a pair of buss bars and a flexed configuration; means for toollessly coupling an attachment comprising a housing to the lighting track, comprising means for electrically coupling the attachment to the pair of buss bars of the lighting track; means for hingedly coupling a cover to the housing of the attachment; means for placing the cover in a closed configuration, comprising means for rotating the cover relative to the housing so that at least a portion of the lighting track is positioned between the cover and the housing; and means for locking the cover to the housing so that the cover is generally prevented from rotating relative to the housing; wherein the cover is locked in response to rotating the cover relative to the housing so that the at least a portion of the lighting track is positioned between the cover and the housing; means for maintaining the electrical coupling between the attachment and the pair of buss bars when the lighting track is in the flexed configuration, comprising means for accommodating a bend in the lighting track; and means for forming a grounding coupling between the attachment and the lighting track.

A method has been described that includes providing first and second lighting tracks; and pivotally coupling the first and second lighting tracks. In an exemplary embodiment, pivotally coupling the first and second lighting tracks comprises coupling a first lighting track to a first housing; coupling a second lighting track to a second housing; and pivotally coupling the first and second housings. In an exemplary embodiment, coupling the first lighting track to the first housing comprises guiding the first lighting track into the first housing; and wherein coupling the second lighting track to the second housing comprises guiding the second lighting track into the second housing. In an exemplary embodiment, the method further comprises locking the first lighting track to the first housing. In an exemplary embodiment, the method further comprises locking the second lighting track to the second housing. In an exemplary embodiment, the method further comprises supporting the first and second housings. In an exemplary embodiment, the method further comprises suspending the first and second housings from a support structure. In an exemplary embodiment, the method further comprises coupling the first and second housings to a support structure. In an exemplary embodiment, coupling the first and second housings to a support structure comprises coupling a mounting assembly to the support structure and to the first and second housings. In an exemplary embodiment, each of the first and second lighting tracks comprises a first pair of buss bars; and wherein the method further comprises transferring electrical power at a first voltage between the first pair of buss bars of the first lighting track and the first pair of buss bars of the second lighting track. In an exemplary embodiment, each of the first and second lighting tracks comprises a second pair of buss bars; and wherein the method further comprises transferring electrical power at a second voltage between the second pair of buss bars of the first lighting track and the second pair of buss bars of the second lighting track. In an exemplary embodiment, each of the first and second lighting tracks comprises a third pair of buss bars; and wherein the method further comprises transferring electrical power at a third voltage between the third pair of buss bars of the first lighting track and the third pair of buss bars of the second lighting track. In an exemplary embodiment, the first lighting track comprises a first pair of buss bars and wherein the method further comprises transferring electrical power at a first voltage from a source of electrical power to the first pair of buss bars of the first lighting track. In an exemplary embodiment, the second lighting track comprises a first pair of buss bars and wherein the method further comprises transferring electrical power at the first voltage from the source of electrical power to the first pair of buss bars of the second lighting track. In an exemplary embodiment, each of the first and second lighting tracks comprises a second pair of buss bars and wherein the method further comprises transferring electrical power at a second voltage between the second pair of buss bars of the first lighting track and the second pair of buss bars of the second lighting track. In an exemplary embodiment, each of the first and second lighting tracks comprises a third pair of buss bars and wherein the method further comprises transferring electrical power at a third voltage between the third pair of buss bars of the first lighting track and the third pair of buss bars of the second lighting track. In an exemplary embodiment, an angle is defined between the first and second lighting tracks. In an exemplary embodiment, the method further comprises adjusting the angle. In an exemplary embodiment, the angle is adjustable down to a predetermined angle. In an exemplary embodiment, the predetermined angle is about 40 degrees. In an exemplary embodiment, the predetermined angle is about 70 degrees. In an exemplary embodiment, the predetermined angle is about 60 degrees. In an exemplary embodiment, the method further comprises maintaining the angle. In an exemplary embodiment, each of the first and second lighting tracks comprises a first pair of buss bars and wherein the method further comprises transferring electrical power at a first voltage between the first pair of buss bars of the first lighting track and the first pair of buss bars of the second lighting track. In an exemplary embodiment, transferring electrical power at the first voltage between the first pair of buss bars of the first lighting track and the first pair of buss bars of the second lighting track comprises disposing a first pair of contact assemblies in the first housing; and disposing a second pair of contact assemblies in the second housing. In an exemplary embodiment, transferring electrical power at the first voltage between the first pair of buss bars of the first lighting track and the first pair of buss bars of the second lighting track further comprises capturing each of the contact assemblies in the first pair of contact assemblies within the first housing; and capturing each of the contact assemblies in the second pair of contact assemblies within the second housing. In an exemplary embodiment, the method further comprises coupling a third lighting track to the first and second lighting tracks. In an exemplary embodiment, each of the first, second and third lighting tracks comprises a first pair of buss bars and wherein the method further comprises transferring electrical power at a first voltage from the first pair of buss bars of one of the first, second and third lighting tracks to the first pair of buss bars of each of the others of the first, second and third lighting tracks. In an exemplary embodiment, each of the first, second and third lighting tracks comprises a second pair of buss bars and wherein the method further comprises transferring electrical power at a second voltage from the second pair of buss bars of one of the first, second and third lighting tracks to the second pair of buss bars of each of the others of the first, second and third lighting tracks. In an exemplary embodiment, each of the first, second and third lighting tracks comprises a third pair of buss bars and wherein the method further comprises transferring electrical power at a third voltage from the third pair of buss bars of one of the first, second and third lighting tracks to the third pair of buss bars of one other of the first, second and third lighting tracks. In an exemplary embodiment, each of the first, second and third lighting tracks comprises a third pair of buss bars and wherein the method further comprises transferring electrical power at a third voltage from the third pair of buss bars of one of the first, second and third lighting tracks to the third pair of buss bars of each of the others of the first, second and third lighting tracks. In an exemplary embodiment, each of the first, second and third lighting tracks comprises a first pair of buss bars and wherein the method further comprises transferring electrical power at a first voltage from a source of electrical power to the first pair of buss bars of one of the first, second and third lighting tracks. In an exemplary embodiment, each of the first, second and third lighting tracks comprises a first pair of buss bars and wherein the method further comprises transferring electrical power at the first voltage from the source of electrical power to the first pair of buss bars of another of the first, second and third lighting tracks. In an exemplary embodiment, the method further comprises transferring electrical power at the first voltage from the source of electrical power to the first pair of buss bars of one other of the first, second and third lighting tracks. In an exemplary embodiment, each of the first, second and third lighting tracks comprises a second pair of buss bars and wherein the method further comprises transferring electrical power at a second voltage from the second pair of buss bars of one of the first, second and third lighting tracks to the second pair of buss bars of another of the first, second and third lighting tracks. In an exemplary embodiment, the method further comprises transferring electrical power at the second voltage from the second pair of buss bars of the one of the first, second and third lighting tracks to the second pair of buss bars of one other of the first, second and third lighting tracks. In an exemplary embodiment, each of the first, second and third lighting tracks comprises a third pair of buss bars and wherein the method further comprises transferring electrical power at a third voltage from the third pair of buss bars of one of the first, second and third lighting tracks to the third pair of buss bars of another of the first, second and third lighting tracks. In an exemplary embodiment, the method further comprises transferring electrical power at the third voltage from the third pair of buss bars of the one of the first, second and third lighting tracks to the third pair of buss bars of one other of the first, second and third lighting tracks. In an exemplary embodiment, a first angle is defined between the first and third lighting tracks and a second angle is defined between the first and second lighting tracks. In an exemplary embodiment, the method further comprises adjusting the first and second angles. In an exemplary embodiment, the first angle is adjustable down to a first predetermined angle and the second angle is adjustable down to a second predetermined angle. In an exemplary embodiment, the first predetermined angle is about 70 degrees and the second predetermined angle is about 40 degrees. In an exemplary embodiment, the first predetermined angle is about 70 degrees and the second predetermined angle is about 140 degrees. In an exemplary embodiment, the method further comprising maintaining the first and second angles.

A method has been described that includes providing first and second lighting tracks; and pivotally coupling the first and second lighting tracks; wherein pivotally coupling the first and second lighting tracks comprises coupling a first lighting track to a first housing; coupling a second lighting track to a second housing; and pivotally coupling the first and second housings; wherein coupling the first lighting track to the first housing comprises guiding the first lighting track into the first housing; and wherein coupling the second lighting track to the second housing comprises guiding the second lighting track into the second housing; wherein the method further comprises locking the first lighting track to the first housing; and locking the second lighting track to the second housing; wherein an angle is defined between the first and second lighting tracks; wherein the method further comprises adjusting the angle; and maintaining the angle; and wherein the angle is adjustable down to a predetermined angle.

A method has been described that includes providing first and second lighting tracks; and pivotally coupling the first and second lighting tracks; wherein pivotally coupling the first and second lighting tracks comprises coupling a first lighting track to a first housing; coupling a second lighting track to a second housing; and pivotally coupling the first and second housings; wherein coupling the first lighting track to the first housing comprises guiding the first lighting track into the first housing; and wherein coupling the second lighting track to the second housing comprises guiding the second lighting track into the second housing; wherein the method further comprises locking the first lighting track to the first housing; and locking the second lighting track to the second housing; wherein the method further comprises coupling the first and second housings to a support structure wherein coupling the first and second housings to a support structure comprises coupling a mounting assembly to the support structure and to the first and second housings; and coupling a third lighting track to the first and second lighting tracks; wherein a first angle is defined between the first and third lighting tracks and a second angle is defined between the first and second lighting tracks; wherein the method further comprises adjusting the first and second angles, wherein the first angle is adjustable down to a first predetermined angle and the second angle is adjustable down to a second predetermined angle; and maintaining the first and second angles.

An apparatus has been described that includes a first side housing adapted to be coupled to a first lighting track; a second side housing adapted to be coupled to a second lighting track; a first connecting housing coupled to the first side housing; and a second connecting housing coupled to the first connecting housing and the second side housing. In an exemplary embodiment, an angle is defined between the first and second side housings. In an exemplary embodiment, the angle is adjustable. In an exemplary embodiment, the apparatus further comprises a first pair of contact assemblies disposed in the first side housing; and a second pair of contact assemblies disposed in the second side housing. In an exemplary embodiment, the apparatus further comprises one or more wires extending between and coupled to one contact assembly in the first pair of contact assemblies and one contact assembly in the second pair of contact assemblies. In an exemplary embodiment, the apparatus further comprises one or more first tabs for capturing each of the contact assemblies in the first pair of contact assemblies within the first side housing; and one or more second tabs for capturing each of the contact assemblies in the second pair of contact assemblies within the second side housing. In an exemplary embodiment, the apparatus further comprises one or more first protrusions for guiding the first lighting track into the first side housing; and one or more second protrusions for guiding the second lighting track into the second side housing. In an exemplary embodiment, the apparatus further comprises a first locking mechanism for locking the first lighting track to the first side housing; and a second locking mechanism for locking the second lighting track to the second side housing. In an exemplary embodiment, the apparatus further comprises a mounting assembly coupled to the first connecting housing and a support structure. In an exemplary embodiment, the apparatus further comprises a terminal block assembly disposed in the first connecting housing. In an exemplary embodiment, the apparatus further comprises a first contact assembly disposed in the first side housing; a second contact assembly disposed in the second side housing; and one or more wires extending between and coupled to the terminal block assembly and at least one of the first and second contact assemblies. In an exemplary embodiment, the apparatus further comprises a tubular member coupled to the second connecting housing and adapted to be coupled to a third lighting track. In an exemplary embodiment, the apparatus further comprises one or more protrusions for guiding the third lighting track into the tubular member. In an exemplary embodiment, the apparatus further comprises a locking mechanism for locking the third lighting track to the tubular member. In an exemplary embodiment, the apparatus further comprises a pair of contact assemblies disposed in the tubular member. In an exemplary embodiment, the apparatus further comprises one or more ribs for capturing each of the contact assemblies in the pair of contact assemblies within the tubular member. In an exemplary embodiment, the apparatus further comprises a first contact assembly disposed in the first side housing; a second contact assembly disposed in the second side housing; and a third contact assembly disposed in the tubular member. In an exemplary embodiment, the apparatus further comprises a terminal block disposed in the first connecting housing. In an exemplary embodiment, the apparatus comprises one or more wires extending between and coupled to the first contact assembly and the terminal block assembly; one or more wires extending between and coupled to the second contact assembly and the terminal block assembly; and one or more wires extending between and coupled to the third contact assembly and the terminal block assembly. In an exemplary embodiment, the apparatus further comprises a cover plate adapted to be coupled to the tubular member; wherein, when the cover plate is coupled to the tubular member, the third lighting track is generally prevented from extending all the way through the tubular member. In an exemplary embodiment, another angle is defined between the first and third lighting tracks. In an exemplary embodiment, the angle is adjustable down to a first predetermined angle and the another angle is adjustable down to a second predetermined angle. In an exemplary embodiment, the first predetermined angle is about 40 degrees and the second predetermined angle is about 70 degrees. In an exemplary embodiment, the first predetermined angle is about 140 degrees and the second predetermined angle is about 70 degrees. In an exemplary embodiment, the apparatus further comprises a support plate coupled to the second connecting housing; and an eyelet engaged with the first connecting housing and the support plate. In an exemplary embodiment, relative rotation between the support plate and the first connecting housing is permitted to adjust the angle. In an exemplary embodiment, the apparatus further comprises a washer disposed between the first connecting housing and the support plate. In an exemplary embodiment, the washer facilitates the relative rotation between the first connecting housing and the support plate. In an exemplary embodiment, the washer facilitates the maintenance of the angle. In an exemplary embodiment, the angle is adjustable down to a predetermined angle. In an exemplary embodiment, the predetermined angles is about 40 degrees. In an exemplary embodiment, the predetermined angle is about 70 degrees. In an exemplary embodiment, the predetermined angle is about 60 degrees.

An apparatus has been described that includes a first side housing adapted to be coupled to a first lighting track; a second side housing adapted to be coupled to a second lighting track; a first connecting housing coupled to the first side housing; and a second connecting housing coupled to the first connecting housing and the second side housing; wherein an angle is defined between the first and second side housings; wherein the angle is adjustable; wherein the apparatus further comprises a first pair of contact assemblies disposed in the first side housing; and a second pair of contact assemblies disposed in the second side housing; one or more first tabs for capturing each of the contact assemblies in the first pair of contact assemblies within the first side housing; one or more second tabs for capturing each of the contact assemblies in the second pair of contact assemblies within the second side housing; one or more first protrusions for guiding the first lighting track into the first side housing; one or more second protrusions for guiding the second lighting track into the second side housing; a first locking mechanism for locking the first lighting track to the first side housing; and a second locking mechanism for locking the second lighting track to the second side housing.

An apparatus has been described that includes a first side housing adapted to be coupled to a first lighting track; a second side housing adapted to be coupled to a second lighting track; a first connecting housing coupled to the first side housing; and a second connecting housing coupled to the first connecting housing and the second side housing; wherein an angle is defined between the first and second side housings; wherein the angle is adjustable; wherein the apparatus further comprises a first pair of contact assemblies disposed in the first side housing; and a second pair of contact assemblies disposed in the second side housing; one or more first tabs for capturing each of the contact assemblies in the first pair of contact assemblies within the first side housing; one or more second tabs for capturing each of the contact assemblies in the second pair of contact assemblies within the second side housing; one or more first protrusions for guiding the first lighting track into the first side housing; one or more second protrusions for guiding the second lighting track into the second side housing; a first locking mechanism for locking the first lighting track to the first side housing; and a second locking mechanism for locking the second lighting track to the second side housing; a mounting assembly coupled to the first connecting housing and a support structure; a support plate coupled to the second connecting housing; an eyelet engaged with the first connecting housing and the support plate, wherein relative rotation between the support plate and the first connecting housing is permitted to adjust the angle; a washer disposed between the first connecting housing and the support plate, wherein the washer facilitates the relative rotation between the first connecting housing and the support plate and wherein the washer facilitates the maintenance of the angle.

An apparatus has been described that includes a side housing for receiving at least one lighting track; a contact insulator disposed in the side housing; a contact insulator spring coupled to the contact insulator; and one or more tabs for capturing the contact insulator and the contact insulator spring within the side housing. In an exemplary embodiment, the apparatus further comprising a plate coupled to the side housing. In an exemplary embodiment, the one or more tabs for capturing the contact insulator and the contact insulator spring within the side housing comprises a first tab of the side housing; and a second tab of the plate; wherein the contact insulator is disposed between an inside wall of the side housing and the first and second tabs; and wherein the contact insulator spring is disposed between the inside wall of the side housing and the contact insulator and applies a biasing force against the contact insulator. In an exemplary embodiment, in response to the application of the biasing force, the contact insulator engages the first and second tabs. In an exemplary embodiment, the apparatus further comprises one or more contacts engaged with the contact insulator. In an exemplary embodiment, the side housing is adapted to receive another lighting track so that, when the side housing receives the at least one lighting track and the another lighting track, a straight coupling is formed between the at least one lighting track and the another lighting track. In an exemplary embodiment, the apparatus further comprises another side housing pivotally coupled to the first-mentioned side housing. In an exemplary embodiment, the apparatus further comprises a first connecting housing coupled to the side housing; a second connecting housing coupled to the first connecting housing; and another side housing coupled to the second connecting housing. In an exemplary embodiment, an angle is defined between the side housings. In an exemplary embodiment, the angle is adjustable.

An apparatus has been described that includes a side housing for receiving at least one lighting track; a contact insulator disposed in the side housing; a contact insulator spring coupled to the contact insulator; a plate coupled to the side housing; one or more contacts engaged with the contact insulator; one or more tabs for capturing the contact insulator and the contact insulator spring within the side housing, comprising a first tab of the side housing; and a second tab of the plate; wherein the contact insulator is disposed between an inside wall of the side housing and the first and second tabs; and wherein the contact insulator spring is disposed between the inside wall of the side housing and the contact insulator and applies a biasing force against the contact insulator; wherein, in response to the application of the biasing force, the contact insulator engages the first and second tabs.

A system has been described that includes first and second lighting tracks; and means for pivotally coupling the first and second lighting tracks. In an exemplary embodiment, means for pivotally coupling the first and second lighting tracks comprises means for coupling a first lighting track to a first housing; means for coupling a second lighting track to a second housing; and means for pivotally coupling the first and second housings. In an exemplary embodiment, means for coupling the first lighting track to the first housing comprises means for guiding the first lighting track into the first housing; and wherein means for coupling the second lighting track to the second housing comprises means for guiding the second lighting track into the second housing. In an exemplary embodiment, the system further comprises means for locking the first lighting track to the first housing. In an exemplary embodiment, the system further comprises means for locking the second lighting track to the second housing. In an exemplary embodiment, the system further comprises means for supporting the first and second housings. In an exemplary embodiment, the system further comprises means for suspending the first and second housings from a support structure. In an exemplary embodiment, the system further comprises means for coupling the first and second housings to a support structure. In an exemplary embodiment, means for coupling the first and second housings to a support structure comprises means for coupling a mounting assembly to the support structure and to the first and second housings. In an exemplary embodiment, each of the first and second lighting tracks comprises a first pair of buss bars; and wherein the system further comprises means for transferring electrical power at a first voltage between the first pair of buss bars of the first lighting track and the first pair of buss bars of the second lighting track. In an exemplary embodiment, each of the first and second lighting tracks comprises a second pair of buss bars; and wherein the system further comprises means for transferring electrical power at a second voltage between the second pair of buss bars of the first lighting track and the second pair of buss bars of the second lighting track. In an exemplary embodiment, each of the first and second lighting tracks comprises a third pair of buss bars; and wherein the system further comprises means for transferring electrical power at a third voltage between the third pair of buss bars of the first lighting track and the third pair of buss bars of the second lighting track. In an exemplary embodiment, the first lighting track comprises a first pair of buss bars and wherein the system further comprises means for transferring electrical power at a first voltage from a source of electrical power to the first pair of buss bars of the first lighting track. In an exemplary embodiment, the second lighting track comprises a first pair of buss bars and wherein the system further comprises means for transferring electrical power at the first voltage from the source of electrical power to the first pair of buss bars of the second lighting track. In an exemplary embodiment, each of the first and second lighting tracks comprises a second pair of buss bars and wherein the system further comprises means for transferring electrical power at a second voltage between the second pair of buss bars of the first lighting track and the second pair of buss bars of the second lighting track. In an exemplary embodiment, each of the first and second lighting tracks comprises a third pair of buss bars and wherein the system further comprises means for transferring electrical power at a third voltage between the third pair of buss bars of the first lighting track and the third pair of buss bars of the second lighting track. In an exemplary embodiment, an angle is defined between the first and second lighting tracks. In an exemplary embodiment, the system further comprises means for adjusting the angle. In an exemplary embodiment, the angle is adjustable down to a predetermined angle. In an exemplary embodiment, the predetermined angle is about 40 degrees. In an exemplary embodiment, the predetermined angle is about 70 degrees. In an exemplary embodiment, the predetermined angle is about 60 degrees. In an exemplary embodiment, the system further comprises means for maintaining the angle. In an exemplary embodiment, each of the first and second lighting tracks comprises a first pair of buss bars and wherein the system further comprises means for transferring electrical power at a first voltage between the first pair of buss bars of the first lighting track and the first pair of buss bars of the second lighting track. In an exemplary embodiment, transferring electrical power at the first voltage between the first pair of buss bars of the first lighting track and the first pair of buss bars of the second lighting track comprises means for disposing a first pair of contact assemblies in the first housing; and means for disposing a second pair of contact assemblies in the second housing. In an exemplary embodiment, transferring electrical power at the first voltage between the first pair of buss bars of the first lighting track and the first pair of buss bars of the second lighting track further comprises means for capturing each of the contact assemblies in the first pair of contact assemblies within the first housing; and means for capturing each of the contact assemblies in the second pair of contact assemblies within the second housing. In an exemplary embodiment, the system further comprises means for coupling a third lighting track to the first and second lighting tracks. In an exemplary embodiment, each of the first, second and third lighting tracks comprises a first pair of buss bars and wherein the system further comprises means for transferring electrical power at a first voltage from the first pair of buss bars of one of the first, second and third lighting tracks to the first pair of buss bars of each of the others of the first, second and third lighting tracks. In an exemplary embodiment, each of the first, second and third lighting tracks comprises a second pair of buss bars and wherein the system further comprises means for transferring electrical power at a second voltage from the second pair of buss bars of one of the first, second and third lighting tracks to the second pair of buss bars of each of the others of the first, second and third lighting tracks. In an exemplary embodiment, each of the first, second and third lighting tracks comprises a third pair of buss bars and wherein the system further comprises means for transferring electrical power at a third voltage from the third pair of buss bars of one of the first, second and third lighting tracks to the third pair of buss bars of one other of the first, second and third lighting tracks. In an exemplary embodiment, each of the first, second and third lighting tracks comprises a third pair of buss bars and wherein the system further comprises means for transferring electrical power at a third voltage from the third pair of buss bars of one of the first, second and third lighting tracks to the third pair of buss bars of each of the others of the first, second and third lighting tracks. In an exemplary embodiment, each of the first, second and third lighting tracks comprises a first pair of buss bars and wherein the system further comprises means for transferring electrical power at a first voltage from a source of electrical power to the first pair of buss bars of one of the first, second and third lighting tracks. In an exemplary embodiment, each of the first, second and third lighting tracks comprises a first pair of buss bars and wherein the system further comprises means for transferring electrical power at the first voltage from the source of electrical power to the first pair of buss bars of another of the first, second and third lighting tracks. In an exemplary embodiment, the system further comprises means for transferring electrical power at the first voltage from the source of electrical power to the first pair of buss bars of one other of the first, second and third lighting tracks. In an exemplary embodiment, each of the first, second and third lighting tracks comprises a second pair of buss bars and wherein the system further comprises means for transferring electrical power at a second voltage from the second pair of buss bars of one of the first, second and third lighting tracks to the second pair of buss bars of another of the first, second and third lighting tracks. In an exemplary embodiment, the system further comprises means for transferring electrical power at the second voltage from the second pair of buss bars of the one of the first, second and third lighting tracks to the second pair of buss bars of one other of the first, second and third lighting tracks. In an exemplary embodiment, each of the first, second and third lighting tracks comprises a third pair of buss bars and wherein the system further comprises means for transferring electrical power at a third voltage from the third pair of buss bars of one of the first, second and third lighting tracks to the third pair of buss bars of another of the first, second and third lighting tracks. In an exemplary embodiment, the system further comprises means for transferring electrical power at the third voltage from the third pair of buss bars of the one of the first, second and third lighting tracks to the third pair of buss bars of one other of the first, second and third lighting tracks. In an exemplary embodiment, a first angle is defined between the first and third lighting tracks and a second angle is defined between the first and second lighting tracks. In an exemplary embodiment, the system further comprises means for adjusting the first and second angles. In an exemplary embodiment, the first angle is adjustable down to a first predetermined angle and the second angle is adjustable down to a second predetermined angle. In an exemplary embodiment, the first predetermined angle is about 70 degrees and the second predetermined angle is about 40 degrees. In an exemplary embodiment, the first predetermined angle is about 70 degrees and the second predetermined angle is about 140 degrees. In an exemplary embodiment, the system further comprises means for maintaining the first and second angles.

A system has been described that includes first and second lighting tracks; and means for pivotally coupling the first and second lighting tracks; wherein means for pivotally coupling the first and second lighting tracks comprises means for coupling a first lighting track to a first housing; means for coupling a second lighting track to a second housing; and means for pivotally coupling the first and second housings; wherein means for coupling the first lighting track to the first housing comprises means for guiding the first lighting track into the first housing; and wherein means for coupling the second lighting track to the second housing comprises means for guiding the second lighting track into the second housing; wherein the system further comprises means for locking the first lighting track to the first housing; and means for locking the second lighting track to the second housing; wherein an angle is defined between the first and second lighting tracks; wherein the system further comprises means for adjusting the angle; and means for maintaining the angle; and wherein the angle is adjustable down to a predetermined angle.

A system has been described that includes first and second lighting tracks; and means for pivotally coupling the first and second lighting tracks; wherein means for pivotally coupling the first and second lighting tracks comprises means for coupling a first lighting track to a first housing; means for coupling a second lighting track to a second housing; and means for pivotally coupling the first and second housings; wherein means for coupling the first lighting track to the first housing comprises means for guiding the first lighting track into the first housing; and wherein means for coupling the second lighting track to the second housing comprises means for guiding the second lighting track into the second housing; wherein the system further comprises means for locking the first lighting track to the first housing; and means for locking the second lighting track to the second housing; wherein the system further comprises means for coupling the first and second housings to a support structure wherein means for coupling the first and second housings to a support structure comprises means for coupling a mounting assembly to the support structure and to the first and second housings; and means for coupling a third lighting track to the first and second lighting tracks; wherein a first angle is defined between the first and third lighting tracks and a second angle is defined between the first and second lighting tracks; wherein the system further comprises means for adjusting the first and second angles, wherein the first angle is adjustable down to a first predetermined angle and the second angle is adjustable down to a second predetermined angle; and means for maintaining the first and second angles.

It is understood that variations may be made in the foregoing without departing from the scope of the disclosure. In several exemplary embodiments, instead of, or in addition to being coupled to the ceiling 18, one or more of the above-described embodiments may be coupled to one or more other support structures.

In several exemplary embodiments, one or more of the above-described assemblies and/or systems, including the above-described track systems and/or configurations, power feed assemblies and/or systems, support assemblies and/or systems, lamp assemblies and/or systems, transformer assemblies and/or systems and/or connector assemblies and/or systems, may be composed of two or more components, a single component or a single, integral component. Further, in several exemplary embodiments, one or more of the components of any of the above-described assemblies and/or systems, including the above-described track systems and/or configurations, power feed assemblies and/or systems, support assemblies and/or systems, lamp assemblies and/or systems, transformer assemblies and/or systems and/or connector assemblies and/or systems, may be combined in whole or in part with one or more other components thereof. Still further, in several exemplary embodiments, one or more of the above-described assemblies and/or systems, including one or more of the above-described track systems and/or configurations, power feed assemblies and/or systems, support assemblies and/or systems, lamp assemblies and/or systems, transformer assemblies and/or systems and/or connector assemblies and/or systems, may be combined in whole or in part with any one or more of the other above-described assemblies and/or systems.

Any spatial references such as, for example, "upper," "lower," "above," "below," "between," "vertical," "angular," "upward," "downward," "side-to-side," "left-to-right," "right-to-left," "top-to-bottom," "bottom-to-top," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A system comprising:

a lighting track comprising first, second and third pairs of buss bars;

wherein the first, second and third pairs of buss bars are electrically isolated from one another; and wherein the lighting track further comprises:

an I-beam protrusion defining first and second channels; and first and second insulated liners extending within the first and second channels, respectively, of the I-beam protrusion;

wherein each of the first and second insulated liners comprises first, second and third channels;

wherein one buss bar in the first pair of buss bars extends in the first channel of the first insulated liner and the other buss bar in the first pair of buss bars extends in the third channel of the first insulated liner;

wherein one buss bar in the second pair of buss bars extends in the first channel of the second insulated liner and the other buss bar in the second pair of buss bars extends in the third channel of the second insulated liner; and wherein one buss bar in the third pair of buss bars extends in the second channel of the first insulated liner and the other buss bar in the third pair of buss bars extends in the second channel of the second insulated liner.

2. A method comprising:

providing a flexible lighting track comprising;

a first, second, and third pairs of buss bars electrically isolated from one another; and an I-beam protrusion defining first and second channels;

placing the flexible lighting track in a flexed configuration so that the flexible lighting track comprises a bend;

extending first and second insulated liners within the first and second channels, respectively, of the I-beam protrusion, wherein each of the first and second insulated liners comprises first, second and third channels;

extending one buss bar in the first pair of buss bars in the first channel of the first insulated liner and extending the other buss bar in the first pair of buss bars in the third channel of the first insulated liner;

extending one buss bar in the second pair of buss bars in the first channel of the second insulated liner and extending the other buss bar in the second pair of buss bars in the third channel of the second insulated liner; and extending one buss bar in the third pair of buss bars in the second channel of the first insulated liner and extending the other buss bar in the third pair of buss bars in the second channel of the second insulated liner.

3. The system of claim 1, wherein the lighting track further comprises:

first and second protrusions extending from the I-beam protrusion and at least partially defining a channel; and third and fourth protrusions extending from the I-beam protrusion and at least partially defining a channel.

4. The system of claim 3, wherein the channel at least partially defined by the first and second protrusions is adapted to engage a tongue-in-groove attachment used to at least partially support the lighting track; and wherein the channel at least partially defined by the third and fourth protrusions is adapted to engage a tongue-in-groove attachment so that the lighting track at least partially supports a device coupled to the tongue-in-groove attachment.

5. The system of claim 3, wherein the first, second, third and fourth protrusions are sized so that the lighting track is symmetric about a vertical center axis and asymmetric about a horizontal center axis to provide polarity.

6. The system of claim 1 further comprising:

a first source of electrical power electrically coupled to the first pair of buss bars, wherein the first source of electrical power is adapted to generate a first voltage across the first pair of buss bars;

a second source of electrical power electrically coupled to the second pair of buss bars, wherein the second source of electrical power is adapted to generate a second voltage across the second pair of buss bars; and a third source of electrical power electrically coupled to the third pair of buss bars, wherein the third source of electrical power is adapted to generate a third voltage across the third pair of buss bars.

7. A system comprising:

a flexible lighting track comprising:

a straight configuration; and a flexed configuration in which the flexible lighting track comprises a bend;

wherein each of the straight and flexed configurations of the flexible lighting track comprises a first, second, and third pair of buss bars electrically isolated from each other; and wherein the flexible lighting track further comprises:

an I-beam protrusion defining first and second channels; and first and second insulated liners extending within the first and second channels, respectively, of the I-beam protrusion;

wherein each of the first and second insulated liners comprises first, second and third channels;

wherein one buss bar in the first pair of buss bars extends in the first channel of the first insulated liner and the other buss bar in the first pair of buss bars extends in the third channel of the first insulated liner;

wherein one buss bar in the second pair of buss bars extends in the first channel of the second insulated liner and the other buss bar in the second pair of buss bars extends in the third channel of the second insulated liner; and wherein one buss bar in the third pair of buss bars extends in the second channel of the first insulated liner and the other buss bar in the third pair of buss bars extends in the second channel of the second insulated liner.

8. The method of claim 2, wherein the flexible lighting track further comprises:

first and second protrusions extending from the I-beam protrusion and at least partially defining a channel; and third and fourth protrusions extending from the I-beam protrusion and at least partially defining a channel.

9. The method of claim 8 further comprising:

engaging a tongue-in-groove attachment with the channel at least partially defined by the first and second protrusions to at least partially support the flexible lighting track.

10. The system of claim 7, wherein the flexible lighting track further comprises:

first and second protrusions extending from the I-beam protrusion and at least partially defining a channel; and third and fourth protrusions extending from the I-beam protrusion and at least partially defining a channel.

11. The system of claim 10, wherein the channel at least partially defined by the first and second protrusions is adapted to engage a tongue-in-groove attachment used to at least partially support the flexible lighting track; and wherein the channel at least partially defined by the third and fourth protrusions is adapted to engage a tongue-in-groove attachment so that the flexible lighting track at least partially supports a device coupled to the tongue-in-groove attachment.

12. The system of claim 10, wherein the first, second, third and fourth protrusions are sized so that the flexible lighting track is symmetric about a vertical center axis and asymmetric about a horizontal center axis to provide polarity.

13. The system of claim 7 further comprising:

a first source of electrical power electrically coupled to the first pair of buss bars, wherein the first source of electrical power is adapted to generate a first voltage across the first pair of buss bars;

a second source of electrical power electrically coupled to the second pair of buss bars, wherein the second source of electrical power is adapted to generate a second voltage across the second pair of buss bars; and a third source of electrical power electrically coupled to the third pair of buss bars, wherein the third source of electrical power is adapted to generate a third voltage across the third pair of buss bars.

14. A system comprising:

a flexible lighting track comprising:

a straight configuration; and a flexed configuration in which the flexible lighting track comprises a bend;

first, second and third pairs of buss bars, wherein the first, second and third pairs of buss bars are electrically isolated from one another;

an I-beam protrusion defining first and second channels;

first and second insulated liners extending within the first and second channels, respectively, of the I-beam protrusion;

wherein each of the first and second insulated liners comprises first, second and third channels;

wherein one buss bar in the first pair of buss bars extends in the first channel of the first insulated liner and the other buss bar in the first pair of buss bars extends in the third channel of the first insulated liner;

wherein one buss bar in the second pair of buss bars extends in the first channel of the second insulated liner and the other buss bar in the second pair of buss bars extends in the third channel of the second insulated liner; and wherein one buss bar in the third pair of buss bars extends in the second channel of the first insulated liner and the other buss bar in the third pair of buss bars extends in the second channel of the second insulated liner.

15. A system comprising:

a flexible lighting track comprising:

a straight configuration; and a flexed configuration in which the flexible lighting track comprises a bend;

first, second and third pairs of buss bars, wherein the first, second and third pairs of buss bars are electrically isolated from one another;

an I-beam protrusion defining first and second channels;

first and second insulated liners extending within the first and second channels, respectively, of the I-beam protrusion;

wherein each of the first and second insulated liners comprises first, second and third channels;

wherein one buss bar in the first pair of buss bars extends in the first channel of the first insulated liner and the other buss bar in the first pair of buss bars extends in the third channel of the first insulated liner;

wherein one buss bar in the second pair of buss bars extends in the first channel of the second insulated liner and the other buss bar in the second pair of buss bars extends in the third channel of the second insulated liner;

wherein one buss bar in the third pair of buss bars extends in the second channel of the first insulated liner and the other buss bar in the third pair of buss bars extends in the second channel of the second insulated liner;

wherein the flexible lighting track further comprises:

first and second protrusions extending from the I-beam protrusion and at least partially defining a channel;

wherein the channel at least partially defined by the first and second protrusions is adapted to engage a tongue-in-groove attachment;

wherein the flexible lighting track further comprises:

third and fourth protrusions extending from the I-beam protrusion and at least partially defining a channel;

wherein the channel at least partially defined by the third and fourth protrusions is adapted to engage a tongue-in-groove attachment so that the flexible lighting track is adapted to at least partially support a device coupled to the tongue-in-groove attachment;

wherein the first, second, third and fourth protrusions are sized so that the flexible lighting track is symmetric about a vertical center axis and asymmetric about a horizontal center axis to provide polarity;

wherein the flexible lighting track has a minimum bend radius of about 24 inches;

wherein the maximum current-carrying capacity of each of the buss bars in the first and third pairs of buss bars is about 20 A; and wherein the maximum current-carrying capacity of each of the buss bars in the second pair of buss bars is about 25 A.

16. The method of claim 8 further comprising:

engaging a tongue-in-groove attachment with the channel at least partially defined by the third and fourth protrusions so that the flexible lighting track at least partially supports a device coupled to the tongue-in-groove attachment.

17. The method of claim 8, wherein the first, second, third and fourth protrusions are sized so that the flexible lighting track is symmetric about a vertical center axis and asymmetric about a horizontal center axis to provide polarity.

18. The method of claim 2 further comprising:

electrically coupling a first source of electrical power to the first pair of buss bars;

generating a first voltage across the first pair of buss bars using the first source of electrical power;

electrically coupling a second source of electrical power to the second pair of buss bars;

generating a second voltage across the second pair of buss bars using the second source of electrical power;

electrically coupling a third source of electrical power to the third pair of buss bars; and generating a third voltage across the third pair of buss bars using the third source of electrical power.

* * * * *